US011600481B2

(12) United States Patent
Li et al.

(10) Patent No.: US 11,600,481 B2
(45) Date of Patent: Mar. 7, 2023

(54) DEVICES AND PROCESSES FOR MASS SPECTROMETRY UTILIZING VIBRATING SHARP-EDGE SPRAY IONIZATION

(71) Applicant: West Virginia University, Morgantown, WV (US)

(72) Inventors: Peng Li, Morgantown, WV (US); Xiaojun Li, Morgantown, WV (US); Stephen J. Valentine, Morgantown, WV (US); Lisa Holland, Morgantown, WV (US)

(73) Assignee: West Virginia University, Morgantown, WV (US)

( * ) Notice: Subject to any disclaimer, the term of this patent is extended or adjusted under 35 U.S.C. 154(b) by 0 days.

(21) Appl. No.: 16/927,936

(22) Filed: Jul. 13, 2020

(65) Prior Publication Data

US 2021/0082677 A1 Mar. 18, 2021

Related U.S. Application Data

(60) Provisional application No. 62/872,702, filed on Jul. 11, 2019.

(51) Int. Cl.
*H01J 49/16* (2006.01)
*H01J 49/00* (2006.01)

(52) U.S. Cl.
CPC ..... *H01J 49/16* (2013.01); *H01J 49/0031* (2013.01)

(58) Field of Classification Search
CPC ..... H10J 49/10; H10J 49/16; H10J 49/0031; H01J 49/10; H01J 49/16; H01J 49/0031
USPC ..... 250/424
See application file for complete search history.

(56) References Cited

U.S. PATENT DOCUMENTS

| | | | | |
|---|---|---|---|---|
| 8,011,230 | B2 * | 9/2011 | Watanabe | B82Y 35/00 73/105 |
| 8,450,682 | B2 * | 5/2013 | Hiraoka | H01J 49/165 250/288 |
| 9,058,966 | B2 * | 6/2015 | Otsuka | H01J 49/26 |
| 9,230,787 | B2 * | 1/2016 | Kyogaku | H01J 49/0454 |
| 9,269,557 | B2 * | 2/2016 | Otsuka | H01J 49/165 |
| 9,618,488 | B2 * | 4/2017 | Bajic | H01J 49/10 |

(Continued)

OTHER PUBLICATIONS

Xia0jun Li; et al., "Vibrating Sharp-edge Spray Ionization (VSSI) for voltage-free direct analysis of samples using mass spectrometry", Rapid Commun Mass Spectrom, published on-line Jul. 11, 2018, pp. 1-9.*

(Continued)

*Primary Examiner* — Wyatt A Stoffa
(74) *Attorney, Agent, or Firm* — Innovators Legal

(57) ABSTRACT

In accordance with the purpose(s) of the present disclosure, as embodied and broadly described herein, the disclosure, in one aspect, relates to a vibrating sharp edge spray ionization (VSSI) method suitable for coupling with a mass spectrometer, a VSSI method modified with a capillary suitable for use with continuous-flow separation methods such as liquid chromatography, and a VSSI method suitable for coupling with a capillary electrophoresis (CE) device in order to introduce the CE sample flow into a mass spectrometer. Also disclosed herein are devices for carrying out these methods and methods of making the same. This abstract is intended as a scanning tool for purposes of searching in the particular art and is not intended to be limiting of the present disclosure.

19 Claims, 59 Drawing Sheets

Specification includes a Sequence Listing.

(56) References Cited

U.S. PATENT DOCUMENTS 10,020,177 B2 * 7/2018 Bajic ..... H01J 49/16
10,068,200 B1 * 9/2018 Greving ..... G06Q 10/087
10,535,508 B2 * 1/2020 Murray ..... H01J 49/10
10,571,453 B2 * 2/2020 Cooks ..... H01J 49/0445
10,714,323 B2 * 7/2020 Cooks ..... H01J 49/0436
11,125,657 B2 * 9/2021 Van Berkel ..... H01J 49/0431
11,226,309 B2 * 1/2022 Richardson ..... G06N 3/02
2006/0214101 A1 * 9/2006 Takahashi ..... H01J 49/0418 250/288
2009/0140137 A1 * 6/2009 Hiraoka ..... G01Q 60/16 250/281
2014/0070088 A1 * 3/2014 Otsuka ..... H01J 49/0004 250/288
2015/0034821 A1 * 2/2015 Kyogaku ..... H01J 49/0459 250/288
2015/0318157 A9 * 11/2015 Otsuka ..... H01J 49/0459 250/288
2015/0355148 A1 * 12/2015 Bajic ..... H01J 49/165 204/603
2016/0018361 A1 * 1/2016 Trimpin ..... H01J 49/16 250/288
2016/0203968 A1 * 7/2016 Otsuka ..... H01J 49/0431 356/138
2019/0006163 A1 * 1/2019 Yim ..... H01J 49/0454
2019/0164736 A1 * 5/2019 Murray ..... H01J 49/10
2020/0343084 A1 * 10/2020 Trimpin ..... G01N 27/623

OTHER PUBLICATIONS

Banstola, B., Szot, C. W., AP, D. K., & Murray, K. K. (2018). Piezoelectric matrix-assisted ionization. European Journal of Mass Spectrometry (Chichester, England), 25(2), 202-207 (Year: 2018).*
ThorLabs, "Precision Cover Glasses and Microscope Slides." Apr. 9, 2016. (retrieved from https://web.archive.org/web/20160409022329/https://www.thorlabs.com/newgrouppage9.cfm?objectgroup_id=9704) (Year: 2016).*

* cited by examiner

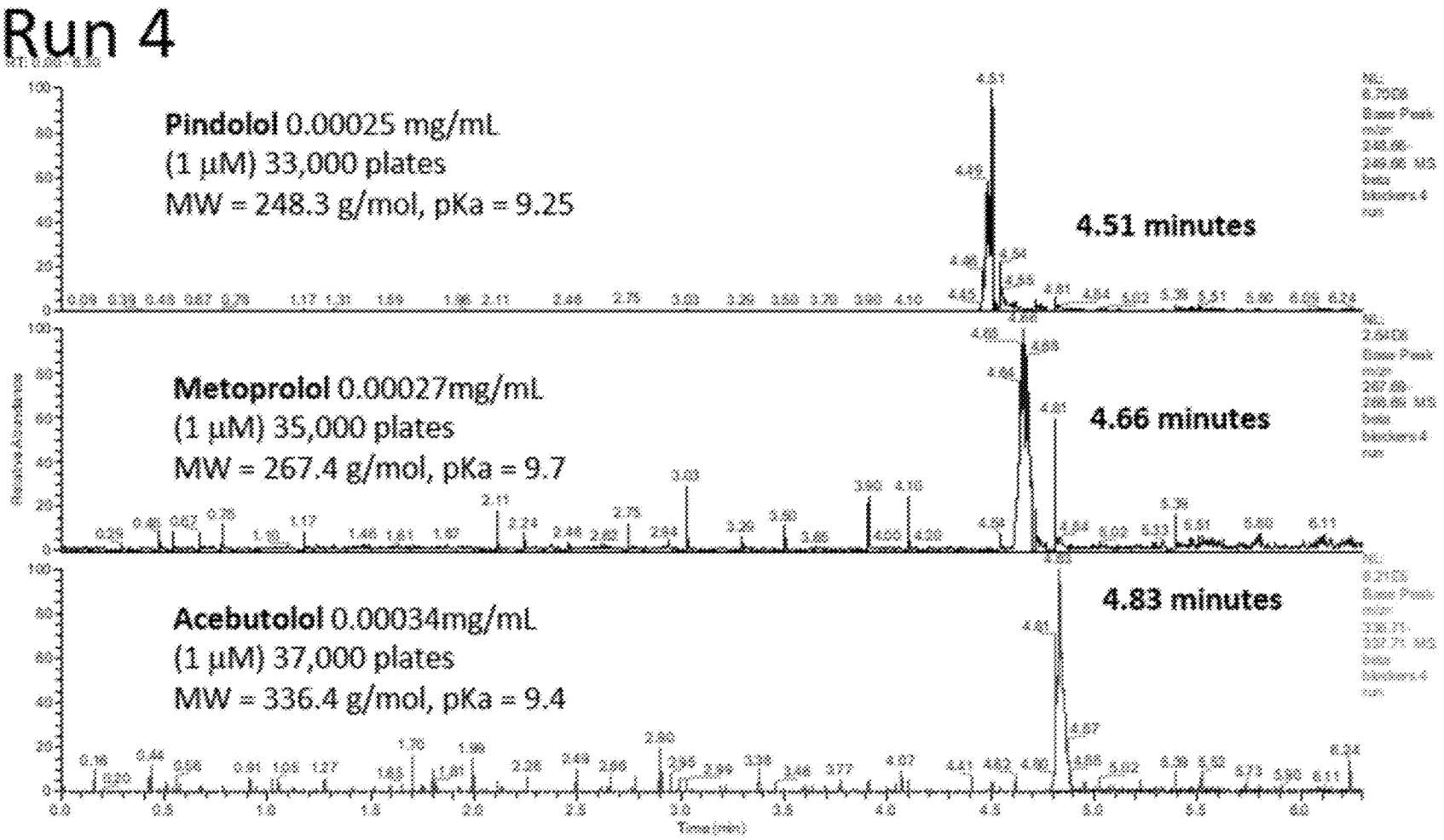
FIG. 14, continued

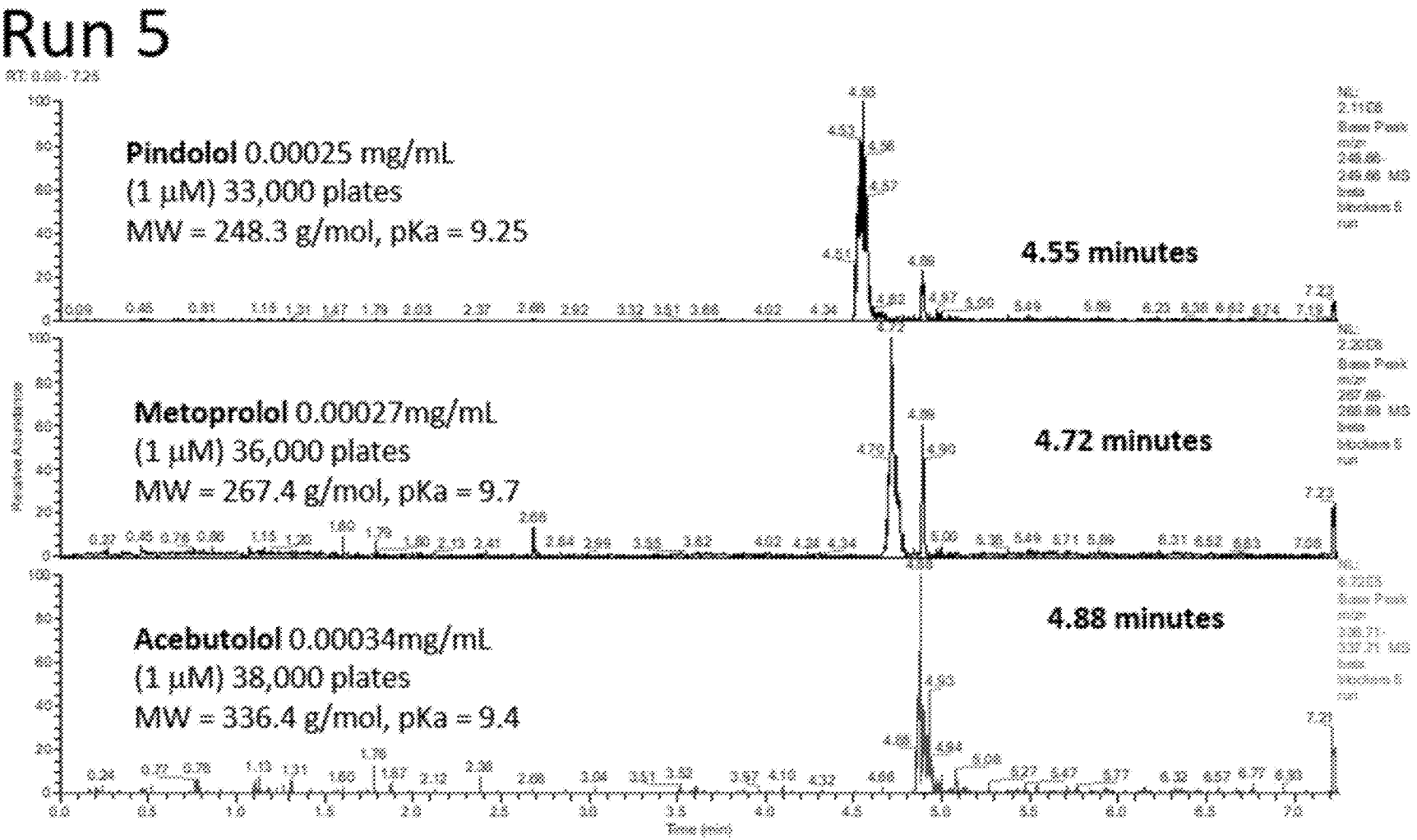
FIG. 14, continued

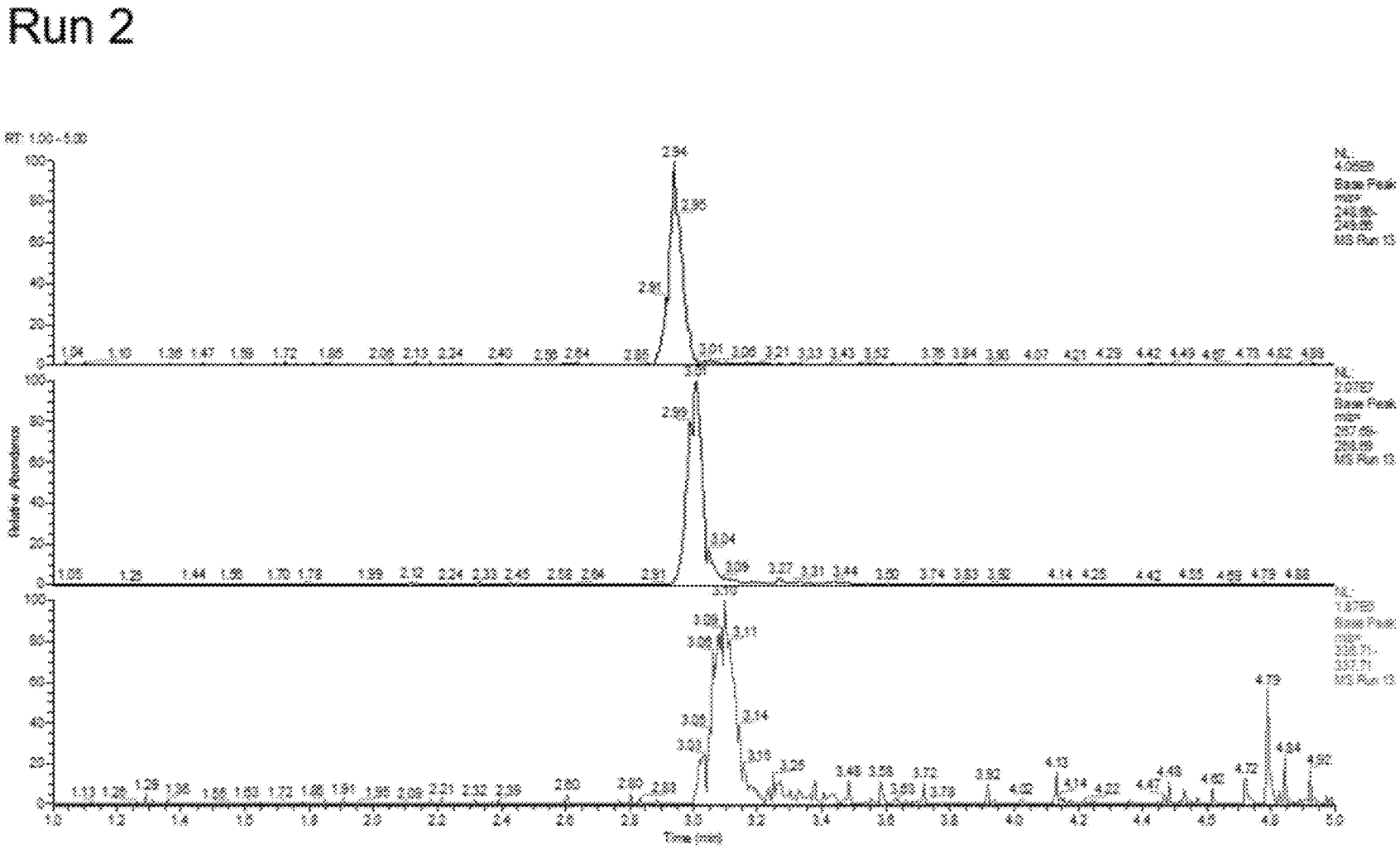
FIG. 15, continued

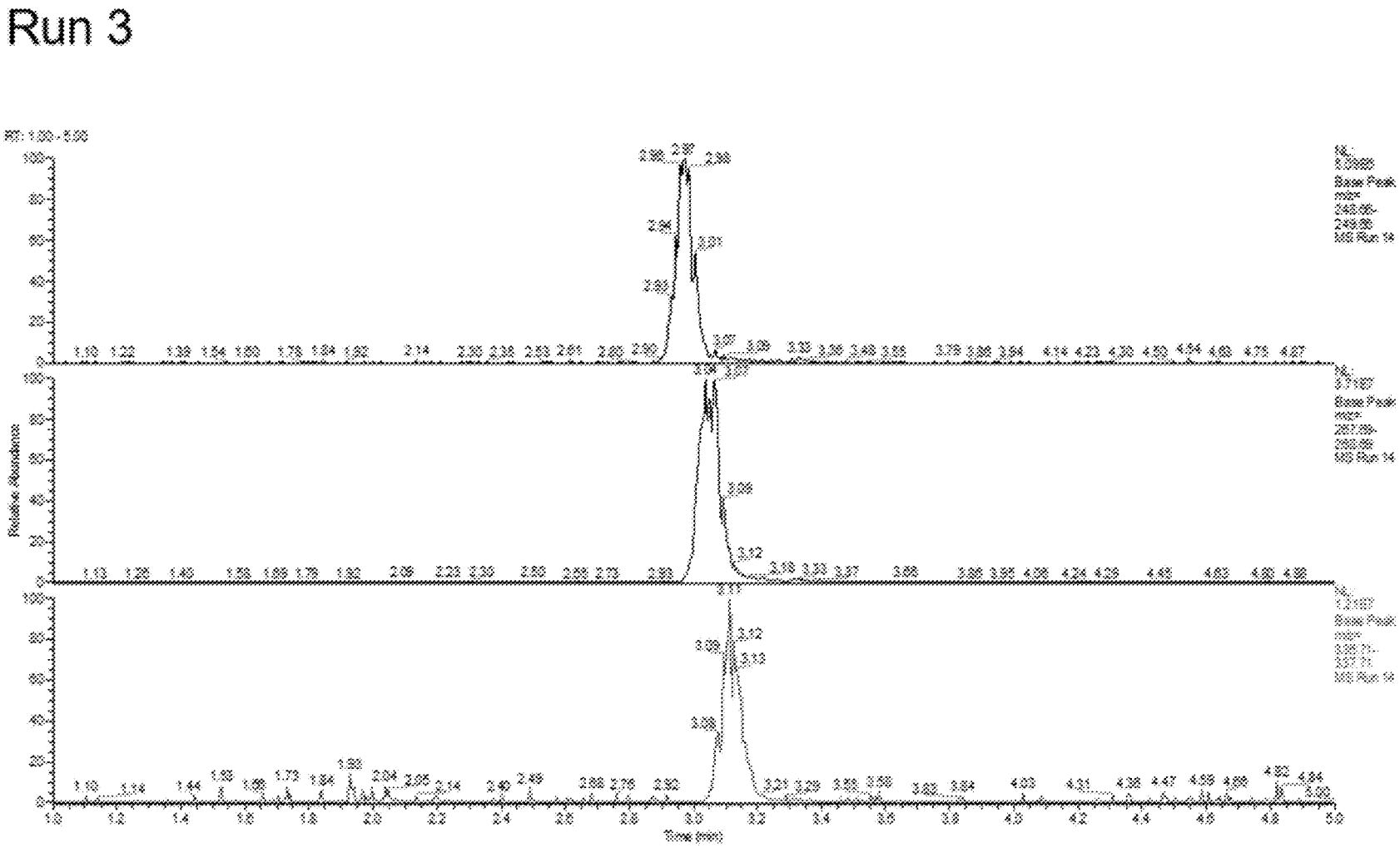
FIG. 15, continued

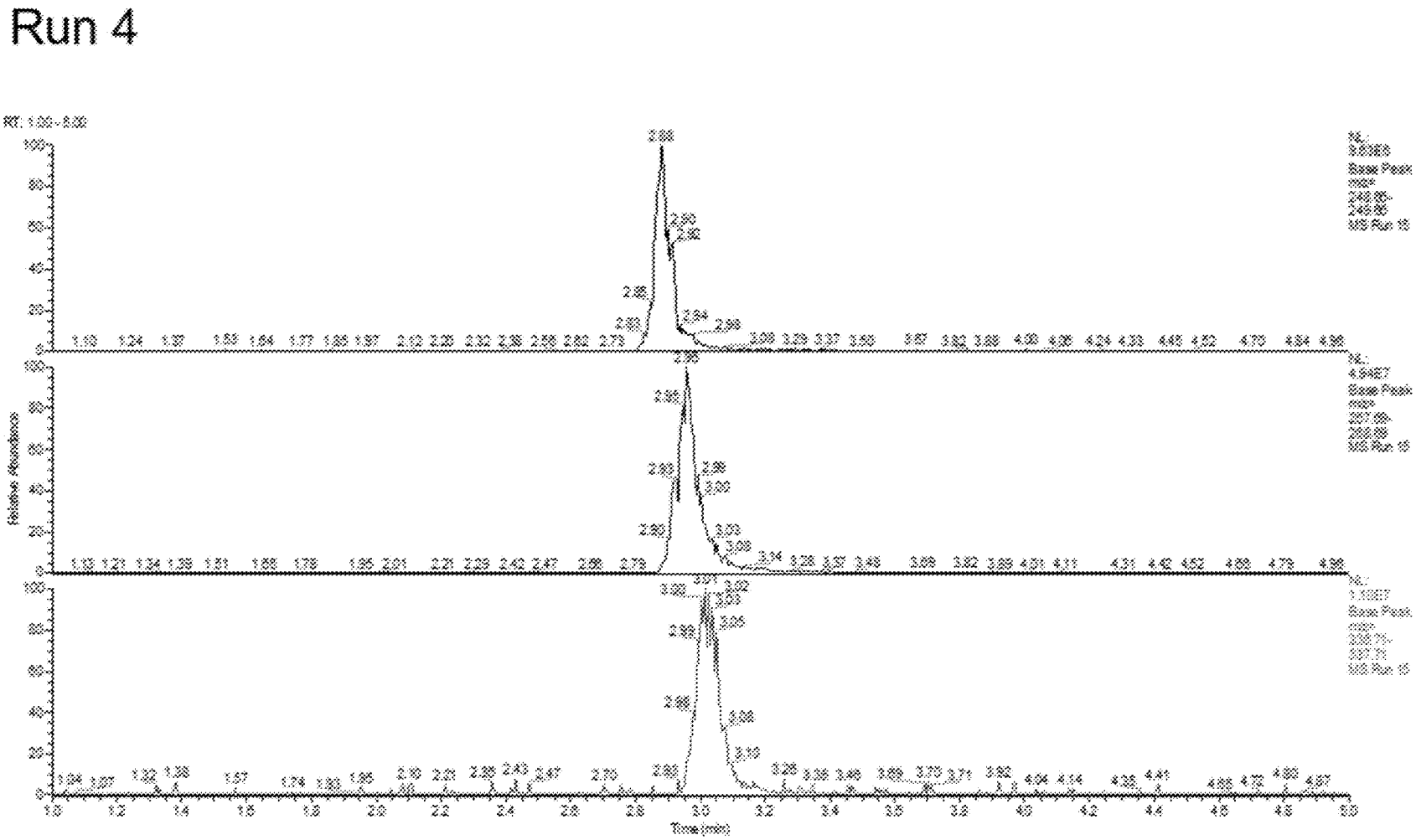
FIG. 15, continued

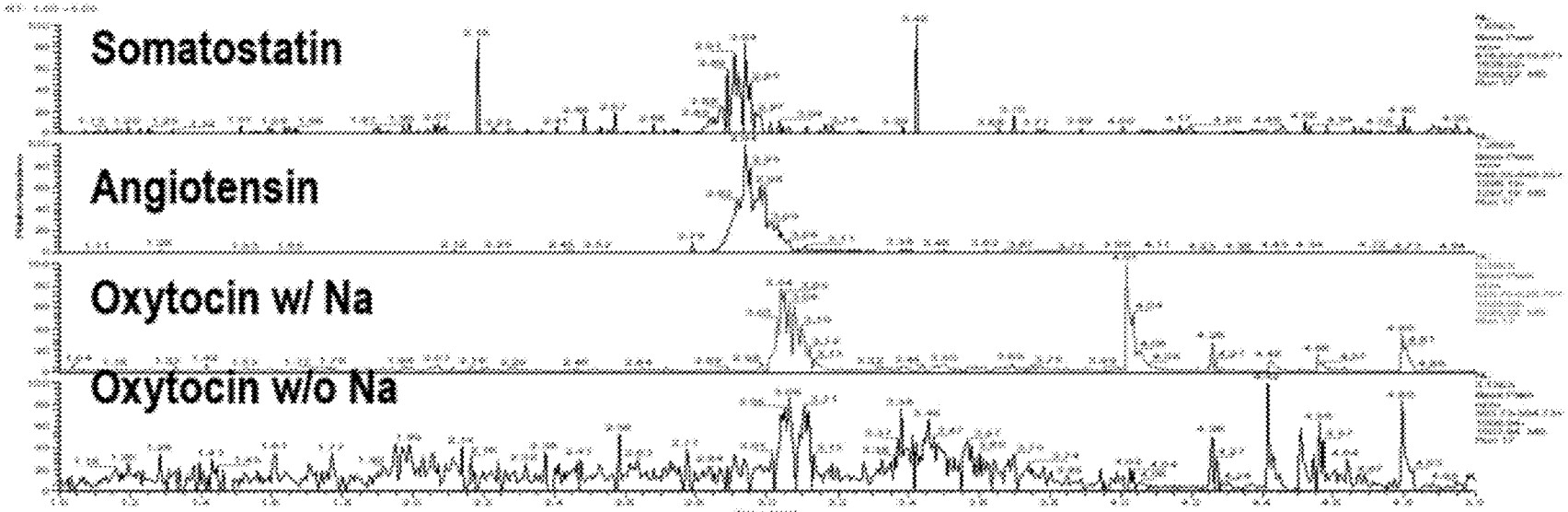
FIG. 16, continued

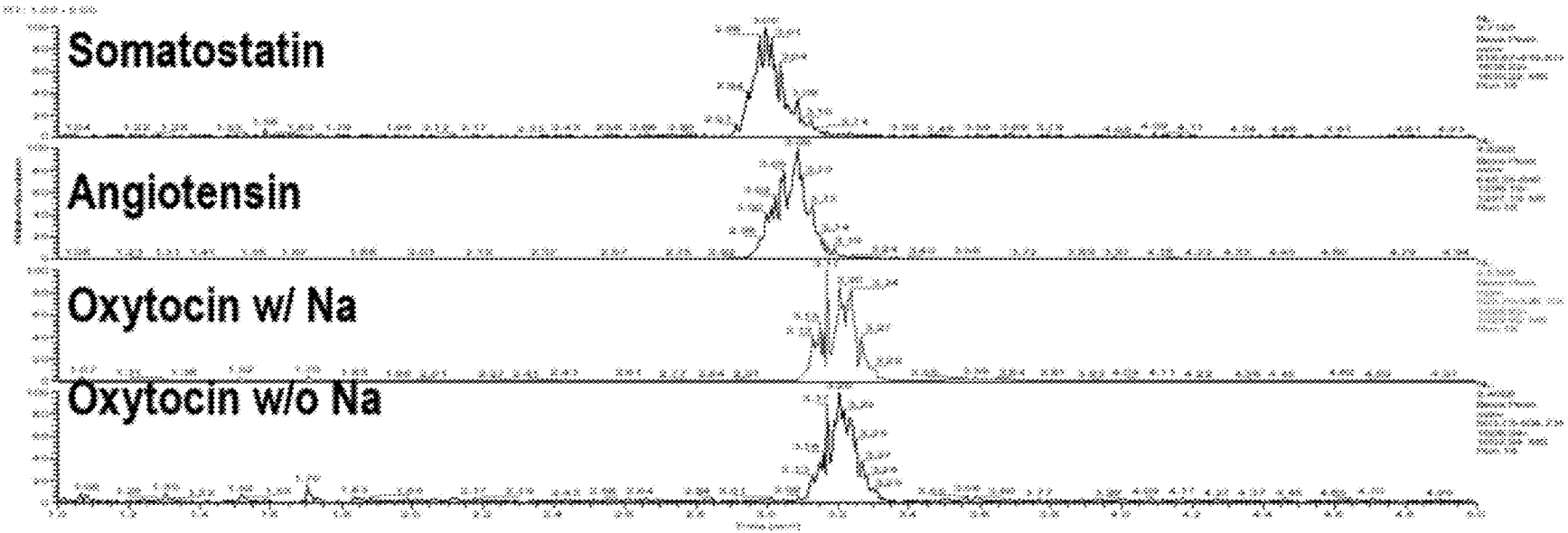
FIG. 16, continued

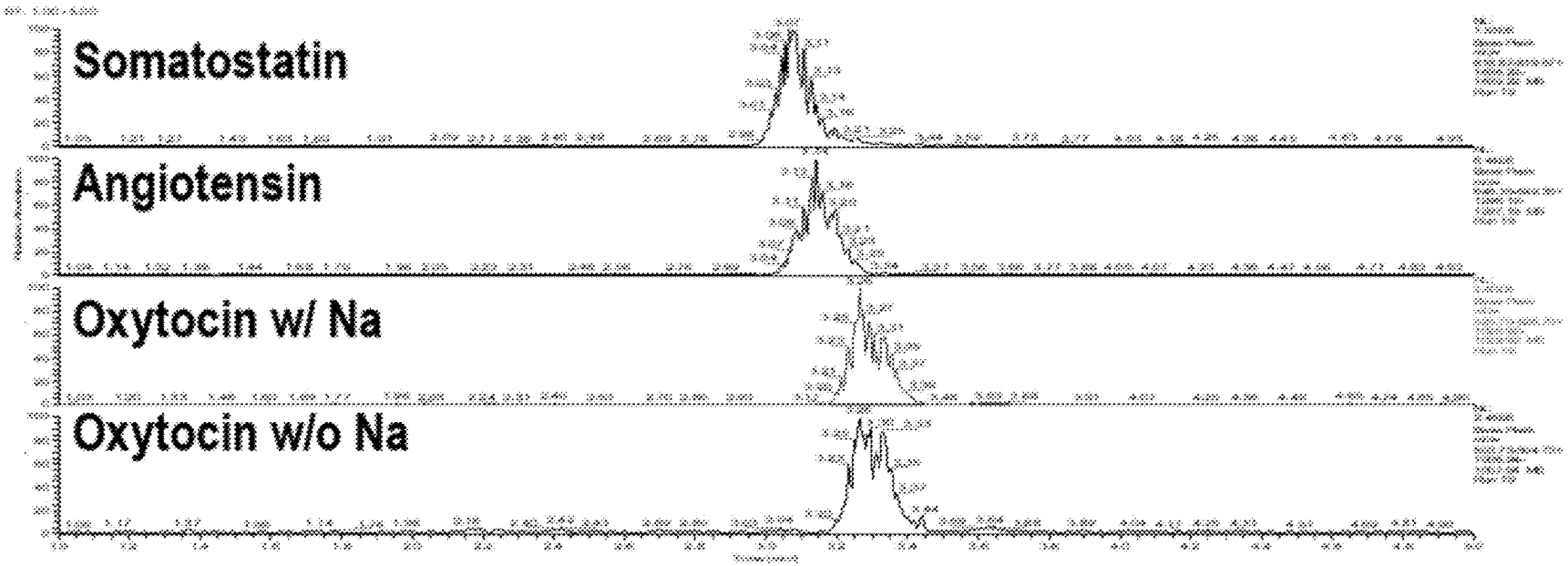
FIG. 16, continued

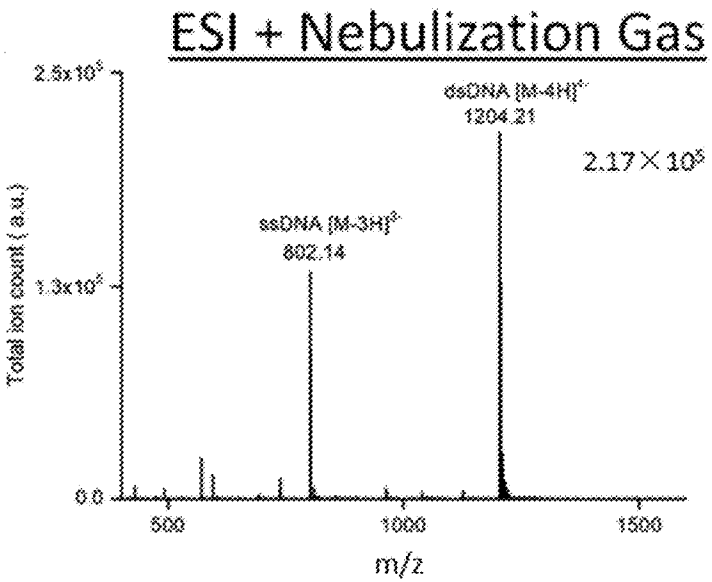
FIG. 29A
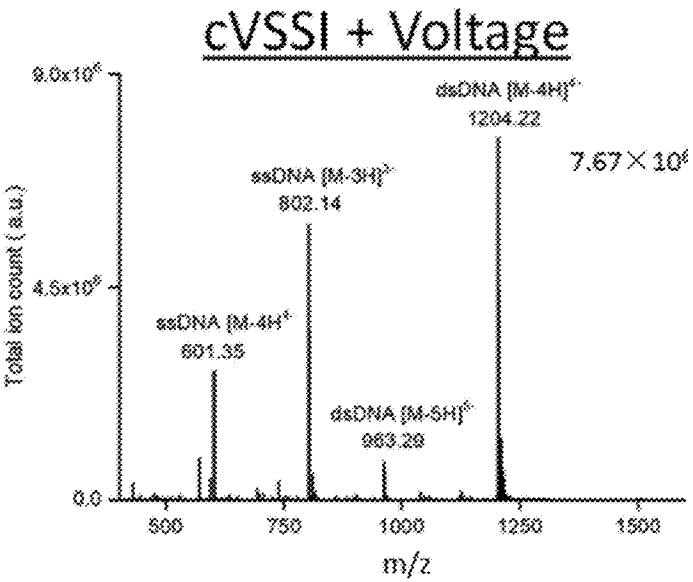
FIG. 29B
FIG. 29C
FIG. 29D

DEVICES AND PROCESSES FOR MASS SPECTROMETRY UTILIZING VIBRATING SHARP-EDGE SPRAY IONIZATION

CROSS-REFERENCE TO RELATED APPLICATIONS

This application claims the benefit of U.S. Provisional Application No. 62/872,702, filed on Jul. 11, 2019, which is incorporated herein by reference in its entirety.

STATEMENT REGARDING FEDERALLY SPONSORED RESEARCH OR DEVELOPMENT

This invention was made with government support GM128577-01 and GM114494 awarded by the National Institutes of Health and CHE1553201 awarded by the National Science Foundation. The government has certain rights in the invention.

REFERENCE TO SEQUENCE LISTING

The Sequence Listing submitted Oct. 26, 2020, as a text file named "2020-10-26_Sequence_Listing_WVU-00017-U-US-01_ST25.K" created on Oct. 26, 2020, and having a size of 14,600 bytes is hereby incorporated by reference pursuant to 37 C.F.R. § 1.52(e)(5).

BACKGROUND

Mass spectrometry is one of the most information-rich analytical techniques for characterizing a broad range of samples. The past decade witnessed explosive growth in development of direct analysis and field portable mass spectrometers with the goal of bringing the analytical capability of mass spectrometry to various field applications including environmental monitoring, pharmaceutical analysis, point of care diagnosis, detection of chemical and/or biological warfare agents, forensic investigation, and discovery and research. A key component for portable mass spectrometers is an ionization source that can directly ionize the sample with minimum sample preparation and/or pretreatment. To date, numerous ambient ionization methods that allow direct sample ionization under atmospheric conditions have been reported. However, most of the existing ambient ionization methods, including desorption electrospray ionization (DESI), easy ambient sonic spray ionization (EASI), plasma-assisted desorption ionization (PADI), and direct analysis in real time (DART) require dedicated and specialized instrumentation or auxiliary gas and solvents, making them less favorable options for many field-portable mass spectrometry applications. Furthermore, complex sample preparation and pretreatment is often required. Currently, the most compelling ionization sources for portable mass spectrometers is paper spray ionization (PSI) or solid substrate based electrospray ionization (ESI) due to their simplicity, minimal sample preparation requirements, and wide range of suitable target molecules. These techniques have been utilized in many applications including biofluid analysis, food sample analysis, and chemical reaction monitoring.

A major limitation of several state-of-the-art ionization methods is the requirement of a high voltage (2-5 kV) to induce electrospray, which increases the external equipment demand for portable applications and incurs safety concerns regarding both operators and living organisms as analytical samples. Although low-voltage and zero-voltage PSI methods have been reported by binding carbon nanotubes to a paper substrate and using pneumatic forces to induce spray, respectively, these methods are achieved at the expense of higher cost, more stringent equipment requirements, and a more limited operational environment.

A further barrier to mass spectrometry analysis is that complex mixtures must be simplified by coupling a separation technique such as gas chromatography, liquid chromatography, or capillary electrophoresis (CE) to the mass spectrometer.

ESI is the most common coupling method for mass spectrometry and liquid chromatography but is difficult to integrate with capillary electrophoresis because both ESI and capillary electrophoresis are voltage-driven techniques. In addition, the low flow rate of capillary electrophoresis is difficult to interface with electrospray ionization. Currently, when capillary electrophoresis and mass spectrometry are coupled, the current limitations of each system interfere with the separation and ionization of complex mixtures. The main strategies to decouple capillary electrophoresis from electrospray are through electrical decoupling with a path to ground, for example, by creating a porous region in the silica capillary and by using a sheath flow.

The use of porous silica to decouple the ESI and capillary electrophoresis voltage is created to allow ions to pass through pores to complete an electrical circuit but to prevent larger molecules from passing through the pores. The porous silica decoupler requires means such as chemical etching with hydrofluoric acid with is difficult to make. Moreover, the porous silica can be considered fragile and can become blocked by the molecules introduced or used in the capillary electrophoresis separation. When voltage is grounded through the porous silica it can crack in the presence of the separation current, even currents exceeding a few μA or following mechanical stress. When the porous silica cracks, molecules and fluid flow pass through the crack and are thus diverted away from the mass spectrometer. This is particularly problematic because high voltage is sometimes required for efficient separations. Electrokinetic injection is a preferred injection method for capillary electrophoresis because it produces smaller analyte bands; however, in this method, analyte is driven with voltage rather than pressure, making the technique incompatible with use of the porous silica. One strategy to improve protein separation is to modify the capillary surface, but modified capillaries tend to have limited lifetimes, which in turn shortens the lifetime of the porous silica.

Meanwhile, the sheath flow approach surrounds the separation capillary with a flow of liquid. The voltage is grounded in the sheath flow to decouple the separation voltage and current from the electrospray voltage and current. However, the additional liquid from the sheath flow dilutes the sample, in turn reducing the detector sensitivity and requiring a higher concentration of analyte for detection.

For many analytes, a voltage-free ionization method would be advantageous. These include certain biomolecules as well as chemicals sensitive to electrochemical reactions. To date, several voltage-free ionization methods have been coupled to liquid chromatography (LC) systems including thermospray, sonic spray ionization (SSI), and solvent assisted inlet ionization (SAII). In some instances, ultrasonic agitation has also been used as an effective voltage-free ionization strategy. However, existing mechanical ultrasonic ionization methods are difficult to integrate with LC systems as these methods require a liquid sample to be placed on a substrate surface which is not directly compatible with an LC fluidic system. Although surface acoustic wave nebulization (SAWN) has been coupled to LC by placing the outlet of the LC capillary tubing on top of the SAW substrate for peptide analysis, this coupling strategy is prone to dead volume, carryover, and injection variation effects. As a result, the optimal flow rate range for this configuration is limited to 1-5 μL/min.

Despite advances in portable, field-deployable, and low-voltage ionization methods for mass spectrometry, at a minimum, these techniques still require specialized technical knowledge to use; may require external gases, fluids, or sources of electricity, and are associated with safety issues for operators and living organisms being used as analytical samples. Furthermore, separation techniques such as liquid chromatography and capillary electrophoresis may be required for complex mixtures of analytes; however, current and voltage requirements for ionization and electrophoretic separation may be difficult to integrate or, in some cases, incompatible, and existing methods for decoupling these and/or reducing interference rely on expensive, fragile equipment and/or require high concentrations of sample. What is needed are a zero-voltage, field-deployable ionization method for mass spectrometry that can be coupled to a separation mechanism without the expense, fragility, and high sample concentration requirements that limit implementation of existing technologies. It would further be desirable if the method could overcome the limitations of known discrete connection methods. These needs and other needs are satisfied by the present disclosure.

SUMMARY

In accordance with the purpose(s) of the present disclosure, as embodied and broadly described herein, the disclosure, in one aspect, relates to a vibrating sharp edge spray ionization (VSSI) method suitable for coupling with a mass spectrometer, a VSSI method modified with a capillary suitable for use with continuous-flow separation methods such as liquid chromatography, and a VSSI method suitable for coupling with a capillary electrophoresis (CE) device in order to introduce the CE sample flow into a mass spectrometer. Also disclosed herein are devices for carrying out these methods and methods of making the same.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A: On-substrate spray working mode of VSSI. FIG. 1B: In situ direct-touch working mode of VSSI. FIG. 1C: Real image of on-substrate direct spray, frequency 97.1 kHz, voltage 12.7 $V_{pp}$. FIG. 1D: Real image of direct-touch spray generation on damp cardboard, frequency 97.1 kHz, voltage 18.0 $V_{pp}$. Image contrast was enhanced to facilitate viewability of fine droplets.

FIG. 2A: 12.7 $V_{pp}$; FIG. 2B: 19.8 $V_{pp}$; and FIG. 2C: 26.8 $V_{pp}$. FIG. 2D: 1:1 water:acetonitrile with 1% acetic acid, 12.7 $V_{pp}$. Number of droplets counted was >1000.

FIG. 3A: mass spectrum of homocysteine (1 mM); FIG. 3B: mass spectrum of sucrose (1 mM); FIG. 3C: mass spectrum of polyalanine peptides (1 mM); FIG. 3D: mass spectrum of ubiquitin (1 mM); and FIG. 3E: mass spectrum of self-complementary DNA CAAATTTG with Hoechst 33342. All spectra were captured in 1:1 water:acetonitrile with 1% acetic acid.

FIG. 4A: ion chromatogram of two VSSI sources in operation. At 3.04 min, a source with ubiquitin in water was turned on. After 3.11 min, a second source with acetonitrile was turned on to generate acetonitrile droplets for denaturation. FIG. 4B: Mass spectrum of ubiquitin prior to turning the acetonitrile source on. FIG. 4C: Mass spectrum of ubiquitin immediately after activating the acetonitrile source.

FIG. 5A: Image of a wet finger. FIG. 5B: Direct spray generation from the wet finger with VSSI. FIG. 5C: Mass spectrum obtained from direct spray of a finger exposed to isoleucine powder. FIG. 5D: Mass spectrum obtained from direct spray of a finger not exposed to isoleucine powder. FIG. 5E: Mass spectrum obtained from on-substrate spray of 1 mM isoleucine solution. FIG. 5F: Mass spectrum from direct spray of a finger stained with the red food dye erythrosine. For all mass spectra, mass analyzer was operated in negative ion mode. Source frequency 97.1 kHz, amplitude 12.7 $V_{pp}$.

FIG. 9A: shows a schematic of a cVSSI-MS device. FIG. 9B: is a photograph of a cVSSI device. FIG. 9C: shows plume generation at the outlet of the capillary of a cVSSI device. FIG. 9D: shows a cVSSI device set up at the inlet of a mass spectrometer with a capillary connector.

FIG. 10A: shows optimal position for capillary attachment on the substrate (here, a glass slide). FIGS. 10B and 10C: show non-optimal positions for capillary attachment that either damp plume generation or cause unstable plume generation. FIG. 10D:

shows droplet size distribution for VSSI. FIG. 10E: shows droplet size distribution for cVSSI.

FIG. 11A: Mass spectrum of acetaminophen in water:acetonitrile (1:1) at 20 μL/min. FIG. 11B: Mass spectrum of 10 μM solution of angiotensin II in water. FIG. 11C: Mass spectrum of 10 μM of cytochrome c in water. FIG. 11D: Mass spectrum of 10 μM of ubiquitin in water.

FIG. 12A: Relative abundance of ions detected using a cVSSI source for 30 s. FIG. 12B: Linear calibration curve for acetaminophen solutions (1 nM to 100 μM) in water. FIG. 12C: Blank solvent and 1 nM, 5 nM, and 10 nM acetaminophen solutions in 1:1 water:acetonitrile.

FIG. 19C shows an image of a disclosed CE-VSSI interface in front of a linear trap mass spectrometer. FIG. 19D shows a schematized drawing of a disclosed CE-VSSI interface in front of a mass spectrometer showing a disclosed arrangement of anode and cathode to the sample (container vial comprising the anode) and VSSI probe. FIG. 19E shows a schematic representation of a disclosed liquid chromatography-cVSSI setup in a the voltage-free operational mode. In various aspects, liquid chromatography can be carried out at flow rates of about 1 μL/min to 500 μL/min are accessible FIGS. 20-A-20B show representative data obtained using a disclosed CE-VSSI interface, e.g., as shown in FIGS. 19A-190, with MS.

FIG. 21A shows CE-VSSI-MS separation of 50 μM somatostatin and oxytocin. The extracted ion electropherograms were created using masses of 820.1 and 504.3 for somatostatin and oxytocin, respectively, with a mass tolerance of 500 mmu. FIG. 21B shows CE-UV separation of 50 μM somatostatin and oxytocin. The peak marked with the asterisk in 3B is an electroosmotic flow marker (dimethylformamide). Separation conditions are listed in FIGS. 20A-20B.

FIG. 22A shows CE-VSSI-MS separation of ubiquitin and trypsin inhibitor with an extracted ion electropherogram of m/z 1428.2765 and 1817.0015 for ubiquitin (black trace) and trypsin inhibitors (lighter gray trace), respectively, with a mass tolerance of 10 ppm. FIG. 22B shows CE-UV separation. FIG. 22C shows mass spectra of ubiquitin and FIG. 22D shows mass spectra of trypsin inhibitor displaying the most abundant charge states for the width of the peaks in FIG. 22A at half the maximum intensity. Separation conditions are as in FIGS. 20A-20B, except the background electrolyte is 50 mM ammonium acetate at pH 6.5 (i=22 μA).

FIG. 24A shows mass spectra containing the dominant charge state of ubiquitin. FIG. 24B shows mass spectrum of the peptides in the trypsin inhibitor with masses of 7746. FIG. 24C shows mass spectrum of the peptides in the trypsin inhibitor with masses of 7860. FIG. 24D shows mass spectrum of the peptides in the trypsin inhibitor with masses of 8016 (m/z 1336 and 1603), 8106 (m/z 1352 and 1621), 8190 (m/z 1365 and 1638), and 8316 (m/z 1386 and 1663). Separation conditions are listed in FIGS. 22A-22D.

FIG. 25A shows a representative schematic view of a disclosed cVSSI-MS device with a bias voltage. FIG. 25B shows a representative image showing a liquid plume generated by a disclosed cVSSI process. FIG. 25C shows a representative schematic view diagramming a disclosed cVSSI-MS process comparing likely date obtained for ssDNA with cVSSI on and off.

FIGS. 26A-

26C show total ion chronogram and full scan mass spectra of DNA duplex d(ACGCGCGT)2 with a capillary bias voltage of −1.27 kV in the presence and absence of cVSSI. Mass spectra were recorded in negative ion mode with 10 μM DNA duplex with 100 mM ammonium acetate using the Q-Exactive Orbitrap mass spectrometer. FIG. 26A shows a total ion chronogram obtained for a DNA duplex, $d(ACGCGCGT)_2$, in the presence and absence of a disclosed cVSSI process. Labels show the cVSSI status for 0 min to 1.14 min, 1.14 min to 2.45 min, and 2.45 to 3.30 min. FIG. 26B shows a full scan mass spectrum in the presence of applied voltage and the absence of cVSSI of DNA duplex $d(ACGCGCGT)_2$ with a capillary bias voltage of −1.27 kV in the presence and absence of cVSSI. FIG. 26C shows a full scan mass spectrum in the presence of applied voltage and the presence of cVSSI of DNA duplex, $d(ACGCGCGT)_2$, with a capillary bias voltage of −1.27 kV in the presence and absence of cVSSI. Mass spectra were recorded in negative ion mode with 10 μM DNA duplex with 100 mM ammonium acetate using the Q-Exactive Orbitrap mass spectrometer. FIGS. 26D-26F show total ion chronogram and full scan mass spectra of single strand DNA d(CATATATG) with a capillary bias voltage of −1.19 kV in the presence and absence of cVSSI. Spectra were recorded in negative ion mode 10 μM DNA single strand with 100 mM ammonium acetate using the LTQ-XL mass spectrometer. FIG. 26D shows a total ion chronogram for single strand DNA d(CATATATG). While the voltage was continuously applied, labels show the VSSI status for 0 to 0.33 min, 0.33 to 0.73 min, and 0.73 to 1.00 min. FIG. 26E shows a mass spectrum in the presence of applied voltage and the absence of cVSSI. FIG. 26F shows a mass spectrum in the presence of both voltage and cVSSI. Mass spectra data set features are identified with labels.

FIG. 27A shows an image of the corona discharge glow without cVSSI. FIG. 27B shows an image of corona discharge suppression with cVSSI.

FIGS. 29A-29H show representative data comparing ionization performance between a commercial ESI sources with nebulization gas and a disclosed cVSSI plus voltage system. Applied voltages and nebulization gas ow rates in the commercial sources were optimized for the highest ion intensity. FIGS. 29A and 29B show a comparison of 10 μM duplex DNA $d(ACGCGCGT)_2$ in 100 mM $NH_4OAc$ solution with nebulization gas and a disclosed cVSSI plus voltage system, respectively. Mass spectra were recorded in negative ion mode using 10 μM duplex DNA with 100 mM $NH_4OAc$. FIGS. 29C and 29D show a comparison of 1 μM 56mer ssDNA in 100 mM $NH_4OAc$ solution with nebulization gas and a disclosed cVSSI plus voltage system, respectively. FIGS. 29E and 29F show a comparison of 10 μM fondaparinux sodium with 0.1% HAc with nebulization gas and a disclosed cVSSI plus voltage system, respectively. FIGS. 29G and 29H show a comparison of 10 μM insulin in 100 mM $NH_4OAc$ with nebulization gas and a disclosed cVSSI plus voltage system, respectively. Mass spectra data set features are identified with labels. Base intensities are provided for each spectrum.

FIG. 30A show data collected using a commercial ESI source with a bias voltage of +4.1 kV and a 20 au gas flow rate, and FIG. 30B shows data collected using a cVSSI plus +1.08 kV. FIG. 30C shows data collected using a commercial ESI source with a bias voltage of −3.5 kV and a 30 au gas flow rate, and FIG. 30D shows data collected using a cVSSI plus −1.07 kV.

FIGS. 31A-310 show representative data different charge states obtained in a disclosed cVSSI system. The data were obtained for a human telomeric G-quadruplex DNA (TTGGGTTAGGGTTAGGGTTAGGGA) sequence (G4) in 100 and 500 mM KCl solutions. Peaks are labeled in the form of [G4+nK], where n and m represent the number of potassium adducts and total charge, respectively. High signal intensities of $[G4+2K]^{5-\ and\ 6-}$ were observed in each spectrum, as there are three guanine quartets present in the G-quadruplex structure. Conventional ESI results are described by Hengel, S. M. and Goodlett, D. R. in Int. J. Mass Spectrom. 2012, 312, 114-121. FIG. 31A show data obtained for the $[M-6H]^{6-}$ charge state in 100 μM KCl solution. FIG. 31B show data obtained for the $[M-5H]^{5-}$ charge state in 500 μM KCl solution.

FIG. 32A shows total ion count data obtained at a flow rat of 200 nL/min. FIG. 32B shows total ion count data obtained at a flow rat of 500 nL/min. FIG. 32C shows total ion count data obtained at a flow rat of 750 nL/min. FIG. 32D shows total ion count data obtained at a flow rat of 1000 nL/min. FIG. 32E shows total ion count data obtained at a flow rat of 1500 nL/min. A typical mass spectrum is shown in FIG. 32F

FIG. 34A shows data obtained with cVSSI off. FIG. 34B shows data obtained with cVSSI on.

FIG. 36A shows data obtained without cVSSI using direct nano-ESI with a bias voltage of −0.9 kV. FIG. 36A shows data obtained with cVSSI using nano-ESI with a bias voltage of −1.3 kV.

FIG. 37A shows mass spectrum data obtained for ssDNA d(CATATATG) in negative ion mode using 10 μM ssDNA in 100 mM $NH_4OAc$ with a commercial ESI source with −3 kV spray voltage and 15 a.u. sheath gas flow rate. FIG. 37B shows mass spectrum data obtained for ssDNA d(CATATATG) in negative ion mode using 10 μM ssDNA in 100 mM $NH_4OAc$ with a disclosed a cVSSI source with a bias voltage of −1.19 kV. FIG. 37C shows full scan mass spectrum data obtained for chondroitin disaccharide Δdi-6S sodium using a conventional ESI source with −2.5 kV spray voltage and 20 a.u. sheath gas flow rate. FIG. 37D shows full scan mass spectrum data obtained for chondroitin disaccharide Δdi-6S sodium using a disclosed cVSSI source with a bias voltage of −1.60 kV. Mass spectra were recorded in negative ion mode using 1 μM chondroitin disaccharide with 100 mM ammonium acetate. FIG. 37E shows full scan mass spectrum data obtained for the peptide Angiotensin 2 using a commercial ESI source with −3.5 kV spray voltage and 40 a.u. sheath gas flow rate. FIG. 37F shows full scan mass spectrum data obtained for the peptide Angiotensin 2 using a disclosed cVSSI source with a voltage of −1.33 kV. Mass spectra dataset features are identified with labels. Base peak intensities are provided for each spectrum.

FIG. 38A shows data obtained with cVSSI off. FIG. 38G shows data obtained with cVSSI on.

FIG. 39A show mass spectra data obtained with cVSSI OFF under positive ion mode. FIG. 39B show mass spectra data obtained with cVSSI OFF under negative ion mode. FIG. 39C show mass spectra data obtained with cVSSI ON under positive ion mode. FIG. 39D show mass spectra data obtained with cVSSI ON under negative ion mode.

FIG. 40A-408 show representative mass spectra data of 10 μM myoglobin in 100 mM $NH_4OAc$. FIG. 40A shows data obtained with cVSSI ON at beginning of continuous operation of cVSSI. FIG. 40A shows data obtained with cVSSI ON after 1 h of continuous operation of cVSSI.

Figure 1A:
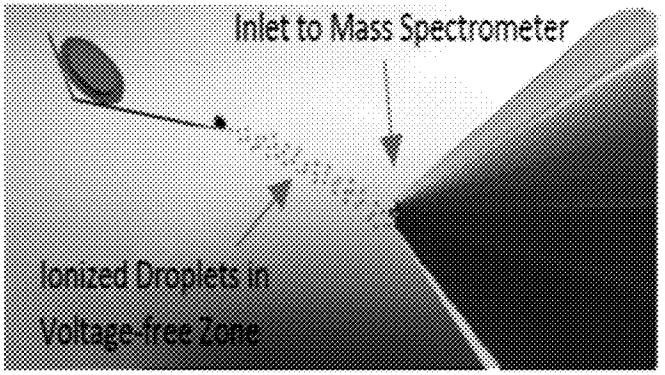
FIGS. 1A-1D show images of various aspects of VSSI as disclosed herein.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Prior to describing the various aspects of the present disclosure, the following definitions are provided and should be used unless otherwise indicated. Additional terms may be defined elsewhere in the present disclosure.

Definitions

As used herein, "comprising" is to be interpreted as specifying the presence of the stated features, integers, steps, or components as referred to, but does not preclude the presence or addition of one or more features, integers, steps, or components, or groups thereof. Moreover, each of the terms "by", "comprising," "comprises", "comprised of," "including," "includes," "included," "involving," "involves," "involved," and "such as" are used in their open, non-limiting sense and may be used interchangeably. Further, the term "comprising" is intended to include examples and aspects encompassed by the terms "consisting essentially of" and "consisting of." Similarly, the term "consisting essentially of" is intended to include examples encompassed by the term "consisting of.

As used in the specification and the appended claims, the singular forms "a," "an" and "the" include plural referents unless the context clearly dictates otherwise. Thus, for example, reference to "a mobile phase" or "an analyte," including, but not limited to, combinations of two or more such mobile phases, analytes, and the like.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

As used herein, the terms "optional" or "optionally" means that the subsequently described event or circumstance can or cannot occur, and that the description includes instances where said event or circumstance occurs and instances where it does not.

As used herein, "voltage-free," "voltage-free zone," "voltage-free environment," and similar terms refer to the absence of high voltage fields (e.g., on the order of kV per cm) typically used to ionize samples for mass spectrometers. In one aspect, the electrical signal used to drive the vibration generator (an electromechanical transducer or a piezoelectric transducer in some embodiments) is on the order of volts to tens of volts, "peak-to-peak," and is considered part of the voltage-free zone or voltage-free environment as defined herein, since that electrical signal is not used to directly create ions through its field strength alone.

A "piezoelectric" material is a material that produces an electric charge when subjected to mechanical stress. Piezoelectric materials include, but are not limited to, potassium sodium tartrate tetrahydrate (also known as Rochelle salt), quartz, cane sugar, topaz, tourmaline, apatite, bone (primarily due to apatite crystals), barium titanate, lead zirconate titanate, and combinations thereof. In one aspect, the electric charge is proportional to the mechanical stress that is applied to the material. Meanwhile, a "piezoelectric transducer" converts electrical charges produced by piezoelectric materials into energy.

A "resonant frequency" is a natural frequency of vibration for a physical object that is vibrating. The resonant frequency is determined by the properties of the object. Most objects possess multiple resonant frequencies. When an object is subjected to a complex excitation, that object will vibrate at its own resonant frequencies.

Unless otherwise specified, temperatures referred to herein are based on atmospheric pressure (i.e. one atmosphere).

Vibrating Sharp-Edge Enabled Aerosol Generator

In one aspect, disclosed herein is a vibrating sharp-edge enabled aerosol generator. In a further aspect, the disclosed vibrating sharp-edge enabled aerosol generator can be utilized to controllably provide a sample in droplet form. For example, the disclosed vibrating sharp-edge enabled aerosol generator can be utilized to generate droplets for an ionization source of mass spectrometer, and accordingly, utilized in methods for mass spectrometry that can directly ionize samples with minimum preparation and/or pretreatment. In a further aspect, the method is voltage-free. In another aspect, the source is constructed only of two components.

In a further aspect, the disclosed vibrating sharp-edge enabled aerosol generator can be used to controllably generate droplets having an average diameter of about 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, 20 μm, 21 μm, 22 μm, 23 μm, 24 μm, 25 μm, 26 μm, 27 μm, 28 μm, 29 μm, 30 μm; or any range encompassed by a lower and upper limit utilizing any two of the foregoing values; or any set of the foregoing values.

In a further aspect, a plurality of the disclosed vibrating sharp-edge enabled aerosol generator can be utilized together, each independently providing droplets to an ionization source of a mass spectrometer. In various further aspects, the vibrating sharp-edge enabled aerosol generator can be utilized, e.g., a single vibrating sharp-edge enabled aerosol generator or a plurality of vibrating sharp-edge enabled aerosol generators, to provide droplets to an input, e.g., as an input to other analytical instruments or for carrying out in droplet reactions.

In some aspects, the droplets are generated as droplets in air. In other aspects, the droplets can be generated as droplets within a two-phase liquid system, i.e., water droplets generated into a surrounding oil medium.

In one aspect, the first component is a thin, rigid substrate. In a further aspect, the thin, rigid substrate is made from glass, quartz, silicon, silicon wafer, brass, steel, hard plastic, a ceramic material, metal, a composite material, fused silica, or a combination thereof. In one aspect, the substrate can be polyether ether ketone (PEEK), pyrolytic boron nitride (PBN), or another material that is less fragile than glass. In a further aspect, a sturdier substrate is preferred over glass for field operations due to the decreased likelihood of breakage. Further in this aspect, the thin, rigid substrate can be a commercial object such as, for example, a glass microscope slide. In one aspect, the thin, rigid substrate includes a proximal end with a flat surface and a distal end with at least one sharp edge. In another aspect, the sharp edge is a corner of the thin, rigid substrate. In one aspect, any hard material that does not cause damping of vibration can serve as the thin, rigid substrate.

In one aspect, the surface of the thin, rigid substrate can be chemically modified with, for example, a polymethylsiloxane or other silicone-based network in order to increase hydrophobicity. In a further aspect, using a more hydrophobic surface may further decrease needed flow rate and/or generate smaller droplets at the sharp edge.

In another aspect, the working dimension and thickness of the substrate can vary. In one aspect, different dimensions of substrate can be used (i.e., 24×50 mm, 24×60 mm, 24×75 mm, etc.). In another aspect, different thicknesses of substrate can be used, such as a No. 0, No. 1, or No. 1.5 microscope slide (0.08-0.13 mm, 0.13-0.16 mm, and 0.16-0.19 mm, respectively). In one aspect, a thinner substrate corresponds to a lower requirement for input power. In another aspect, the substrate can have an irregular shape such as, for example, a triangle. Further in this aspect, the irregular shape can be a capillary with a tapered tip. In still another aspect, the substrate can have microchannels to direct fluid flow.

In a further aspect, the substrate can have a thickness of about 0.01 mm, 0.02 mm, 0.03 mm, 0.04 mm, 0.05 mm, 0.06 mm, 0.07 mm, 0.08 mm, 0.09 mm, 0.10 mm, 0.11 mm, 0.12 mm, 0.13 mm, 0.14 mm, 0.15 mm, 0.16 mm, 0.17 mm, 0.18 mm, 0.19 mm, 0.20 mm, 0.21 mm, 0.22 mm, 0.23 mm, 0.24 mm, 0.25 mm, 0.26 mm, 0.27 mm, 0.28 mm, 0.29 mm, 0.30 mm, 0.31 mm, 0.32 mm, 0.33 mm, 0.34 mm, 0.35 mm, 0.36 mm, 0.37 mm, 0.38 mm, 0.39 mm, 0.40 mm, 0.41 mm, 0.42 mm, 0.43 mm, 0.44 mm, 0.45 mm, 0.46 mm, 0.47 mm, 0.48 mm, 0.49 mm, 0.50 mm, 0.51 mm, 0.52 mm, 0.53 mm, 0.54 mm, 0.55 mm, 0.56 mm, 0.57 mm, 0.58 mm, 0.59 mm, 0.60 mm, 0.61 mm, 0.62 mm, 0.63 mm, 0.64 mm, 0.65 mm, 0.66 mm, 0.67 mm, 0.68 mm, 0.69 mm, 0.70 mm, 0.71 mm, 0.72 mm, 0.73 mm, 0.74 mm, 0.75 mm, 0.76 mm, 0.77 mm, 0.78 mm, 0.79 mm, 0.80 mm, 0.81 mm, 0.82 mm, 0.83 mm, 0.84 mm, 0.85 mm, 0.86 mm, 0.87 mm, 0.88 mm, 0.89 mm, 0.90 mm, 0.91 mm, 0.92 mm, 0.93 mm, 0.94 mm, 0.95 mm, 0.96 mm, 0.97 mm, 0.98 mm, 0.99 mm, 1.00 mm, 1.01 mm, 1.02 mm, 1.03 mm, 1.04 mm, 1.05 mm, 1.06 mm, 1.07 mm, 1.08 mm, 1.09 mm, 1.10 mm, 1.11 mm, 1.12 mm, 1.13 mm, 1.14 mm, 1.15 mm, 1.16 mm, 1.17 mm, 1.18 mm, 1.19 mm, 1.20 mm, 1.21 mm, 1.22 mm, 1.23 mm, 1.24 mm, 1.25 mm, 1.26 mm, 1.27 mm, 1.28 mm, 1.29 mm, 1.30 mm, 1.31 mm, 1.32 mm, 1.33 mm, 1.34 mm, 1.35 mm, 1.36 mm, 1.37 mm, 1.38 mm, 1.39 mm, 1.40 mm, 1.41 mm, 1.42 mm, 1.43 mm, 1.44 mm, 1.45 mm, 1.46 mm, 1.47 mm, 1.48 mm, 1.49 mm, 1.50 mm, 1.51 mm, 1.52 mm, 1.53 mm, 1.54 mm, 1.55 mm, 1.56 mm, 1.57 mm, 1.58 mm, 1.59 mm, 1.60 mm, 1.61 mm, 1.62 mm, 1.63 mm, 1.64 mm, 1.65 mm, 1.66 mm, 1.67 mm, 1.68 mm, 1.69 mm, 1.70 mm, 1.71 mm, 1.72 mm, 1.73 mm, 1.74 mm, 1.75 mm, 1.76 mm, 1.77 mm, 1.78 mm, 1.79 mm, 1.80 mm, 1.81 mm, 1.82 mm, 1.83 mm, 1.84 mm, 1.85 mm, 1.86 mm, 1.87 mm, 1.88 mm, 1.89 mm, 1.90 mm, 1.91 mm, 1.92 mm, 1.93 mm, 1.94 mm, 1.95 mm, 1.96 mm, 1.97 mm, 1.98 mm, 1.99 mm, 2.00 mm; or any range encompassed by a lower and upper limit utilizing any two of the foregoing values; or any set of the foregoing values.

In one aspect, the second component is a vibration generator. In a further aspect, the vibration generator is fixed to the flat surface at the proximal end of the thin, rigid substrate in order to vibrate the sharp edge of the distal end of the thin, rigid substrate. In a still further aspect, the vibration generator is an electromechanical transducer such as, for example, a piezoelectric transducer. In one aspect, activation of the vibration generator causes the sharp edge of the thin, rigid substrate to vibrate. In a further aspect, vibration of the combined body of the vibration generator and thin, rigid substrate occurs at the resonant frequency of the combined body.

Figure 18:
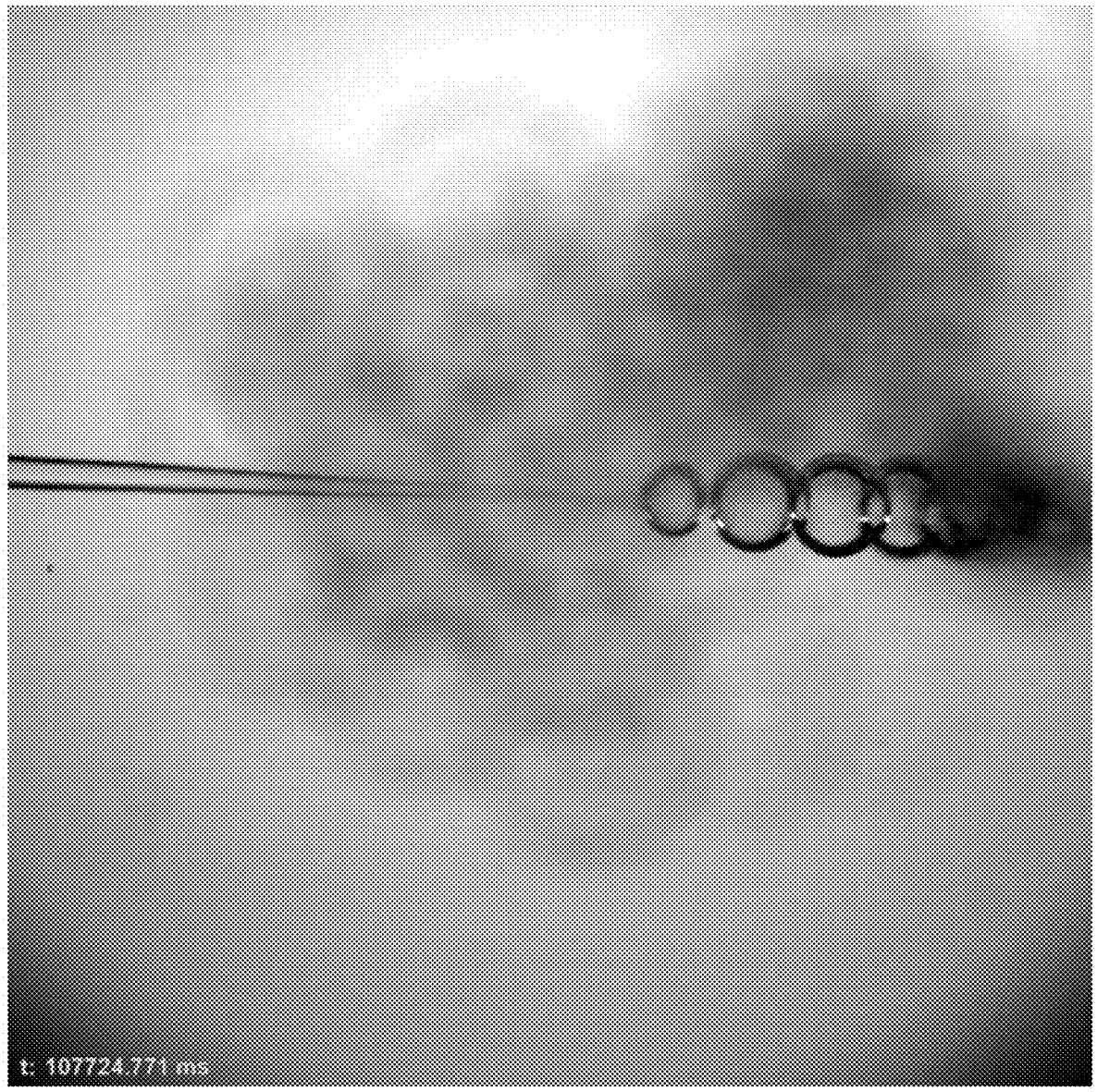
FIG. 18 shows a representative image pertaining to generation of water droplets in an immiscible oil via disclosed VSSI methods.

In another aspect, the vibrating sharp edge nebulizes a portion of a liquid sample into a spray of droplets upon physical contact between the vibrating sharp edge and the liquid sample. In a further aspect, the droplets ionize in a voltage-free zone prior to entering a mass spectrometer connected to the aerosol generator disclosed herein. In an alternative aspect, ionization occurs when a voltage is applied to the vibration generator. In one aspect, the spray of droplets are in aerosol form (i.e., water in air). In an alternative aspect, VSSI can be used to generate liquid droplets in another immiscible liquid, such as, for example, a water in oil emulsion (FIG. 18).

In various aspects, the liquid can be delivered via a capillary to the vibrating sharp of the substrate. The capillary can be prepared from a glass material or a conductive material, e.g., stainless steel.

In one aspect, disclosed herein is an apparatus for producing a spray of liquid droplets. In a further aspect, the apparatus includes a thin, rigid substrate bounded by a sharp edge and having a flat surface, a vibration generator fixed to the flat surface, wherein the vibration generator vibrates the sharp edge. Further in this aspect, a portion of the vibrating sharp edge is used to contact a liquid sample. In one aspect, when the vibrating sharp edge contacts the liquid sample, a portion of the liquid sample is aerosolized. In a further aspect, when the vibrating sharp edge contacts the liquid sample, the vibrating sharp edge ionizes a portion of the liquid sample. In one aspect, ionization occurs in a voltage-free zone. In still another aspect, the apparatus is connected to a mass spectrometer for the purpose of mass spectral analysis of the aerosolized and ionized liquid sample.

In one aspect, the voltage-free ionization method disclosed herein is referred to as Vibrating Sharp-edge Spray Ionization (VSSI). In one aspect, VSSI is simpler and more flexible than other voltage-free ionization methods such as, for example, sonic spray, ultrasonic nebulization, and solvent-assisted inlet ionization (SAII). In another aspect, VSSI enables in situ analysis through direct, contact-based ionization, without the need for extensive and/or complicated sample preparation techniques. Further in this aspect, trace chemicals on wet human and/or animal skin, as well as other substrates and surfaces, can be ionized using VSSI. In one aspect, other methods of ionization (for example, ESI) cannot be used in this matter due to safety concerns relating to high voltage. In still another aspect, samples aerosolized and ionized by VSSI can be analyzed in both positive and negative ion modes in a connected mass spectrometer. In a still further aspect, two VSSI sources can be simultaneously operated in order to study chemical reactions, in-source protein denaturation, solution phase hydrogen-deuterium exchange, and other phenomena as they occur in droplets. In one aspect, VSSI is advantageous over ESI in this regard, as the zero-voltage characteristics of VSSI allow multiple sources to be operated in close proximity whereas, with ESI, electrical breakdown (when opposite polarity needles are used) and/or droplet repulsion (when similar polarity needles are used) can occur.

In one aspect, the VSSI source can be operated by placing a drop of sample to be nebulized directly on the thin, rigid substrate. In an alternative aspect, the VSSI source can be operated by contacting a sample on a substrate with the edge of the thin, rigid substrate. In some aspects, this second mode of operation is useful in aerosolizing small amounts of fluid that are otherwise difficult to retrieve using common laboratory techniques, or, alternatively, to probe local chemical information with a solid glass tip.

In one aspect, VSSI is superior to conventional acoustic nebulization because conventional acoustic nebulization generates droplets from the entire liquid-gas interface, which may lead to the loss of droplets at the mass spectrometer inlet, thereby resulting in reduced sensitivity. In another aspect, VSSI is advantageous in that, in conventional acoustic nebulization, liquid droplets must be placed on top of a piezoelectric substrate, while in VSSI, the thin, rigid substrate merely needs to contact the liquid sample. In still another aspect, VSSI is advantageous in that an inexpensive piezoelectric transducer and glass microscope slide (together, under $1) are sufficient to cause nebulization in VSSI. In still another aspect, the exposed thin, rigid substrate (e.g., glass microscope slide) can be cleaned and reused. In one aspect, the transducer and substrate can be bonded using hard glue such as, for example superglue, UV- or thermal-curable gel, and the like.

In another aspect, the working frequency of VSSI depends on the material, dimensions, and geometry of the substrate and can be from about 4 to about 120 kHz, or can be about 4, 10, 20, 30, 40, 50, 60, 70, 80, 90, 100, 110, or about 120 kHz, or a combination of any of the foregoing values, or a range encompassing any of the foregoing values. In a further aspect, the applied waveform can be a sine wave, a square wave, or a modulated wave.

In one aspect, the peak-to-peak voltage required for VSSI is from about 10 to about 50 V, or is about 10, 15, 20, 25, 30, 35, 40, 45, or about 50 V, or a combination of any of the foregoing values, or a range encompassing any of the foregoing values.

In still another aspect, VSSI is able to work directly with non-polar solvents, which is not possible with ESI-based ionization methods. In one aspect, VSSI can be used with water, toluene, hexane, acetonitrile, a fluorocarbon oil such as FLUORINERT™ FC-40, a coated silica colloid such as PERCOLL® solution (trade name of a product from GE Healthcare Bio-Sciences), and miscible combinations thereof. In one aspect, any liquid with a viscosity lower than 20 cps is suitable for VSSI. In a further aspect, more viscous fluids require higher input powers to ionize. As an example, FC-40 with a viscosity of 4 cps requires 15 $V_{pp}$, whereas PERCOLL® with a viscosity of 15 cps requires a minimum of 35 $V_{pp}$ for aerosolization.

The exact physical process by which the vibrating sharp edge induces nebulization is still under investigation. Without wishing to be bound by theory, it appears that the high frequency vibration at the edge of the thin, rigid substrate causes the detachment of liquid droplets from the bulk fluid, resulting in a continuous spray of fluid from the thin, rigid substrate. It has been further speculated that relatively high amplitude vibration induces fast streaming velocity, a thin layer of fluid at the edge of the thin, rigid substrate, and localized heat, all of which are thought, in some aspects, to contribute to liquid aerosolization.

In one aspect, a well-defined droplet on the surface being analyzed is not necessary for direct VSSI. In some aspects, a thin layer of liquid film is sufficient to generate liquid spray. In a further aspect, this could be useful in field applications such as, for example, an operating room, in order to help surgeons probe the chemical makeup of tissue around a pathological site. In one aspect, VSSI nebulization can safely and effectively be conducted on a variety of wet surfaces and substrates including, but not limited to, cardboard; human or animal skin, hair, feathers, or organs; items suspected of containing explosives or illegal drugs; paper currency; crop plants; building materials; pharmaceutical and/or supplement tablets, pills, capsules, and the like; food or cosmetic items or packaging; cooking surfaces; postal mail; packages delivered by courier services; crime scene surfaces; surfaces at the scenes of suspected terror attacks; environmental surfaces being assessed for pollution or contamination; and any other surface useful in a law enforcement, military, medical, veterinary, environmental, food preparation, manufacturing quality control, pharmaceutical, metabolomics, proteomics, agricultural, or related application or endeavor.

In one aspect, VSSI can be used by the military, law enforcement, first responders, and government agencies for performing environmental assessments, detection of chemical threats, and similar applications. In a further aspect, VSSI ionization techniques can be harnessed for alternative applications including, but not limited to, drug delivery, in-droplet chemical synthesis, cooling, material fabrication, and the like.

Use of mass spectrometry in the operating room has recently gained attention due to the potential of this technique to provide information about the chemical makeup of tissues in and near the surgical incision and/or location of the operation. For example, iKnife technology uses rapid evaporative ionization mass spectrometry (REIMS) to characterize cells in regions of surgical incision. However, REIMS is limited in that information can only be obtained in the region of the incision, and further, REIMS requires destructive methods for generating droplets for ion generation. Furthermore, REIMS requires peripheral technology such as an ESI source that increases device cost, expertise required for operation, and bulkiness of instrumentation. In one aspect, VSSI overcomes these limitations of REIMS by being biocompatible and thus able to contact tissue directly. In a further aspect, a VSSI source has a small footprint and can be operated with a minimal amount of training. In a still further aspect, VSSI can be employed to analyze not only surgical boundaries but can also be used to collect information across the entire surgical region.

In another aspect, VSSI can be employed to determine the identity of an infectious agent afflicting an individual. Traditionally, matrix-assisted laser desorption ionization (MALDI) has been used to search for chemical signatures of different bacteria. In one aspect, VSSI is preferable to MALDI due to lower cost. In a further aspect, VSSI is useful for drug discovery and the screening of drug candidates. In one aspect, VSSI may be useful for rapid initial screening and may be useful in determining binding affinity to specific targets (e.g., through use of two VSSI sources or by another method). In an alternative aspect, VSSI can be used to assess protein stability and denaturation; exemplary procedures for performing protein denaturation experiments using parallel VSSI sources are discussed in the Examples.

In another aspect, because VSSI relies on a thin, rigid substrate such as, for example, a glass microscope slide, it is relatively simple to automate slide washing and thus repeated sampling of the same or different sample liquids, thereby increasing experimental throughput. In an alternative aspect, since microscope slides and other inexpensive substrates are employed, these can easily be switched out to prevent sample carryover.

In another aspect, VSSI can be used as a direct replacement for ESI and similar ionization methods, including DESI, PSI, and the like, in nearly any application. In one aspect, VSSI can be used in MS imaging. In a further aspect, VSSI is advantageous compared to DESI because it has higher resolution. In one aspect, resolution is dictated by the sharp edge used in ionization, whereas DESI produces a wide electrospray plume that is rastered across the sample. By rastering the sharp edge, instead, in one aspect, VSSI can provide a much clearer picture of the locations of different chemical compounds. In a further aspect, VSSI is non-destructive, enabling multiple imaging passes to provide a more robust assessment. In one aspect, this property is expected to be especially useful for biomarker discovery.

In another aspect, vibration can be induced by applying an RF signal to the piezoelectric transducer with a frequency equal to or a frequency combination encompassing the natural or resonance frequency of the VSSI source. In a further aspect, energy for aerosolization is provided by the vibration resonance of the thin, rigid substrate when exposed to the piezoelectric transducer vibrating at its natural frequency. In one aspect, when the solvent is water, with a $V_{pp}$ of from about 12.7 to about 30.6 V, droplet spray is generated only from liquid touching the vibrating edge of the thin, rigid substrate. In another aspect, with a $V_{pp}$ of greater than 32.0 V, aerosolization occurs across the entirety of the liquid-gas interface. In still another aspect, no aerosolization occurs when a water droplet is placed near, but not touching, the edge of the thin, rigid substrate. In any of these aspects, lower power inputs are required for VSSI to achieve nebulization.

In one aspect, droplet size in VSSI can be tuned based on solvent conditions, input voltage, and combinations thereof. In a further aspect, smaller droplets lead to improved ionization efficiency.

In one aspect, when the solvent is water and $V_{pp}$ is about 12.7 V, average droplet size is about 13 to about 23 μm, or is about 13, 14, 15, 16, 17, 18, 19, 20, 21, 22, or about 23 μm, or a combination of any of the foregoing values, or a range encompassing any of the foregoing values. In one aspect, the average droplet size under these conditions is about 18±5 μm. In one aspect, when the solvent is water and $V_{pp}$ is about 19.8 V, average droplet size is about 13 to about 31 μm, or is about 13, 14, 15, 16, 17, 18, 19, 20, 21, 22, 23, 24, 25, 26, 27, 28, 29, 30, or about 31 μm, or a combination of any of the foregoing values, or a range encompassing any of the foregoing values. In one aspect, the average droplet size under these conditions is about 22±9 μm. In one aspect, when the solvent is water and $V_{pp}$ is about 26.8 V, average droplet size is about 19 to about 31 μm, or is about 19, 20, 21, 22, 23, 24, 25, 26, 27, 28, 29, 30, or about 31 μm, or a combination of any of the foregoing values, or a range encompassing any of the foregoing values. In one aspect, the average droplet size under these conditions is about 25±6 μm. In an alternative aspect, when the solvent is a 1:1 mixture of acetonitrile and water with 1% acetic acid (v/v), average droplet size is about 6 to about 14 μm, or is about 6, 7, 8, 9, 10, 11, 12, 13, or about 14 μm, or a combination of any of the foregoing values, or a range encompassing any of the foregoing values. In one aspect, the average droplet size under these conditions is about 10±4 μm.

In any of the foregoing aspects, average droplet size and thus ionization efficiency can be tuned according to peak-to-peak voltage, solvent composition, and variations and combinations thereof.

In one aspect, due to the presence of a sharp edge on the substrate, with VSSI it is possible to form directional streams of droplets, which is not possible with other nebulization techniques. In a further aspect, this directionality can lead to higher sensitivity as droplets can be directed to the inlet region of a mass spectrometer. In a still further aspect, the sharp edge of the substrate in conjunction with the surface tension of the solvent being used can draw liquid to the sharp edge; in this aspect, liquid pumping is not required, thus reducing instrumentation requirements even further.

In one aspect, VSSI may be useful in probing the conformation or folding of biomolecules. In a further aspect, multiple sources can be used to denature or renature proteins within droplets, or can be used to be study the formation of protein complexes.

In still another aspect, VSSI can be useful to monitor rapid chemical reactions, including elucidating the kinetics of rapid reactions. In one aspect, VSSI can be used to monitor enzyme kinetics. Further in this aspect, an enzyme of interest would be deployed on one source and the substrate on a second source. The reactants and products could then be monitored by mass spectrometry after VSSI ionization. Still further in this aspect, a knowledge of droplet size could provide information about the lifetime of the droplet and thus information about reaction kinetics. In a parallel aspect, a similar technique could be used to monitor non-enzymatic reactions by depositing different reactants on different sources.

In one aspect, VSSI can be used as a source for any type of mass spectrometry analysis or related technique such as, for example, ion mobility spectrometry, tandem mass spectrometry, ion mobility mass spectrometry, time of flight mass spectrometry, and the like, and can be coupled to a variety of separation methods useful for analyzing complex samples including, but not limited to, liquid chromatography, gas chromatography, and capillary electrophoresis, as well as two dimensional and hybrid methods encompassing any of the above.

Figure 6:
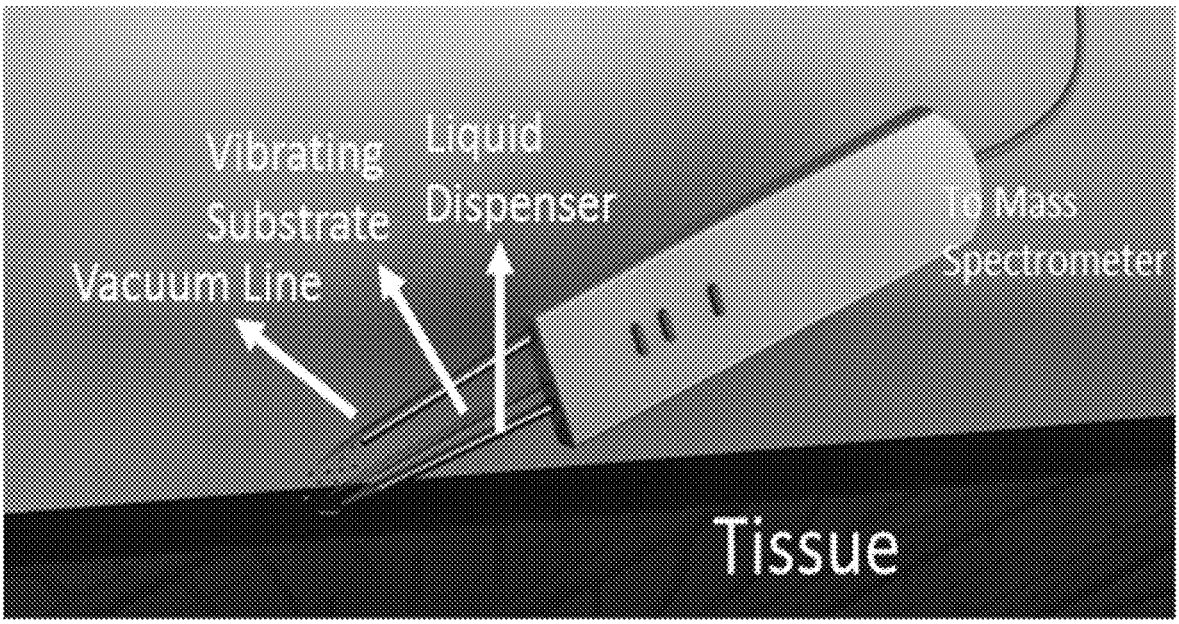
FIG. 6 shows a schematic of a VSSI source integrated with a liquid dispenser and a vacuum port for connection to a mass spectrometer.

Further in this aspect, provided herein are a method and apparatus for integrating a VSSI source with a liquid dispenser and vacuum port for a mass spectrometer (FIG. 6). In one aspect, the apparatus includes:

(a) a vibrating thin, rigid substrate for direct ionization of a liquid droplet on a tissue surface;

(b) a piezoelectric jetting system to apply small liquid droplets on a tissue surface for molecular extraction; and (c) a vacuum line to transport aerosols to a mass spectrometer.

In a further aspect, the piezoelectric jetting unit deposits an extraction microdroplet onto the target tissue at which time a pre-aligned substrate tip will touch the droplet to generate aerosols via VSSI. Further in this aspect, the aerosols are transported to the vacuum line to the mass spectrometer. In an additional aspect, a piezoelectric position controller can map molecular information relating to the tissue with sub-millimeter resolution. In all of the above aspects, the system is biocompatible and can, for example, allow real-time diagnosis on the operating table or in other time-critical applications.

In one aspect, the apparatus includes an ion funnel chamber to direct analytes into the mass spectrometer. In one aspect, the ion funnel can be constructed from printed circuit board, providing free space between lenses. In a further aspect, the free space can be used to pump away neutral solvent molecules. In a further aspect, the apparatus includes one or more pumping ports configured for attachment to mechanical pumps. In a still further aspect, the mechanical pumps can remove extra solvent molecules.

Capillary Vibrating Sharp-Edge Spray Ionization for Mass Spectrometry Detection

As discussed previously, VSSI offers a convenient way of ionizing target molecules for direct MS analysis. One disadvantage of the thin, rigid substrate platform in VSSI is the difficulty of continuous flow injection analysis. Thus, VSSI may not be suitable for direct coupling with LC or other continuous flow-based MS analyses. In one aspect, provided herein is a modified VSSI method (cVSSI) that can nebulize liquid samples directly at the outlet of a fused silica capillary, which allows for continuous flow-based injection.

In one aspect, a cVSSI instrument includes a capillary attached to a thin, rigid substrate that can be vibrated by a piezoelectric transducer (FIG. 9*a-d*). In a further aspect, once liquid reaches the outlet of the vibrating capillary, it is subsequently nebulized and directed to the inlet of a mass spectrometer. In a further aspect, the capillary configuration improves signal stability, reproducibility, and quantification capability over standalone VSSI sources. In still another aspect, cVSSI enables direct coupling of LC separation with MS analysis. In a further aspect, cVSSI is superior to other LC-MS ionization methods because it can generate a microdroplet plume directly from the capillary outlet without the need for a nebulizing gas or electrical field. Further in this aspect, this configuration simplifies the setup and reduces the footprint of the ionization unit for continuous flow-based MS analysis.

In one aspect, described herein is a novel method for direct fluid nebulization from the outlet of a capillary without the need for a nebulization gas or electric field.

In one aspect, positioning of the capillary on the VSSI slide can be critical to nebulization performance. In a further aspect, a short fused silica capillary is positioned on the distal end of a VSSI substrate (see FIG. 10 *a-c*). In one aspect, the capillary is from about 3 to about 10 cm in length, or is about 3, 4, 5, 6, 7, 8, 9, or about 10 cm in length. In a further aspect, the capillary can be 5.5 cm in length. In one aspect, when a significant length of capillary (such as, for example, at least 4 cm) extends beyond the substrate, nebulization efficiency decreases due to a damping effect. Thus, further in this aspect, the length of capillary (and hence mass of capillary extended beyond the substrate) was minimized. In one aspect, the optimum length of outlet end of the capillary is about 1 cm. Further in this aspect, this length of capillary outlet can maintain a stable spray while requiring small power input. In another aspect, when the outlet end of the capillary is relatively short, the inlet end of the capillary can be longer (i.e., about 4 cm). In one aspect, this length is convenient for connection to tubing. In a further aspect, this tubing can be plastic tubing suitable for low pressure sample injection, or can be a capillary connector for high-pressure applications. In either of these aspects, tubing connection does not affect nebulization at the capillary outlet. In a further aspect, due to the added mass of the capillary in CVSSI, the natural (resonant) frequency of the substrate can shift. In one aspect, the frequency shifts from about 97 kHz to about 93 kHz.

In one aspect, the capillary is affixed to the VSSI substrate using epoxy, superglue, UV- or heat-curable gel, or any suitable adhesive. In one aspect, the capillary is affixed to the VSSI substrate using a two-part epoxy that cures in approximately one minute.

In one aspect, the sizes of the droplets generated by cVSSI are similar to those generated by VSSI. In one aspect, the average size of droplet generated by cVSSI is from about 7 to about 17 μm, or is about 7, 8, 9, 10, 11, 12, 13, 14, 15, 16, or about 17 μm, or a combination of any of the foregoing values, or a range encompassing any of the foregoing values. In one aspect, the average size of droplet generated by cVSSI is 12±5 μm.

In one aspect, a capillary with an inner diameter (ID) ranging from about 50 to about 250 μm is suitable for use in cVSSI analysis. In another aspect, the capillary can have a diameter of about 50, about 75, about 100, about 125, about 150, about 175, about 200, about 225, about 250 μm, a combination of any of the foregoing values, or a range encompassing any of the foregoing values. In still another aspect, the capillary has a diameter of 100 μm. In another aspect, as the ID of the capillary decreases, a higher power input to nebulize the liquid sample is required. Without wishing to be bound by theory, as the ID decreases, the thickness of the capillary wall increases, resulting in less efficient vibration at the capillary tip, thus requiring a higher power input.

In a further aspect, the flow rate through the capillary can be about 1 μL/min to 1 mL/min (1000 μL/min) fora 100 μm ID capillary, or can be about 1, about 20, about 50, about 100, about 150, about 200, about 250, about 300, about 350, about 400, about 450, about 500, about 550, about 600, about 650, about 700, about 750, about 800, about 850, about 900, about 950, about 1000 μL/min, a combination of any of the foregoing values, or a range encompassing any of the foregoing values. In a further aspect, the flow rate is 1 μL/min. In another aspect, the flow rate is 20 μL/min. In a still further aspect, the flow rate is 1 mL/min. In another aspect, higher flow rates can be achieved with higher ID capillaries. In one aspect, for a 250 μm capillary, the flow rate through the capillary can be up to about 3 mL/min, or can be about 2.8 mL/min. In a further aspect, fora capillary with an ID less than 100 μm, flow rates less than 1 μL/min can be achieved.

In another aspect, as the flow rate increases, the power requirement for nebulization increases. In one aspect, the power requirement for nebulization is from about 100 mW to about 1 W (1000 mW), or is about 100, 150, 200, 250, 300, 350, 400, 450, 500, 550, 600, 650, 700, 750, 800, 850, 900, 950, about 1000 mW, a combination of any of the foregoing values, or a range encompassing any of the foregoing values fora 100 μm ID capillary. In one aspect, at 1 μL/min the power requirement for nebulizing fluid is about 130 mW. In another aspect, at 20 μL/min, the power requirement for nebulizing fluid is about 260 mW. In still another aspect, at 1 mL/min, the power requirement for nebulizing fluid is about 760 mW.

In another aspect, multiple capillary VSSI sources can be assembled in parallel to achieve simultaneous or sequential sampling and ionization for high throughput screening applications using mass spectrometry. In one aspect, 8 pulled tip cVSSI devices are attached onto a device holder that allows these devices to direct insert into 8 wells of a 96 well plate for direct sampling of liquid samples. After sampling, the devices are positioned close to the inlet of a mass spectrometer for ionization. In one aspect, the operation of multiple VSSI devices are controlled through multi-channel mechanical or solid-state relay.

Capillary Electrophoresis Coupled to VSSI

In one aspect, VSSI sources can be coupled to a separation method such as, for example, capillary electrophoresis. In one aspect, provided herein is an instrument configured to nebulize samples via VSSI that have first been separated by capillary electrophoresis.

In a typical capillary electrophoresis (CE) instrument, after sample introduction, the ends of a fused silica capillary rest in separate electrolyte solutions and voltage is supplied to electrodes in those solutions, which serve as cathode and anode. Depending on the mode of CE and the sample being analyzed, analytes travel from one end of the capillary to the other and are separated based on electrophoretic mobility. In one aspect, presented herein is an interface between a CE system and a mass spectrometer. In a further aspect, the interface uses VSSI as an ionization/nebulization method.

In a further aspect, in the interface disclosed herein, the site of injection is immersed in a vial of background electrolyte as with a typical CE instrument. In a further aspect, however, the detection end of the capillary is designed to be suspended in air while maintaining an electrical connection to the liquid inside of the capillary. In a still further aspect, this can be accomplished by folding a single piece of 25 μm platinum wire into a U shape and positioning this wire directly over or near the orifice of the capillary. In a still further aspect, both ends of the platinum wire can be fixed to the outer surface of the electrophoresis capillary with an adhesive such as, for example, fast-drying epoxy. Further in this aspect, the ends of the platinum wire are then connected to a second wire using a conductive adhesive such as, for example, conductive silver epoxy. In some aspects, the conductive epoxy can be further sealed with another adhesive such as, for example, fast-drying epoxy. Still further in this aspect, the detection end of the capillary can be grounded by connecting this second wire to ground.

In one aspect, the injection end of the capillary can be maintained at positive high voltage to perform normal polarity capillary electrophoresis (i.e., injection at anode and detection at cathode) or can be maintained at negative high voltage to perform reversed polarity capillary electrophoresis (i.e., injection at cathode and detection at anode). In one aspect, in order to avoid introducing gas bubbles into the capillary, the grounded electrode must touch the liquid coming out of the capillary to complete the circuit. Further in this aspect, the grounded electrode should not be placed inside the capillary channel.

In one aspect, the outlet from the electrophoresis capillary is positioned adjacent to a VSSI probe (substrate). In a further aspect, the VSSI probe (i.e., substrate) is a long, thin element such as, for example, a borosilicate capillary that has been pulled to have a narrow tip. In one aspect, in this instance, the VSSI probe tip is from about 5 to about 100 μm in diameter, or is about 5, 10, 15, 20, 25, 30, 35, 40, 45, 50, 55, 60, 65, 70, 75, 80, 85, 90, 95, about 100 μm in diameter, or a combination of any of the foregoing values, or a range encompassing any of the foregoing values. In one aspect, the VSSI probe tip is pulled to about 50 μm in diameter. In another aspect, the VSSI probe tip is positioned at an angle relative to the capillary outlet tip. In one aspect, the angle is from about 70 to about 110°, or is about 70, 75, 80, 85, 90, 95, 100, 105, or about 110°, or a combination of any of the foregoing values, or a range encompassing any of the foregoing values. In one aspect, the angle is 90°.

In a further aspect, the VSSI probe can touch the capillary surface in order for nebulization to occur. In a still further aspect, the VSSI probe functions optimally when the VSSI probe tip is near the capillary outlet orifice. In one aspect, once the capillary and VSSI probe are assembled as described above, a waveform can be applied to the probe to induce nebulization. In a further aspect, the waveform can range in frequency from about 3 kHz to about 1 MHz (1000 kHz), or can be about 3, 50, 100, 150, 200, 250, 300, 350, 400, 450, 500, 550, 600, 650, 700, 750, 800, 850, 900, 950, or about 1000 kHz, or a combination of any of the foregoing values, or a range encompassing any of the foregoing values. In a still further aspect, the waveform can be a sine wave, a square wave, or another modulated signal. In a still further aspect, the VSSI probe does not damage or modify the capillary. Further in this aspect, the VSSI probe can be used repeatedly.

In one aspect, the VSSI probe can be coupled with any size of electrophoresis capillary. In a further aspect, the electrophoresis capillary can have an inner diameter (ID) of from about 10 to about 110 μm, or can be about 10, 15, 20, 25, 30, 35, 40, 45, 50, 55, 60, 65, 70, 75, 80, 85, 90, 95, 100, 105, or about 110 μm, or a combination of any of the foregoing values, or a range encompassing any of the foregoing values. In one aspect, the electrophoresis capillary has an ID of 50 μm. In another aspect, the electrophoresis capillary has an ID of 100 μm. In a further aspect, the electrophoresis capillary can have any length suitable for capillary electrophoresis. In one aspect, the electrophoresis capillary is about 50 cm long. In an alternative aspect, the electrophoresis capillary is about 60 cm long.

In one aspect, the capillary electrophoresis flow rate can be from about 2 nL/min to about 1000 nL/min (1 μL/min), or can be about 2, 5, 10, 15, 20, 25, 30, 35, 40, 45, 50, 55, 60, 65, 70, 75, 80, 85, 90, 95, 100, 105, 110, 120, 130, 140, 150, 200, 250, 300, 350, 400, 450, 500, 550, 600, 650, 700, 750, 800, 850, 900, 950, or about 1000 nL/min, or a combination of any of the foregoing values, or a range encompassing any of the foregoing values. In a further aspect, flow rates of about 2 nL/min can be paired with narrow bore capillaries such as, for example, 10 μm inner diameter electrophoresis capillaries and conditions of low electroosmotic flow, such as with an uncoated electrophoresis capillary with a background electrolyte at pH 4. In another aspect, flow rates of up to 1 μL/min can be achieved with a large bore capillary such as, for example, 100 μm inner diameter, under conditions that generate a high electroosmotic flow, such as with an uncoated capillary with a background electrolyte at pH 12, or, in an alternative aspect, a coated capillary at a pH that generates high flow.

In another aspect, the capillary electrophoresis flow rate can be from about 10 nL/min to about 500 nL/min. In one aspect, a flow rate of about 10 nL/min can be paired with a 25 μL/min capillary under conditions of low electroosmotic flow. In an alternative aspect, a flow rate of about 500 nL/min can be paired with a larger bore capillary such as, for example, one with 100 μm inner diameter under conditions that generate a moderate electroosmotic flow such as using an uncoated capillary with a background electrolyte at pH 8.

In still another aspect, the capillary electrophoresis flow rate can be from about 50 to about 500 nL/min. In one aspect, when the flow rate is about 50 nL/min, a narrow bore capillary is used such as, for example, one with a 50 μm inner diameter, under conditions of low electroosmotic flow. In still another aspect, capillary bore, flow rate, coating, pH, and background electrolyte can be modified based on the analyte of interest using the above parameters as guidelines.

In one aspect, separations performed using the combined VSSI-capillary electrophoresis approach are reproducible in both time and intensity. In another aspect, VSSI-capillary electrophoresis separations are consistent with commercial equipment at pH values near neutral (such as, for example, around pH 6.5). In still another aspect, VSSI-capillary electrophoresis migration time is shorter at pH values below neutral when compared to commercial instruments (such as, for example, at around pH 5). In one aspect, VSSI-capillary electrophoresis can be performed at any pH compatible with the materials used to construct the instrument, or can be performed at about pH 1, 1.5, 2, 2.5, 3, 3.5, 4, 4.5, 5, 5.5, 6, 6.5, 7, 7.5, 8, 8.5, 9, 9.5, 10, 10.5, 11, 11.5, or about pH 12, or a combination of any of the foregoing values, or a range encompassing any of the foregoing values. In another aspect, VSSI-capillary electrophoresis can be performed from about pH 2 to about pH 10. Further in this aspect, a coating may be required for the electrophoresis capillary at lower pH values. Still further in this aspect, when ionization occurs at pH 10, either positive or negative ion mode can be used for MS ion collection. In another aspect, VSSI-capillary electrophoresis can be performed from about pH 2 to about pH 7. Further in this aspect, the electrophoresis capillary may require an acid-resistance coating from about pH 2 to about pH 4. Still further in this aspect, the volatile buffering agent for capillary electrophoresis can be selected from formic acid, acetic acid, or ammonium acetate. In yet another aspect, VSSI-capillary electrophoresis can be performed from about pH 4 to about pH 7. Further in this aspect, capillary electrophoresis can generate electrically driven bulk flow with no coating. Still further in this aspect, volatile buffering agents would be applicable for ionization including acetic acid or ammonium acetate.

Aspects

The following listing of exemplary aspects supports and is supported by the disclosure provided herein.

Aspect 1. An apparatus for ionizing a liquid sample, the apparatus comprising: (a) a thin, rigid substrate; and (b) a vibration generator.

Aspect 2. The apparatus of Aspect 1, wherein the thin, rigid substrate comprises glass, quartz, silicon, hard plastic, a ceramic material, metal, a composite material, fused silica, polyether ether ketone (PEEK), pyrolytic boron nitride (PBN), or a combination thereof.

Aspect 3. The apparatus of Aspect 2, wherein the thin, rigid substrate comprises glass.

Aspect 4. The apparatus of any of Aspect 1-Aspect 3, wherein the thin, rigid substrate comprises a proximal end with a flat surface and a distal end with at least one sharp edge.

Aspect 5. The apparatus of Aspect 4, wherein the sharp edge is a corner.

Aspect 6. The apparatus of any of Aspect 1-Aspect 3, wherein the thin, rigid substrate comprises an irregular shape.

Aspect 7. The apparatus of Aspect 6, wherein the irregular shape comprises a triangle or a capillary with a tapered tip.

Aspect 8. The apparatus of any of Aspect 1-Aspect 3, wherein the thin, rigid substrate comprises microchannels to direct fluid flow.

Aspect 9. The apparatus of Aspect 1, wherein the thin, rigid substrate is chemically modified with a polymethylsiloxane or other silicone-based network in order to increase hydrophobicity.

Aspect 10. The apparatus of any of Aspect 1-Aspect 3, wherein the thin, rigid substrate comprises a glass microscope slide.

Aspect 11. The apparatus of any of Aspect 1-Aspect 3 or Aspect 10, wherein the thin, rigid substrate comprises a top surface area of from about 24×50 mm to about 24×75 mm.

Aspect 12. The apparatus of any of Aspect 1-Aspect 3 or Aspect 10, wherein the thin, rigid substrate comprises a thickness of from about 0.08 mm to about 0.19 mm.

Aspect 13. The apparatus of Aspect 1, wherein the vibration generator is an electromechanical transducer.

Aspect 14. The apparatus of Aspect 13, wherein the electromechanical transducer is a piezoelectric transducer.

Aspect 15. The apparatus of Aspect 4, wherein the vibration generator is fixed to the proximal end of the thin, rigid substrate to form a combined body.

Aspect 16. The apparatus of Aspect 15, wherein activation of the vibration generator causes the sharp edge of the thin, rigid substrate to vibrate.

Aspect 17. The apparatus of Aspect 16, wherein the vibration frequency of the combined body is its resonant frequency.

Aspect 18. A method for producing a spray of droplets, the method comprising: (a) causing the sharp edge of the thin, rigid substrate of Aspect 1 to vibrate, generating a vibrating sharp edge; and (b) contacting a liquid sample with the vibrating sharp edge.

Aspect 19. The method of Aspect 18, wherein the spray of droplets comprises an aerosol.

Aspect 20. The method of Aspect 18, wherein the spray of droplets comprises an emulsion.

Aspect 21. The method of Aspect 18, wherein a droplet of the liquid sample is placed on the thin, rigid substrate.

Aspect 22. The method of Aspect 18, wherein the thin, rigid substrate is used to contact a wet surface.

Aspect 23. The method of Aspect 18, wherein contacting the liquid sample with the vibrating sharp edge causes the spray of droplets to ionize.

Aspect 24. The method of Aspect 23, wherein ionization is voltage-free.

Aspect 25. The method of Aspect 24, wherein voltage is applied to the vibration generator to achieve ionization.

Aspect 26. The method of any of Aspect 18-Aspect 25, wherein the spray of droplets is generated only along the vibrating sharp edge.

Aspect 27. The method of Aspect 26, wherein the spray of droplets is generated continuously and ends only when the vibrating sharp edge is removed from the liquid sample or when the liquid sample has been fully ionized.

Aspect 28. The method of Aspect 18, wherein the liquid sample comprises a solvent.

Aspect 29. The method of Aspect 28, wherein the solvent comprises water, toluene, hexane, acetonitrile, a fluorocarbon oil, a coated silica colloid, or a miscible combination thereof.

Aspect 30. The method of Aspect 22, wherein the wet surface comprises cardboard; human or animal skin, hair, feathers, or organs; items suspected of containing explosives or illegal drugs; paper currency; crop plants; building materials; pharmaceutical and/or supplement tablets, pills, or capsules; food items; food packaging; cosmetic items; cosmetic packaging; cooking surfaces; postal mail; packages delivered by courier services; crime scene surfaces; surfaces at the scenes of suspected terror attacks; environmental surfaces being assessed for pollution or contamination; or the like.

Aspect 31. The method of Aspect 18, wherein application of a radio frequency (RF) signal to the thin, rigid substrate induces vibration.

Aspect 32. The method of Aspect 31, wherein the liquid sample is dissolved in water and the peak-to-peak voltage (Vpp) of the RF signal is from about 12.7 V to about 30.6 V.

Aspect 33. The method of Aspect 32, wherein Vpp is 12.7 V and average droplet size in the spray of droplets is about 18±5 μm.

Aspect 34. The method of Aspect 32, wherein Vpp is 19.8 V and average droplet size in the spray of droplets is about 22±9 μm.

Aspect 35. The method of Aspect 32, wherein Vpp is 26.8 V and average droplet size in the spray of droplets is about 25±6 μm.

Aspect 36. The method of Aspect 31, wherein the liquid sample is dissolved in a 1:1 mixture of acetonitrile and water with 1% acetic acid and the average droplet size in the spray of droplets is about 10±4 μm.

Aspect 37. The apparatus of Aspect 1, further comprising a vacuum port for injecting the liquid sample into a mass spectrometer following ionization.

Aspect 38. The apparatus of Aspect 37, wherein the mass spectrometer can analyze the liquid sample in either positive or negative ion mode.

Aspect 39. A method for analyzing a change to a molecule, the method comprising: (a) introducing a first liquid sample to a first apparatus according to Aspect 1 and generating a first spray of droplets; (b) introducing a second liquid sample to a second apparatus according to Aspect 1 and generating a second spray of droplets; (c) allowing the first spray of droplets and the second spray of droplets to contact one another to form a combined spray of droplets; and (d) introducing the combined spray of droplets into a mass spectrometer.

Aspect 40. The method of Aspect 39, wherein the change to a molecule is protein denaturation, the first liquid sample comprises a protein of interest, and the second liquid sample comprises a reactant, solvent, acid, or base that will denature the protein of interest upon contact.

Aspect 41. The method of Aspect 39, wherein the change to a molecule is a chemical reaction, the first liquid sample comprises a first reactant, the second liquid sample comprises a second reactant, and the chemical reaction will occur when the first spray of droplets and the second spray of droplets contact one another.

Aspect 42. The apparatus of Aspect 1, further comprising: (a) a piezoelectric jetting system to apply small liquid droplets on a surface for molecular extraction; and (b) a vacuum line to transport aerosols to a mass spectrometer.

Aspect 43. The apparatus of Aspect 42, further comprising a piezoelectric position controller.

Aspect 44. The apparatus of Aspect 43, wherein the piezoelectric position controller can modulate the position of the thin, rigid substrate such that molecular information about the surface can be mapped.

Aspect 45. The apparatus of Aspect 1 or Aspect 44, wherein the apparatus is biocompatible.

Aspect 46. The apparatus of Aspect 1, wherein the apparatus further comprises a capillary fixed to the thin, rigid substrate.

Aspect 47. The apparatus of Aspect 46, wherein the capillary is glued to the thin, rigid substrate.

Aspect 48. The apparatus of Aspect 46 or Aspect 47, wherein the capillary comprises an inlet end configured to connect to tubing from a source of continuous liquid flow.

Aspect 49. The apparatus of Aspect 48, wherein the inlet end of the capillary extends about 4 cm past the thin, rigid substrate.

Aspect 50. The apparatus of Aspect 46 or Aspect 47, wherein the capillary comprises an outlet end configured to transmit the ionized liquid sample to a mass spectrometer.

Aspect 51. The apparatus of Aspect 50, wherein the outlet end extends about 1 cm past the thin, rigid substrate.

Aspect 52. The apparatus of Aspect 46, wherein the capillary has an inner diameter of from about 50 to about 250 μm.

Aspect 53. The apparatus of Aspect 52, wherein the capillary has an inner diameter of 100 μm.

Aspect 54. An apparatus comprising the capillary of Aspect 48, wherein the source of continuous liquid flow has a flow rate of from about 1 μL/min to about 1 mL/min.

Aspect 55. The apparatus of Aspect 54, wherein the flow rate is 1 μL/min.

Aspect 56. The apparatus of Aspect 54, wherein nebulization requires a power input and the power input is proportional to the flow rate.

Aspect 57. The apparatus of Aspect 56, wherein the power input is from about 100 mW to about 1 W.

Aspect 58. The apparatus of Aspect 56, wherein, for a 100 μm capillary with a 1 μL/min flow rate, the power input is about 130 mW.

Aspect 59. The apparatus of Aspect 56, wherein, for a 100 μm capillary with a 20 μL/min flow rate, the power input is about 260 mW.

Aspect 60. The apparatus of Aspect 56, wherein, for a 100 μm capillary with a 1 mL/min flow rate, the power input is about 760 mW.

Aspect 61. An interface between a capillary electrophoresis apparatus and a mass spectrometer comprising the apparatus of Aspect 1.

Aspect 62. The interface of Aspect 61, wherein the capillary electrophoresis apparatus comprises a capillary with a detection end suspended in air.

Aspect 63. The interface of Aspect 62, wherein the capillary has an inner diameter of from about 50 to about 100 μm.

Aspect 64. The interface of Aspect 62, wherein the detection end comprises a U-shaped platinum wire.

Aspect 65. The interface of Aspect 64, wherein the platinum wire serves as an electrode for capillary electrophoresis separations.

Aspect 66. The interface of Aspect 64, wherein the platinum wire is grounded.

Aspect 67. The interface of Aspect 66 wherein a flow of liquid exits the detection end and the platinum wire is contacted by the flow of liquid, and wherein the platinum wire does not enter the detection end of the capillary.

Aspect 68. The interface of Aspect 62, wherein the capillary electrophoresis apparatus can be operated in normal polarity mode or in reverse polarity mode.

Aspect 69. The interface of Aspect 62, wherein the thin, rigid substrate comprises a borosilicate capillary pulled to a thin diameter.

Aspect 70. The interface of Aspect 69, wherein the borosilicate capillary is oriented at a 90° angle to the detection end of the capillary included in the capillary electrophoresis apparatus.

Aspect 71. The interface of Aspect 70, wherein the borosilicate capillary touches the detection end.

Aspect 72. The interface of any of Aspect 69-Aspect 71 wherein the borosilicate capillary can be used multiple times prior to replacement.

Aspect 73. The interface of any of Aspect 69-Aspect 71, wherein a waveform is applied to the borosilicate capillary to induce ionization.

Aspect 74. The interface of Aspect 73, wherein the waveform comprises a frequency of from about 3 kHz to about 1 MHz.

Aspect 75. The interface of Aspect 73, wherein the waveform comprises a sine wave or a square wave.

From the foregoing, it will be seen that aspects herein are well adapted to attain all the ends and objects hereinabove set forth together with other advantages which are obvious and which are inherent to the structure.

While specific elements and steps are discussed in connection to one another, it is understood that any element and/or steps provided herein is contemplated as being combinable with any other elements and/or steps regardless of explicit provision of the same while still being within the scope provided herein.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings and detailed description is to be interpreted as illustrative and not in a limiting sense.

It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the disclosure and are not intended to limit the scope of what the inventors regard as their disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1: Ionization and Analysis of Samples Using VSSI

A. Construction of VSSI Device and Mass Spectrometer Settings

The VSSI device was made by attaching a piezoelectric transducer (Murata) to one end of a No. 1 glass microscope glass slide (VWR) using superglue. The RF signal was generated using a Tektronix function generator (AFG-1062) connected to an amplifier (Krohn-Hite 7500).

Droplet images for size measurement were taken using an Olympus IX-73 inverted fluorescence microscope and analyzed using Image J software (v1.51s).

All mass spectrometry experiments were carried out using an Orbitrap mass spectrometer (Thermo). For these experiments, the resolving power was set at $7.0\times10^4$ for precursor ion analysis. The capillary inlet was maintained at 250° C. Ion chromatograms were collected for varying times (from 1 to 3 min).

B. Generation of Droplet Spray

Figure 1B:
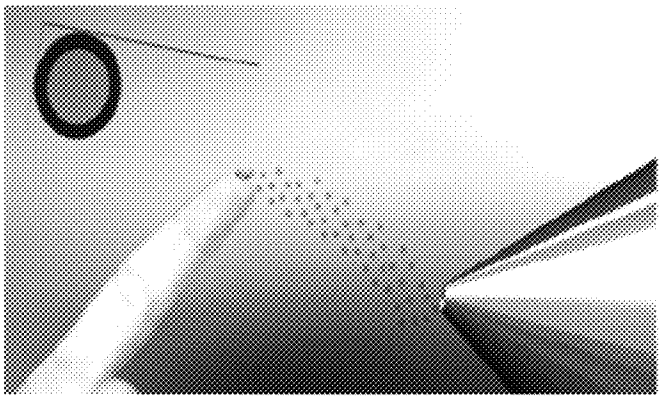
Figure 1C:
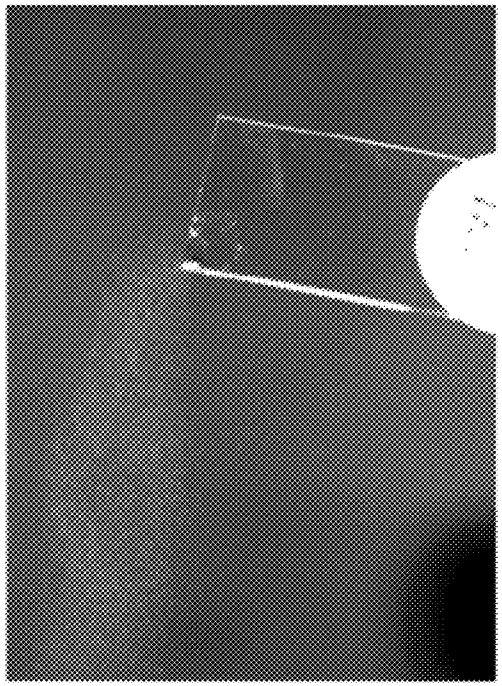

A typical sample was ionized by adding a drop of liquid to the edge of a vibrating microscope glass slide (FIG. 1*a-c*). Vibration was induced by applying an RF signal to a piezoelectric transducer with a frequency of ~97 kHz. Energy for aerosolization was provided by the vibration resonance of the glass slide when exposed to the piezoelectric transducer vibrating at its natural frequency. When peak-to-peak voltage input was between 12.7 and 30.6 V, it was determined that the liquid spray was solely generated from the liquid touching the vibrating edge as opposed to the entire liquid-gas interface. No spray was generated when a water droplet was placed near, but not touching, the edge of the glass side, even though this caused the water droplet to vibrate. When peak-to-peak voltage input was 32.0 V or greater, liquid aerosolization from the entire liquid-gas interface was observed, similarly to the classic ultrasonic nebulization scenario. Thus, lower power inputs are required for VSSI to achieve nebulization.

Figure 1D:
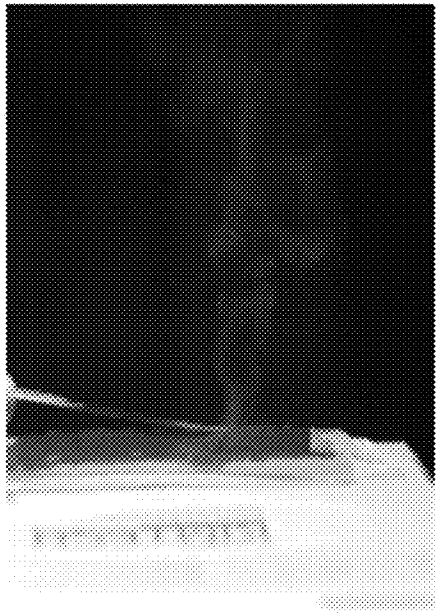

In some experiments, spray was generated simply by touching liquid on a solid surface with a vibrating glass edge. In one aspect, VSSI was used to successfully induce liquid spray from wet cardboard (FIG. 1*d*).

C. Droplet Size

Droplet size is important for both ionization efficiency and chemical processes occurring during ion production. Size distribution of VSSI-generated droplets and factors affecting this size distribution were investigated. Droplets were collected using a petri dish placed 20 mm away from the glass slide. A drop of mineral oil was applied immediately after liquid droplets reached the bottom of the petri dish to prevent further evaporation. The diameter of the droplets was obtained by examination under a microscope.

Figure 2A:
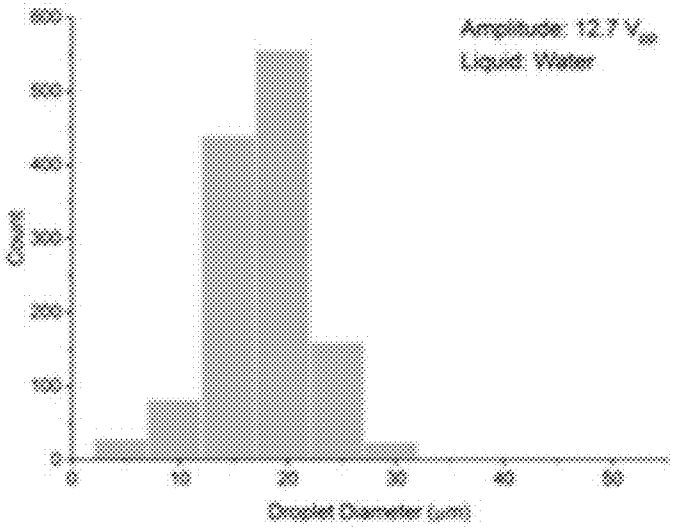
FIGS. 2A-2D show representative data pertaining to the size distributions of droplets generated by VSSI under different power input conditions and for different solvent systems.
Figure 2B:
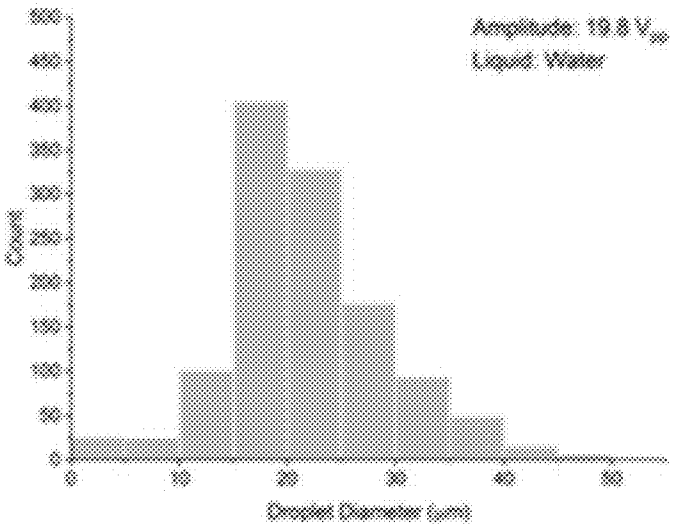
Figure 2C:
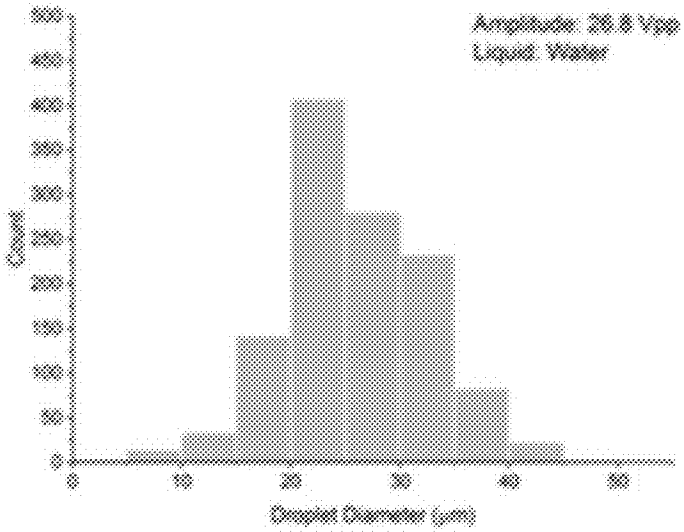

For pure water, average droplet diameter was 18 μm with a standard deviation of 5 μm using a 12.7 $V_{pp}$ power input (FIG. 2*a*). An increase in the average droplet size was observed with increasing voltage input. The average diameters for 19.8 $V_{pp}$ and 26.8 $V_{pp}$ were 22±9 μm and 25±6 μm, respectively (FIG. 2*b-c*).

Figure 2D:
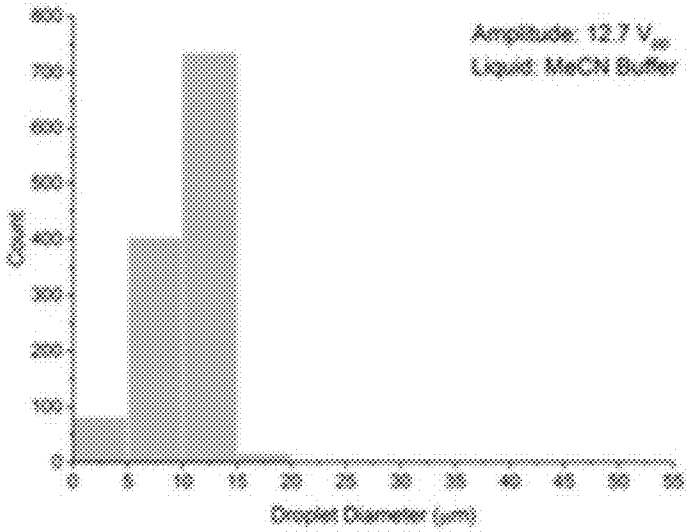

In addition to voltage input, solvent content was also found to play a role in determining VSSI-generated droplet size. Water was replaced with a 1:1 mixture of water and acetonitrile containing 1% acetic acid, the average droplet size decreased from 18±5 μm to 10±4 μm under the same input power conditions (FIG. 2*d*). These results indicate that droplet size in VSI can be tuned by adjusting power input and solvent content, and thus optimized for specific applications and target samples.

D. VSSI as Ionization Source for Mass Spectrometry

A series of 1 mM solutions were prepared using homocysteine, sucrose, polyalanine peptides, and ubiquitin in 1:1 water:acetonitrile with 1% acetic acid. For each solution, 20 μL sample was added to the edge of a glass slide and spray was generated by applying a radio frequency signal of 97.1 kHz and 14.4 $V_{pp}$ to the piezoelectric transducer. Mass spectra were obtained using an Orbitrap analyzer in positive ion mode with a capillary temperature of 250° C.

Figure 3A:
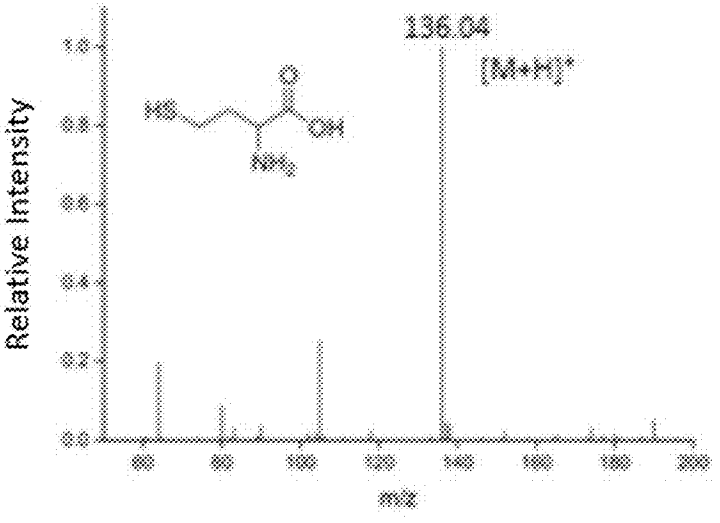
FIGS. 3A-3E show representative mass spectra obtained using the disclosed methods.
Figure 3B:
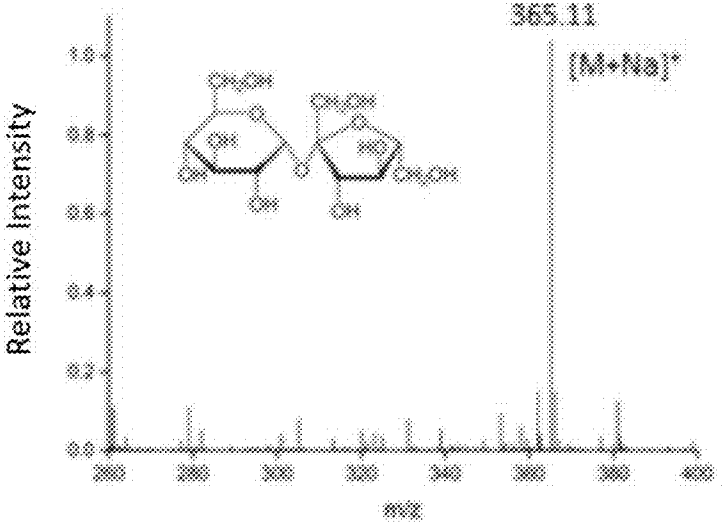
Figure 3C:
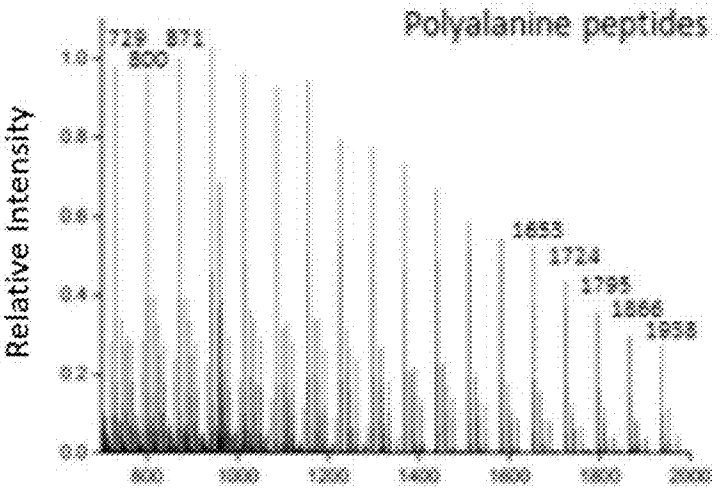
Figure 3D:
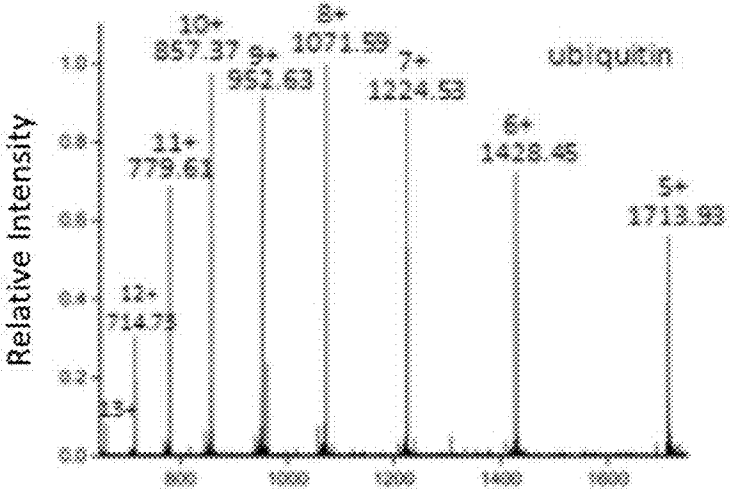
Figure 3E:
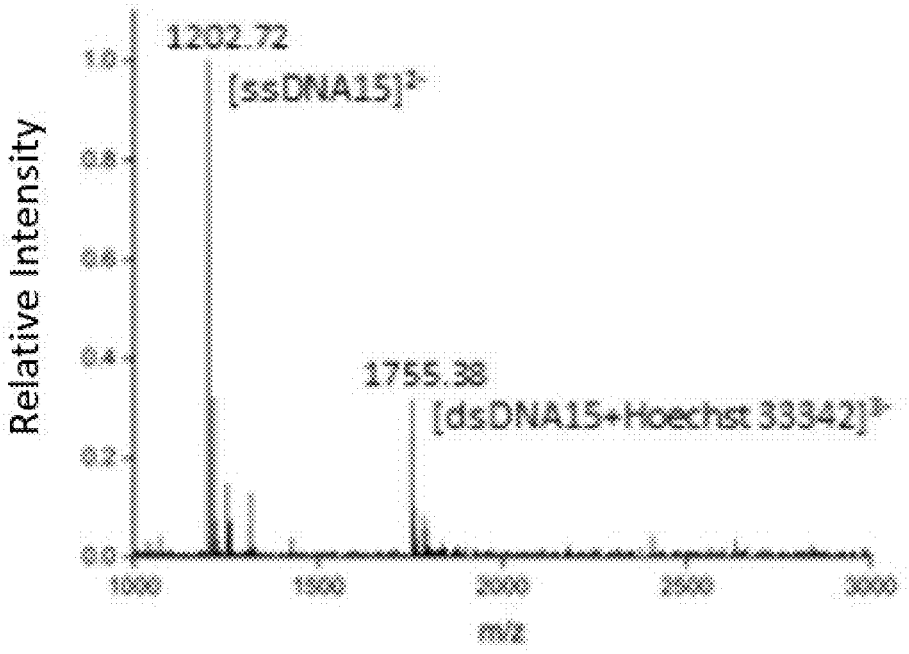

Mass spectra revealed ESI-type ions produced by VSSI. Upon VSSI of the homocysteine sample, a dominant peak was observed at m/z of ~136 (FIG. 3*a*). This peak corresponds to $[M+H]^+$ homocysteine ions. VSSI of sucrose produced a dominant feature at m/z of ~365 (FIG. 3*b*), corresponding to $[M+Na]^+$ precursor ions. The polyalanine solution produced a number of dominant features spaced apart by m/z of ~71 (FIG. 3*c*). These peaks correspond to $[Ala_n+H]^+$ ions (where n is 10 to 27). Upon VSSI of the ubiquitin sample, the +5 to +13 charge states are observed as dominant features (FIG. 3*d*). This spectrum is similar to that obtained using ESI for the same protein. A further sample was prepared containing a mixture of a DNA duplex (the self-complementary strand CAAATTTG complexed with Hoechst 33342) using negative ion mode. Dominant features were observed at m\z ~1203 and ~1755 (FIG. 3*e*). These ions correspond to doubly-charged single stranded DNA and triply charged DNA duplex complexed with Hoechst 33342. Thus, VSSI is able to efficiently ionize a number of diverse molecules.

E. Operation of Multiple Sources Simultaneously

Figure 4A:
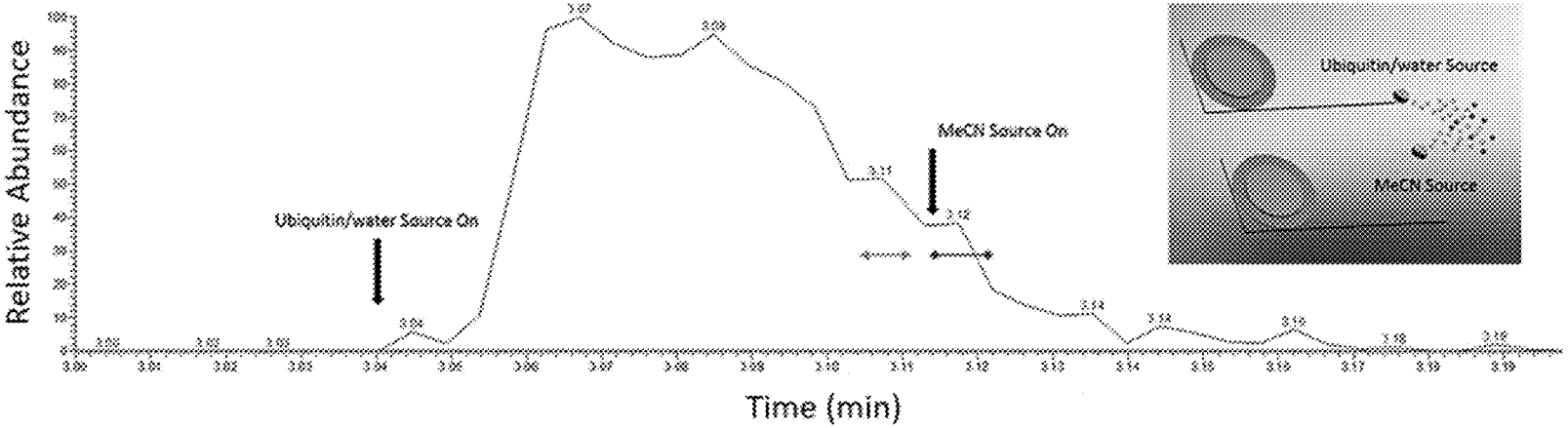
FIGS. 4A-4C show in-droplet denaturation of ubiquitin by acetonitrile.
Figure 4B:
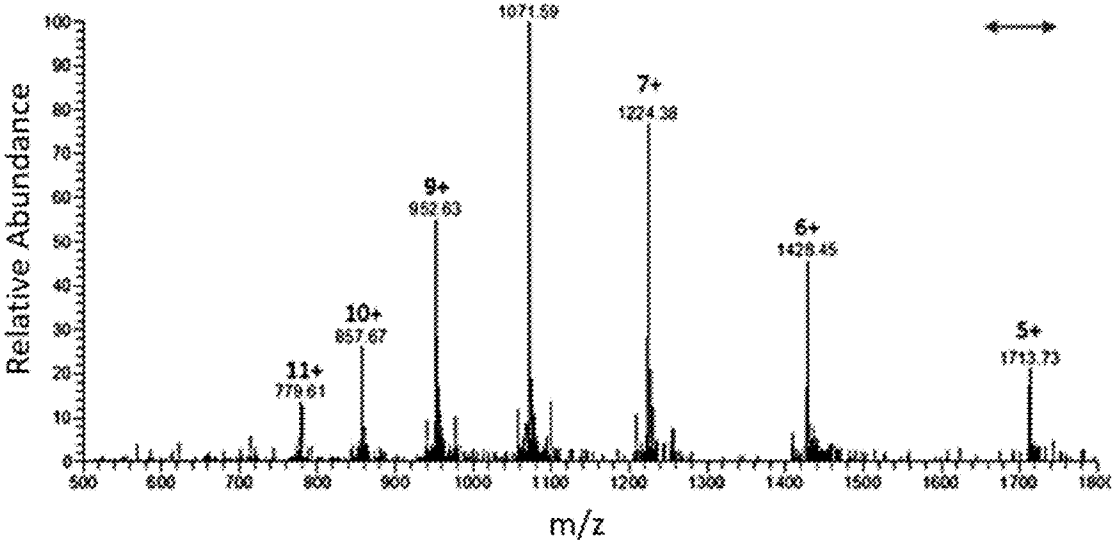
Figure 4C:
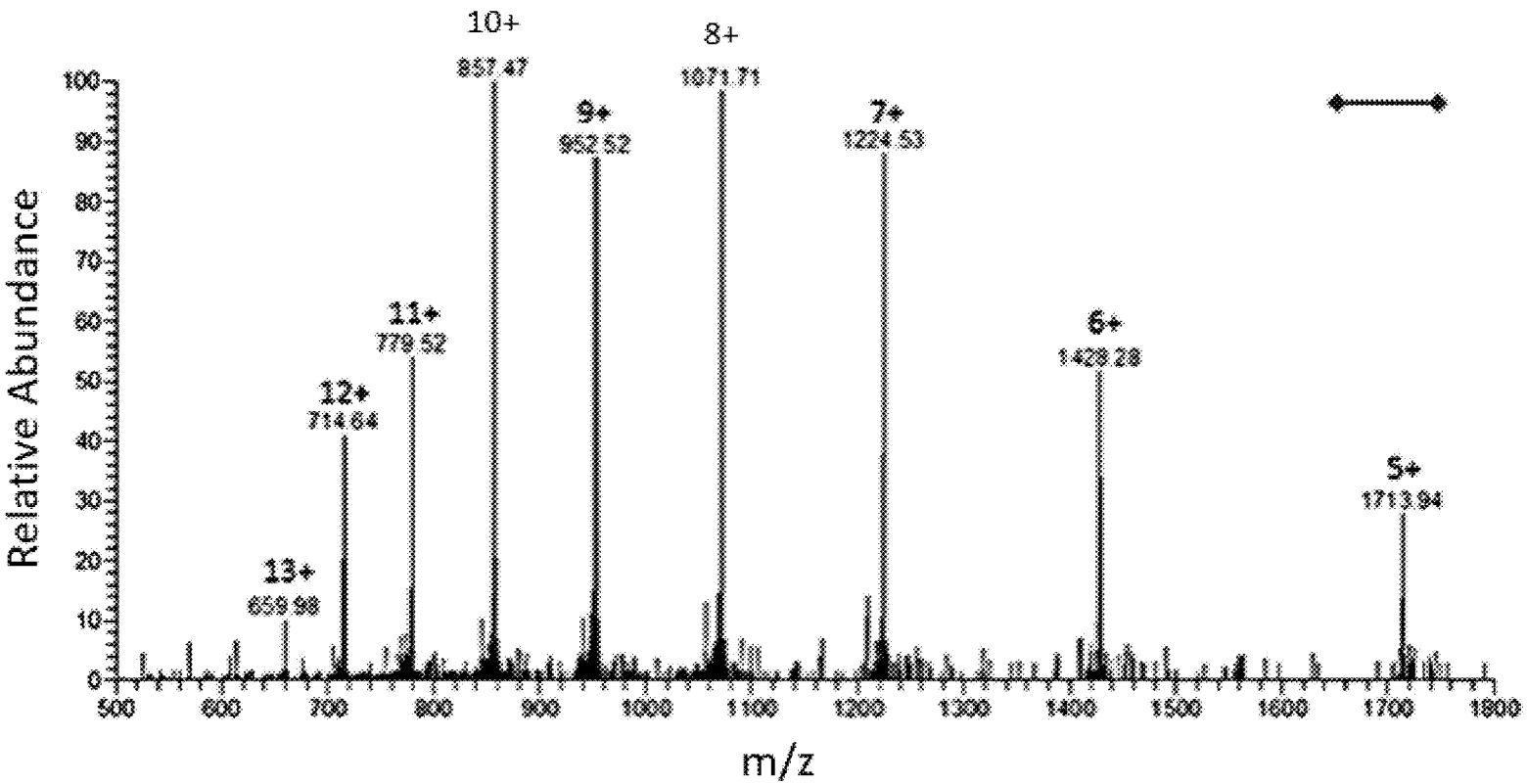

The zero-voltage characteristics of VSSI make it convenient to operate multiple sources in close proximity without worrying about electrical breakdown (in the case of opposite polarity needles) or problems of droplet repulsion (in the case of similar polarity needles). In-droplet denaturation of ubiquitin was demonstrated using two VSSI sources. 40 μL of a solution of ubiquitin in water was placed on one source and 40 μL of acetonitrile (containing 1% acetic acid) was placed on a second source. The two sources were positioned near the mass analyzer inlet as shown in FIG. 4*a*. The first source was turned on to generate ubiquitin droplets for 4 s. The second source was turned on to generate acetonitrile droplets that could be combined with the droplets containing ubiquitin. This in-droplet denaturation process was recorded in the mass spectrum shown in FIG. 4*b*. Over the first 4 s of data acquisition, the major ubiquitin ions produced by VSSI were the +7 and +8 states (FIG. 4*b*). Overall, the charge state distribution produced by VSSI extended to from the +5 to the +11 ions. Immediately after turning on the acetonitrile source, a significant increase in higher (+9 to +13) charge states of ubiquitin ions was observed, indicating droplet denaturation of ubiquitin (FIG. 4*c*).

F. Direct Ionization from Living Organisms

Figure 5A:
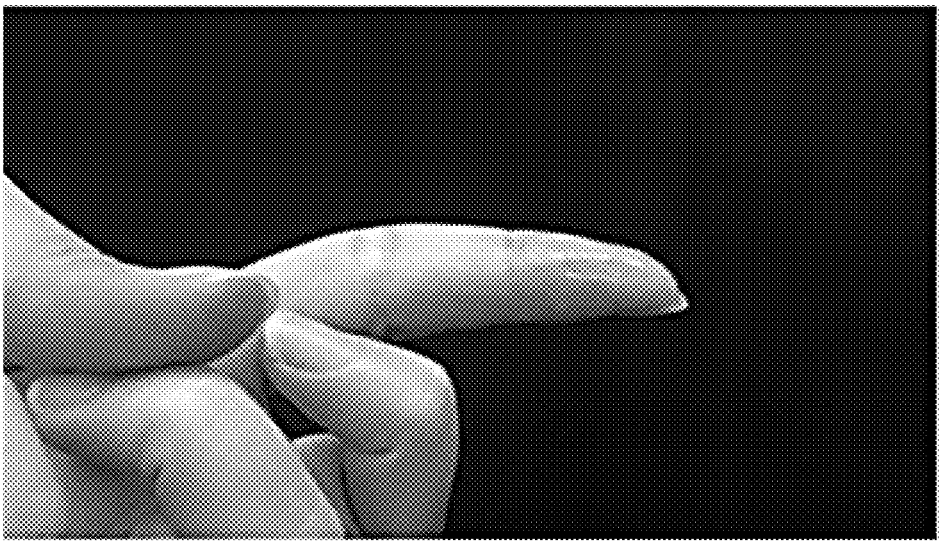
FIGS. 5A-5F show in-situ analysis of trace chemicals on human fingertips using disclosed VSSI methods.
Figure 5B:
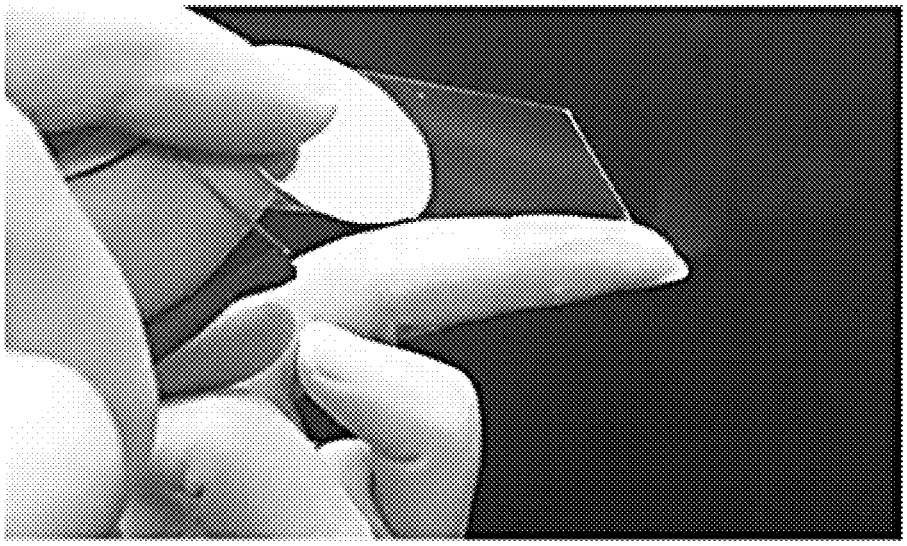
Figure 5C:
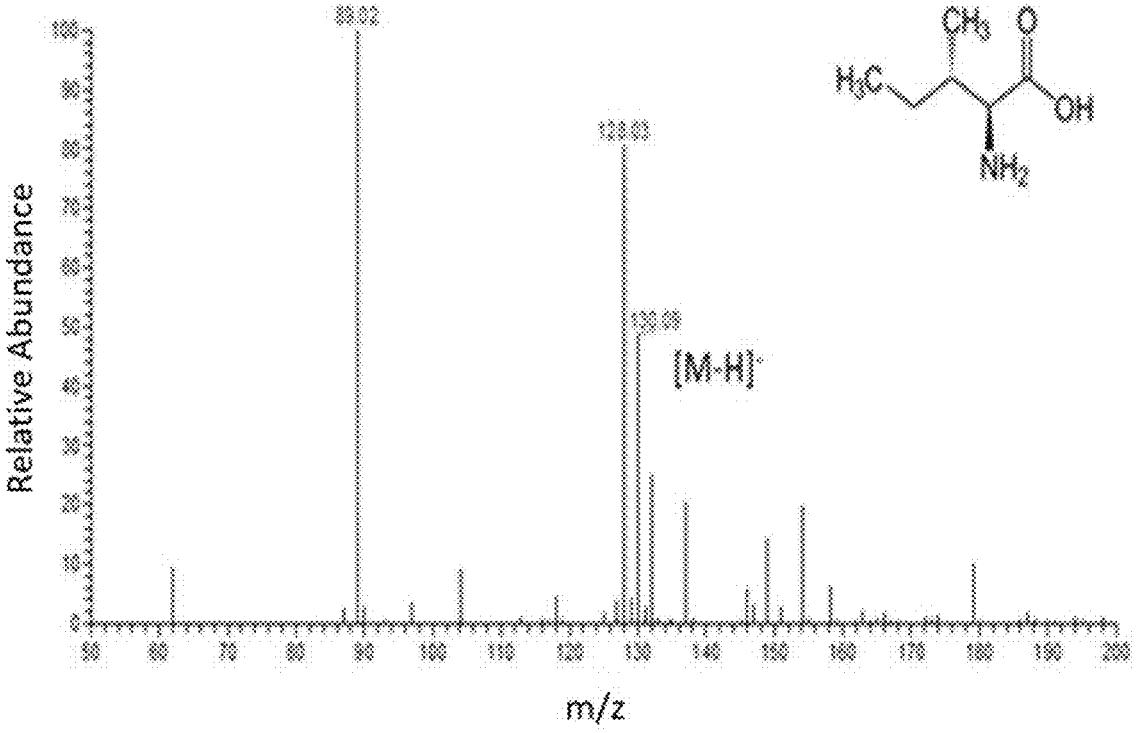
Figure 5D:
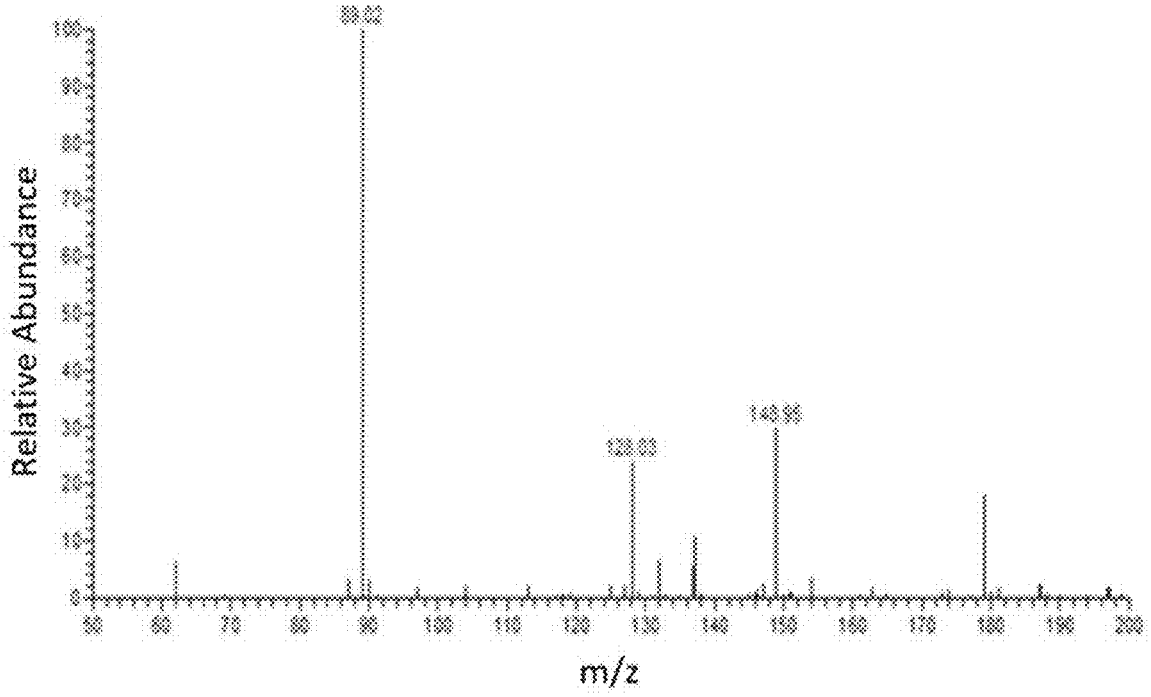
Figure 5E:
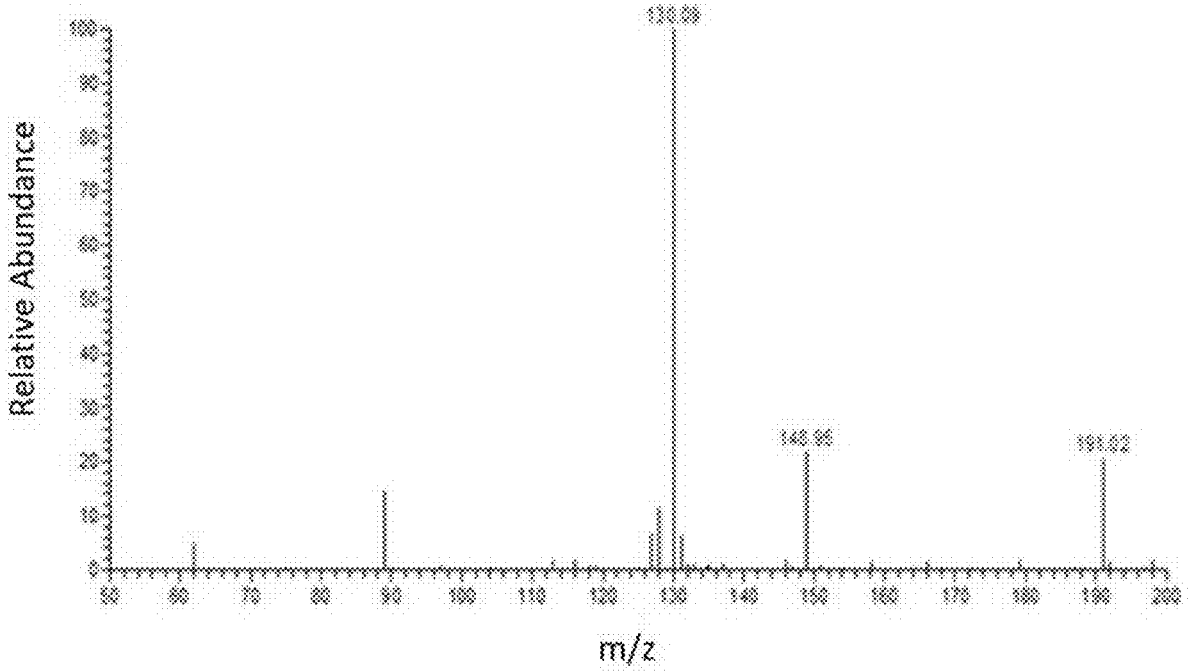

The tip of a vibrating glass slide was touched to a wet human finger, generating a liquid spray in situ without the need for sample transfer (FIG. 5*a-b*). Direct analysis of trace chemicals was then performed using an Orbitrap mass analyzer. The finger was used to touch isoleucine powder and 10 μL of water was added to the fingertip. After 1 min, the vibrating glass tip was applied to the finger and a mass spectrum was obtained in negative ion mode (FIG. 5*c*). Compared to a blank analysis (separate finger as a negative control, FIG. 5*d*) and the on-substrate VSSI of isoleucine solution (positive control, FIG. 5*e*), the trace amount of isoleucine on the fingertip was clearly detected with direct VSSI analysis.

Figure 5F:
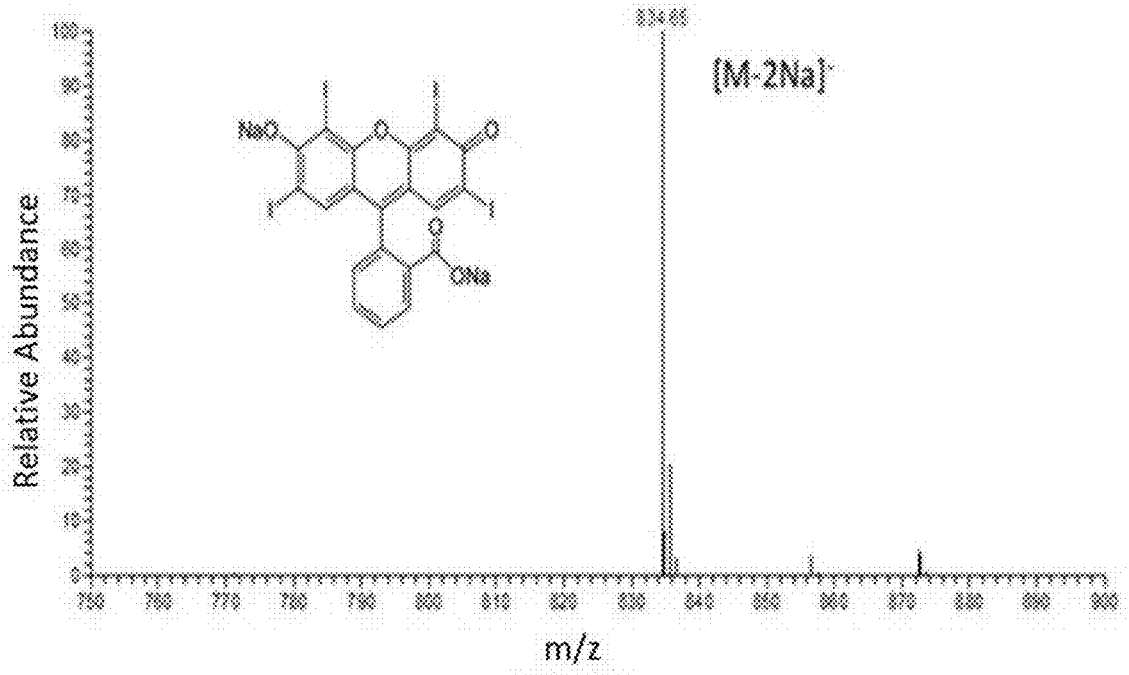

In an alternative experiment, a trace amount of red food coloring on a fingertip was detected by VSSI using the same setup. Red food dye mixture (Wilton Gel Food Color) was diluted 100-fold and a small drop was applied to the fingertip. The liquid was wiped off with a paper towel and a red trace was observed on the fingertip. 5 μL of water was then applied to the red trace and ionized by direct VSSI. A peak having a nominal m/z of 835 was observed in the mass spectrum and corresponds with $[M-H]^-$ ions of the red dye (erythrosine) as shown in FIG. 5*f*.

Example 2: cVSSI Design, Configuration, and Operation

A. Materials and Reagents

High performance liquid chromatography (HPLC) grade acetonitrile, water, ammonium acetate, formic acid, methanol, and benzoic acid were purchased from Fisher Scientific (NJ, USA). Sucrose, caffeine, acetaminophen, dopamine, acetic acid, cytochrome c (equine), and pepsin (porcine, 2500 units/mg protein) were purchased from Sigma Aldrich (MO, USA) and used without further purification. Guanine and guanosine were purchased from Acros Organics (NJ, USA). Angiotensin II was purchased from Alfa Aesar (MA, USA). Ubiquitin was purchased from Boston Biochem (MA, USA).

B. Instrumentation

A high performance Q-Exactive (ThermoScientific) mass spectrometer featuring quadrupole precursor selection with high resolution, accurate-mass (HR/AM) Orbitrap detection was used for all MS analyses. An Accela ultra high-performance liquid chromatography (UHPLC or UPLC) system (ThermoScientific) was used for LC separation experiments. This system also features a photodiode array detector (DAD) for absorbance measurements across multiple wavelengths. Measurements were conducted under ambient conditions and employed a capillary inlet temperature of 250° C. A Model Fusion 200 syringe pump from Chemyx Inc. was used to pump analytes at set flow rates.

C. cVSSI Fabrication and Operation cVSSI devices were fabricated by attaching a short piece (~5.5 cm) of fused silica capillary (Polymicro) on the distal end of a VSSI device using a glass side as the thin, rigid substrate. The capillary was immobilized on the VSSI glass slide by glass glue. A detailed discussion of the fabrication of the VSSI device appears in Example 1. A schematic and photographs of the cVSSI device are shown in FIG. 9*a-d*.

The cVSSI device was activated using a function generator (Tektronix) and a power amplifier (Mini-Circuits) at frequencies of 93-97 kHz. For direct MS analysis, cVSSI was connected with 30-gauge PTFE tubing for sample introduction. The device was nominally placed in line with the inlet of the mass spectrometer at a distance of ~5 mm.

For LC-MS experiments, cVSSI was connected to the LC fluidic system using a MicroTight Union connector (Upchurch).

D. LC-MS and LC-MS/MS Analysis

A reverse phase C18 column was used for LC separation. 0.1% formic acid in water (A) and HPLC grade methanol (B) were used as the aqueous and organic mobile phases. Flow rate was set to 500 μL/min with the following gradient employed for metabolite separation: 0 min 5.0% B; 1.5 min 5.0% B, 8.5 min 30% B, 11.5 min 100% B, 14.5 min 100% B, 17.5 min 5.0% B. For each injection 20 μL of sample was used. The flow was split 10:1 for cVSSI into the mass spectrometer.

The same reverse phase column, solvent buffers, and flow rate were used for protein digest separations. Digestion of cytochrome c by pepsin was achieved by dissolving 10 mg of cytochrome c in 1.0 mL of deionized water with subsequent addition of 0.5 mg of pepsin. The solution was acidified to pH ~3.5 by dropwise addition of acetic acid. A gradient program for the peptide separation is as follows: 0 min 5.0% B; 1 min 5.0% B, 18 min 50% B, 21 min 100% B, 24 min 100% B, 27 min 5.0% B, 30 min 5.0% B. For each injection 20 μL of sample was used. The flow was split 10:1 for cVSSI into the mass spectrometer.

Mass spectrometer settings were as follows. For full/precursor ion mass spectrum collection in LC-MS and LC-MS/MS analyses, a resolving power of $7\times10^4$ was used. For the LC-MS/MS analysis, the data-dependent approach used a resolving power of $1.75\times10^4$ for the fragment ion spectra and an m/z isolation window of 5. A value of 5 was used for the maximum number of MS/MS spectra to be acquired between precursor ion MS spectra collection.

E. Nebulization with Glass Capillary

Figure 10A:
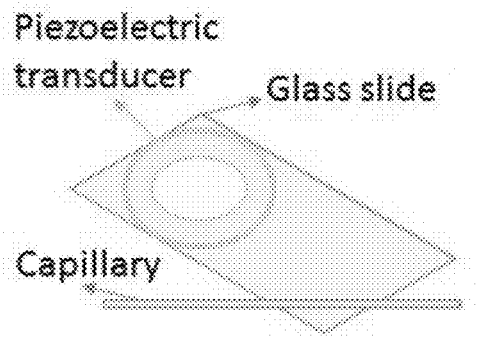
FIGS. 10A-10E show representative schematic drawings showing positioning for a capillary attachment on the VSSI substrate and droplet size distribution.
Figure 10B:
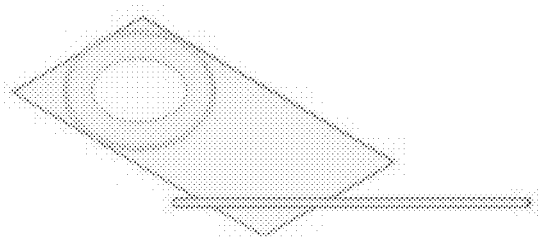
Figure 10C:
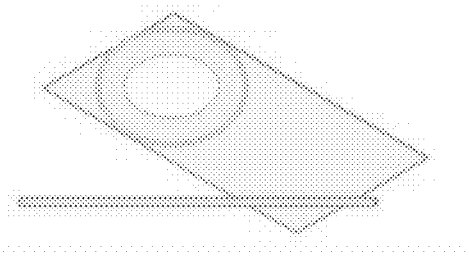

The VSSI configuration of Example 1 was modified by attaching a short piece of fused silica capillary (5.5 cm long; 100 μm ID, 360 μm OD) on the distal end of a VSSI glass slide (FIG. 10*a-c*). A ~93 kHz signal was applied to the transducer. Plume generation occurred when water was pumped through the capillary at a flow rate of 20 μL/min with a power input of ~160 mW.

Relative positioning of the capillary and the glass slide was optimized as follows. With the VSSI configuration, the distal end of the glass slide allows for the highest vibration amplitude, so the capillary was first attached to the distal end of the glass slide using epoxy glue (FIG. 10*a*). To ensure optimal vibration at the outlet of the capillary, the total mass extended beyond the glass slide was minimized. When the capillary extends ~4 cm beyond the glass slide (FIG. 10*b*), nebulization efficiency decreases due to a damping effect. The outlet of the capillary should also not be placed too close to the end of the glass slide, which causes unstable spray as liquid can flow back onto the glass slide (FIG. 10*c*). The optimal extension for the outlet end of the capillary was determined to be ~1 cm; this arrangement can maintain a stable spray while requiring only a small power input. The length of the inlet end of the capillary had minimal impact on the nebulization, which allows for a long inlet end (~4 cm) for convenient tubing connection. The inlet end of the capillary could be connected to plastic tubing directly for low pressure injection or connected to a capillary connector for high pressure applications, e.g., LC-MS, without affecting nebulization at the capillary outlet. Compared to direct VSSI, a frequency shift of 97 kHz to 93 kHz was observed in cVSSI experiments due to the added mass of the cVSSI apparatus.

E. Droplet Size, Capillary Diameter, and Flow Rate

Figure 10D:
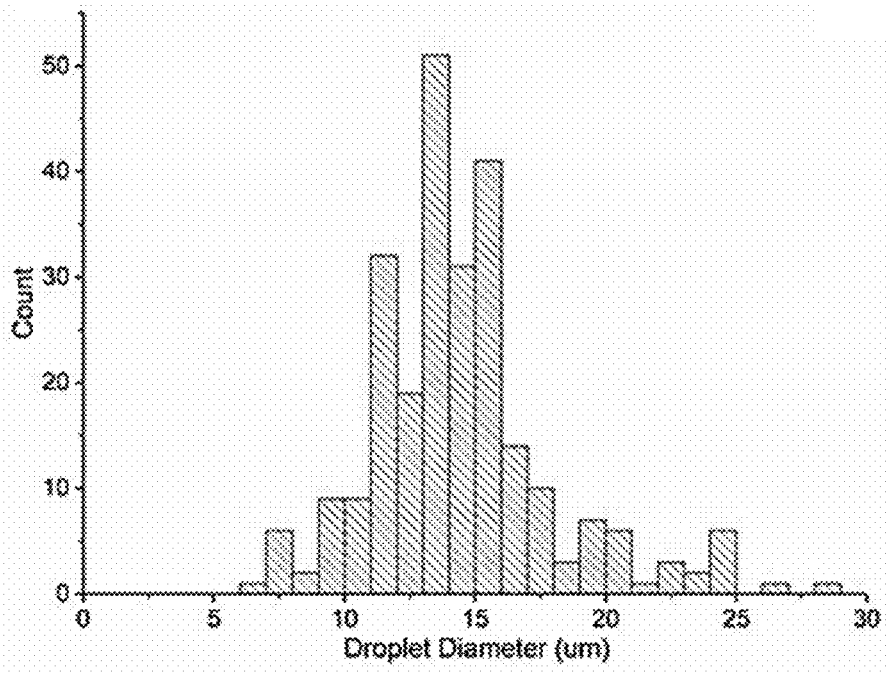
Figure 10E:
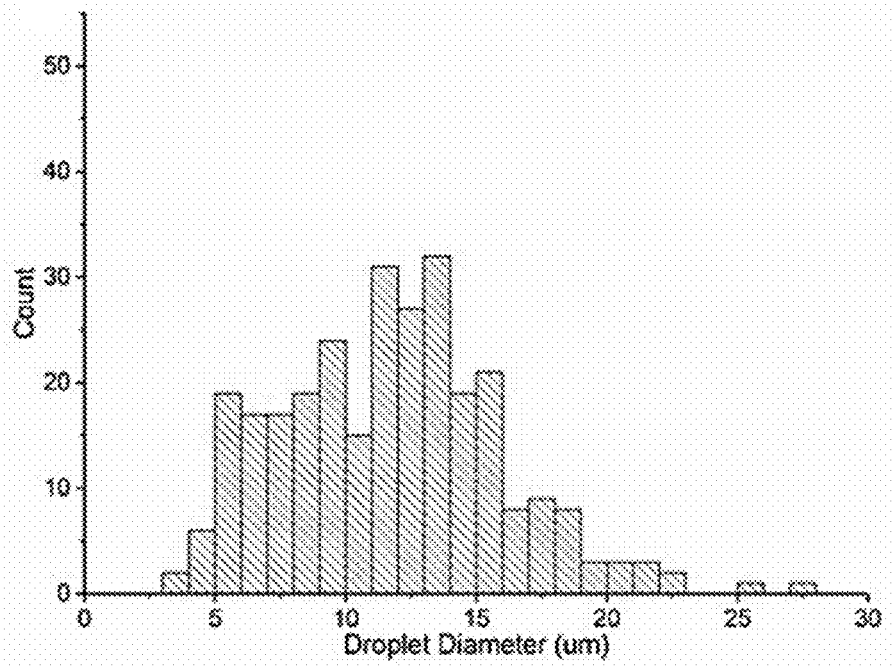
Figure 11A:
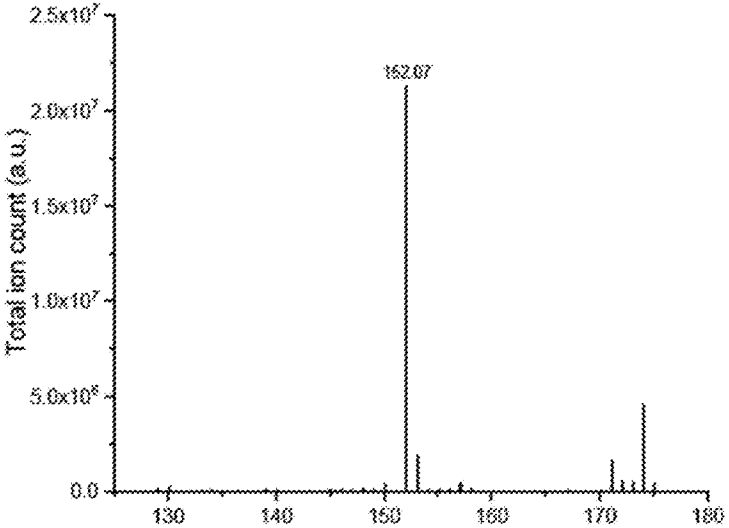
FIGS. 11A-11D show representative mass spectra for various compounds obtained using cVSSI-MS.
Figure 11B:
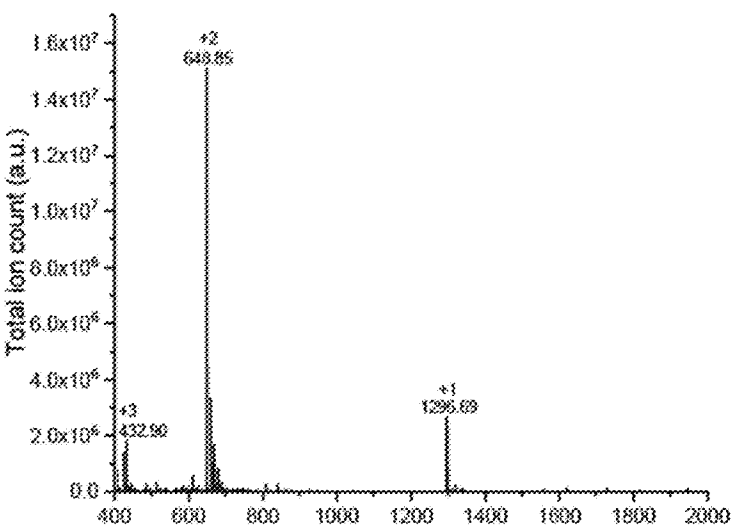
Figure 11C:
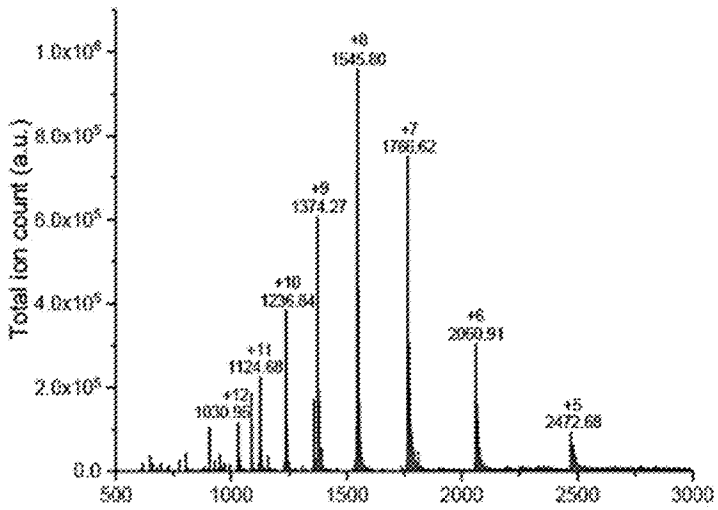
Figure 11D:
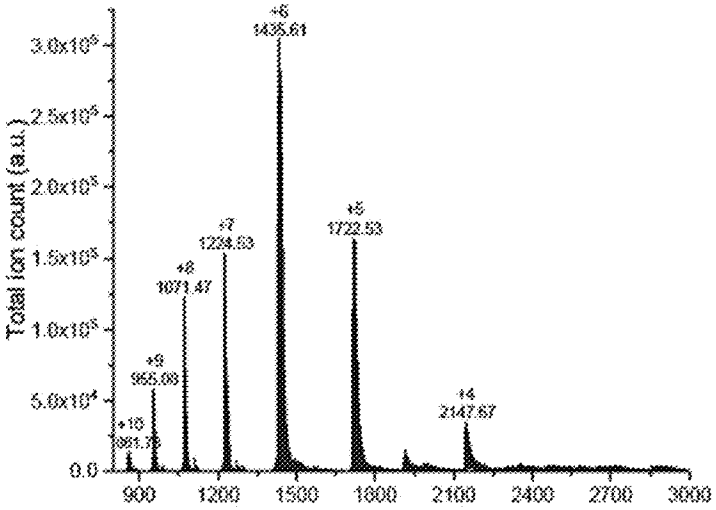

Relative droplet size distribution for cVSSI and VSSI was measured as described above. Both configurations showed a similar size distribution (FIG. 10*d-e*). In cVSSI, the average size of droplets was 12±5 μm, which was determined by capturing the droplets from the plume with mineral oil and subsequently examining aqueous droplets under a microscope.

Capillary size and its impact on plume generation was studied as follows. 50, 75, 100, and 250 μm ID capillaries were tested. All sizes worked for cVSSI under the proper power input. Generally, as the inner diameter of the capillary decreased, a higher power input was required for nebulization. Based on previous studies, vibration at the VSSI sharp edge was critical to the nebulization phenomenon. As the ID of the capillaries decreased, the thickness of the capillary wall increased. A thicker wall, in turn, resulted in less efficient vibration at the tip so that higher power input was required. The 250 μm ID capillary had the thinnest wall but was more fragile than the other capillaries and was not as satisfactory as other ID capillaries when handling low flow rates (<10 μL/min). Despite the slight difference in power requirements, the 100 μm ID capillary was selected as optimal for additional experiments.

Flow rates for cVSSI were also optimized. Flow rates ranging from 1 μL/min to 1 mL/min were tested with a 100 μm ID capillary. cVSSI successfully nebulized liquid samples at all the flow rates in this range with the appropriate power input. At 1 μL/min, the power requirement for nebulizing fluid was ~130 mW. As the flow rate increased to 20 μL/min, the power requirement increased to ~260 mW. At 1 mL/min, a ~760 mW power input was required to form a stable plume. These experiments demonstrated that cVSSI can work over a wide range of flow rates to accommodate different experimental setups. Even at the only tested high flow rates (~1 mL/min), less than 1 W of power consumption was still reasonable. Here, the flow rate range was mainly limited by the capillary dimension rather than cVSSI. Using a 250 μm ID capillary, a flow rate of ~2.8 mL/min flow rate was achieved using cVSSI. For flow rates <1 μL\min, a smaller ID capillary was required as the 100 μm capillary was prone to unstable flow with common syringe pumps.

F. Ionization Performance

Ionization performance of cVSSI in MS was analyzed as followed. A series of solutions containing a small molecule, a peptide, and proteins were tested using cVSSI-MS. Flow rate was set at 20 μL/min for all measurements. 10 μM solutions of acetaminophen, angiotensin II, cytochrome c, and ubiquitin in either acetonitrile:water (1:1) or in pure water resulted in successful analyte detection with cVSSI-MS (FIG. 11*a-d*). The mass spectra were consistent with those obtained using VSSI (without capillary), both of which present ESI-like spectra. For angiotensin II, a charge state distribution ranging from +1 to +3 was observed with pure water as the solvent, with +2 being the dominant peak. After adding 0.1% acetic acid to the water solution, the relative abundance of the +3 peak increased significantly, thought the +2 feature was still dominant. For protein solutions, ESI-like charge state distributions were obtained with +5 to +12 charge states for cytochrome c and +4 to +10 ions for ubiquitin. Charge state reduction was also observed when adding 10 mM ammonium acetate to the ubiquitin solution, with a shift to a +3 to +6 distribution. Thus, ionization characteristics observed for VSSI were maintained in cVSSI, despite the difference in droplet nebulization location.

Figure 12A:
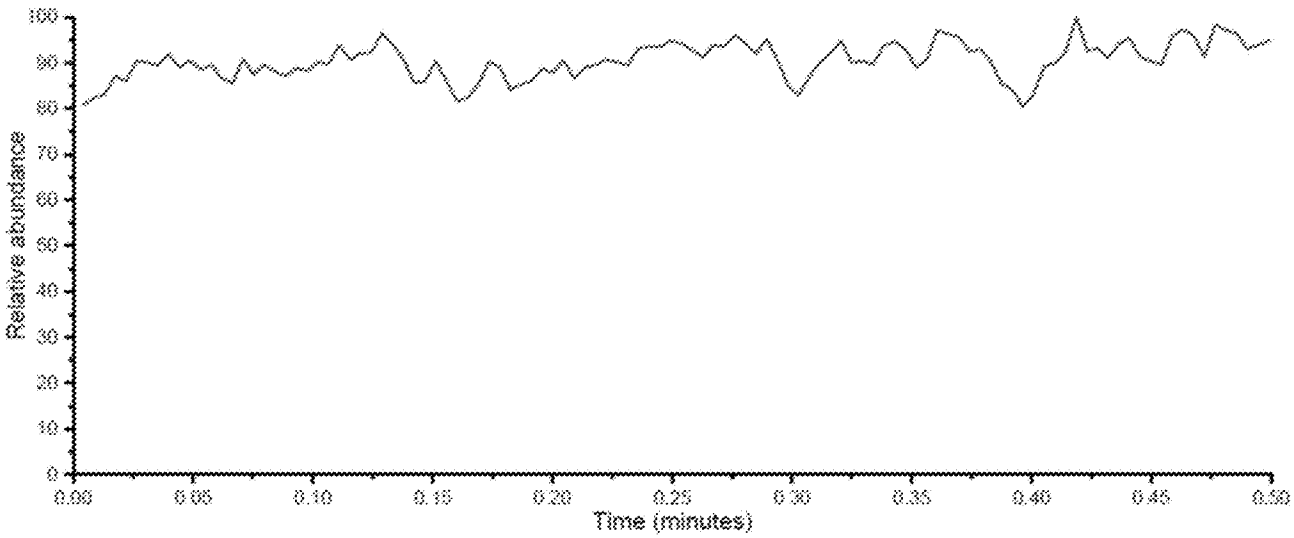
FIGS. 12A-12C show representative data pertaining to reliability and reproducibility of results with respect to the disclosed cVSSI-MS methods.
Figure 12B:
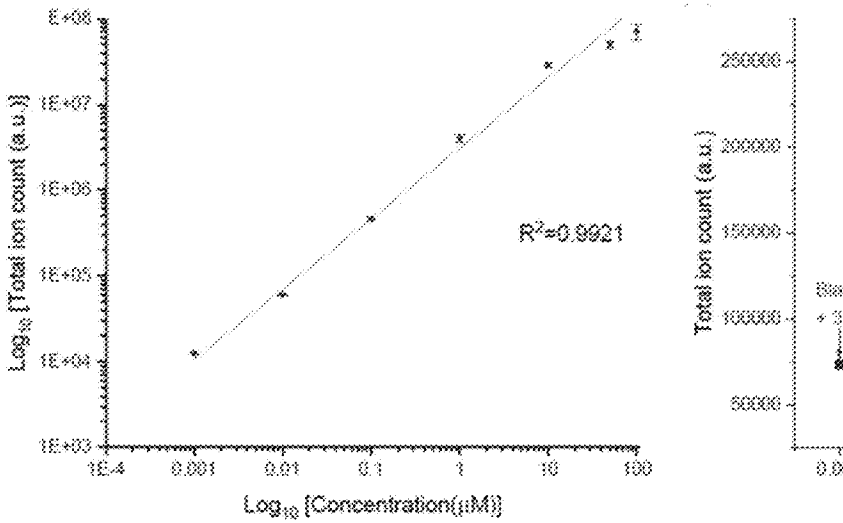
Figure 12C:
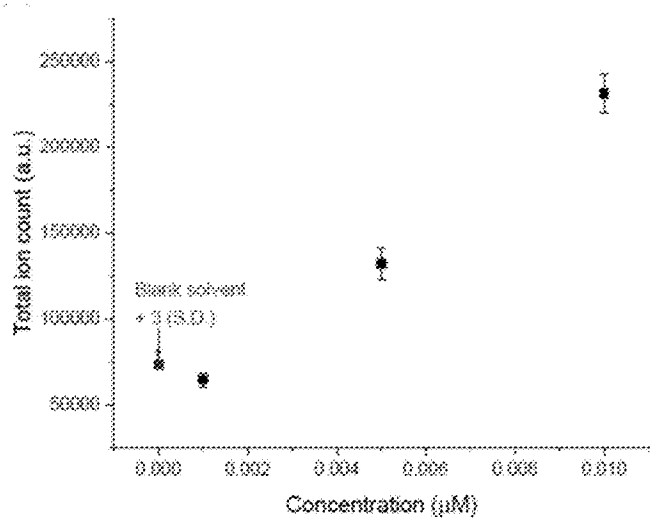

Capillary-based direct injection in cVSSI enables more stable and convenient injection for quantitative analysis. A mass chronogram of a 0.5 min cVSSI injection is shown in FIG. 12*a*. A stable injection was achieved with a CV of 4.5% observed for the ion current. Thus, the stable injection feature of cVSSI facilitated quantitative analysis of target molecules. Different concentrations (1 nM-100 μM of acetaminophen in acetonitrile:water (1:1) were prepared and analyzed. A linear response over 5 orders of magnitude was obtained (FIG. 12*b*). Limit of detection (LOD) for acetaminophen solution was tested using the mean intensity of the blank solution plus three times the standard deviation as the threshold (FIG. 12*c*). LOD was determined to be ~3 nM. The sensitivity of cVSSI should thus be sufficient for many voltage-free MS analyses, and can be further boosted when coupling to an electrical field.

G. Coupling of cVSSI to HPLC

Figure 9A:
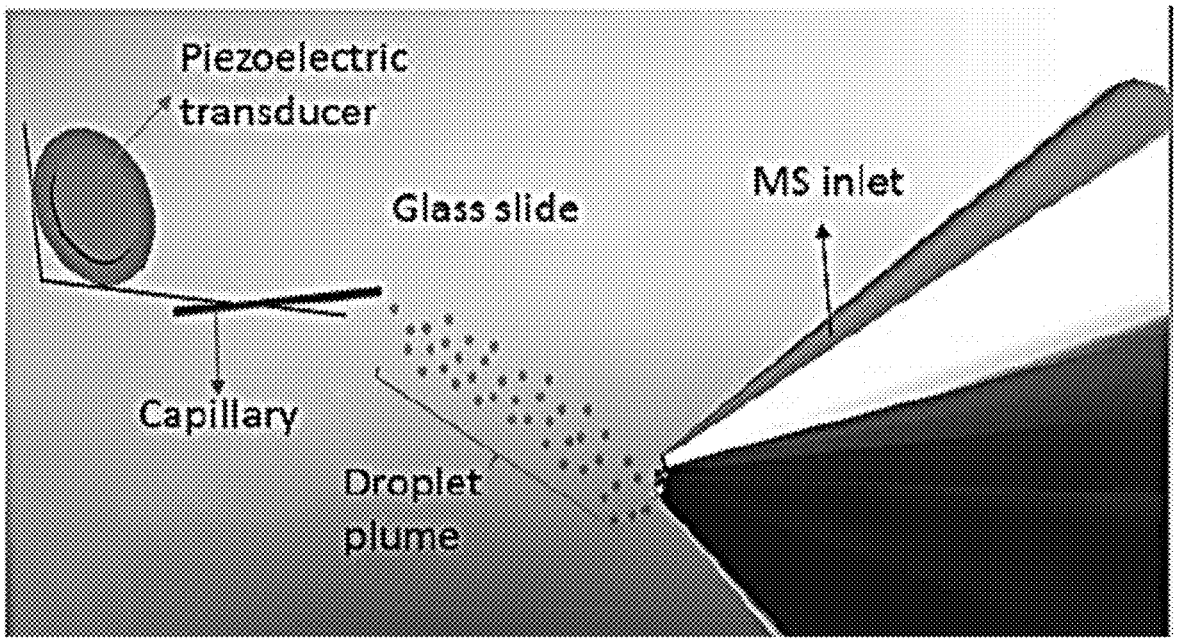
FIGS. 9A-9D show several aspects of a cVSSI device as described herein.
Figure 9B:
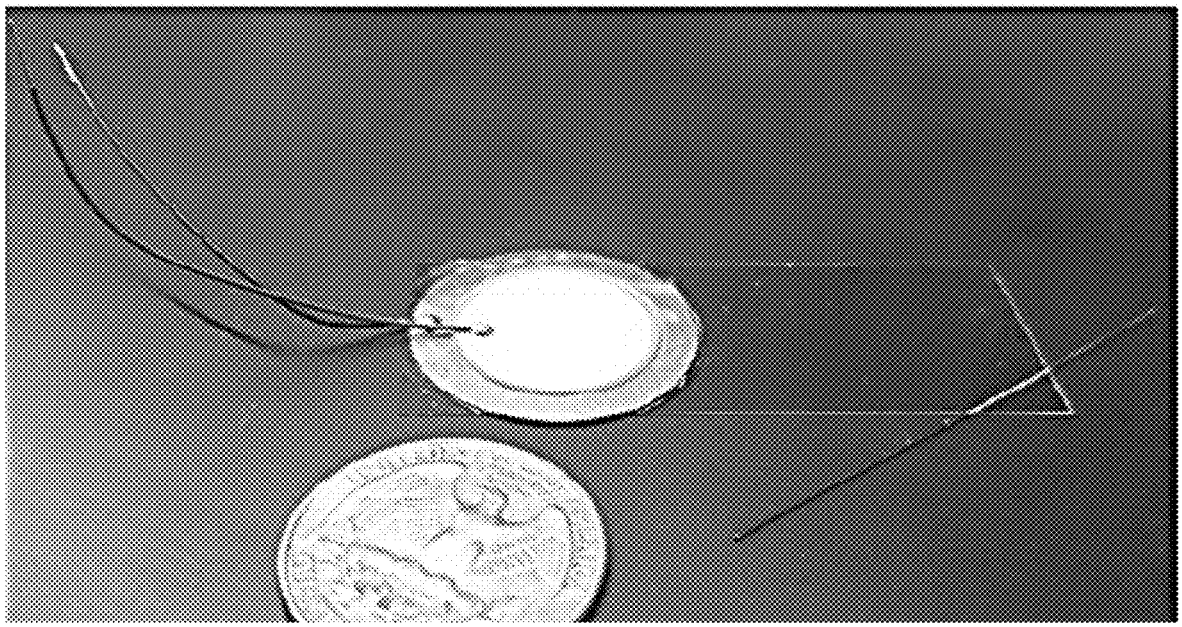
Figure 9C:
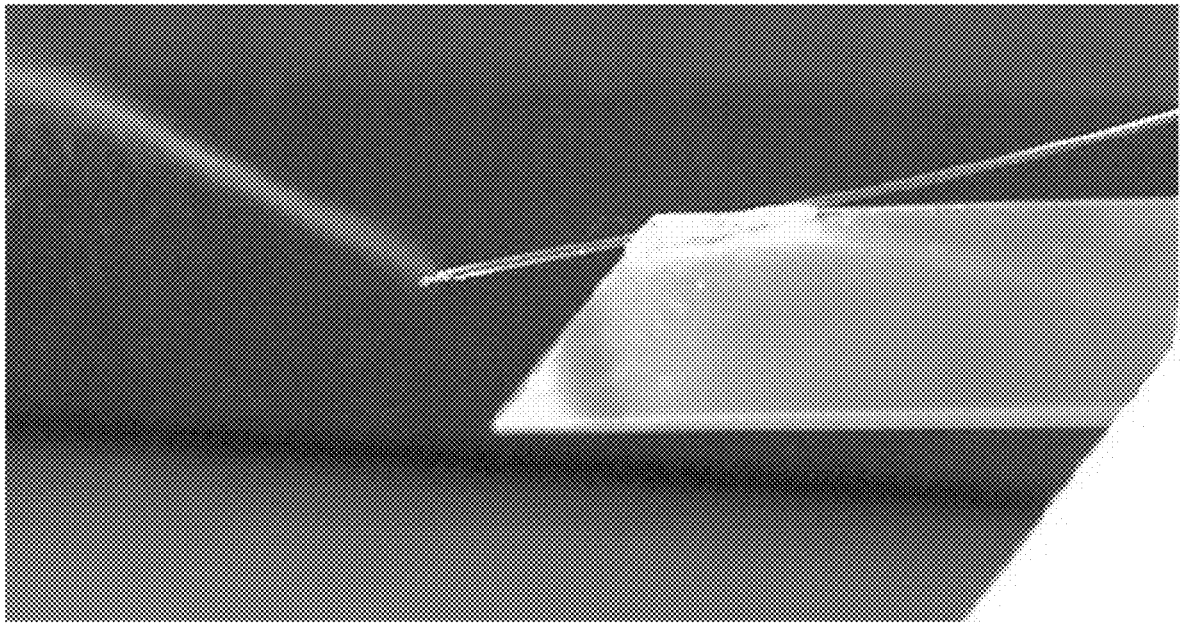
Figure 9D:
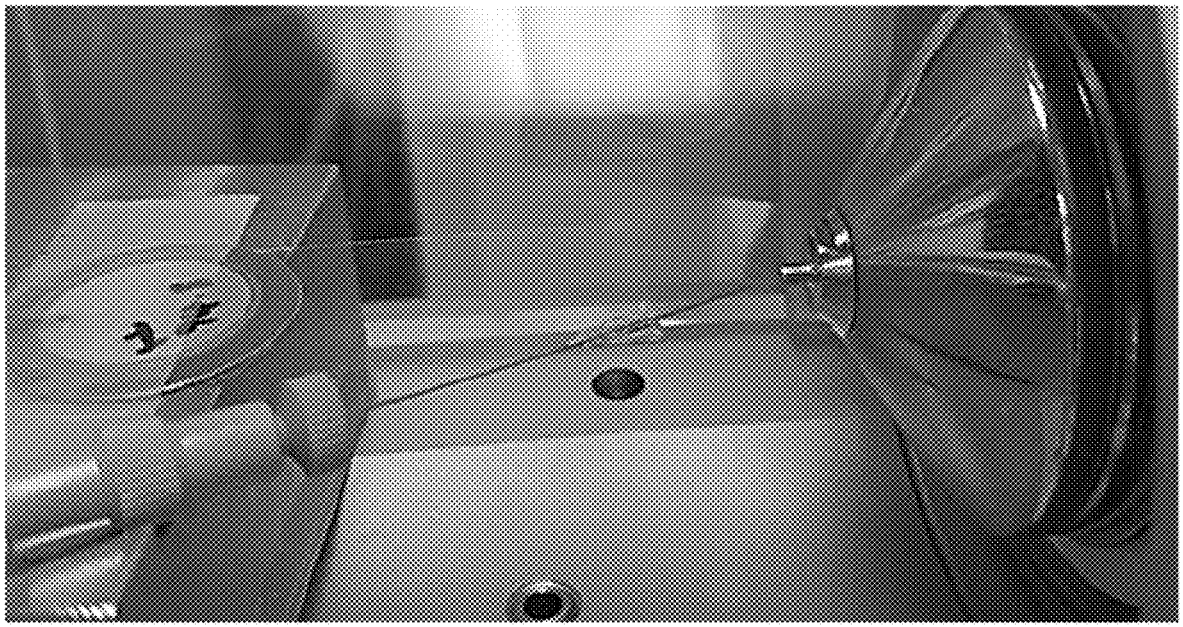

Coupling of cVSSI to HPLC for LC-MS analysis was also carried out. To accommodate the high-pressure HPLC pump and avoid leakage, a capillary connector was used to couple a cVSSI source to the HPLC fluidic system (FIG. 9*d*). The addition of the capillary connector did not affect the performance of cVSSI. With the HPLC pump, the plume could be properly generated under a 500 μL/min flow rate. Although cVSSI could handle the 500 μL/min flow rate, a 10:1 flow splitter was used to reduce the amount of waste generated around the inlet of the mass spectrometer.

H. Metabolomics Experiments

Figure 13:
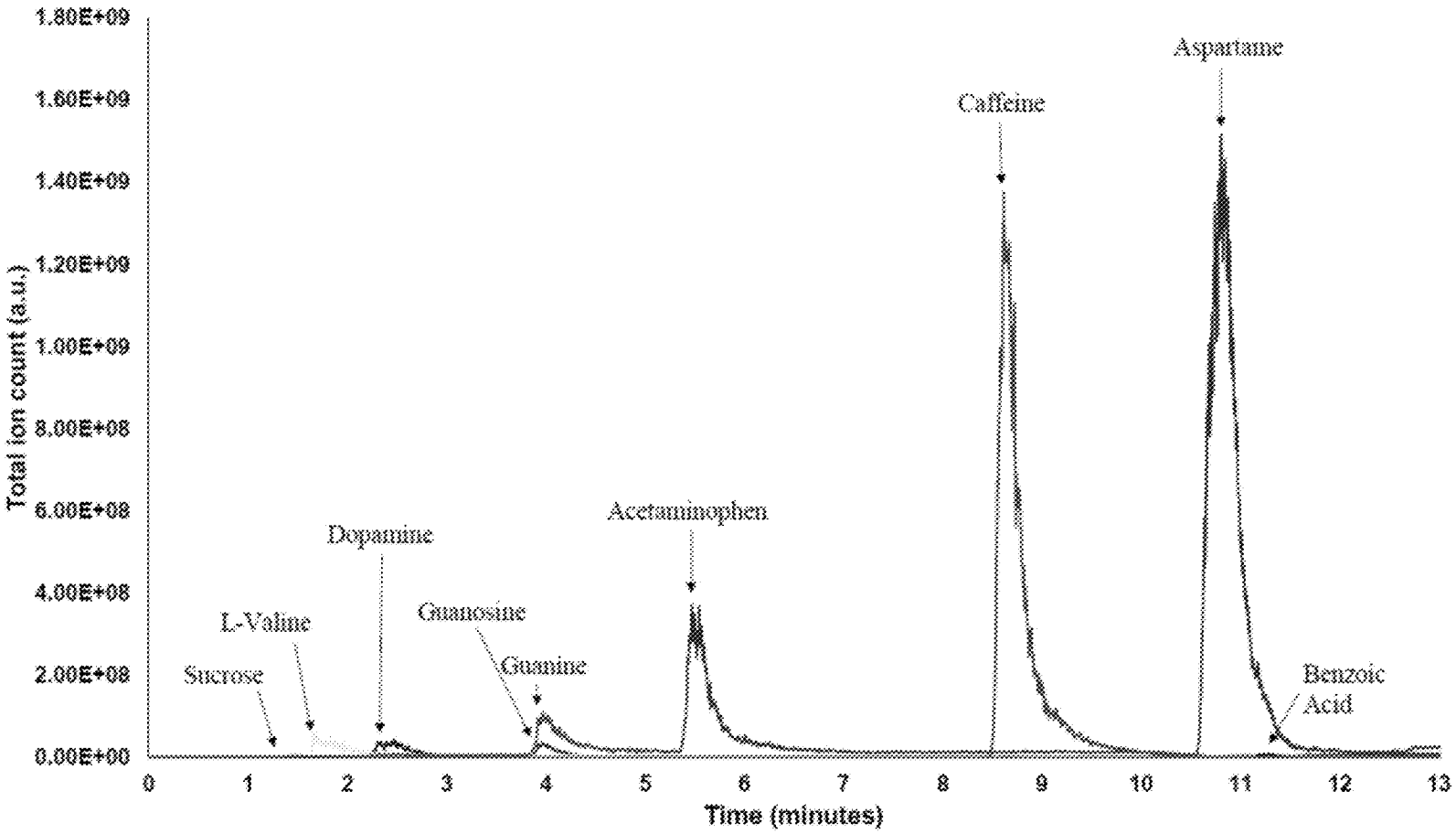
FIG. 13 shows representative LC-cVSSI-MS separation of a metabolite mixture containing sucrose, L-valine, dopamine, guanosine, guanine, acetaminophen, caffeine, aspartame, and benzoic acid, each at a concentration of 1000 ppm.

A series of representative metabolites including endogenous metabolites (L-valine, dopamine, guanosine, guanine) and exogenous metabolites (sucrose, acetaminophen, caffeine, aspartame, benzoic acid) were mixed in water with each compound at ~100 ppm concentration. The sample was introduced onto a reverse phase C18 HPLC column at a flow rate of 500 μL/min. Water with 0.1% formic acid and methanol were used as the aqueous and organic phases, respectively. The eluent was introduced directly on the cVSSI device through a capillary connector and detected using an Orbitrap mass spectrometer. As shown in FIG. 13, most of the metabolites were separated and detected by LC-cVSSI-MS. Guanosine and guanine were not separated under the present LC separation settings, but both were detected with cVSSI-MS. The same separation was performed with LC-ESI-MS, which showed a similar chromatogram. The overall signal intensity of cVSSI was about 10 times lower than ESI, most likely due to the difficulty in introducing all of the plume into the mass spectrometer. However, the elution times for both systems agreed well, with less polar molecules such as caffeine and aspartame having higher signal intensities. Ionization by cVSSI may be more selective for less polar compounds compared to ESI. The ratio between caffeine and L-valine was ~10 in cVSSI, but was ~3 in ESI. Thus, the ionization efficiency of voltage-free cVSSI appears to be more affected by this property of the target molecules. A slight peak broadening was observed in cVSSI compared to the ESI method. The full width at half maximum (FWHM) for caffeine was 0.19 versus 0.15 min for cVSSI and ESI, respectively. For aspartame, FWHM was 0.31 versus 0.20 min in cVSSI and ESI, respectively. The slight peak broadening in cVSSI could be caused by the less optimal fluidic connections and extended tubing length.

I. Proteomics Experiments

LC-MS/MS experiments were conducted for a pepsin digest of cytochrome c to test the suitability of cVSSI-MS/MS for peptide identification. After LC-cVSSI-MS/MS analysis, peptides were identified by a protein database search. Overall, ~75% sequence coverage was obtained for cytochrome c protein using the protein database approach. The incomplete sequence coverage could result from low-quality MS/MS spectra for some peptides or from the fact that the precursor ions for some peptides containing the missing sequences simply are not selected for MS/MS analysis. To determine whether or not peptide assignments were missed by the protein database search, the ion chromatogram was searched manually. Here, the ion signal was averaged over retention time ($t_R$) windows of 2 min in duration. Peptide ion assignments, made by accurate mass assessments, are provided in Table 1.

TABLE 1

| Sequence[a] | Charge | Experimental m/z[b] | Theoretical m/z[c] | Mass Accuracy[d] | $t_R$ Window[e] |
|---|---|---|---|---|---|
| TL | 1 | 233.1496 | 233.1501 | 2.25 | 2 to 4 |
| ME | 1 | 279.1009 | 279.1014 | 1.88 | 2 to 4 |
| HGL | 1 | 326.1818 | 326.1828 | 3.14 | 4 to 6 |
| IAY | 1 | 366.2026 | 366.2029 | 0.89 | 10 to 12 |
| MEY | 1 | 442.1646 | 442.1648 | 0.51 | 10 to 12 |
| HGLF (SEQ ID NO 1) | 1 | 473.2512 | 473.2512 | 0.05 | 20 to 22 |
| IAYL (SEQ ID NO 2) | 1 | 479.2869 | 479.2869 | 0.05 | 16 to 18 |
| KEETL (SEQ ID NO 3) | 1 | 619.3309 | 619.3302 | 1.09 | 8 to 10 |
| KKATNE (SEQ ID NO 4) | 1 | 690.3786 | 690.3786 | 0.04 | 2 to 4 |
| KGKKIF (SEQ ID NO 5) | 1 | 720.4773 | 720.4772 | 0.10 | 14 to 16 |
| LKKATNE (SEQ ID NO 6) | 1 | 803.4622 | 803.4626 | 0.53 | 6 to 8 |
| YLKKATNE (SEQ ID NO 7) | 1 | 966.5262 | 966.5260 | 0.18 | 6 to 8 |
| GRKTGQAPGF (SEQ ID NO 8) | 1 | 1018.5440 | 1018.5433 | 0.66 | 8 to 10 |
| KGGKHKTGPNL (SEQ ID NO 9) | 1 | 1136.6548 | 1136.6540 | 0.68 | 6 to 8 |
| KEETLMEYL (SEQ ID NO 10) | 1 | 1155.5682 | 1155.5607 | 6.47 | 18 to 20 |

TABLE 1-continued

| Sequence[a] | Charge | Experimental m/z[b] | Theoretical m/z[c] | Mass Accuracy[d] | $t_R$ Window[e] |
|---|---|---|---|---|---|
| AGIKKKTERE (SEQ ID NO 11) | 1 | 1159.6842 | 1159.6798 | 3.77 | 0 to 2 |
| GIKKKTEREDL (SEQ ID NO 12) | 1 | 1316.7551 | 1316.7537 | 1.04 | 6 to 8 |
| AGIKKKTEREDL (SEQ ID NO 13) | 1 | 1387.7915 | 1387.7908 | 0.49 | 6 to 8 |
| KGGKHKTGPNLHGL (SEQ ID NO 14) | 1 | 1443.8190 | 1443.8184 | 0.40 | 8 to 10 |
| HGLFGRKTGQAPGF (SEQ ID NO 15) | 1 | 1472.7757 | 1472.7762 | 0.36 | 12 to 14 |
| GIKKKTEREDLIA (SEQ ID NO 16) | 1 | 1500.8756 | 1500.8749 | 0.45 | 12 to 14 |
| TYTDANKNKGITW (SEQ ID NO 17) | 1 | 1511.7485 | 1511.7494 | 0.61 | 14 to 16 |
| KGGKHKTGPNLHGLF (SEQ ID NO 18) | 1 | 1590.8875 | 1590.8868 | 0.42 | 12 to 14 |
| ENPKKYIPGTKMIF (SEQ ID NO 19) | 1 | 1665.9082 | 1665.9038 | 2.63 | 18 to 20 |
| TYTDANKNKGITWKE (SEQ ID NO 20) | 1 | 1768.8893 | 1768.8869 | 1.34 | 12 to 14 |
| LENPKKYIPGTKMIF (SEQ ID NO 21) | 1 | 1778.9921 | 1778.9878 | 2.40 | 18 to 20 |
| TYTDANKNKGITWKEE (SEQ ID NO 22) | 1 | 1897.9328 | 1897.9295 | 1.73 | 12 to 14 |
| KEETL (SEQ ID NO 23) | 2 | 310.1689 | 310.1690 | 0.40 | 6 to 8 |
| LKKATNE (SEQ ID NO 24) | 2 | 402.2351 | 402.2352 | 0.31 | 2 to 4 |
| YLKKATNE (SEQ ID NO 25) | 2 | 483.7670 | 483.7669 | 0.16 | 4 to 6 |
| GRKTGQAPGF (SEQ ID NO 26) | 2 | 509.7755 | 509.7756 | 0.15 | 12 to 14 |
| KGGKHKTGPNL (SEQ ID NO 27) | 2 | 568.8313 | 568.8309 | 0.66 | 4 to 6 |
| AGIKKKTERE (SEQ ID NO 28) | 2 | 580.3440 | 580.3438 | 0.30 | 2 to 4 |
| AGIKKKTEREDL (SEQ ID NO 29) | 2 | 694.3993 | 694.3993 | 0.04 | 8 to 10 |
| KGGKHKTGPNLHGL (SEQ ID NO 30) | 2 | 722.4130 | 722.4131 | 0.17 | 8 to 10 |
| HGLFGRKTGQAPGF (SEQ ID NO 31) | 2 | 736.8921 | 736.8920 | 0.10 | 14 to 16 |
| GIKKKTEREDLIA (SEQ ID NO 32) | 2 | 750.9412 | 750.9414 | 0.23 | 10 to 12 |
| TYTDANKNKGITW (SEQ ID NO 33) | 2 | 756.3788 | 756.3786 | 0.23 | 12 to 14 |
| NKNKGITWKEETL (SEQ ID NO 34) | 2 | 780.9232 | 780.9232 | 0.03 | 14 to 16 |
| KGGKHKTGPNLHGLF (SEQ ID NO 35) | 2 | 795.9473 | 795.9473 | 0.03 | 10 to 12 |
| ENPKKYIPGTKMIF (SEQ ID NO 36) | 2 | 833.4549 | 833.4558 | 1.11 | 18 to 20 |
| LENPKKYIPGTKMIF (SEQ ID NO 37) | 2 | 889.9990 | 889.9978 | 1.32 | 20 to 22 |
| TYTDANKNKGITWKEE (SEQ ID NO 38) | 2 | 949.4687 | 949.4687 | 0.03 | 10 to 12 |
| TYTDANKNKGITWKEETL (SEQ ID NO 39) | 2 | 1056.5356 | 1056.5346 | 0.97 | 14 to 16 |
| KGKKIF (SEQ ID NO 40) | 3 | 240.8304 | 240.8310 | 2.32 | 8 to 10 |
| LKKATNE (SEQ ID NO 41) | 3 | 268.4921 | 268.4928 | 2.45 | 2 to 4 |
| YLKKATNE (SEQ ID NO 42) | 3 | 322.8467 | 322.8472 | 1.63 | 6 to 8 |

TABLE 1-continued

| Sequence[a] | Charge | Experimental m/z[b] | Theoretical m/z[c] | Mass Accuracy[d] | $t_R$ Window[e] |
|---|---|---|---|---|---|
| GRKTGQAPGF (SEQ ID NO 43) | 3 | 340.1861 | 340.1863 | 0.66 | 10 to 12 |
| GDVEKGKKIF (SEQ ID NO 44) | 3 | 374.2169 | 374.2174 | 1.40 | 14 to 16 |
| KGGKHKTGPNL (SEQ ID NO 45) | 3 | 379.5564 | 379.5566 | 0.42 | 4 to 6 |
| AGIKKKTERE (SEQ ID NO 46) | 3 | 387.2322 | 387.2318 | 0.97 | 0 to 2 |
| GIKKKTEREDL (SEQ ID NO 47) | 3 | 439.5895 | 439.5898 | 0.66 | 6 to 8 |
| AGIKKKTEREDL (SEQ ID NO 48) | 3 | 463.2704 | 463.2688 | 3.40 | 6 to 8 |
| KGGKHKTGPNLHGL (SEQ ID NO 49) | 3 | 481.9446 | 481.9447 | 0.19 | 8 to 10 |
| HGLFGRKTGQAPGF (SEQ ID NO 50) | 3 | 491.5972 | 491.5973 | 0.19 | 14 to 16 |
| GIKKKTEREDLIA (SEQ ID NO 51) | 3 | 500.9630 | 500.9635 | 1.05 | 10 to 12 |
| TYTDANKNKGITW (SEQ ID NO 52) | 3 | 504.5876 | 504.5884 | 1.50 | 12 to 14 |
| NKNKGITWKEETL (SEQ ID NO 53) | 3 | 520.9512 | 520.9514 | 0.37 | 14 to 16 |
| KGGKHKTGPNLHGLF (SEQ ID NO 54) | 3 | 530.9675 | 530.9675 | 0.02 | 20 to 22 |
| ENPKKYIPGTKMIF (SEQ ID NO 55) | 3 | 555.9738 | 555.9732 | 1.15 | 18 to 20 |
| TYTDANKNKGITWKE (SEQ ID NO 56) | 3 | 590.3006 | 590.3009 | 0.44 | 12 to 14 |
| LENPKKYIPGTKMIF (SEQ ID NO 57) | 3 | 593.6679 | 593.6678 | 0.13 | 18 to 20 |
| TYTDANKNKGITWKEE (SEQ ID NO 58) | 3 | 633.3150 | 633.3151 | 0.09 | 12 to 14 |
| TYTDANKNKGITWKEETL (SEQ ID NO 59) | 3 | 704.6925 | 704.6923 | 0.25 | 18 to 20 |
| VQKCAQCHTVEKGGKHKTGPNL (SEQ ID NO 60) | 3 | 993.1353 | 993.1283 | 7.03 | 18 to 20 |
| VQKCAQCHTVEKGGKHKTGP NLHGL (SEQ ID NO 61) | 3 | 1095.5216 | 1095.5164 | 4.70 | 18 to 20 |
| KGKKIFVQKCAQCHTVEKGG KHKTGPNL (SEQ ID NO 62) | 3 | 1226.9549 | 1226.9479 | 5.69 | 18 to 20 |
| AGIKKKTEREDL (SEQ ID NO 63) | 4 | 347.7036 | 347.7036 | 0.07 | 6 to 8 |
| KGGKHKTGPNLHGLF (SEQ ID NO 64) | 4 | 398.4774 | 398.4776 | 0.44 | 18 to 20 |
| TYTDANKNKGITWKE (SEQ ID NO 65) | 4 | 442.9776 | 442.9776 | 0.00 | 12 to 14 |
| TYTDANKNKGITWKEETL (SEQ ID NO 66) | 4 | 528.7717 | 528.7712 | 0.95 | 16 to 18 |
| VQKCAQCHTVEKGGKHKTGPNL (SEQ ID NO 67) | 4 | 745.1040 | 745.0982 | 7.79 | 18 to 20 |
| VQKCAQCHTVEKGGKHKTGP NO 68) | 4 | 821.8944 | 821.8893 | 6.21 | 18 to 20 |
| KGKKIFVQKCAQCHTVE (SEQ ID NO 69) | 5 | 513.0479 | 513.0448 | 6.12 | 18 to 20 |
| KGKKIFVQKCAQCHTVEKGG KHKTGPNL (SEQ ID NO 70) | 5 | 736.5756 | 736.5719 | 5.05 | 18 to 20 |
| VQKCAQCHTVEKGGKHKTGPNL (SEQ ID NO 71) | 6 | 497.0704 | 497.0681 | 4.69 | 18 to 20 |

TABLE 1-continued

| Sequence[a] | Charge | Experimental m/z[b] | Theoretical m/z[c] | Mass Accuracy[d] | $t_R$ Window[e] |
|---|---|---|---|---|---|
| VQKCAQCHTVEKGGKHKTGP NLHGL (SEQ ID NO 72) | 6 | 548.2661 | 548.2621 | 7.23 | 18 to 20 |
| KGKKIFVQKCAQCHTVEKGG KHKTGPNL (SEQ ID NO 73) | 6 | 613.9822 | 613.9779 | 7.05 | 18 to 20 |

[a]Peptic peptide sequence obtained from the Peptide Mass software at https./web.expasy.org/peptide_mass/. Peptides containing the two cysteine residues were observed with the attached heme group.
[b]Experimental m/z (monoisotopic) obtained by hand from the ion chromatogram
[b]Theoretical m/z (monoisotopic) obtained from the Peptide Mass software at https://web.expasy.org/peptide_mass/
[d]Mass accuracy expressed as ppm
[e]Retention time window that was averaged to obtain the mass spectrum for peak picking. Times are given in minutes.

From the stepwise precursor ion analysis, a total of 78 peptides were identified. These included species ranging in size from 2 to 29 amino acid residues and in charge states of +1 to +6. Several heme-containing peptides were also observed. Considering the sequences of those peptides, 100% sequence coverage of the protein was demonstrated by the peptides shown in Table 1. In general, cVSSI was shown to be sufficiently efficient for the ionization of peptides in proteomics studies. It is noted that a split-flow geometry was employed. cVSSI can be conducted at much higher flow rates because there is no impetus for the large number of droplets to enter the MS inlet beyond gas-flow entrainment, so a 10-fold split was employed, which helped maintain cleanliness of the source.

Example 3: VSSI-Capillary Electrophoresis

A. Design and Fabrication of VSSI Probe Capillary Electrophoresis

Figure 7:
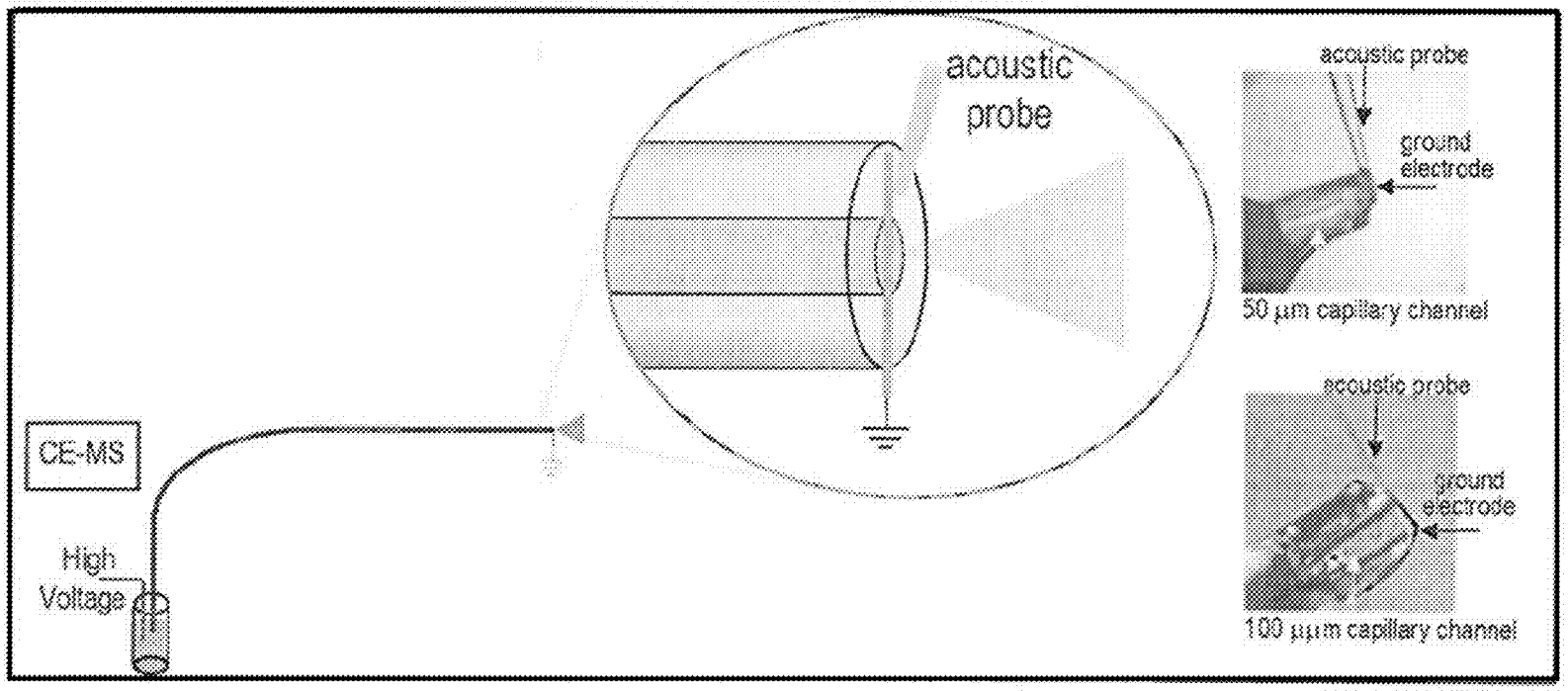
FIG. 7 shows a schematic of a combined capillary electrophoresis-VSSI (cVSSI) ionization device. Insets: devices fabricated with a 50 or 100 μm inner diameter capillary.

A conceptual diagram of the capillary and probe is depicted in FIG. 7. The capillary electrophoresis separation was designed so that the site of injection is immersed in a vial of background electrolyte; however, the detection end of the capillary was designed so that it can be suspended in air and still maintain a connection to the liquid inside of the capillary. This was accomplished by fabricating a single piece of 25 μm outer diameter platinum wire that was folded into a U shape and positioning the wire directly over or near the orifice of the capillary. Both ends of the platinum wire were fixed to the outer surface of the capillary with 1-minut epoxy. These ends were then connected to a wire with conductive silver epoxy. The conductive epoxy was then sealed with 1-minute epoxy. In this configuration, the detection end of the capillary was grounded by connecting the wire to ground. The injection end of the capillary was maintained at positive high voltage to perform normal polarity capillary electrophoresis (injection at anode and detection at cathode) or at negative high voltage to perform reversed polarity capillary electrophoresis (injection at cathode and detection at anode). For any capillary electrophoresis configuration, electrolysis of water occurs at the electrode to produce oxygen gas at the anode and hydrogen gas at the cathode. On the detection end, the electrode could not be placed in such a way that gas bubbles generated at the electrode formed inside of the capillary. When this occurs, the capillary electrophoresis separation ceases because the gas is an insulator and interrupts the electrical circuit. For this design, the grounded electrode had to touch the liquid coming out of the capillary to complete the circuit, but could not be placed inside the capillary channel.

Figure 8:
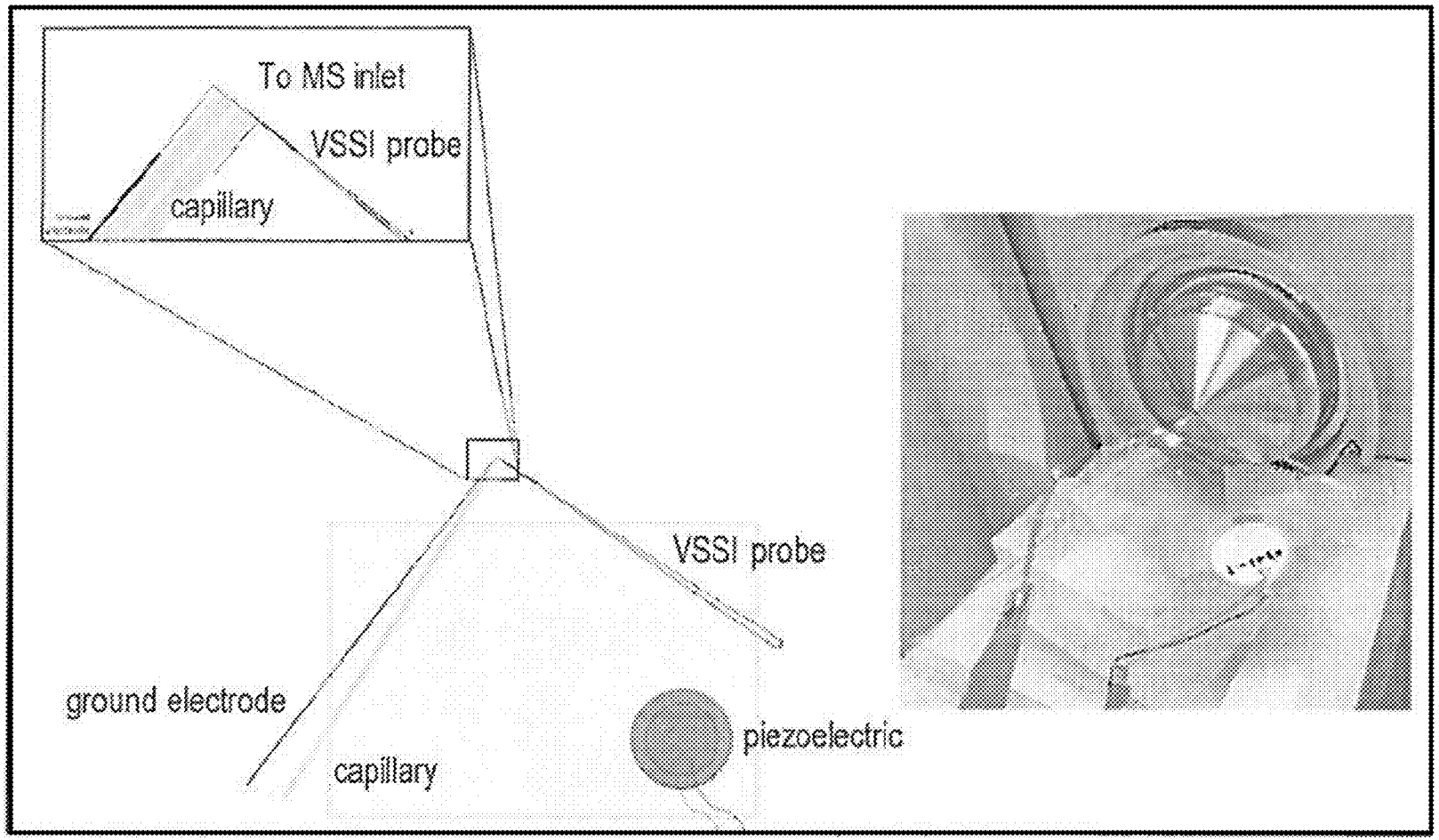
FIG. 8 shows a schematic diagram of a piezoelectric assembly with the cVSSI device. Inset: device positioned in front of a mass spectrometer.

The VSSI probe was fabricated from a borosilicate capillary that was pulled to approximately 50 μm outer diameter at the tip (FIG. 7). The probe was positioned at an approximately 90° angle to the capillary tip. The acoustic probe must touch the capillary surface and worked best when the tip was near the capillary orifice. The waveform applied to the acoustic probe ranged from 3 kHz to 1 MHz depending on the size of the acoustic probe. The waveform that drives the oscillations can be a sine wave, a square wave, or another modulated signal. The probe did not damage or modify the capillary and was used repeatedly. Images of the capillary, probe, and piezoelectric transducer are provided in FIG. 8. The electrophoresis was grounded at the site of the interface, enabling it to be freely coupled to mass analyzers such as the Q Extractive (FIG. 8).

B. VSSI Probe Capillary Electrophoresis Proof of Principle (50 μm ID Capillary)

Prototype VSSI probe sources were fabricated and used to demonstrate the functionality of the approach. In one example, spray was generated using an acoustic probe fabricated from a pulled glass capillary at pH 5 and 6.5. The probe was fabricated with a 50 μm ID capillary and 25 μm platinum electrode to ground the separation current. Separations were performed with background electrolyte adjusted to two different pH values. The separations were reproducible in time and intensity; see Table 2 below.

TABLE 2

Summary of Capillary Electrophoresis Data Collected with VSSI-MS versus UV-absorbance detection

| | Migration Time in min (RSD) | | | |
|---|---|---|---|---|
| | pH 6.5 CE-MS | pH 6.5 CE-UV | pH 5 CE-MS | pH 6 CE-UV |
| Pindolol | 4.45 (3) | 5.51 (5) | 2.94 (1) | 5.28 (0.8) |
| Metoprolol | 4.61 (3) | 5.73 (5) | 3.01 (1) | 5.47 (0.9) |
| Acebutolol | 4.76 (3) | 5.98 (6) | 3.08 (2) | 5.70 (0.9) |

Measurements of migration time were based on n = 3. Separations were performed using a 50 μm inner diameter fused silica capillary and an electric field strength of 250 V/cm. For UV measurements the total length of the capillary and length to the window were 50 cm and 40, respectively. For VSSI-MS measurements the total length of the capillary and length to the window was 40 cm. Sample was injected electrokinetically (5 kV, 2 s). The background electrolyte was 25 mM ammonium acetate unadjusted around pH 6.5 or 25 mM acetic acid adjusted to pH 5 with ammonium hydroxide. Capillary electrophoresis UV absorbance measurements were performed using a PA/CE MDQ instrument. Capillary electrophoresis VSSI-MS measurements were performed using a lab-built instrument composed of a high voltage power supply (Spellman, model CZEI OOOR).

Figure 14:
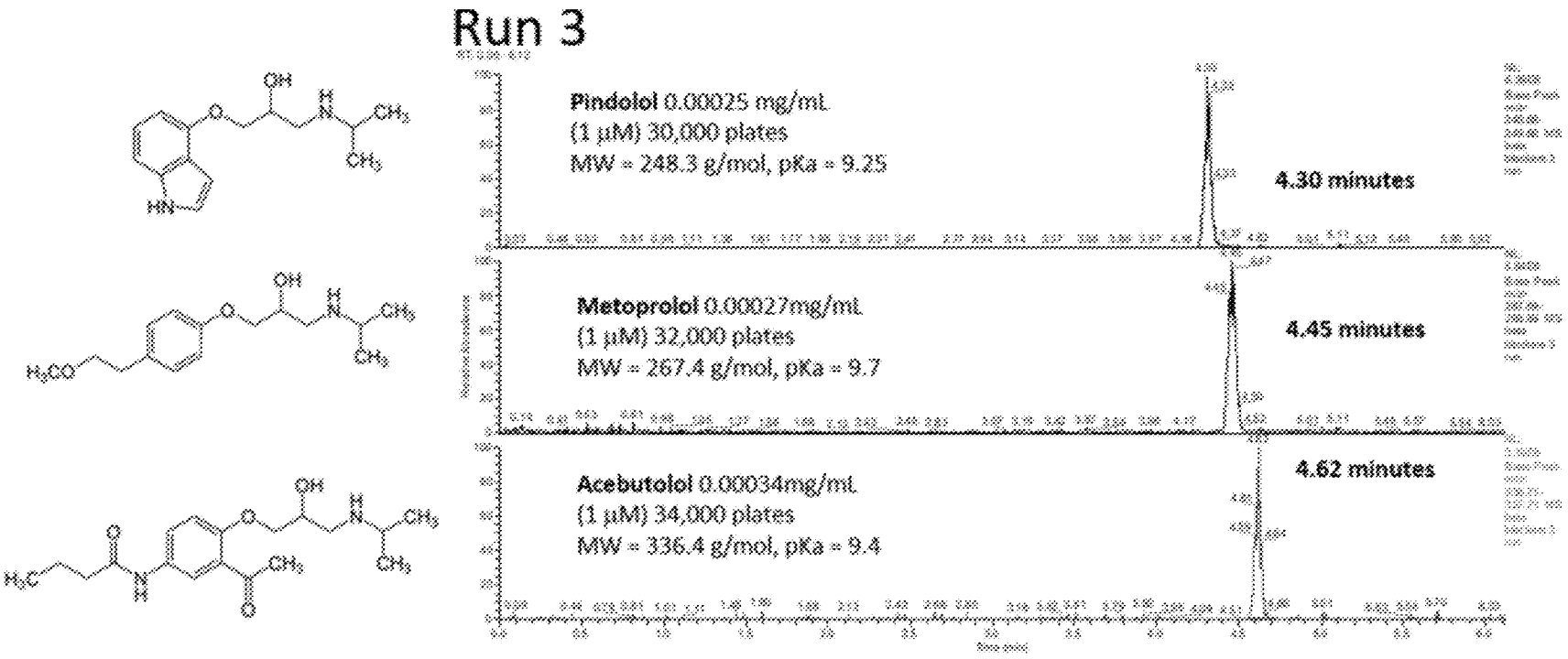
FIG. 14 shows representative cVSSI-MS separation and detection of a mixture of 3 pharmaceutical compounds (pindolol, metoprolol, and acebutolol) ranging in concentration from 0.2 μg/mL to 0.3 μg/mL. The separations were similar in migration time and precision to results obtained with capillary electrophoresis with UV detection. Experiments were conducted at pH 6.5 in 25 mM ammonium acetate aqueous solution.
Figure 15:
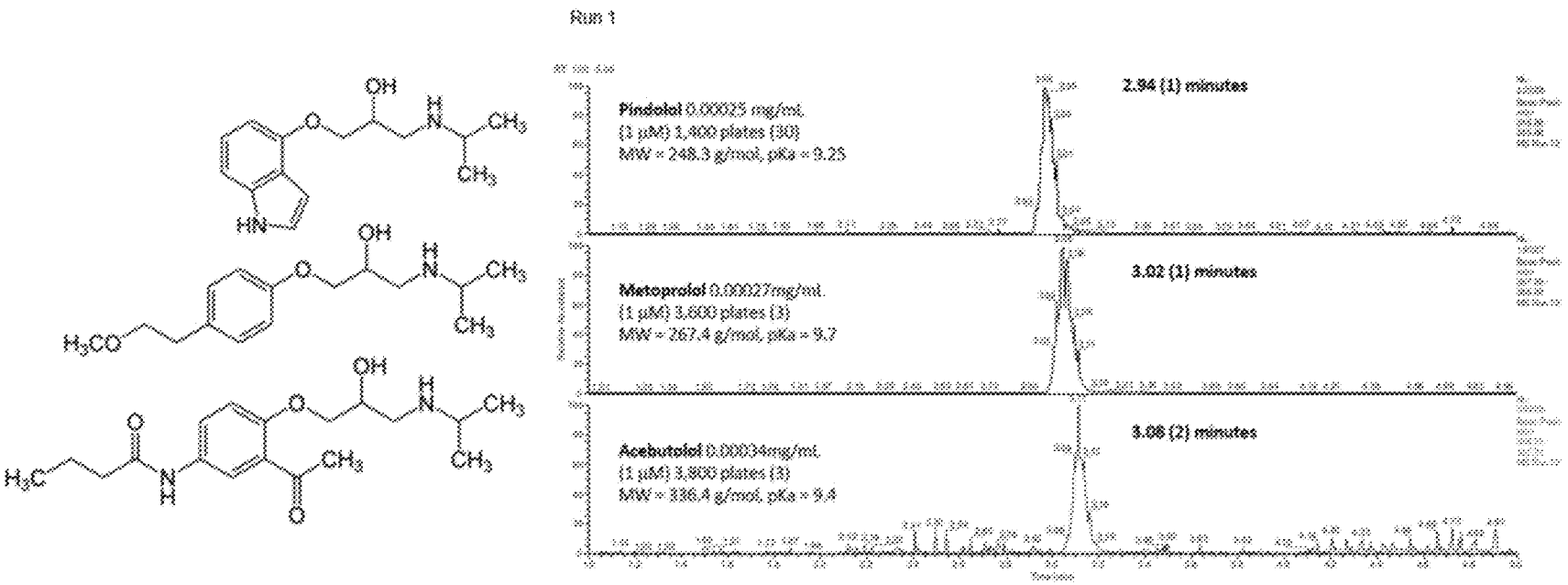
FIG. 15 shows representative cVSSI-MS separation and detection of a mixture of 3 pharmaceutical compounds (pindolol, metoprolol, and acebutolol) ranging in concentration from 0.2 μg/mL to 0.3 μg/mL. The migration times were faster compared to results obtained with capillary electrophoresis with UV detection, but migration time precision was similar. Experiments were conducted at pH 5 in 25 mM ammonium acetate aqueous solution.
Figure 16:
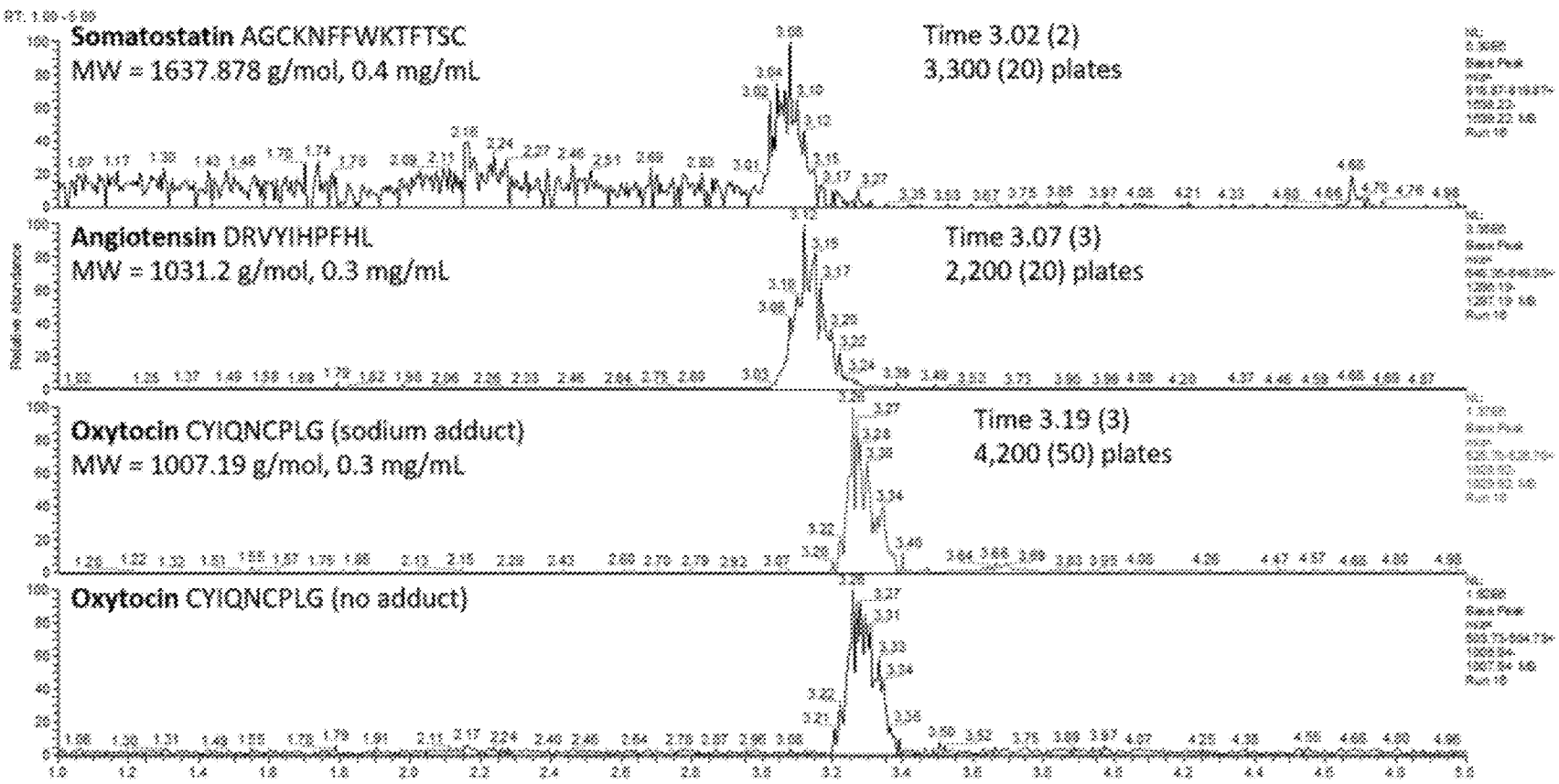
FIG. 16 shows representative cVSSI-MS separation and detection of a mixture of 3 peptides (somatostatin, angiotensin, and oxytocin). The migration times were faster compared to results obtained with capillary electrophoresis with UV detection, but migration time precision was similar. Experiments were conducted at pH 5 in 25 mM ammonium acetate aqueous solution.

For proof of concept experiments, the beta-blocker drugs pindolol, metoprolol, and acebutolol were used as analytes. Each has a conjugated pi-electron ring system for verification using UV-absorbance in a traditional CE device. When benchmarked against a traditional capillary electrophoresis separation composed of a 50 cm long 50 μm ID capillary with an effective length to the detection window of 40 cm with UV-absorbance detection, the migration time of the pH 6.5 data obtained with the vibrational spray (FIG. 14) was similar to that obtained with the commercial instrument. The migration time of the pH 5 data was faster when obtained with vibrational spray (FIG. 15, FIG. 16) as compared to the commercial instrument.

The effect of flow rate on spray ionization and role of electric field on vibrational spray were performed. These results are summarized in Tables 3 and 4 and demonstrate that there is a flow rate dependence with respect to ionization efficiency. These results do not confirm that the electrophoresis is necessary to drive the spray, but do indicate that flow must be delivered at the end of the capillary to complete the electrical spray and to deliver the molecules to the mass spectrometer through a droplet train that is desolvated en route to the mass analyzer.

TABLE 3

Evaluation of role of flow rate and electric field at pH 6.5

| Conditions Applied | | Average (RSD) | |
|---|---|---|---|
| Pressure | Voltage | Peak time | Peak intensity |
| 0.9 psi | 0 kV | 4.0 (30) | 2.5E+04 (100) |
| 0.0 psi | 10 kV | 4.67 (10) | 6.88E+06 (10) |
| 0.9 psi | 10 kV | 2.40 (20) | 7.7E+06 (50) |
| 1.8 psi | 0 kV | 2.35 (10) | 3.1E+04 (70) |

Measurements of migration time were based on n = 3. Separations were performed using a 50 μm inner diameter fused silica capillary and an electric field strength of 250 V/cm. For UV measurements the total length of the capillary and length to the window were 50 cm and 40, respectively. For VSSI-MS measurements the total length of the capillary and length to the window was 40 cm. Sample was injected hydrodynamically (0.3 psi, 3 s). The background electrolyte was 25 mM ammonium acetate unadjusted around pH 6.5. Capillary electrophoresis UV absorbance measurements were performed using a PA/CE MDQ instrument. Capillary electrophoresis VSSI-MS measurements were performed using a lab-built instrument composed of a high voltage power supply (Spellman, model CZEI OOOR).

TABLE 4

Evaluation of role of flow rate and electric field at pH 4

| Conditions Applied | | Average (RSD) | |
|---|---|---|---|
| Pressure | Voltage | Peak time | Peak intensity |
| 0.9 psi | 0 kV | 3.01 (6) | 9.6E+06 (20) |
| 0.9 psi | 10 kV | 2.283 (4) | 2.0E+07 (50) |
| 1.8 psi | 0 kV | 2.03 (6) | 1.32E+07 (30) |
| 1.8 psi | 10 kV | 1.643 (4) | 8.6E+06 (60) |

Measurements of migration time were based on n = 3. Separations were performed using a 50 μm inner diameter fused silica capillary and an electric field strength of 250 V/cm. For UV measurements the total length of the capillary and length to the window were 50 cm and 40, respectively. For VSSI-MS measurements the total length of the capillary and length to the window was 40 cm. Sample was injected hydrodynamically (0.3 psi, 3 s). The background
electrolyte was 5 mM acetic acid adjusted to pH 5 with ammonium hydroxide. Capillary electrophoresis UV absorbance measurements were performed using a PA/CE MDQ instrument. Capillary electrophoresis VSSI-MS measurements were performed using a lab-built instrument composed of a high voltage power supply (Spellman, model CZEI OOOR).

C. VSSI Probe Capillary Electrophoresis Proof of Principle (100 μm ID Capillary)

Figure 17:
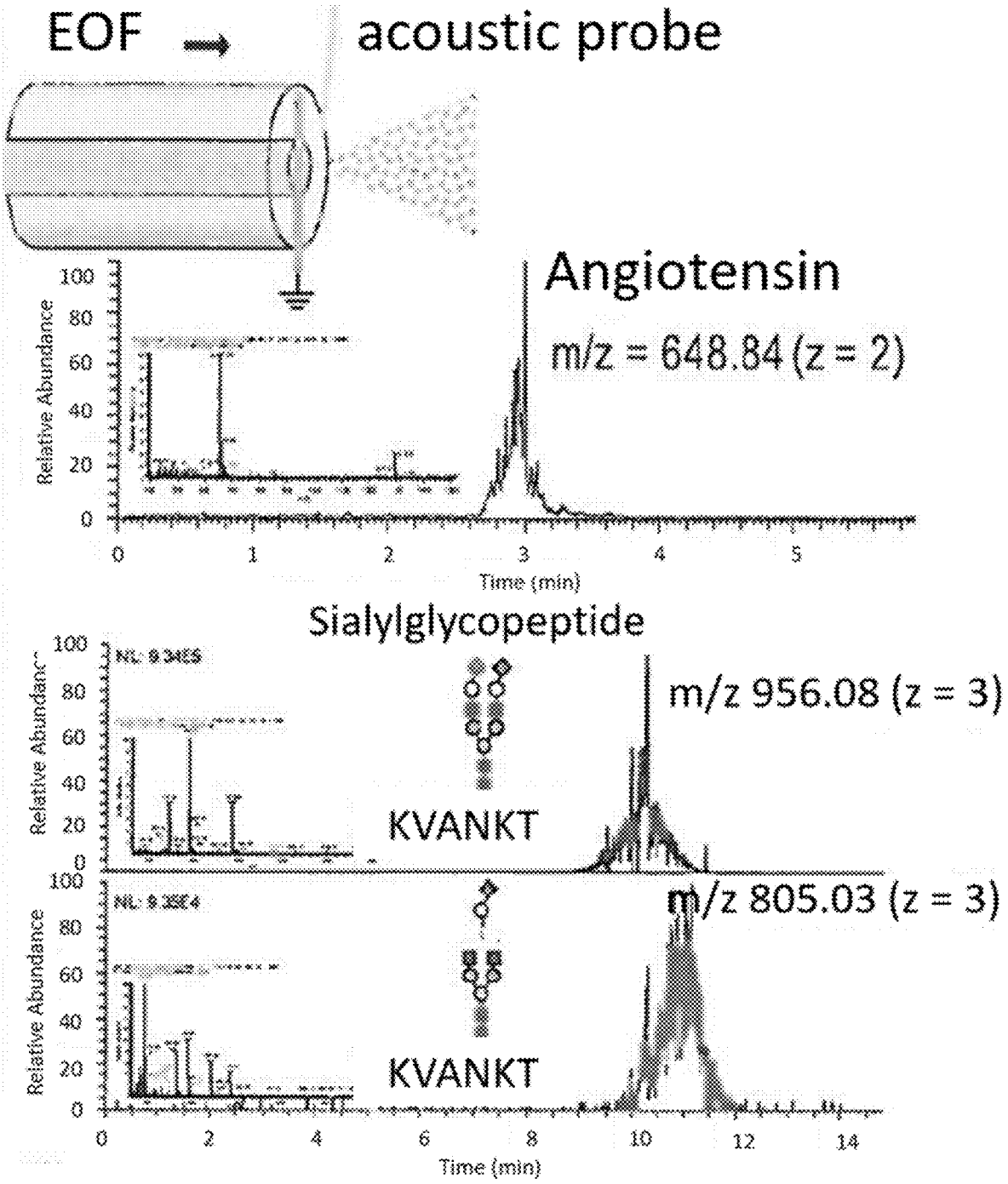
FIG. 17 shows representative separation and detection of angiotensin and sialylglycopeptide using a prototype cVSSI device.

Prototype acoustic spray sources were fabricated and used to demonstrate the functionality of the approach. In one example, spray was generated using an acoustic probe fabricated from a pulled glass capillary at near neutral pH. Angiotensin and sialylglycopeptide were each separated in a 60 cm long, 100 μm ID fused silica capillary under reversed polarity with an applied voltage of 5 kV. A 25 μm diameter platinum wire was affixed across the capillary orifice and connected to ground to complete the electrophoresis electrical circuit using techniques described above and/or previously reported for fabrication of integrated capillary electrophoresis-electrochemical systems. The separation current of 16 μA remained stable throughout multiple runs. A prototype acoustic source was composed of a 100 μM ID capillary modified with a semi-permanent cationic surface coating. The device was used to separate and detect 0.3 mg/mL angiotensin in 25 mM pH 6.5 ammonium acetate or 0.15 mg/mL sialylglycopeptide in 25 mM pH 4.0 ammonium acetate analyzed with a Q Extractive (FIG. 17).

Example 4: Low Flow Voltage Free Interface for Capillary Electrophoresis and Mass Spectrometry Driven by Vibrating Sharp-Edge Spray Ionization Chemicals and Reagents. Ammonium acetate (73594), acetic acid (A6283), pindolol (P-0778), acebutolol (A-3669), soybean trypsin inhibitor (T9128), and ubiquitin (U6253) were purchased from Millipore Sigma (Burlington, Mass.). Ammonium hydroxide (44273) was purchased from Fisher Scientific (Waltham, Mass.). Somatostatin and oxytocin were purchased from American Peptide (Sunnyvale, Calif.). Deionized water was filtered with an Elga Purelab ultra water system (Lowell, Mass.). Solutions were filtered using 0.45 μm PTFE filters (VWR).

CE-VSSI Probe Fabrication. Fused silica capillary (50 μm i.d., 365 μm o.d., Polymicro Technologies, Phoenix, Ariz.) was cut to a length of 40 cm, and 0.5 cm of the polyimide coating was burned off the outside on both ends. The ends were checked under a microscope for clean, straight cuts. A 25 μm platinum wire (PT005113, Goodfellow, Huntingdon, England) was cut to approximately 1 cm in length and bent at two 90° angles in a "U" shape. This wire was maintained across the front orifice of the capillary using a small amount of 1 min epoxy 1366072, Henkel, Düsseldorf, Germany). A thicker wire cut to about 5 cm was attached to the thinner wire via conductive epoxy (8331-14G, MG Chemicals, Ontario, Canada) to create an electrical connection. After the conductive epoxy cured, it was covered with an additional layer of 1 min epoxy (1366072, Henkel) for mechanical stability and to insulate the connection. The end of the larger wire was soldered with a drop of lead solder. Capillaries were allowed to cure completely before they were aligned with the VSSI spray probe.

To fabricate the VSSI spray probes, a P-2000 capillary puller (Sutter Instrument Company, Novato, Calif.) was used to pull 75 mm long capillaries with an I.D. of 0.4 mm (no. 1-000-800/12 Drummond Scientific Company, Broomall, Pa.). Parameters used were HEAT=700, FIL=4, VEL=55, DEL=200, and PUL=175. A pulled glass capillary was attached to one end of a glass microscope slide and a piezoelectric transducer (7BB-27-4 LO, Murata). The piezoelectric transducer was glued to the other end as reported previously (Ranganathan, N., et al., J. Am. Soc. Mass Spectrom. 2019, 30, 824). The probe was attached to a function generator (AFG-1062, Tektronix, Beaverton, Oreg.) and amplifier (7500, Krohn-Hite, Brockton, Mass.) and driven with a square wave, having a frequency in the range of 92-96 kHz and an amplitude in the range of 30-140 mVpp, depending upon the size and geometry of the glass probe. Each spray probe has a slightly different geometry which means that one frequency and amplitude is not applicable to all probes. In general, larger probes (i.e., >50 μm o.d. tip) require a larger amplitude than small probes (i.e., ≤50 μm o.d. tip).

The capillary and spray probe were aligned on the microscope with the tip of the spray probe touching the wall of the capillary near the orifice. The glass probe was fixed on the corner of the glass coverslip with no more than 4 cm extending over the edge, as depicted in prior work.(43) This allowed the probe to vibrate freely when the frequency and amplitude are applied. A 90° angle relative to the capillary was chosen so that sufficient contact with the capillary could be made. Since the probe must touch the orifice of the capillary, this angle allowed for the most contact between the probe and the capillary tip. The spray probe was placed parallel to the platinum electrode or at a small angle relative to the platinum electrode to ensure that the probe and electrode did not come into contact. This was done because placing the probe perpendicular to the electrode often resulted in severing the platinum electrode. The integrated probe and capillary assembly were placed within 2 mm of the transfer line.

CE-VSSI-MS Separation and Analysis. A lab-built instrument composed of a nitrogen gas tank to supply pressure and a high voltage power supply (CZE1000R, Spellman, Hauppauge, N.Y.) was constructed as previously described (White, C. M.; Hanson, K. M.; Holland, L. A. Analytical Sciences Digital Library: http://www.asdlib.org/2005, ASDL Entry 10031). Separations were carried out using bare fused silica capillaries with a total and effective length of 40 cm, an inner diameter of 50 μm, and an outer diameter of 365 μm. At the beginning of each day, flushes were done at 41 kPa (6 psi) with 0.1 N ammonium hydroxide for 60 min, water for 10 min, and buffer for 30 min with the acoustic spray off. In between runs, the capillary was flushed for 1 min with background electrolyte with the VSSI active during the flush. If the probe was not active during the 1 min flush applied in between the CE runs, then liquid accumulated at the capillary tip and entered the probe. When acoustic spray was restored, the additional liquid in the probe was ejected and an increase in the MS signal was observed for a few seconds. The injection was either 10 kV for 2 or 4 s and the separation voltage was 10 kV applied in normal polarity. Scanning ranges on the MS were mass-to-charge (m/z) 165-400 for β-blockers, 400-1700 for peptides, and 500-4000 for protein. The MS capillary temperature was set to 350° C. An LTQ XL or Q-exactive mass spectrometer equipped with LTQ Tune Plus software (version 2.7) was used to collect the data (Thermo Fisher Scientific, San Jose, Calif.). Data were processed using Thermo Fisher Scientific Xcalibur (version 4.1) and Microsoft Excel (2016, Microsoft, Redmond, Wash.).

The limit of detection (LOD) and limit of quantification (LOQ) were determined using LOD=ks(C/(H−h)), where k is the confidence factor (i.e., 3 for LOD and 10 for LOQ), s is the standard deviation of the noise, C is the sample concentration, H is the average signal of the analyte, and h is the average signal of the noise. The standard deviation of the noise was determined using the same number of points that comprised the analyte peak, but from a portion of the baseline just before the analyte peak eluted.

CE-UV Separation and Analysis. Bare-fused silica separations were conducted using a ProteomeLab PA800 capillary electrophoresis system (Sciex, Redwood City, Calif.). Capillaries had a total length of 50 cm, an effective length of 40 cm, and an inner diameter of 50 μm. The capillary preparation and separation were the same as those used for the VSSI-MS analyses. To maintain the same electric field strength used on the CE-VSSI-MS system, the separation voltage was +12.5 kV. The analyses were performed using UV absorbance detection at a wavelength of 200 nm. The cartridge temperature was set to 19° C. for flushes and 25° C. for separations. Data were collected and analyzed using 32Karat software (version 7.0, Sciex).

Figure 19A:
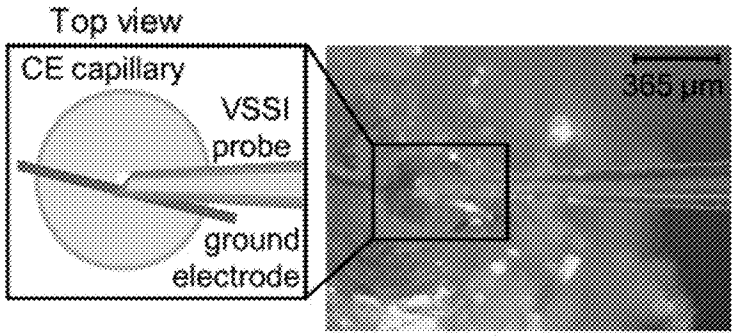
FIG. 19A-19E show a representative diagram and image of a disclosed spray probe, capillary and electrode alignment in the z-direction (FIG. 19A) and the x,y-direction (FIG. 19B).
Figure 19B:
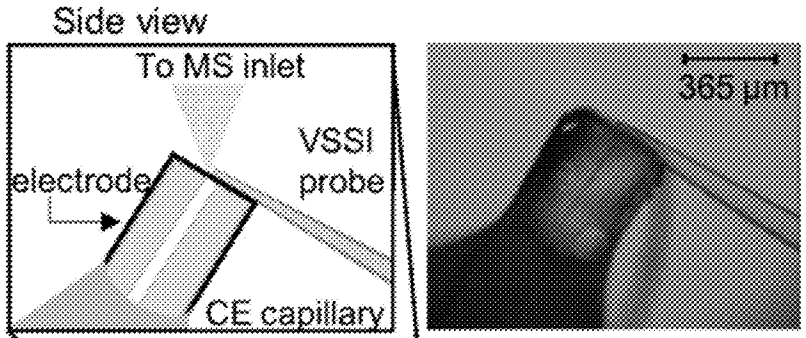
Figure 19C:
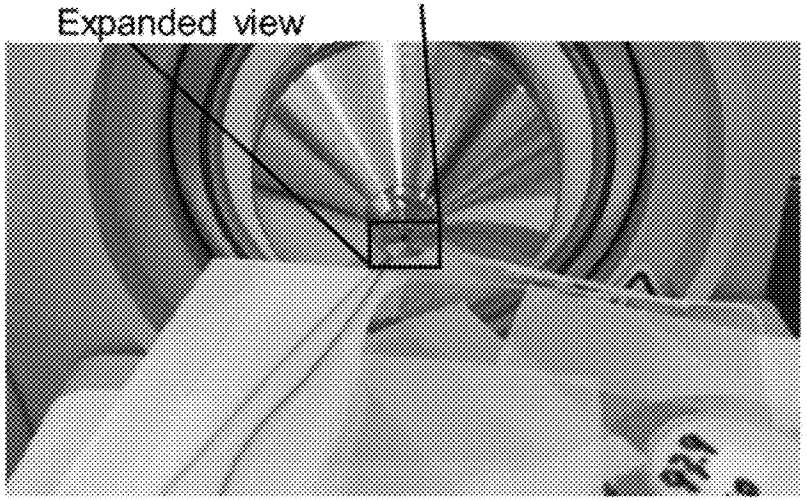
Figure 19D:
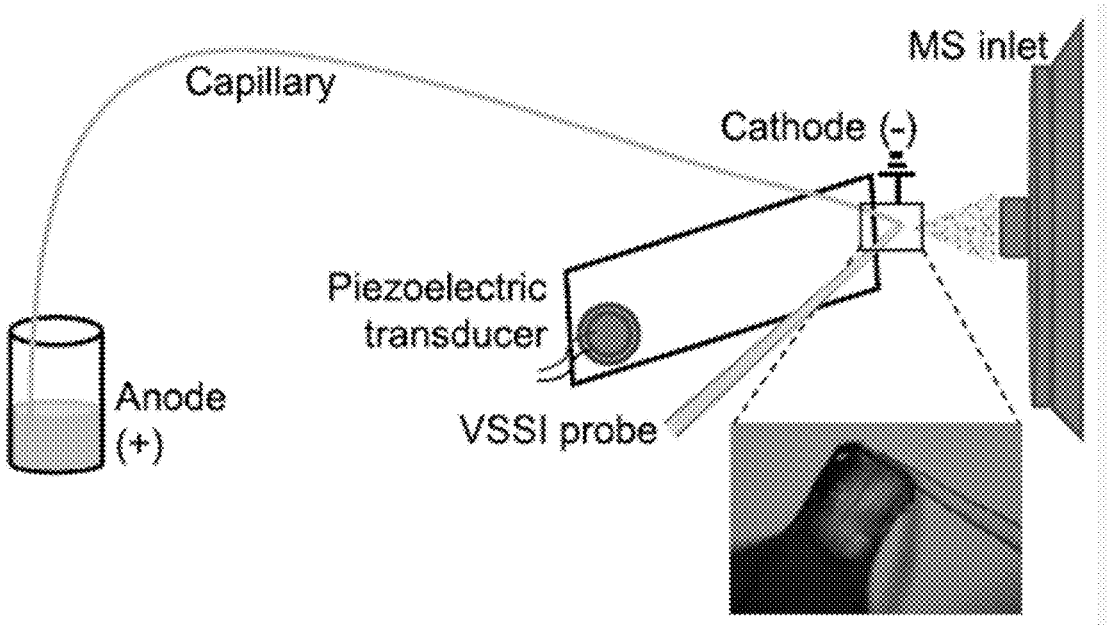
Figure 19E:
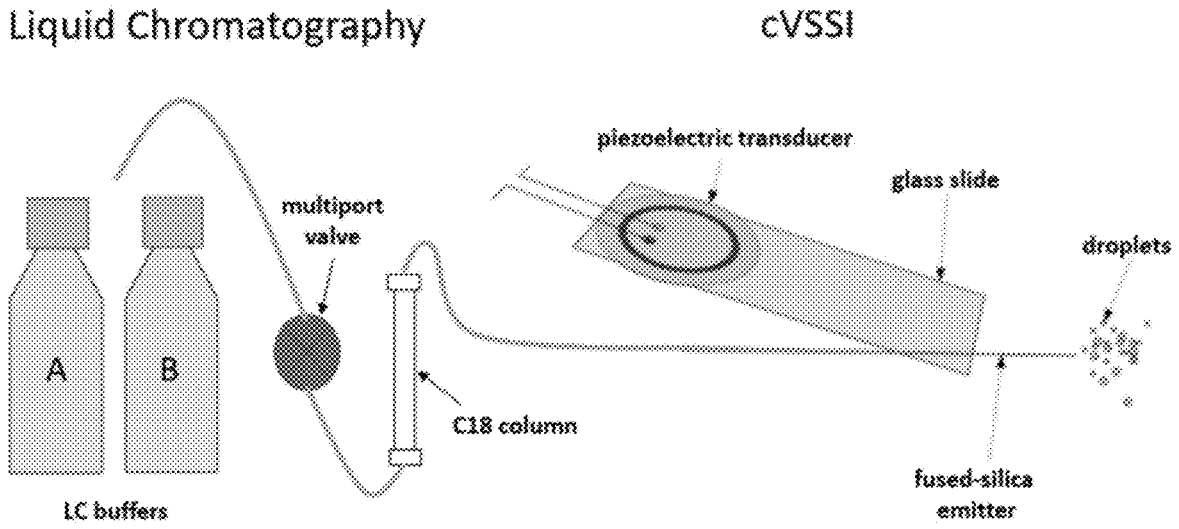

Interface Design and Implementation. The elements of the CE-VSSI interface are the probe, grounding electrode, blunt capillary tip, and acoustic generator. The arrangement of each component is shown in FIG. 19A (top view), FIG. 19B (side view), and FIG. 19C (expanded view of the interface). A fused silica capillary of 50 μm inner diameter and 360 μm outer diameter was used for the separation. The separation current was grounded through a 25 μm o.d. platinum wire. A glass probe pulled to approximately 50 μm tip was used to efficiently transfer vibrations from the piezoelectric source to the liquid. Both the cathodic electrode and vibrating probe were placed near the capillary orifice to maintain contact with the liquid expelled from the capillary. While the probe was in direct contact with the capillary surface to transfer energy, the electrode was offset from the capillary orifice. This was done to prevent hydrogen gas bubbles generated from electrolysis of water from disrupting the electrical circuit of the separation and causing unstable separation current. The spray probe was positioned at a 90° angle relative to the capillary (FIG. 19B) and the capillary tip was positioned between 1 and 2 mm away from the mass spectrometer transfer line (FIG. 19C) to facilitate transfer of the nebulized droplets.

Prior to installing the CE-VSSI device on the mass spectrometer, each device was assembled and tested to ensure that a plume of droplets was observed. This was done by applying a pressure equivalent to the rate of the electroosmotic flow and adjusting the applied frequency and amplitude until a strong and stable plume was observed that lasted for 3 min. The stability of the droplet plume was also tested in the presence of electrophoresis. The VSSI spray system was compatible with both 75 and 50 μm i.d. capillaries; however, the larger bore capillary was susceptible to siphoning. Measures that were taken to reduce siphoning included leveling the setup each time and maintaining the liquid above the bottom of the capillary no higher than 0.5 cm. 45 The 50 μm inner diameter of the separation capillary generated sufficient electroosmotic flow to sustain both electrophoresis and a visible plume of droplets.

Figure 23:
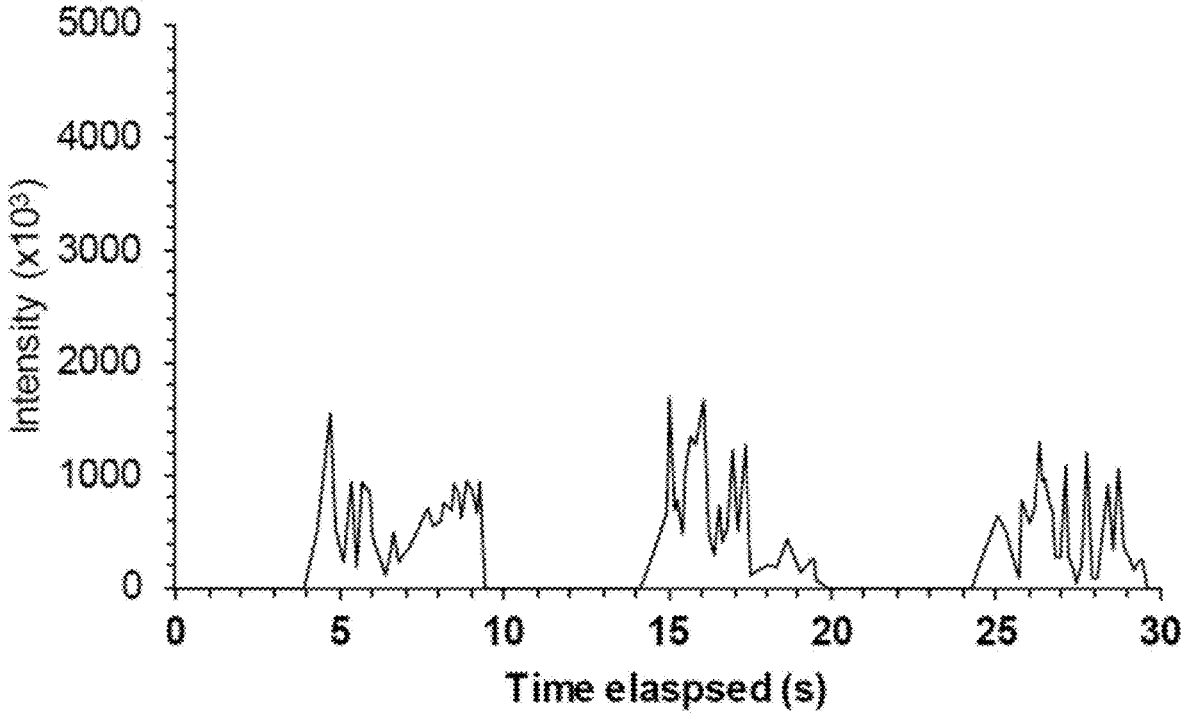
FIG. 23 shows representative that ionization starts and stops with acoustics. A voltage of 10 kV was applied to the CE capillary during the experiment. The acoustics were pulsed on and off in 5-sec increments starting with an off period of 0-5 sec elapsed. The extracted ion electropherogram depicts ionization intensity for pindolol which is plotted as the extracted base peak of 249.3 with a mass tolerance of 500 mmu.
Figure 24B:
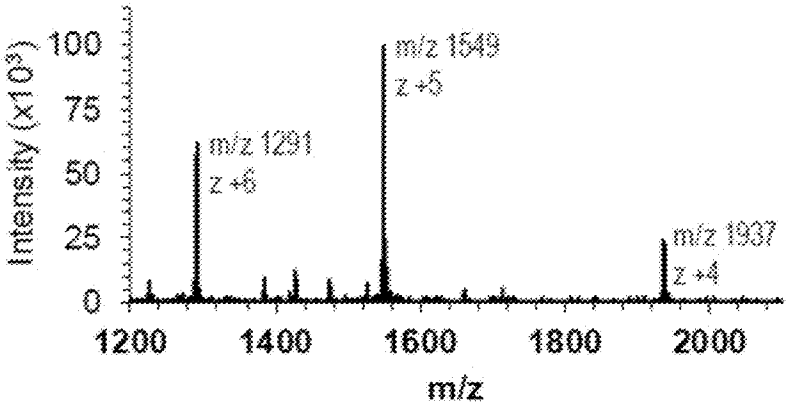
FIGS. 24A-24D show representative data obtained using the disclosed methods and devices for analysis of ubiquitin.
Figure 24C:
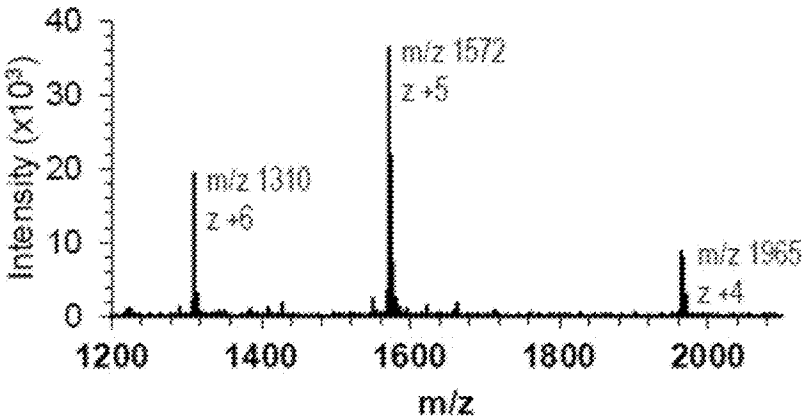
Figure 24A:
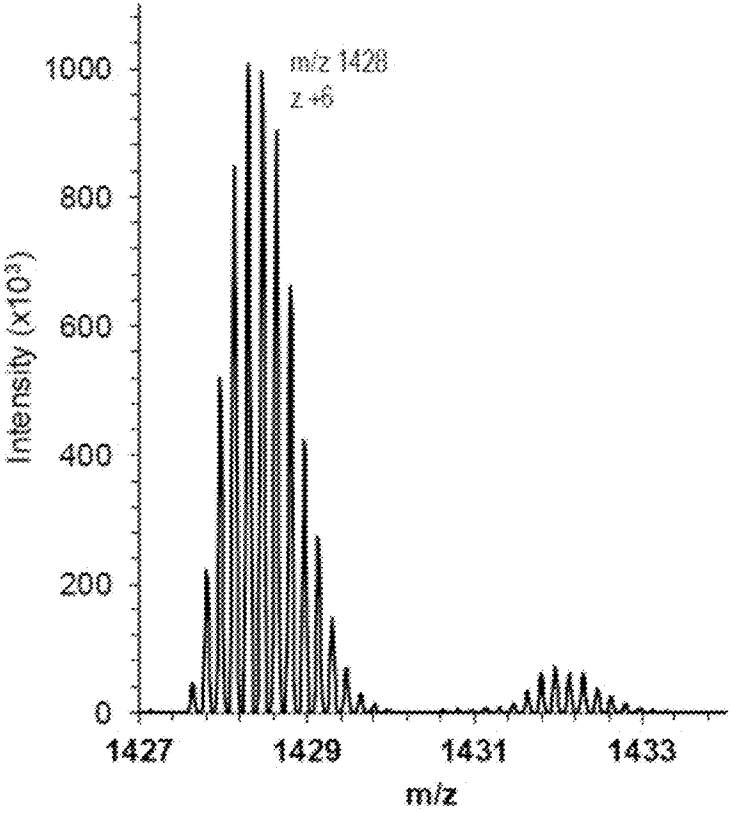
Figure 24D:
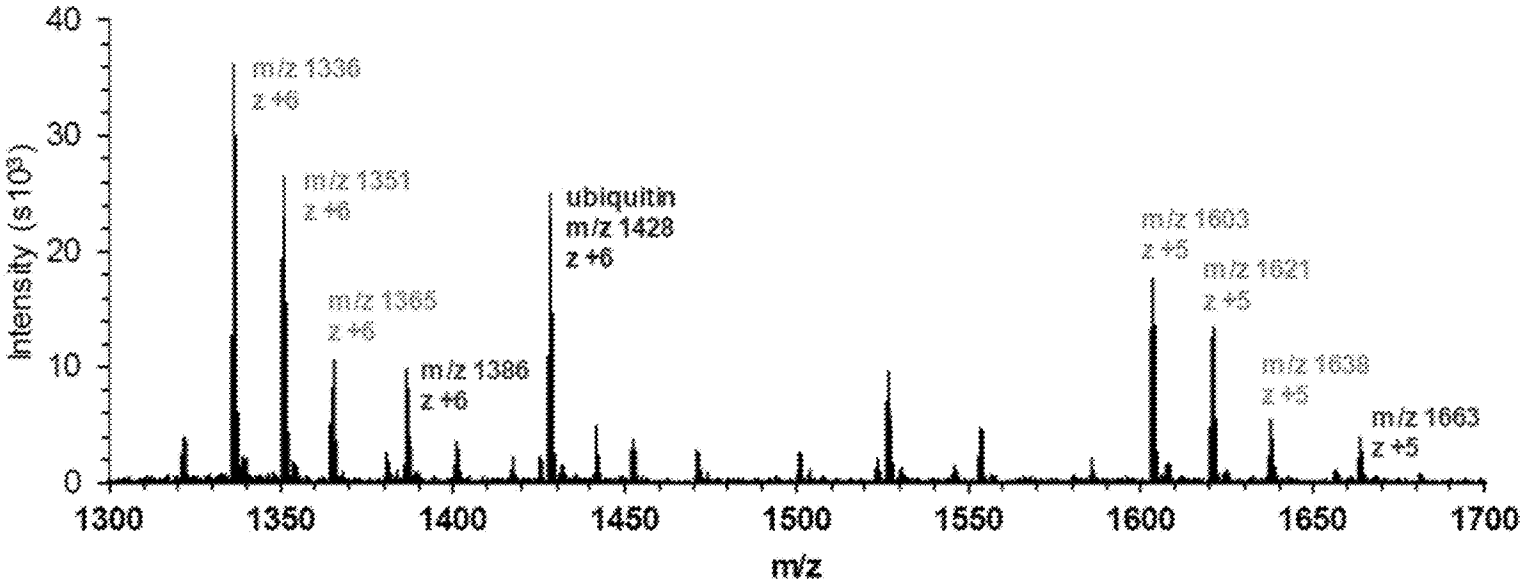

Evidence of Acoustic Driven Spray. Application of the device demonstrated the significance of the VSSI probe for droplet formation leading to sample transfer to the mass spectrometer rather than direct spray at low CE flow rates. CE was initiated using a background electrolyte of 25 mM acetic acid buffered to pH of 5 that also contained 10 μM pindolol. Under these conditions the pindolol is cationic and easily ionized. The approximate electroosmotic flow rate at this pH was 70 nL/min at a field strength of 250 V/cm. The acoustic source was manually cycled on and off with no interruption of the CE voltage. Turning the acoustics off coincided with a drop in the ionization intensity (FIG. 23). The average duration of near zero intensity during the off-cycle was 4.3±0.3 s for the four off-cycles. Assuming no error in manually turning off the acoustics, these data indicate that the response to acoustics is as little as 0.35 s per on-off cycling. The average signal intensity during the three on-cycles was 37,000, 29,000, and 32,000, respectively. During the off-cycle the plume was no longer visible and fluid accumulated at the end of the capillary because the electrophoresis separation continued to eject running buffer. The device was switched to pressure driven flow to deliver 200 nL/min. However, switching from voltage to pressure yielded between 10 and 100-fold lower ion intensity.

The nebulized droplets are generally, but not always, ejected at a right angle to the vibrating probe for different probes and capillaries coupled to create CE-VSSI. This is attributed to subtle differences in the probe geometry and alignment. Although the mechanism of droplet formation is different, a similar observation was reported with CE-ESI, 11 which was rectified through the use of a nitrogen chamber. A less sophisticated nitrogen chamber was constructed and used with VSSI with a goal of directing more droplets into the MS and making a more uniform environment for ionization since the VSSI interface was developed with an open platform for the ion source. The peak areas obtained for the separation and detection of a sample of 1 μM pindolol in the presence and absence of the nitrogen chamber, which were 300,000±100,000, and 180,000±80,000, respectively, were not significantly different. Improvements in the design as well as optimization of the nitrogen flow may dramatically enhance the performance. Additional studies are needed to define the factors that orient the direction of the plume in order to maintain efficient ion transfer.

To test the effects of flow rate on signal, pindolol was separated at different applied voltages, and the migration velocity was used as a measure of flow rate. The relationship between migration velocity and peak area was linear (R2=0.94). This study was performed using two different CE-VSSI devices with each capillary spanning three points (i.e., 0.15, 0.23, and 0.41 cm/s or 0.23, 0.54, and 0.74 cm/s). At higher pindolol velocity, a higher peak area was obtained as more analyte was delivered to the MS. Flow rates below the minimum velocity of 0.15 cm/s could not be evaluated because the spray was unstable at these low flow rates. Conversely, rates above the maximum velocity were not tested because the separation currents approached levels that lead to Joule heating (i=39 μA).

The ionic strength of the background electrolyte affects the rate of electroosmotic flow as well as ionization. The impact of four different concentrations (ranging from 10 to 75 mM) of ammonium acetate were tested. As ionic strength was increased successively, the peak area of pindolol decreased. At ammonium acetate concentrations of 10, 18, 25, and 75 mM, peak areas were 9,400,000±800,000, 3,300,000±300,000, 1,400,000±100,000, and 1,100,000±100,000, respectively. The same trend was observed for acebutolol, which at ammonium acetate concentrations of 10, 18, 25, and 75 mM, had peak areas of 5,200,000±400,000, 1,600,000±200,000, 510,000±10,000, and 490,000±60,000, respectively. While these data suggest that lower ionic strengths should be used to achieve better signal, other aspects of the background electrolyte concentration must also be considered. For example, the concentration of the background electrolyte may affect the separation through nonspecific adsorption to the capillary surface.

The compatibility of VSSI with different volatile background electrolytes was evaluated. Pindolol was separated and detected with three different electrolytes systems at near-neutral or basic pH values each at a concentration of 25 mM. Ammonium acetate and ammonium bicarbonate both had a measured pH value of 6.5. Bicarbonate is an effective buffer at this pH value; whereas acetate does not serve as a buffer at pH 6.5. Peak areas resulting from the near-neutral background electrolytes, which were 280,000±10,000 for ammonium acetate and 360,000±60,000 for ammonium bicarbonate, were similar. However, ammonium hydroxide buffered at pH 10 yielded a 10-fold higher signal with an area of 2,900,000±200,000. This increase of positive ions at highly basic pH values has previously been reported in the literature as the "wrong-way round" principle (Mansoori, B. A., et a., Rapid Commun. Mass Spectrom. 1997, 11, 1120-1130).

Figure 20A:
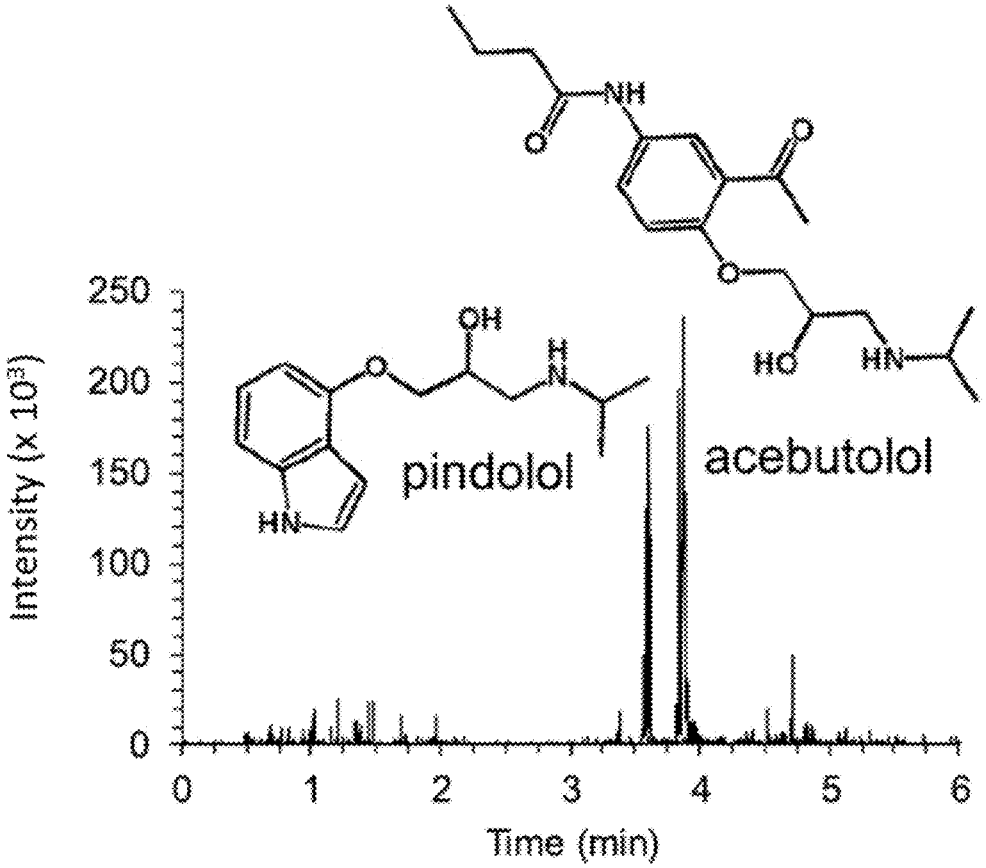
FIG. 20A shows CE-VSSI-MS separation of 1 μM pindolol and acebutolol. The extracted ion electropherograms were created using masses of 249.1554 and 337.2061 for pindolol and acebutolol, respectively, with a mass tolerance of 10 ppm. Separation was achieved with a 40 cm (total and effective length), 50 μm i.d. capillary at an applied voltage of +10 kV with a current of 12 μA.
Figure 20B:
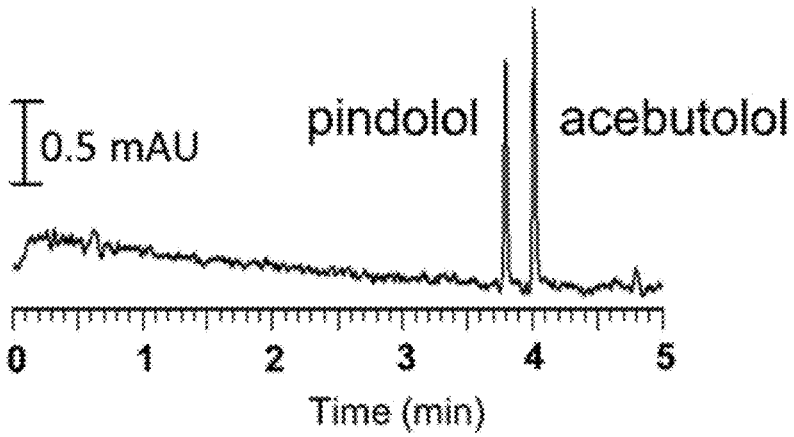
FIG. 20B shows CE-UV separation of 50 μM pindolol and 100 μM acebutolol. Separation was achieved with a 50 cm (total length), 40 cm (effective length), 50 μm i.d. capillary at an applied voltage of +12.5 kV with a current of 12 μA. All separations were achieved with a background electrolyte of pH 6.5, 25 mM ammonium acetate.

Separation and Detection with CE-VSSI-MS Compared to CE-UV. The CE-VSSI-MS system was used to separate two β-blockers at a near neutral pH in order to compare the separation with CE-UV. A background electrolyte of 25 mM ammonium acetate at pH 6.5 was used, which generated an electroosmotic flow of approximately 110 nL/min. A β-blocker mixture composed of 1 μM (0.25 μg/mL) pindolol and 1 μM (0.34 μg/mL) acebutolol was used to characterize the separation and device performance (FIGS. 20A and 20B). Under these conditions the β-blockers are cationic (i.e., $pK_a$ values greater than 9; see Zhou, C., et al., J. Pharm. Sci. 2005, 94, 576-589 and Shalaeva, M., et al., Pharm. Sci. 2008, 97, 2581- 2606). Sample was introduced with an electrokinetic injection. The mass of analyte injected in the capillary (Q) can be estimated as ($Q=\pi r^2\mu_{app}V_{inj}t_{inj}C/L$; Oda, R. P. and Landers, J. P. Handbook of Capillary Electrophoresis, 2nd ed.; Landers, J. P., Ed.; Taylor & Francis: Boca Raton, 1997; p 869) given the apparent mobility (μapp), capillary radius (r), capillary length (L), injection voltage ($V_{inj}$), injection time ($t_{inj}$), and analyte concentration (C). The 10 kV 2 s injection of analyte corresponds to 1.4 pg pindolol and 1.7 pg acebutolol in the capillary. CE-VSSI-MS was compatible with hydrodynamic injections. Similar peak areas and plate counts were obtained with a 10 kV 4 s electrokinetic injection and 14 kPa (2 psi) 5 s hydrodynamic injection. A 5-fold smaller hydrodynamic injection was used on the commercial CE-UV instrument as compared to the lab-built CE-MS instrument, which was likely due to differences in the delivery and regulation of pressure with these two different systems. With electrokinetic injections of the sample diluted in the pH 6.5 ammonium acetate background electrolyte, the LOD and LOQ for pindolol were calculated to be 0.002 and 0.007 μM, respectively. This LOD can be improved further if stacking techniques are employed. However, in the absence of stacking, the pindolol LOD is comparable to values reported for CE-ESI-MS analyses achieved with acidic background electrolytes of similar small cationic molecules with sheath-flow (Portero, E. P. and Nemes, P., Analyst 2019, 144, 892- 900; Lapainis, T., et al., Anal. Chem. 2009, 81, 5858- 5864; Lindenburg, P. W., et al., Electrophoresis 2014, 35, 1308- 1314) and sheathless (Hirayama, A., et al., Electrophoresis 2018, 39, 1382- 1389; and Zhang, W., et al., Chromatogr. B: Anal. Technol. Biomed. Life Sci. 2019, 1105, 10-14) interfaces. Pindolol standards were detected by CE-VSSI-MS at concentrations ranging from 0.01 to 5 μM. Although the use of internal standards is recognized as the appropriate strategy for MS quantification, in the absence of an internal standard, a linear relationship was observed between concentration and peak area ($R^2$=0.98) as determined using five different concentrations of pindolol (i.e., 0.01, 0.01, 0.1, 1, 5 μM).

The separation efficiency of 80,000 plates/m was comparable to that obtained with the UV detection (Tables 5 and 6). The theoretical plates are 80%-95% of those observed with the capillary electrophoresis UV system, and migration times vary by no more than 7% with either β-blocker. While most CE-ESI-MS separations are performed at acidic conditions to eliminate surface adsorption and facilitate ionization, these data indicate that CE-VSSI is compatible with capillary electrophoresis operated under near neutral conditions that generate electroosmotic flow. The plate counts obtained with VSSI using a background electrolyte at pH 6.5 approach plate counts reported in the literature of 170,000 plates/m for cationic metabolites (Portero, E. P. and Nemes, P., Analyst 2019, 144, 892- 900), which was achieved under conditions of low pH. With acidic background electrolyte in bare fused silica capillary, the analyte migration is based solely on electrophoretic mobility resulting in longer run times. If flow is superimposed to stabilize the electrospray and speed the separation, the efficiency of the electrophoresis will be reduced. In other instances, it has also been noted that the process of electrospray itself may superimpose laminar flow in capillary electrophoresis (do Lago, C. L., et al. Electrophoresis 2014, 35, 2412-2416; and Busnel, J.-M., et al., Anal. Chem. 2010, 82, 9476- 9483).

TABLE 5

Separation efficiency per metera at pH 6.5 (VSSI-MS vs CE-UV).

| pH 6.5 | CE-MS (n = 3)[b] Plates (RSD)[d] | CE-UV (n = 3)[c] Plates (RSD)[d] |
|---|---|---|
| Pindolol | 70,000 (40) | 80,000 (10) |
| Acebutolol | 80,000 (20) | 80,000 (20) |
| Somatostatin | 11,000 (90) | 10,000 (60) |
| Oxytocin | 30,000 (40) | 40,000 (40) |
| Ubiquitin | 10,000 (50) | 17,500 (5) |
| Trypsin inhibitor | 30,000 (40) | 17,000 (2) |

TABLE 6

Migration time at pH 6.5 (VSSI-MS vs CE-UV).

| pH 6.5 | CE-MS (n = 3) Time (RSD) | CE-UV (n = 3) Time (RSD) |
|---|---|---|
| Pindolot | 3.59 (0.5) | 3.84 (1) |
| Acebutolol | 3.85 (0.7) | 4.06 (1) |
| Somatostatin | 4.7 (10) | 4.6 (3) |
| Oxytocin | 4.9 (10) | 5.06 (0.7) |

TABLE 6-continued

Migration time at pH 6.5 (VSSI-MS vs CE-UV).

| pH 6.5 | CE-MS (n = 3) Time (RSD) | CE-UV (n = 3) Time (RSD) |
|---|---|---|
| Ubiquitin | 7.5 (2) | 5.60 (1) |
| Trypsin inhibitor | 11.0 (1) | 7.61 (0.8) |

Figure 21A:
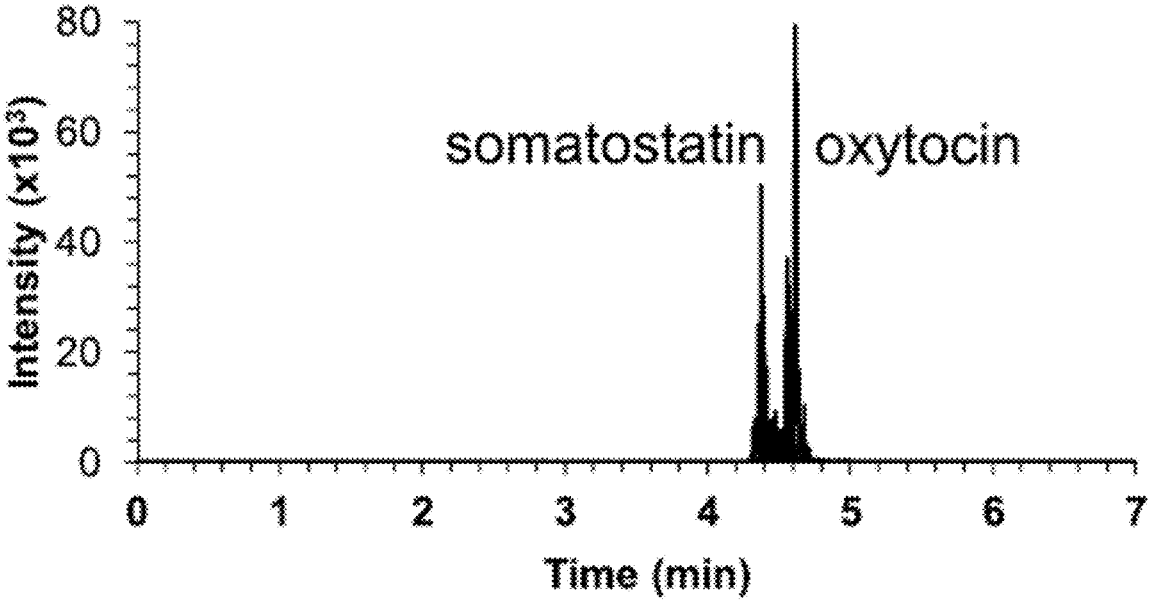
FIGS. 21A-21B show representative data obtained using a disclosed CE-VSSI interface, e.g., as shown in FIGS. 19A-19C, with MS.
Figure 21B:
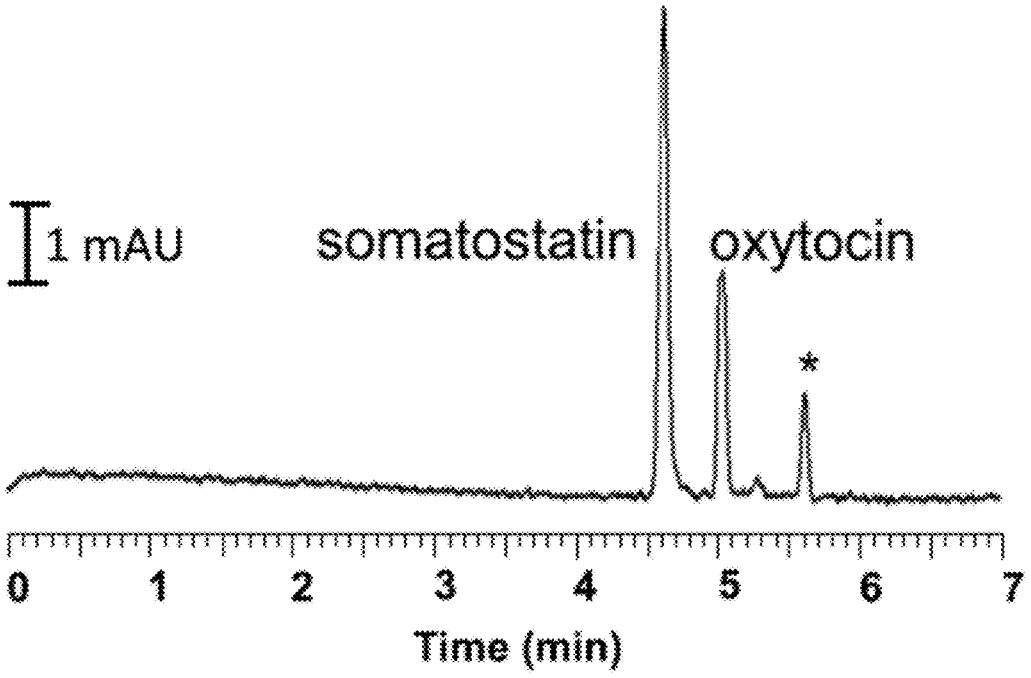
Figure 22A:
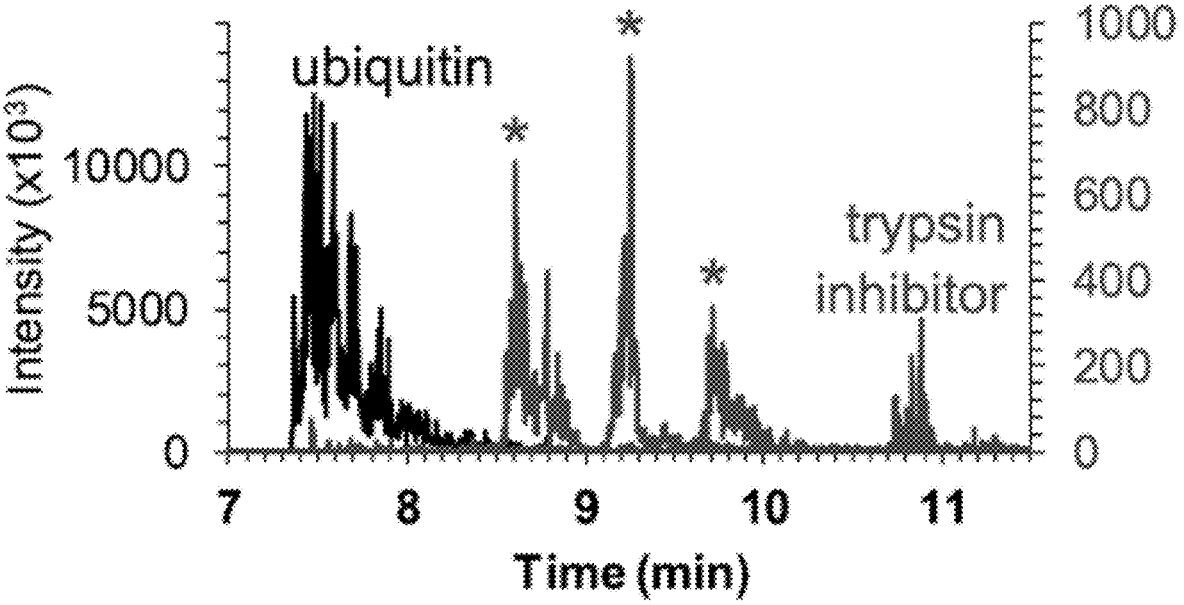
FIG. 22A-22D show representative data obtained using a disclosed CE-VSSI interface, e.g., as shown in FIGS. 19A-19C, with MS.
Figure 22B:
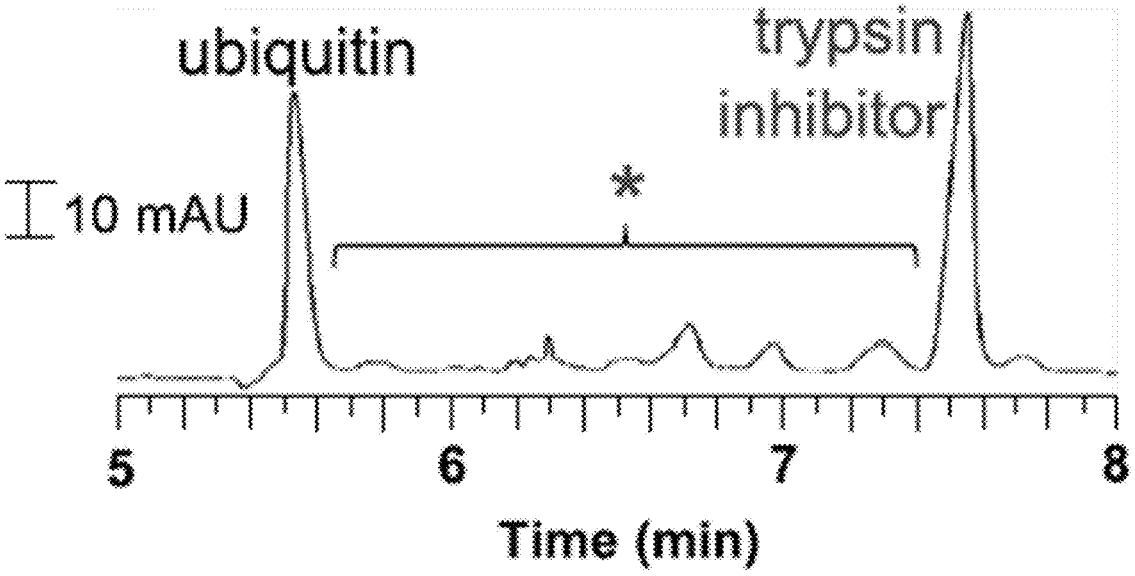
Figure 22C:
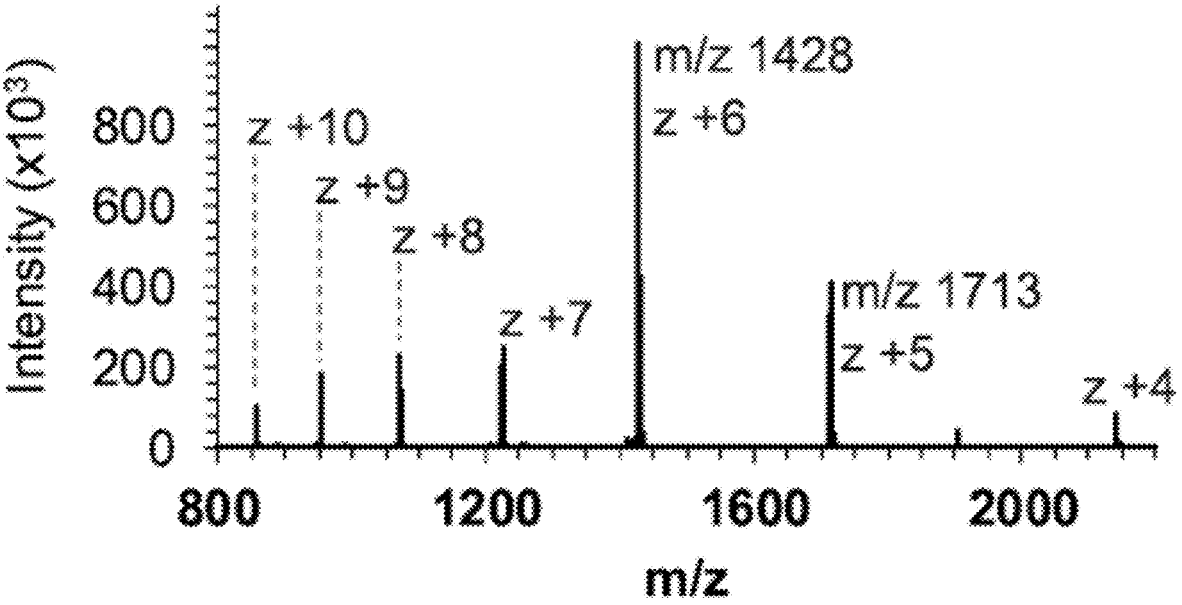
Figure 22D:
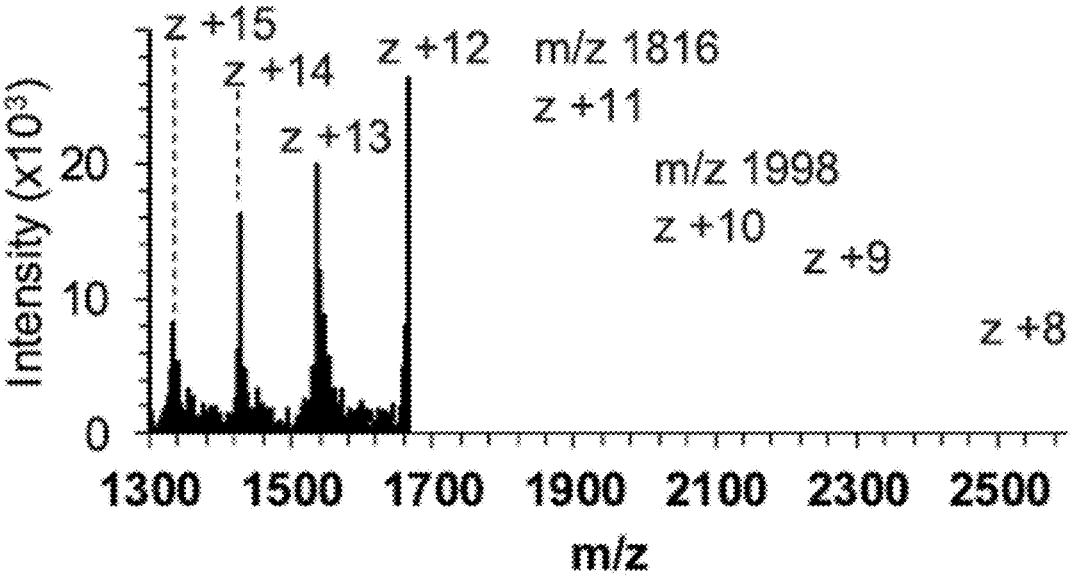

[a]Distance to detector is 40 cm.
[b]Values for peak width were obtained with 2 significant figures.
[c]Values for peak width were obtained with 4 significant figures.
[d]Calculated by determining the width at base (w) as $N = 16t^2/w^2$ The CE-VSSI interface was also applied to the separation of a sample containing 50 μM (82 μg/mL) somatostatin and 50 μM (50 μg/mL) oxytocin. Peptides were injected electrokinetically (10 kV, 2 s), corresponding to a mass of 370 pg somatostatin and 210 pg oxytocin loaded into the capillary. It should be noted no effort was made to desalt the peptides prior to analysis and subsequently sodium adducts were observed for oxytocin. Peptide separations had similar performance relative to CE-UV data (FIGS. 21A and 21B). The migration times and theoretical plate counts were similar for somatostatin and oxytocin for CE-VSSI and CE-UV (Tables 5 and 6), The utility of CE-VSSI-MS for protein analysis was evaluated by injecting and separating ubiquitin mixed with a commercial soybean preparation that primarily contained trypsin inhibitor. The benefit of the VSSI interface is depicted in FIGS. 22A-22D. With the CE-UV trace, the presence of other molecules is evident as noted by the asterisk in FIG. 22B. However, the CE-VSSI-MS trace (FIG. 22A) sheds light on the composition (FIGS. 24A-24D). The dominant charge state of +6 was detected for ubiquitin and was calculated to have a mass of 8567 Da (FIG. 22C) which is within 0.02% of the average mass reported by the vendor. The m/z differences between adjacent isotopic envelopes reveal the presence of some adducts. The extracted ion electropherogram of the peaks associated with trypsin inhibitor (FIGS. 24A-24D) reveal the presence of peptide fragments isolated from soybean with masses of 7746 and 7860 Da, as well as other fragments (i.e., at 8.75 min) with masses ranging from 8016 to 8316 Da. In addition to trypsin inhibitor, soybeans contain Bowman-Birk inhibitors which are peptides with molecular weights reported in the literature ranging from 6941 to 947554,55 and have pKa values ranging from 3.9 to 6.3.54,56 The peaks migrating faster than the peak attributed to trypsin inhibitor protein are less negative (i.e., have higher isoelectric points). These peptide fragments had nominal response in CE-UV, but had higher ionization intensity in MS than the main protein peak observed in the UV separation. The dominant peak for trypsin inhibitor corresponds to +11 ions with a calculated mass of 19,979 Da (FIG. 22D). Although the trypsin inhibitor is reported to contain three variants, the vendor reports that the mass of trypsin inhibitor can be approximated to be 20,100 Da, which is within 0.6% of the mass observed with the CE-VSSI-MS interface. Masses for all peaks were calculated based upon the average m/z of the three dominant charge states. The capillary electrophoresis system separated the trypsin inhibitor peptides from the intact protein, which enabled discrimination of the protein and peptides, rendering the mass identification more straightforward.

While the concentrations of the proteins and peptides in the soybean trypsin inhibitor standard is not known, the 10 kV 4 s injection of proteins corresponds to 580 μg ubiquitin. The peak areas for ubiquitin and trypsin inhibitor were 33,000,000±9,000,000 and 400,000±400,000, respectively. The worse precision of trypsin inhibitor relative to ubiquitin is attributed to the presence of the peptides and protein variants in the stock. This adversely impacts the ionization efficiency of this anionic protein, leading to a substantially lower signal. The plate counts for ubiquitin and trypsin inhibitor are lower or the same with CE-VSSI-MS as compared to CE-UV (Table 5). The trace in FIG. 22B indicates tailing for the ubiquitin peak. The migration times obtained with CE-VSSI-MS for ubiquitin and trypsin inhibitor are 1.8 and 3.4 min slower. The slower migration times and tailing may be due to nonspecific surface adsorption from prior analyses. Although strategies were used to minimize laminar flow, it is possible the configuration of the lab-built instrument may have been subject to siphoning toward the site of injection.

The ubiquitin and trypsin inhibitor proteins were selected because with neutral or basic separation buffers, most other proteins adsorb to the bare fused silica surface and produce broad peaks. Further optimization of the electrophoretic separation is underway to reduce surface adsorption of the protein to achieve higher efficiency separations. Finally, although the trypsin inhibitor was desalted through buffer exchange with a 10 kDa molecular weight cutoff filter (Merck Millipore UFC501024, Burlington, Mass.), sodium adducts were observed in the extracted ion electropherogram. Applying insource ion activation will improve the technique further by declustering the protein adducts.

Discussion. This example demonstrates the utility of the CE-VSSI-MS interface disclosed herein. Under the conditions used to evaluate VSSI performance in the present disclosure, the performance was similar to sheathless and coaxial-sheath CE-ESI-MS. The CE-VSSI maintained the CE separation efficiency and was compatible with different volatile background electrolytes, ionic strength, and enabled separations at near-neutral pH. Organic modifiers were not required to assist with droplet formation. The present example demonstrates the utility of this first working example of the disclosed interface for CE-MS analysis with small molecules, peptides, and proteins. Beyond performance, the disclosed CE-VSSI is inexpensive given that probes are fabricated from pulled glass tubes costing $0.10 each and piezoelectric transducers available for under $1. Collectively, these attributes of CE-VSSI may offer advantages to a variety of applications including ionization under native conditions (i.e., neutral pH values and in the absence of organic solvents) or field measurements where lower cost interfaces are needed. Finally, the disclosed devices and processes are readily adaptable to conventional commercial instruments to increase the accessibility of the disclosed techniques.

Example 5: Facile Improvement of Negative Ion Mode Electrospray Ionization Using Capillary Vibrating Sharp-Edge Spray Ionization Materials and Reagents. High performance liquid chromatography (HPLC) grade water, nuclease-free water, potassium chloride, and ammonium acetate (NH4OAc) were purchased from Fischer Scientific (NJ, U.S.A.). Trimethylammonium acetate (TMAA) was obtained by slowly adding 4.3 M acetic acid to 50 mL of 4.3 M trimethylamine (TCI chemical) solution until the pH was around 7.0, and this process was monitored by a pH meter (Mettler Toledo, Ohio). Acetic acid, fondaparinux sodium ($C_{31}H_{43}N_3Na_{10}O_{49}S_8$, m.w. 1728.1 g/mol) and chondroitin disaccharide Δdi-6S sodium salt ($C_{14}H_{19}NO_{14}SNa_2$, m.w. 503.34 g/mol) were purchased from Sigma-Aldrich (MO, U.S.A.). Insulin (human) and angiotensin 2 (human) were purchased from Alfa Aesar (MA, U.S.A.). Ubiquitin (~8.5 kDa) was purchased from Boston Biochem (MA, U.S.A.). Myoglobin (~17 kDa) was purchased from Sigma-Aldrich (St. Louis, Mo., U.S.A.). All DNA oligonucleotides used in this work, d(CATATATG), d(ACGCGCGT), 56-mer ssDNA, and human telomeric G-quadruplex sequence d(TT $(GGGTTA)_3$GGGA) were pur-chased from Integrated DNA Technologies, Inc. (Coralville, Iowa, U.S.A.). All the chemical reagents and oligonucleotides were used without further purification.

Figure 25B:
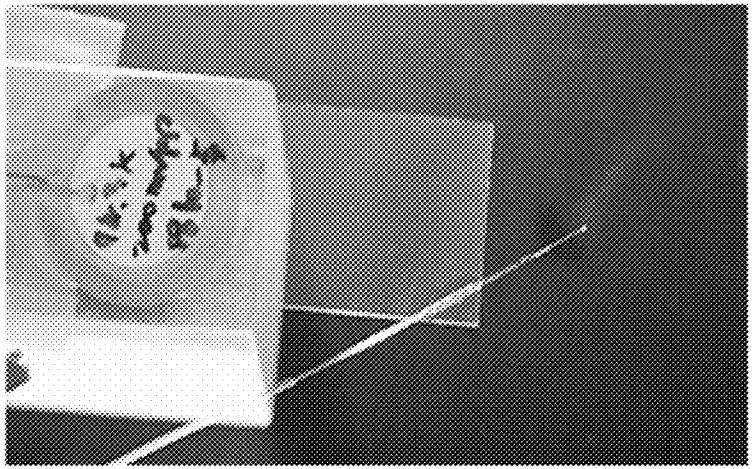
FIGS. 25A-25C show representative schematic view and images of a disclosed devices for cVSSI-MS.
Figure 25A:
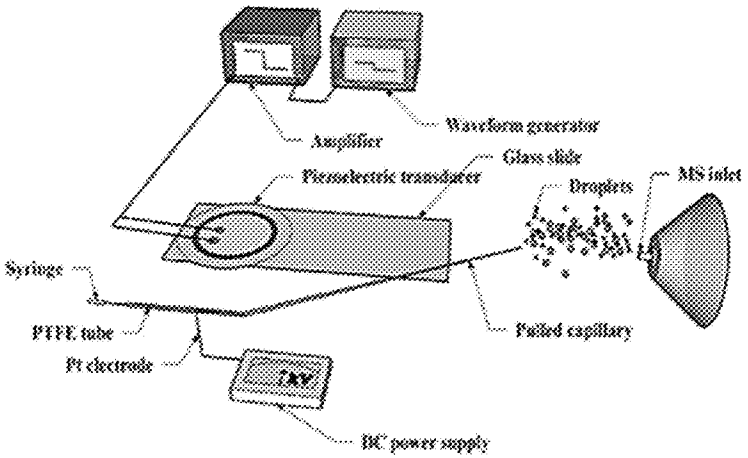
Figure 25C:
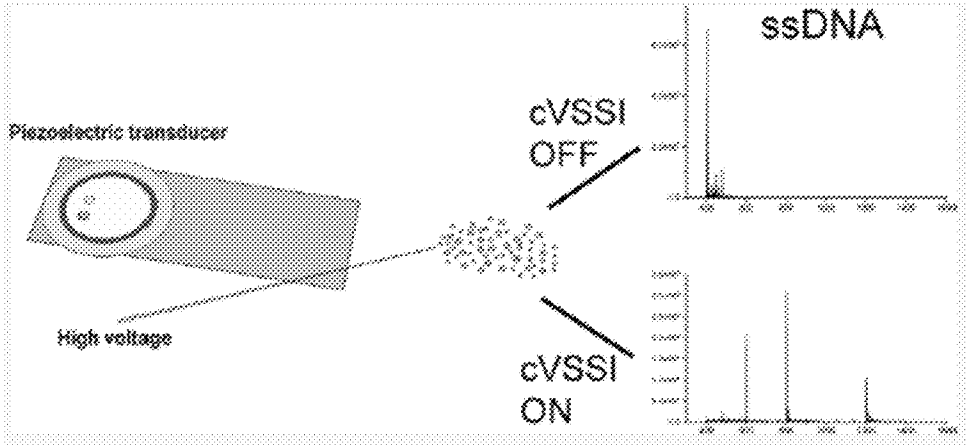
Figure 33:
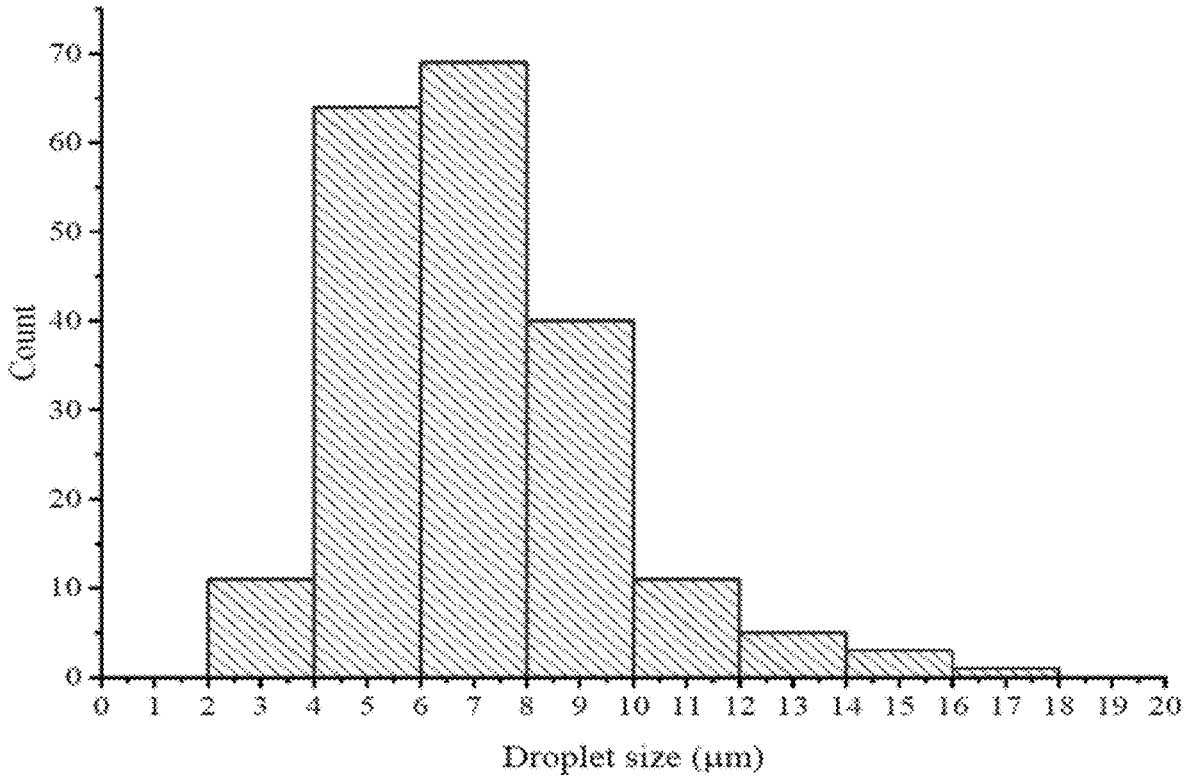
FIG. 33 shows representative droplet size distribution of the plume generated by cVSSI with a tip ID of 10 μm.

Fabrication of Pulled-Tip Capillary and cVSSI Device. Pulled-tip capillaries were prepared using a Laser-Based Micropipette Puller Sutter P-2000 (CA, U.S.A.). Program settings for the pulled fused silica capillary were HEAT 750, FIL 4, VEL 60, DEL 200, and PUL 175. Before being bonded to the No. 1 cover glass slide (24×60 mm, VWR), the pulled capillary was soaked in 30% hydrofluoric acid for ~2 min until the end I.D. of the pulled capillary is the desired I.D. (9-20 μm), and this process was monitored under the microscope. The fabrication procedures of each cVSSI device is similar to our previous report (Ranganathan, N., et al., J. Am. Soc. Mass Spectrom. 2019, 30, 824-831; Li, X., et al. Rapid Commun. Mass Spectrom. 2018, na DOI: 10.1002/rcm.8232). Briefly, a piezoelectric transducer is first attached to a glass cover slide by epoxy glue, and the pulled capillary is bonded to the same glass slide by glass glue. The cVSSI device was activated using a function generator (RIGOL DG4102) and a power amplifier (Krohn-Hite 7500). The working frequency of each cVSSI device was determined by scanning frequencies from 90 to 105 kHz under a constant voltage input of 10 $V_{pp}$. The operational voltage is then determined to be the minimum voltage input that produces a stable plume under the selected working frequency. The normal working frequencies and amplitudes are 93-97 kHz and 5-10 $V_{pp}$, respectively. A piece of 20 cm long PTFE tubing (#30 thin wall tubing, Cole-Parmer Instrument Company) was used to connect the sample syringe and the pulled capillary. A 5 cm long Pt wire (Diameter: 20 μm) was inserted into the PTFE tubing as an electrode, and the end of the Pt electrode was ~1 cm away from the end of the PTFE tube (FIGS. 25A-25C). During testing, the Pt electrode was connected with a DC power supply (HEOPS-10B2, Matsusada Precision Inc.) to provide bias voltage to the liquid samples (FIGS. 25A-25C). A Chemyx Syring pump (Model: Fusion 4000) was used to pump the sample solutions through the system lines, and the flow rate was set at 0.5-1 μL/min for the pulled capillary experiments and 10 μL/min for unmodified capillary experiments. Separate experiments reveal that the VSSI process can independently induce flow rates of 200 nL/min and thus the minimal flow rate that allows stable operation under current setup is ~200 nL/min. For flow rates higher than 200 nL/min, stable MS signals can be obtained (FIG. S1). Additionally, using oil capture experiments and microscopy characterization,[28] the droplet sizes for the cVSSI studies are estimated to be 3-9 μm in diameter (7.3±2.4 μm, FIG. 33).

Preparation of the DNA Duplex and G-Quadruplex. For all DNA samples, the stock solution concentrations were determined before an annealing process was employed using the Thermo Scientific Nanodrop 2000 Spectrophotometer. Stock solution of 100 μM ssDNA, d(CATATATG) was prepared in purified water and diluted to 10 μM in 100 mM $NH_4OAc$. The DNA duplex of self-complementary strand d-(ACGCGCGT) was prepared by diluting the stock solution to reach 20 μM ssDNA and annealing was performed in 100 mM $NH_4OAc$ at 94° C. in an oil bath for 2 min. This was cooled to room temperature overnight to obtain 10 μM DNA duplex solution. Stock solutions of 1 M TMAA and 1 mM KCl were used for G-quadruplex DNA solutions. The G-quadruplex DNA stock solution was diluted to reach 10 μM ssDNA and quadruplex structure was prepared by mixing 100 μM ssDNA, 100 mM TMAA, and 100 or 500 μM KCl in water, annealing at 85° C. for 5 min then followed by cooling to room temperature overnight. Final concentration of G-quadruplex DNA is 10 μM as each single strand folds to create the quadruplex structure.

Mass Spectrometry Analysis. A Q-Exactive Hybrid Quadruple Orbitrap mass spectrometer and a LTQ-XL mass spectrometer (Thermo Fisher, San Jose, Calif., U.S.A.) were used for mass spectrometry measurements. Both mass spectrom-eters are equipped with Ion Max Ionization Sources with HESI probe for ESI ionization. For Q-Exactive mass spectrometric analysis, the resolving power was set at 70000, and the inlet capillary temperature was maintained at 100° C. For experiments using the HESI source, voltage, and sheath gas flow rates were optimized for each analyte to achieve the highest ion intensities. Typical ranges for bias voltage and sheath gas rates were −3 to −4 kV and 15 to 30 absolute units (a.u.), respectively. For experiments using a cVSSI source plus voltage, the same instrument setting as HESI experime is was used, except that the applied voltage was ~−1.1 to −1.4 kV and no sheath gas was applied. For ESI analysis with the LTQ-XL mass spectrometer, the capillary voltage, tube lens voltage, and the mass inlet capillary temperature were set at −10.00 V, −100.00 V, and 275° C., respectively. Without special notice, the sample flow rates for both the Q-Exactive and LTQ-XL HESI were 10 μL/min, and sample flow rates for VSSI analysis were 1 μL/min. The S/N of features in as spectra was calculated based on the following equation:

$$S/N = \frac{I_{peak}}{\sigma_{STD\ of\ the\ noise}},$$

where $I_{peak}$ is the peak intensity of the analyte (above the average of the noise) and $\sigma_{STD\ of\ the\ noise}$ is the standard deviation of the noise. For each spectrum, the noise region was selected a few m/z before or after the analyte peak, and the noise region does not include any detectable ion peak.

Enhancing Ion Signal Levels in Negative Ion Mode with cVSSI. Because the cVSSI process allows the generation of a plume independent of the electrical properties of the solvent, it is speculated that this process should provide benefits to ESI experiments when the required voltage for ESI onset is high. We therefore first examined if applying cVSSI to a pulled-tip capillary with a negative bias voltage can enhance signal levels of DNA molecules in negative ion mode analyses. DNA mass spectrometry is primarily performed in negative ion mode because DNA contains a negatively charged phospho-diester backbone that facilitates negative ion formation by ESI (Potier, N., et al., Nucleic Acids Res. 1994, 22, 3895-3903; Tretyakova, N., et al., Chem. Rev. 2013, 113, 2395-2436; and Hua, Y., et al., J. Am. Soc. Mass Spectrom. 2001, 12, 80-87). This highly polar nature of DNA presents significant challenges with regard to native MS analysis, requiring significant bath gas usage to aid the desolvation process. Nano-ESI circumvents this requirement (Banerjee, S. and Mazumdar, S., Int. J. Anal. Chem. 2012, 2012, 1; and Banoub, J. H., et al., Chem. Rev. 2005, 105, 1869-1915); however, it provides unique challenges for stable and efficient ion production (Rahman, M. M., et al., Analyst 2013, 138, 6316-6322). For example, the larger influence of corona discharge has a significant effect on the overall stability of the process and thus affects the reproducibility of the measurement (McClory, P. J. and Hakansson, K. Anal. Chem. 2017, 89, 10188-10193). This is unfortunate especially in cases where only limited sample is available. To examine the potential role of cVSSI in DNA analysis, experiments were designed to compare ion production of a DNA duplex $d(ACGCGCGT)_2$ sample for conditions in which voltage biasing (~1.27 kV) of the emitter tip (ID: ~15 μm) was employed alone with that of the addition of cVSSI. The total ion chronogram is presented in FIG. 26A and shows the enhancement of total ion production as a function of time obtained with the Q-exactive mass spectrometer. Initially, when no cVSSI is employed at the emitter tip, the overall level of produced ions is low. Immediately after the application of VSSI over the time frame of ~1.15 to 2.45 min, this level rises dramatically. With the subsequent removal of VSSI (~2.5 min), the ion signal returns to its previous level. This result clearly shows the influence of cVSSI on signal levels of ESI in negative ion mode. It is instructive to consider the types of ions that are produced under both ion production operational modes. During the initial data collection period in which only −1.27 kV was applied to the sample emitter tip (cVSSI off), the mass spectrum (FIG. 26B) is dominated by low molecular weight ions with a data set feature at m/z ~494 comprising the base peak of the spectrum. Notably, none of the dominant data set features correspond to DNA ions. With the addition of cVSSI to the capillary device at time 1.15 min, the dominant peaks observed in the mass spectrum (FIG. 26C) were m/z ~801.14 and 1204.21, which corresponded to ssDNA $[M-3H]^{3-}$ ions and dsDNA $[M-4H]^{4-}$ ions, respectively. Here, the signal enhancement of the DNA ions is significant. With the application of VSSI, the signal level for DNA ions shifts from essentially 0 to $>10^6$. That is, although ions are produced with the application of emitter tip bias voltage, essentially no DNA ions are observed until cVSSI is utilized. Notably, the duplex nature of DNA can be preserved with this ionization process as evidenced by the abundant −3 to −5 charge state distribution for dsDNA.

Figure 26A:
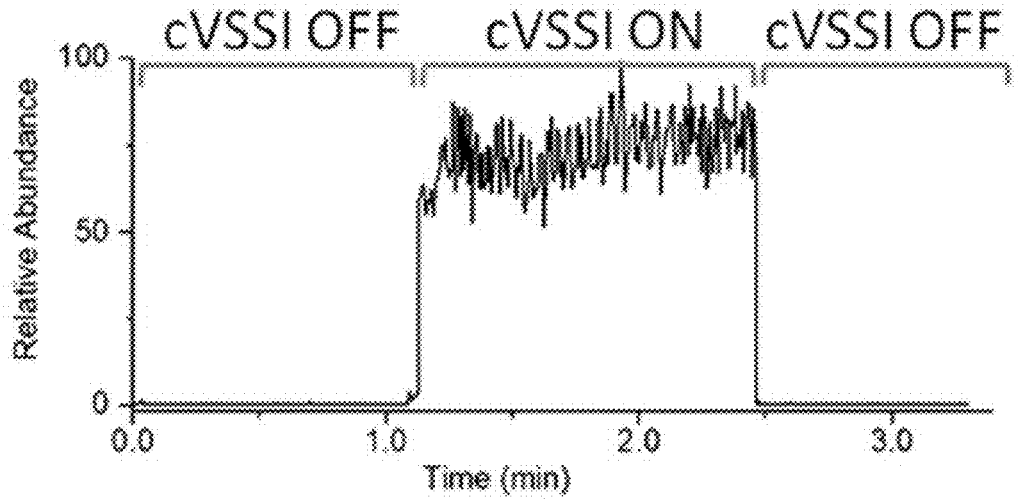
FIGS. 26A-26F show representative obtained using a disclosed process with a DNA duplex sample.
Figure 26B:
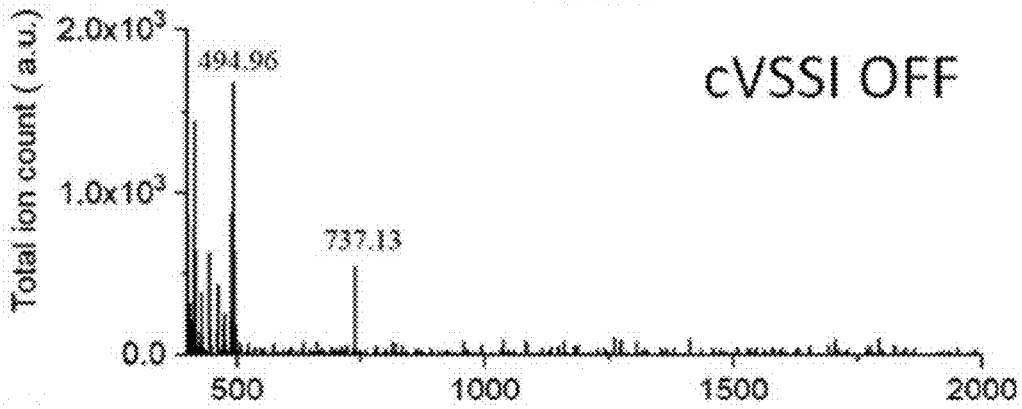
Figure 26C:
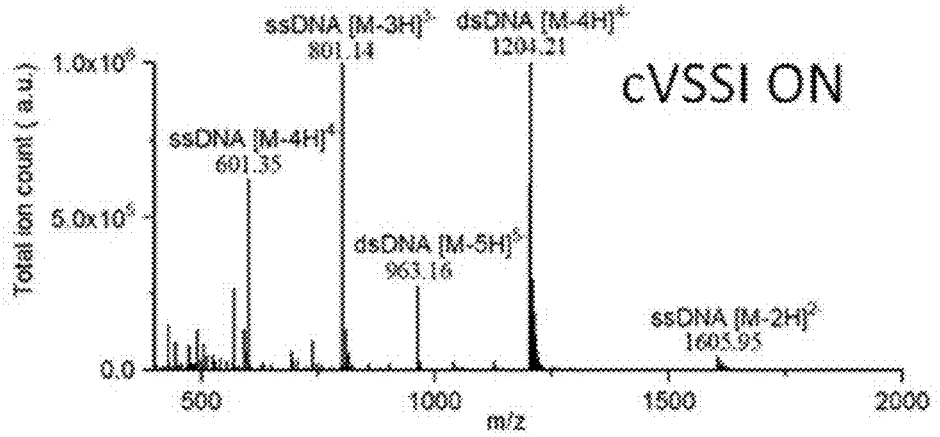
Figure 26D:
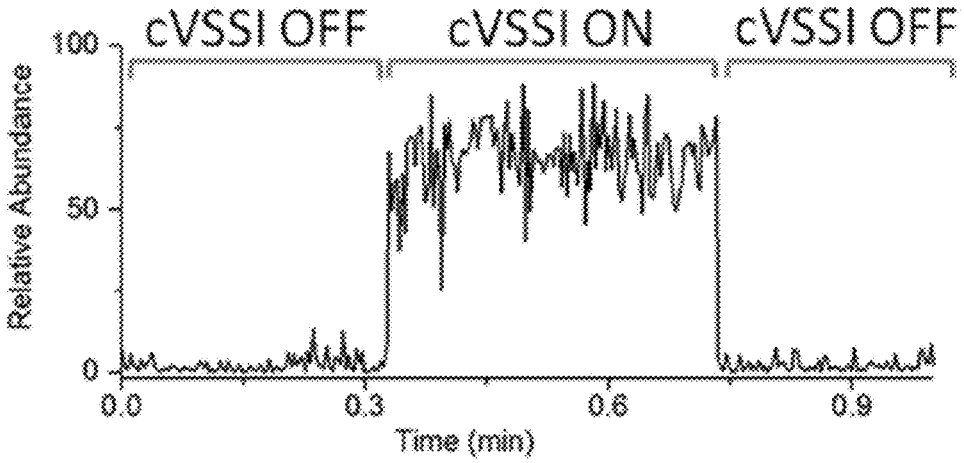
Figure 26E:
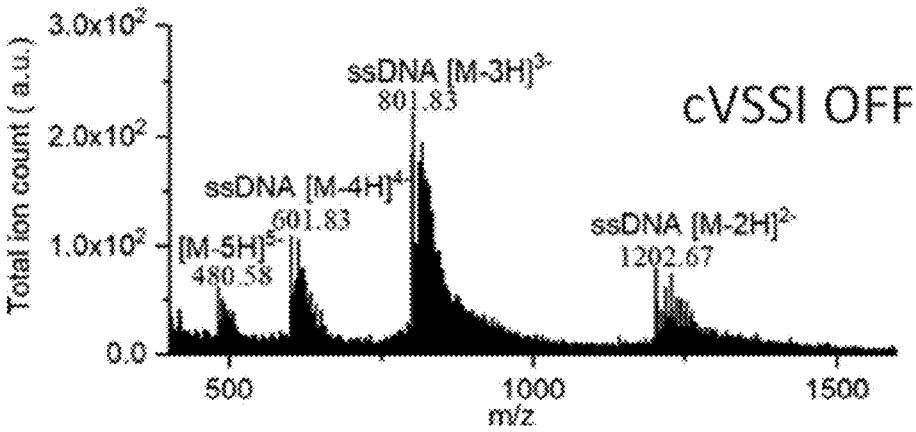
Figure 26F:
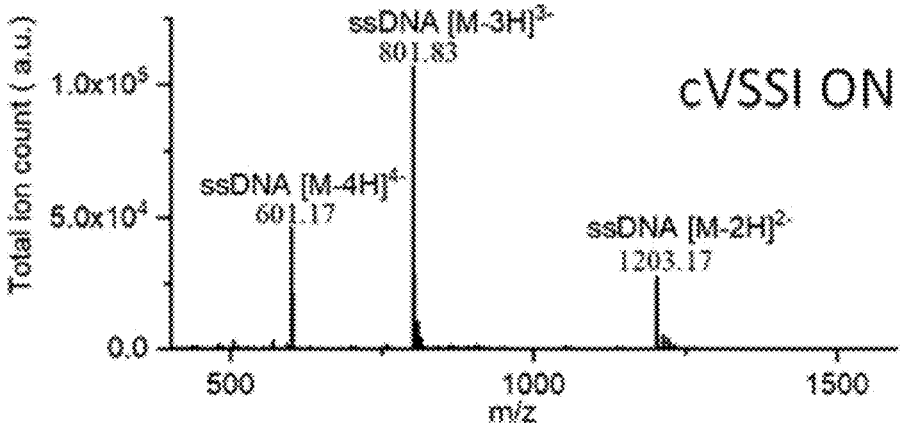

FIGS. 26A-26C shows that remarkable ion production can be achieved with the addition of cVSSI, even under conditions in which the applied field alone is not sufficient to yield biomolecular ion signals. A question arises as to whether or not such an advantage remains under more optimal electro-spray conditions for the employed emitter tip upon application of cVSSI. FIG. 26D shows data for ssDNA d(CATATATG) as a function of time, in which results for optimized electrospray ionization (−1.19 kV) alone are compared with those employing both cVSSI and emitter tip voltage application using a LTQ-XL mass spectrometer. From the ion chronogram shown in FIG. 26D, a clear enhancement in ion production is observed over the same time frame of 0.33 to 0.73 min, corresponding with the addition of VSSI to optimal conditions of the emitter tip voltage application. As before, it is instructive to compare the types of ions produced for the different experimental conditions. In the mass spectrum recorded without VSSI (FIG. 26E), a clear charge state distribution is evident, with a dominant data set feature at m/z ~801.83. This feature corresponds to ssDNA $[M-3H]^{3-}$ ions. Overall, the distribution is comprised of −2 to −5 ions. The spectrum shows that the DNA ions exist as a wide variety of ion adduct species (primarily Na and $NH_3$), leading to very broad features associated with each charge state. When cVSSI is applied to the device containing the voltage bias, for the most part, the same charge state distribution is produced;

notably, relatively fewer −5 ions are produced (FIG. 26F). The adduct peaks are suppressed and the spectrum is dominated by $[M-nH]^{n-}$ ions. It is important to note that neither the spray voltage nor the mass spectrometer acquisition parameters were changed with the application and removal of VSSI. Therefore, the enhancement/favoring of the deproto-nated ions is associated entirely with the vibration of the emitter tip.

Figure 27A:
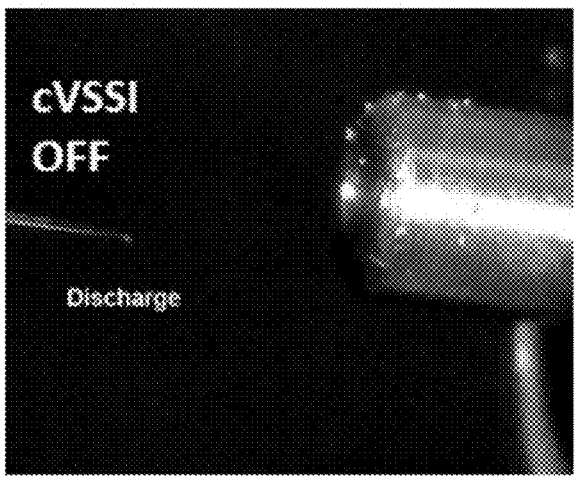
FIG. 27A-27B show representative images for corona discharge behavior without cVSSI and with cVSSI.
Figure 27B:
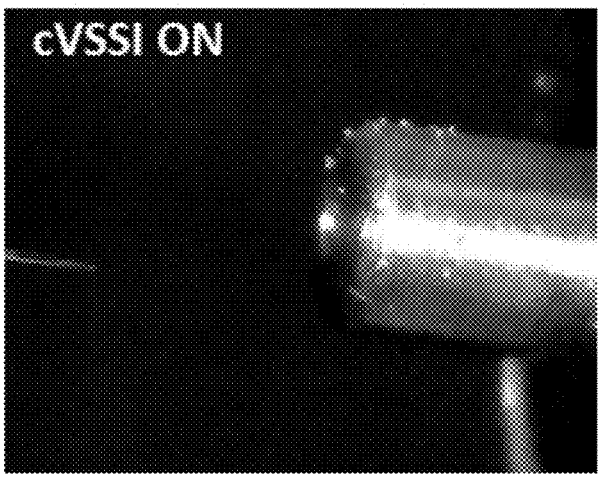
Figure 28:
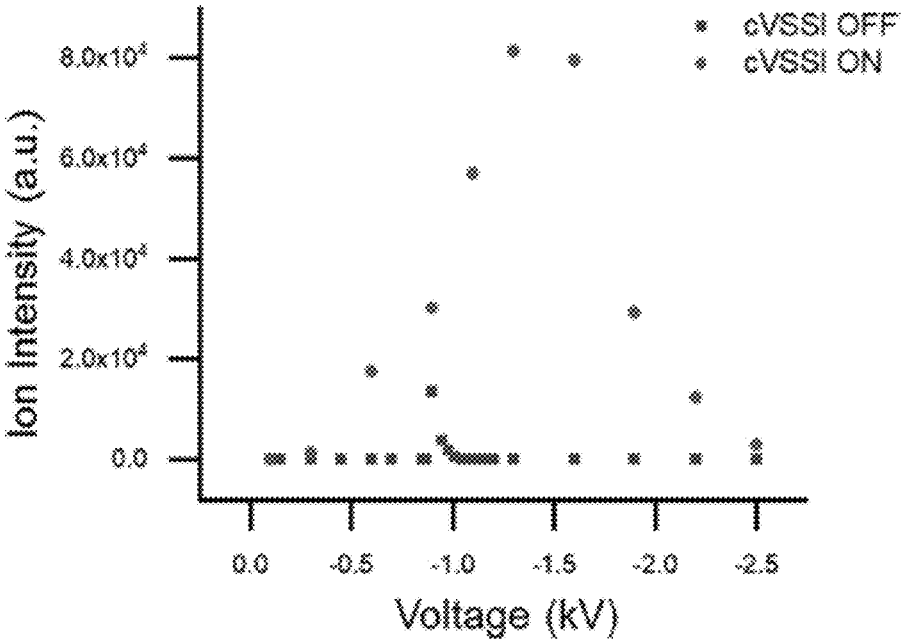
FIG. 28 shows representative date for the relationship between ion intensity and different bias voltages with cVSSI and without cVSSI. A total of 10 μM ssDNA d(CATATATG) in 100 mM NH4Ac aqueous solution was sprayed with and without cVSSI under different voltages. When the cVSSI is on, the working range of voltages is extended significantly.
Figure 34A:
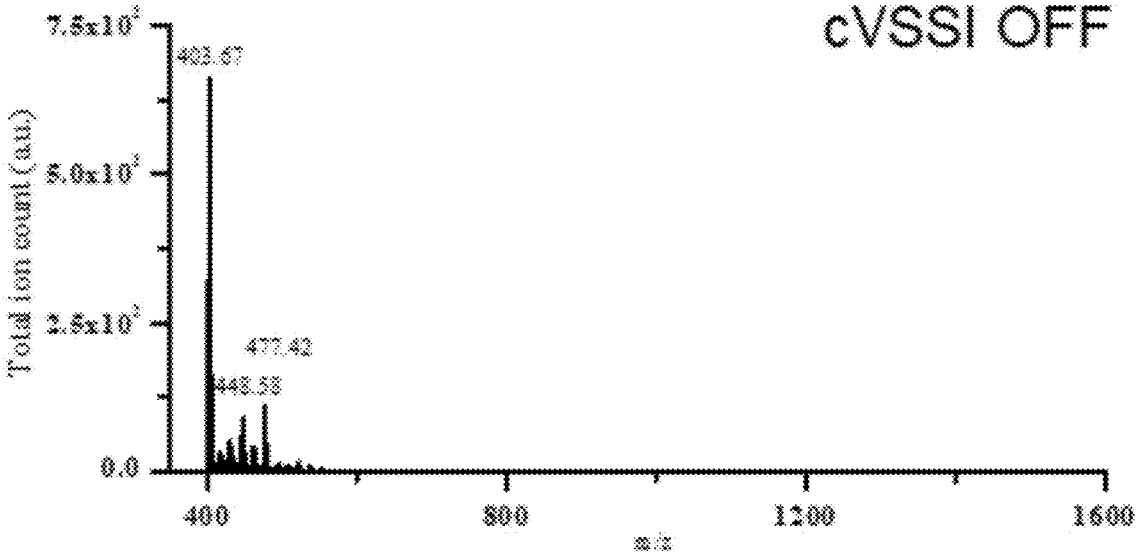
FIG. 34A-34B show representative full scan mass spectra obtained for 10 μM ssDNA d(CATATATG) in 100 mM NH4OAc with a capillary bias voltage of −1.27 kV with cVSSI on and off. Spectra were recorded in negative ion mode using the LTQ-XL mass spectrometer.
Figure 34B:
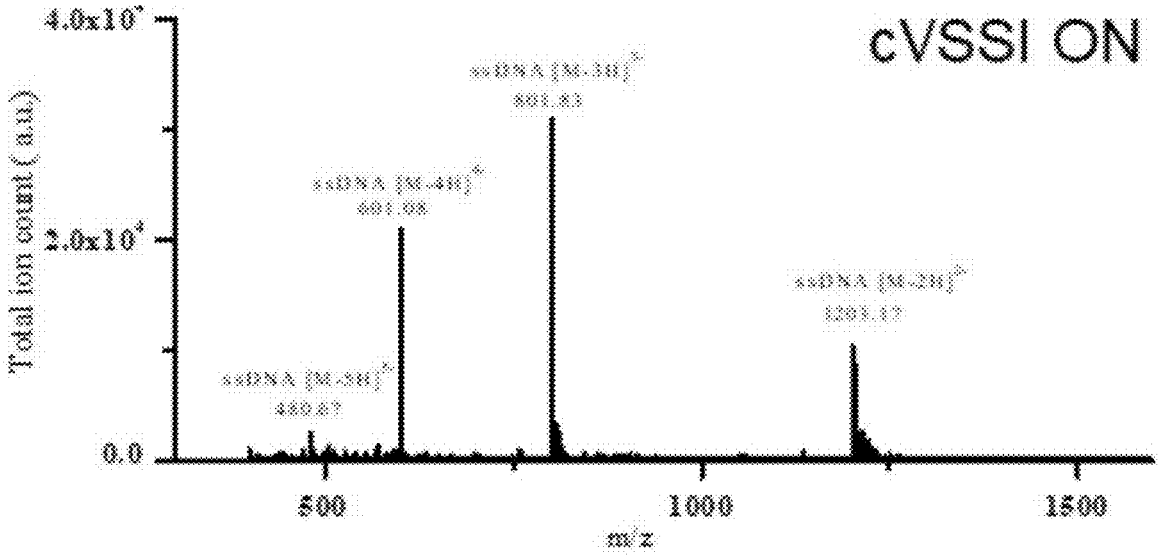
Figure 35:
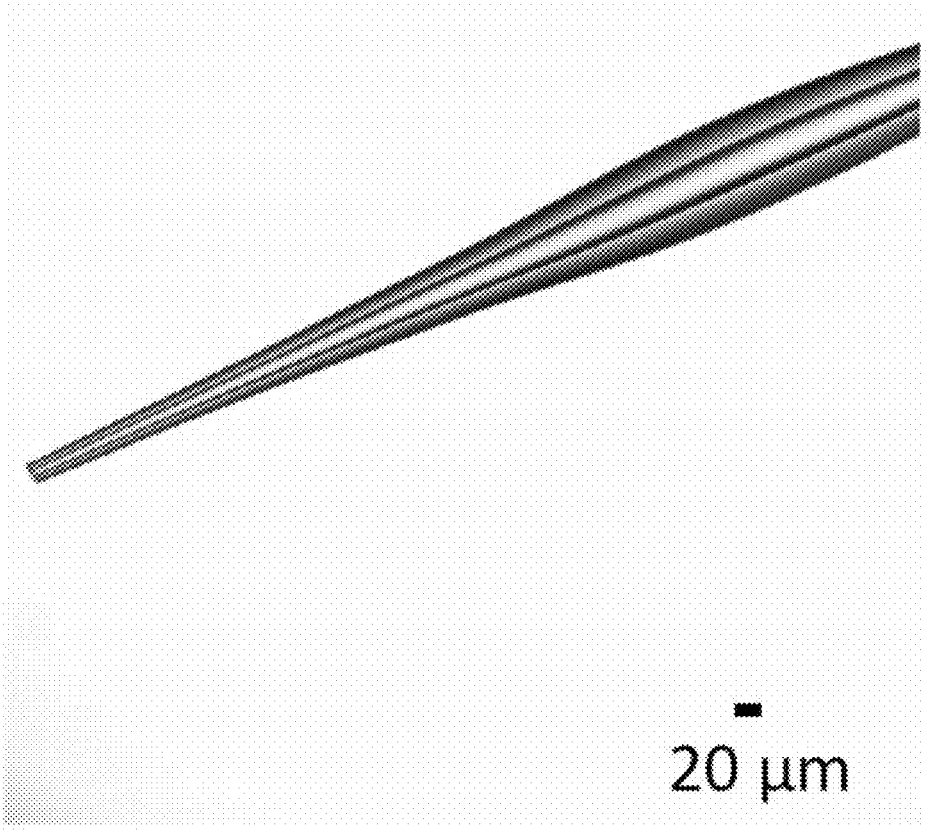
FIG. 35 shows a representative microscope image of a representative pulled capillary tip used in disclosed cVSSI plus voltage methods. The capillary is made using a P-2000 capillary puller (see text for details).
Figure 36A:
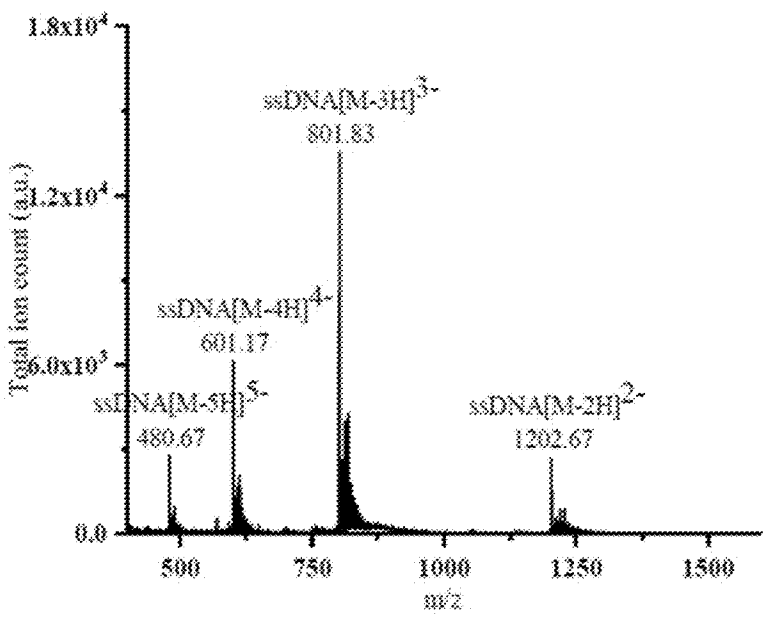
FIG. 36A-36B show representative mass spectra obtained for 10 μM ssDNA d(CATATATG) in 100 mM NH4OAc solution without and with cVSSI under their respective optimal voltages.
Figure 36B:
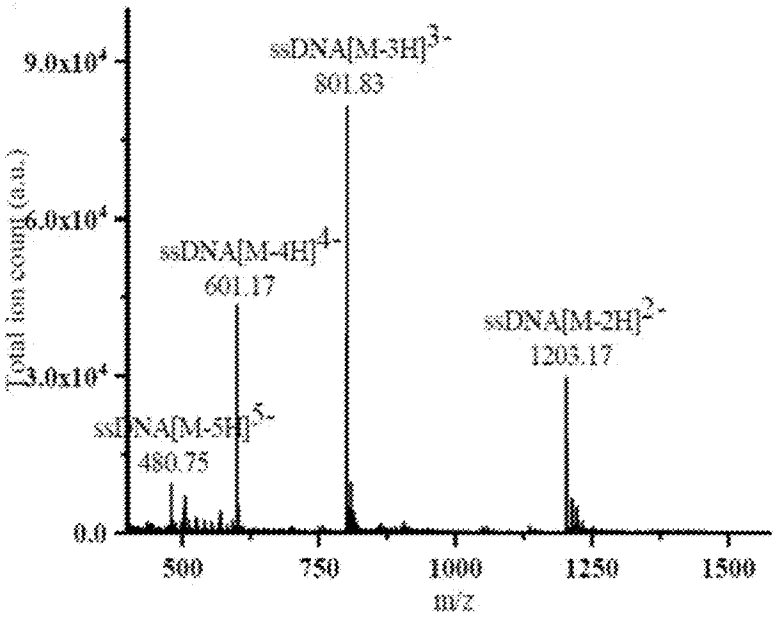

Corona Discharge Suppression by cVSSI. Part of the enhanced signal levels in negative ion ESI could be attributed to discharge suppression by cVSSI. To test this hypothesis, a digital microscope was employed to monitor the emitter tip (ID: ~18 μm) during ESI experiments. As shown in FIG. 27A, a blue glow (seen in original photograph, but obscured due to grayscale image shown herein) was seen at the emitter tip when a voltage of −1.27 kV was applied, which indicates the onset of corona discharge. When an AC signal (94.3 kHz, 10 Vpp) was applied to the piezoelectric transducer to initiate cVSSI, the blue glow disappeared, indicating that the discharge was suppressed at the onset of cVSSI. Notably, the onset and suppression of corona discharge also corresponds to the ion production of ssDNA (d(CATATATG)) species. When −1.27 kV was applied to the emitter tip, a low molecular weight ion m/z 403.67 is the major peak, and none of the major peaks in this spectrum corresponds to ssDNA ions (FIG. 34A-34B). With cVSSI, ssDNA peaks are clearly detected with a dominant peak at m/z 801.83 for $[M-3H]^{3-}$ ions, and the overall detected charge state distribution extends from −2 to −5 ions (FIGS. 34A-34B). The mechanism of discharge suppression could be explained by a reduced charge build up at the emitter tip during the cVSSI process. As demonstrated in our previous work, cVSSI can generate a liquid plume at the emitter tip independent of the applied voltage, which prevents the buildup of an excessive charge at the tip. In addition, because of the cVSSI operation, the emitter tip has a vibration amplitude of ~10 μm that can further disperse the charges. Collectively, these effects lead to a much lower level of charge accumulation directly at the tip when cVSSI is on, which results in the discharge suppression observed in FIGS. 27A-27B.

cVSSI Stabilizes the NanoESI in Negative Ion Mode. The above results demonstrate the role of cVSSI in suppressing corona discharge and enhancing ion signals in negative ion mode analyses of DNA in aqueous solutions. In many cases, cVSSI salvages the signal from corona discharge as no detectable DNA peaks are obtained by ESI alone. The emitter has a very narrow working voltage range from −0.85 to −1.01 kV. The performance degrades rapidly as the applied voltage deviates from the optimal value (−0.9 kV). Applying cVSSI allows a much wider range of working voltages from −0.3 to −2.5 kV with the best peak performance observed at −1.3 kV. There are two major advantages associated with the extended voltage range. First, a higher optimal voltage is achieved with cVSSI compared to direct electrospray alone, which results in ~6-fold improvement in ion intensity (FIG. S5). Second, a larger working voltage range implies better signal stability over time. The narrow working range of direct electrospray makes ion signals very sensitive to field fluctuations at the emitter tip which can occur in nanoESI experiments in which the tips degrade (Kirby, A. E., et al., Rapid Commun. Mass Spectrom. 2010, 24, 3425-3431; and Wetterhall, M., et al., Analyst 2003, 128, 728-733). During the experiments, we frequently observed signal disruption every several minutes, which requires readjusting the optimal voltage to restore the signal. When cVSSI is applied with the negative voltage, stable and continuous analyte signals are maintained for 1 h using a flow rate of 500 nL/min without any intervention until we stopped the experiment. Long-term stable signals are especially advantageous for kinetics studies and quantification experiments. In addition to pulled-tip capillaries, cVSSI can also be applied to unmodified fused silica capillaries with IDs ranging from 30 to 100 μm to salvage analyte signals in negative ion mode. In this regime, the ESI onset voltage (~−4 to −5 kV) for aqueous solution is much larger than the optimal spray voltage (~−2 to −3 kV). No analyte signals can be observed with voltage alone, so cVSSI is important.

Ion Production Enhancement from VSSI Compared with Commercial ESI Sources. The experiments described above demonstrate the benefits of applying cVSSI to the ESI emitter tip over using ESI alone in negative ion mode when spraying DNA from aqueous solutions. The performance of using cVSSI plus voltage was compared with commercial ESI sources equipped with nebulization gas. Nebulization gas is the most widely used and amenable instrumentation method to alleviate the discharge issue in negative ion mode. Due to the challenging working conditions of nano-ESI for negative ion production of molecules in aqueous solutions, as shown above, many native MS experiments are performed using commercial ESI sources equipped with nebulization gas capabilities (Khristenko, N., et al., J. Am. Soc. Mass Spectrom. 2019, 30, 1069-1081; Porrini, M., et al., ACS Cent. Sci. 2017, 3, 454-461; and Gabelica, V., et al., J. Am. Soc. Mass Spectrom. 2018, 29, 2189-2198).[3] It is instructive to compare the ionization efficiency of cVSSI plus voltage with that obtained from a well-engineered commercial ESI source. For the following comparisons, HESI sources on the Q-Exactive mass spectrometer and the LTQ-XL mass spectrometer were optimized and compared with the device that couples cVSSI with electrospray voltage. In brief, ion signal levels are again dramatically enhanced with the combined approach.

Figure 29E:
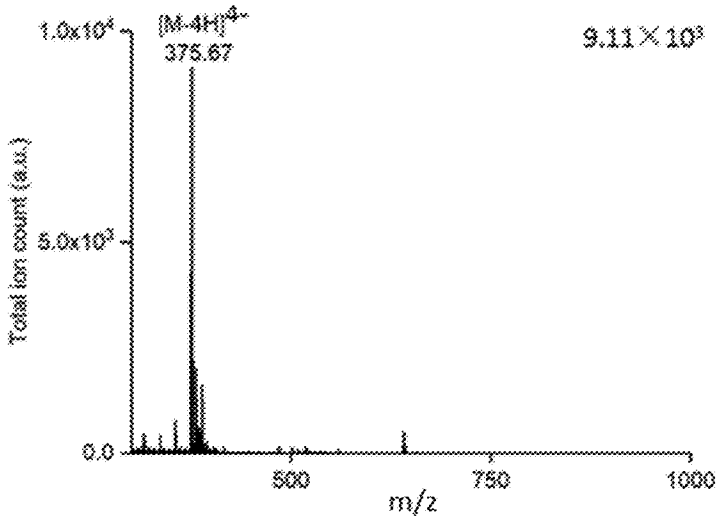
Figure 29F:
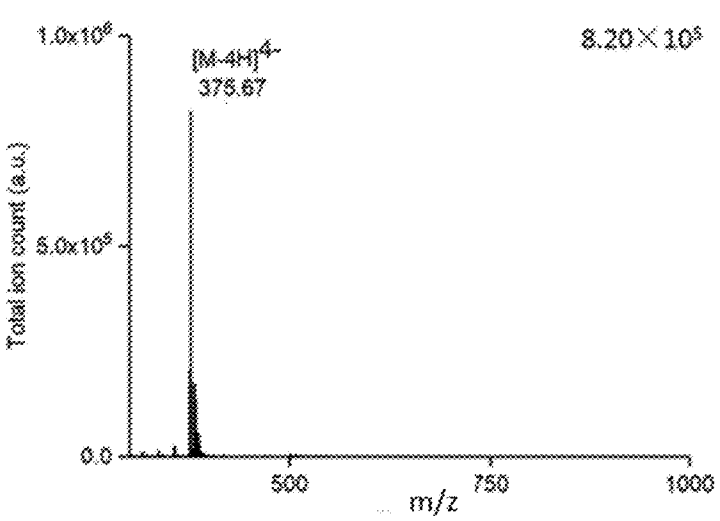
Figure 29G:
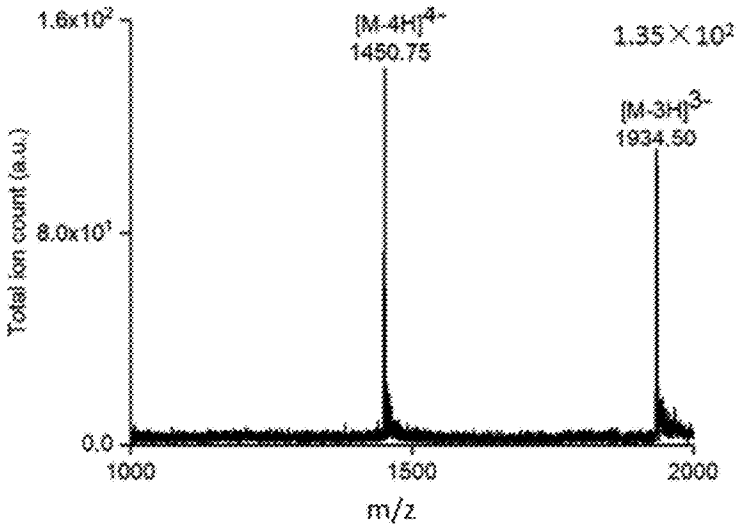
Figure 29H:
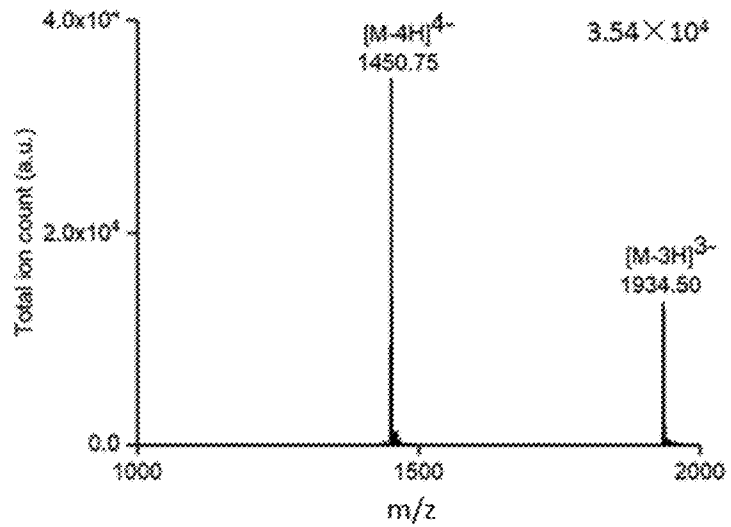
Figure 37B:
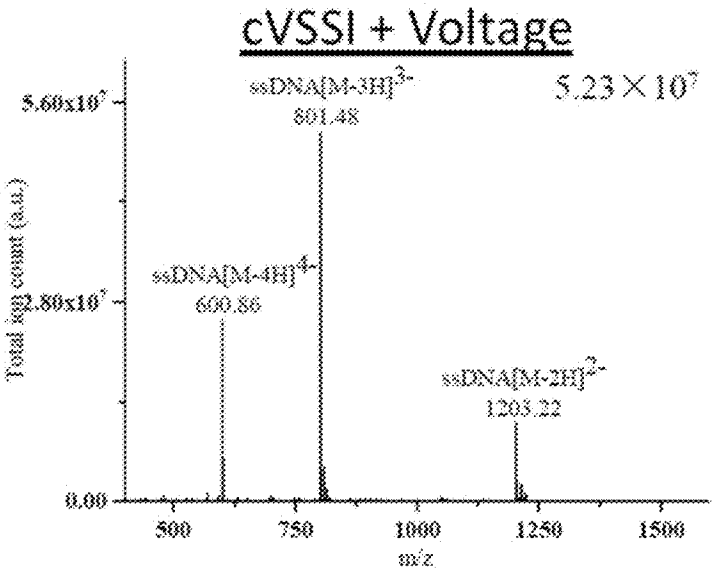
FIG. 37A-37F show representative data comparing ionization performance between convention ESI sources with nebulization gas and a disclosed cVSSI plus voltage system.
Figure 37A:
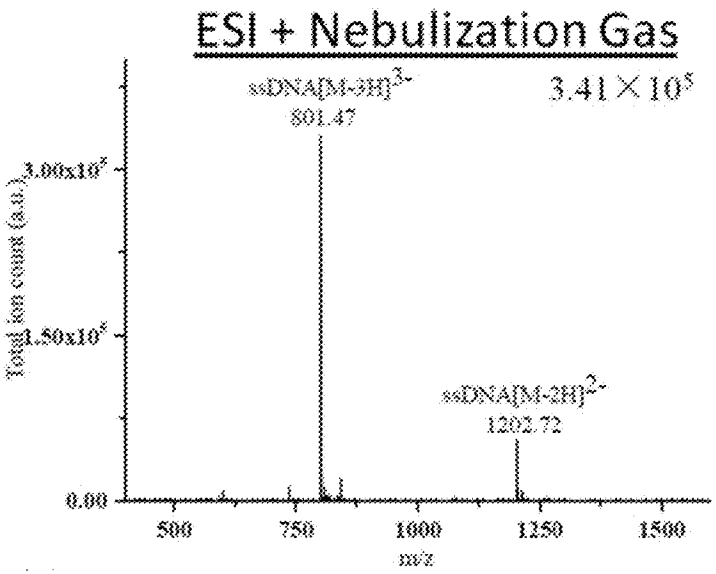
Figure 37D:
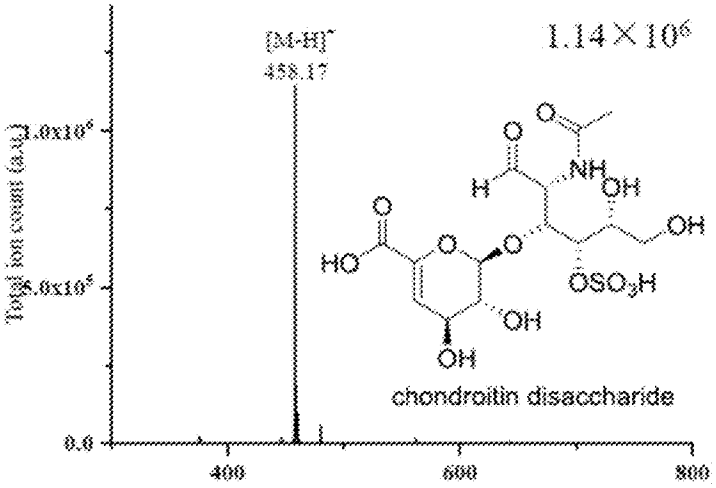
Figure 37C:
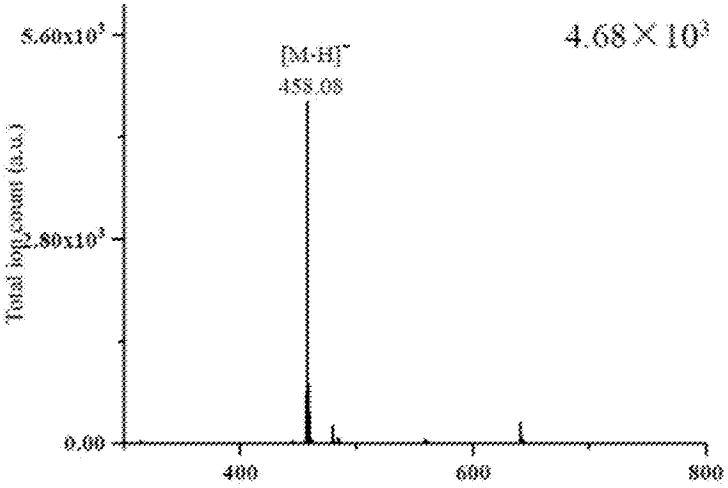

A series of solutions were tested, including nucleic acids, oligosaccharides, peptides, and proteins, in negative ion mode. FIGS. 29A-29H and FIGS. 30A-30D, as well as show the comparison between experiments conducted with the HESI and the VSSI plus bias voltage ion sources on the Q-Exactive mass spectrometer. Experiments show that ion production is significantly enhanced for 10 μM ssDNA d(CATATATG) with the VSSI device compared with the commercial source. For the commercial ion source, the base peak in the mass spectrum FIG. 37A) corresponds to $[M-3H]^{3-}$ ions. The $[M-2H]^{2-}$ ions comprise ~16% of the base peak in the mass spectrum. Usage of the VSSI based ion source also produces a base peak (FIG. 37B) corresponding to $[M-3H]^{3-}$ ions. The $[M-2H]^{2-}$ ions now comprise ~23% of the base peak. Additionally, $[M-4H]^{4-}$ ions are observed at ~55% of the base peak height. For the base peak, the overall improvement in ion signal level is ~150-fold. The improvement in S/N is ~110-fold. For experiments with dsDNA, similar enhancements in ion signal levels are observed. FIGS. 29A and 29B shows mass spectra obtained for dsDNA $d(ACGCGCGT)_2$. Experiments with the commercial ionization source show that the base peak (FIG. 29A) is comprised of $[M-4H]^{4-}$ dsDNA ions. Also observed is the $[M-3H]^{3-}$ ssDNA ion at ~60% relative intensity, compared with the base peak. In comparison, the VSSI based ion source also produces $[M-4H]^{4-}$ dsDNA ions in the greatest abundance (FIG. 29B). The $[M-3H]^{3-}$ and $[M-4H]^{4-}$ ssDNA ions are observed at respective intensities of 75% and 35%. For this DNA sample, improvements in base peak intensity level and S/N are ~35- and ~3-fold, respectively. Having demonstrated improved ionization for small oligonucleotides including double-stranded molecules, it is worthwhile to determine whether or not the ionization enhancement effect of cVSSI extends to much larger oligonucleotides. For these studies, 1 μM of a 56-mer DNA oligonucleotide in 100 mM $NH_4OAc$ solution was examined by ESI as well as the VSSI plus spray voltage. FIG. 29 shows the mass spectra collected using the commercial ionization source (FIG. 29C) as well as the prototype cVSSI source (FIG. 29D). ESI of the large oligonucleotide produces the −6 to −8 charge states. For the prototype ionization source, the same charge states are produced. A comparison of the relative intensities of the data set features shows that the order of charge state intensities is −7>−8>−6 and −7>−6>−8 for the commercial and prototype ionization sources, respectively. Additionally, significantly narrower (~3 fold for fwhm −7 ions) peaks are observed for the cVSSI source indicating a favoring of ions with fewer adducts. Remarkably, the overall improvement in ion signal level and S/N for the −7 ions is observed to be ~60- and ~10-fold, respectively.

In addition to the DNA samples, a similar level of improvement was observed for oligosaccharides, peptides, and proteins, when comparing the HESI and the cVSSI plus bias voltage ion sources on the LTQ-XL mass spectrometer. For oligosaccharides, 10 μM of chondroitin disaccharide Δdi-6S sodium (FIG. S6C,D) and fondaparinux sodium (FIGS. 30E and 30F) solutions were tested, respectively. Chondroitin disaccharide was detected at a m/z 458.08, which corresponds to the peak of $[M-H]^-$ ions; and fondaparinux was detected at a m/z 375.67, which corresponds to the peak of $[M-4H]^{4-}$ ions. As shown in FIG. S6C,D and FIG. 6E,F, the cVSSI plus voltage system shows ~240- and ~90-fold improvements in ion intensity and ~2- and ~3-fold improvements in S/N for the chondroitin disaccharide and fondaparinux samples, respectively.

Figure 37F:
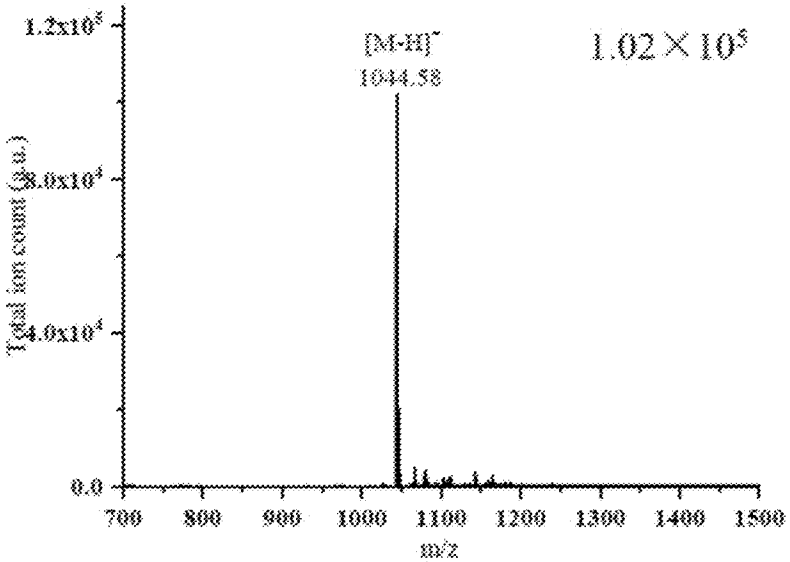
Figure 37E:
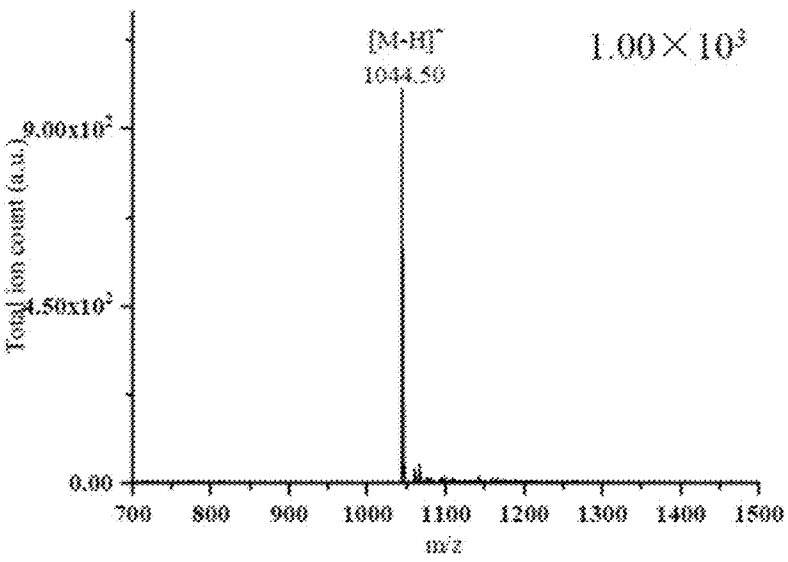

Angiotensin 2 (FIGS. 37E and 37F) and insulin (FIGS. 37G and 37H) in 100 mM $NH_4OAc$ were also tested to evaluate the performance of the cVSSI plus voltage ion source for peptide and protein ion generation from aqueous media. Although angiotensin and insulin are often analyzed in positive ion mode, they also show clear deprotonated peaks under negative ion mode settings so they can be used in this comparison. Significant improvements in both total ion counts (~100-fold) and S/N (~10-fold) were observed for VSSI coupled with voltage.

This example demonstrates that the cVSSI plus voltage source provides better ion intensity and S/N than the commercial HESI source does. Replacing the nebulization gas with cVSSI to suppress the discharge enables an ionization source setup that has a significant improvement in total ion intensity detected. Part of the enhancement could come from the use of a pulled fused silica capillary tip instead of the stainless-steel capillary used in the HESI system. Replacing the nebulization gas with cVSSI to suppress the discharge could also contribute to the enhancement. This contrast between the nebulization and cVSSI process is rendered more striking by the fact that the flow rates (and thus sample consumption) in HESI experiments are 5-10-fold higher.

The improvements in ion signal level and S/N have clear implications with regard to different analyses. For example, S/N improvements would impact the ability to distinguish precursor ions in complex mixtures such as those encountered in "omics analyses". That is, S/N improvements allow the detection of lower-signal species in the presence of higher-signal ions (Counterman, A. E., et al., J. Am. Soc. Mass Spectrom. 2001, 12, 1020-1035; Faktor, J., et al., Proteomics 2017, 17, 1600323; Bantscheff, M., et al., Anal. Bioanal. Chem. 2007, 389, 1017-1031; and Yates, J. R., et al., Annu. Rev. Biomed. Eng. 2009, 11, 49-79). In the case of ion signal level enhancements, a clear advantage is provided to tandem MS and multistage tandem MS ($(MS^n)$); see McLuckey, S. A., et al., J. Am. Soc. Mass Spectrom. 1992, 3, 60-70; McLuckey, S. A. and Habibi-Goudarzi, S., J. Am. Soc. Mass Spectrom. 1994, 5, 740-747; Hengel, S. M. and Goodlett, D. R., Int. J. Mass Spectrom. 2012, 312, 114-121; Heller, M., et al., Mol. Cell. Proteomics 2007, 6, 1059-1072; and Kang, H., et al., J. Am. Soc. Mass Spectrom. 2007, 18, 1332-1343). Here, the ability to dependent on ion numbers in the precursor ion selection step. This is especially true for species that may not undergo facile fragmentation or when attempting to observe a low-frequency ion fragment. Finally, enhancements in S/N levels of ions from aqueous media enable the coupling of separation techniques that rely on such media. Thus, the enhancements in ion signal level and S/N realized here with cVSSI provide immediate advantages fora number of fields employing MS analysis.

Potential Applications in Native MS Analysis. An increasing area of interest in biological mass spectrometry is the characterization of biomolecular structure (Cheatham, T. E., et al., Curr. Protoc Nucleic Acid Chem. 2001, 5, na; Baker, E. S., et al., J. Am. Soc. Mass Spectrom. 2005, 16, 989-997; Zucker, S. M., et al., J. Am. Soc. Mass Spectrom. 2011, 22, 1477-148; Kondalaji, S. G., et al., J. Am. Soc. Mass Spectrom. 2018, 29, 1665-1677; Zhang, W., et al., Nat. Commun. 2019, 10, 79; and Zhang, W., et al., Anal. Chem. 2019, 91, 6986-6990). To evaluate the potential of cVSSI plus voltage for structure characterization, experiments have been conducted for molecules for which it has been proposed that native MS allows the preservation of solution structure in the gas phase (Wyttenbach, T. and Bowers, M. T. J. Phys. Chem. B 2011, 115, 12266-12275). The first study involves the examination of the globular protein ubiquitin which was examined in both positive and negative ion mode. The second study involves the examination of the formation of a G-quadruplex DNA structure in solution. Each is described in greater detail below.

Figure 30A:
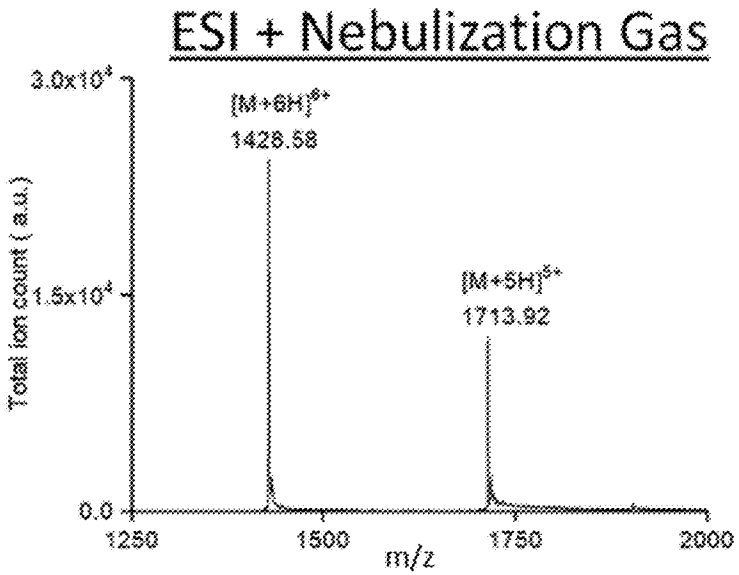
FIGS. 30A-30D show representative data comparing ionization performance between a commercial ESI sources with nebulization gas and a disclosed cVSSI plus voltage system for 10 μM ubiquitin in 100 mM $NH_4OAc$ between a commercial ESI source and a cVSSI plus voltage source. Full scan mass spectra of ubiquitin in both positive and negative ion mode. Mass spectra data set features are labeled.
Figure 30B:
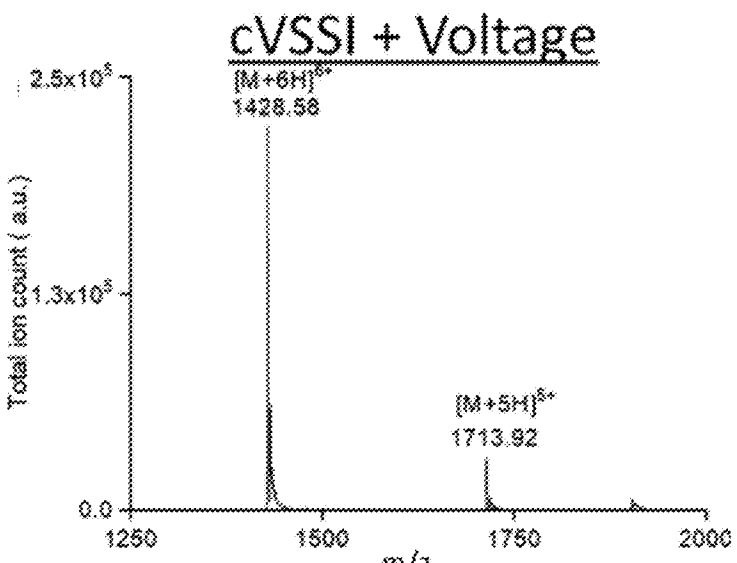
Figure 30C:
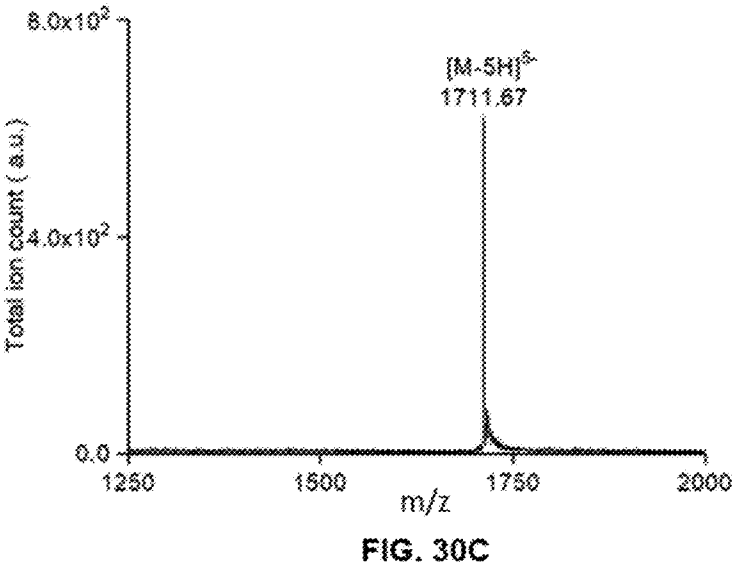
Figure 30D:
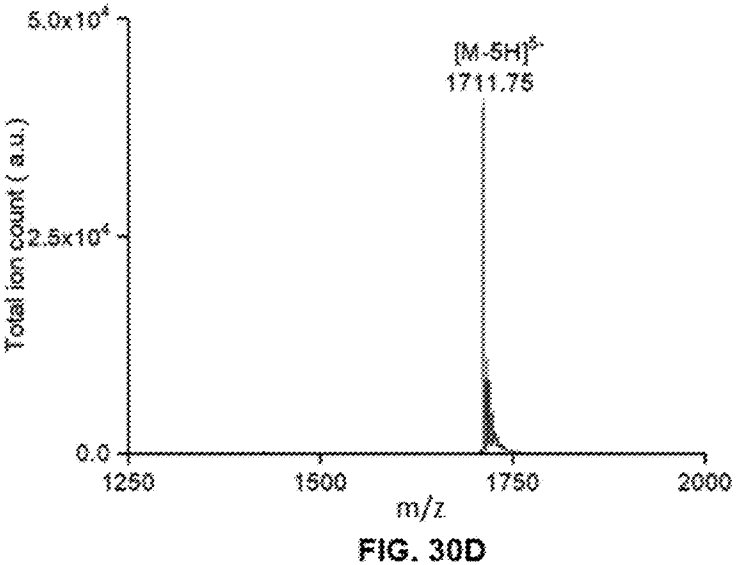
Figure 38A:
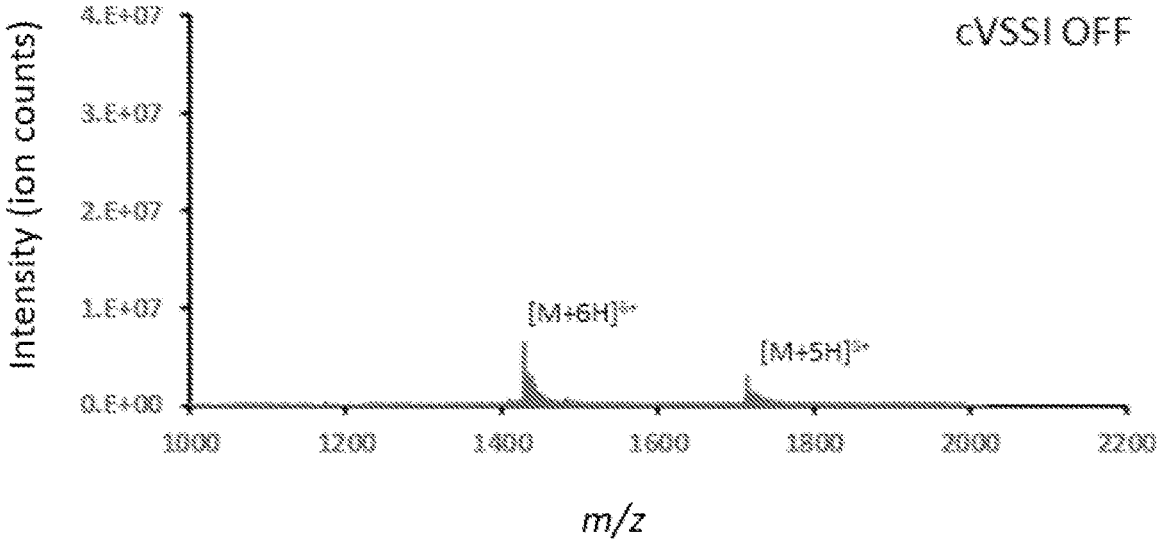
FIG. 38A-38B show representative charge state distribution data and ion intensity obtained with cVSSI off or on for 10 μM ubiquitin in 100 mM $NH_4OAc$ in positive ion mode.
Figure 38B:
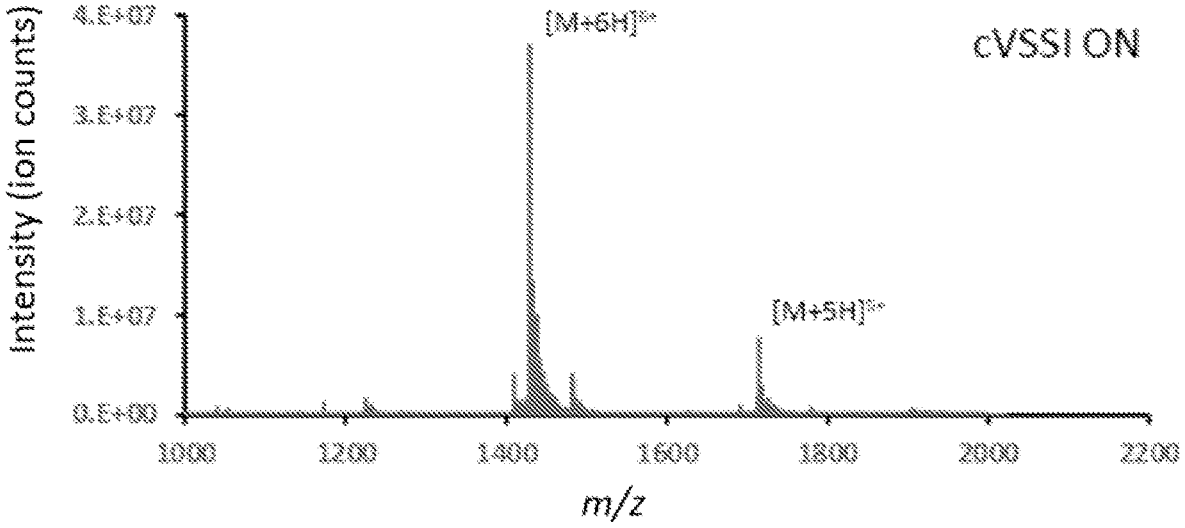
Figure 39A:
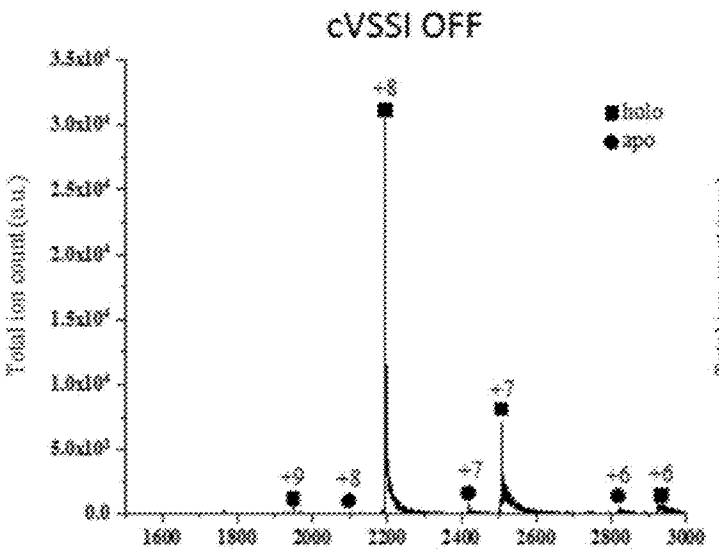
FIG. 39A-39D show representative mass spectra data of 10 μM myoglobin in 100 mM $NH_4OAc$ with cVSSI ON and OFF under positive ion mode and negative ion mode. Holo forms of myoglobin are preserved in both cVSSI ON and OFF conditions.
Figure 39B:
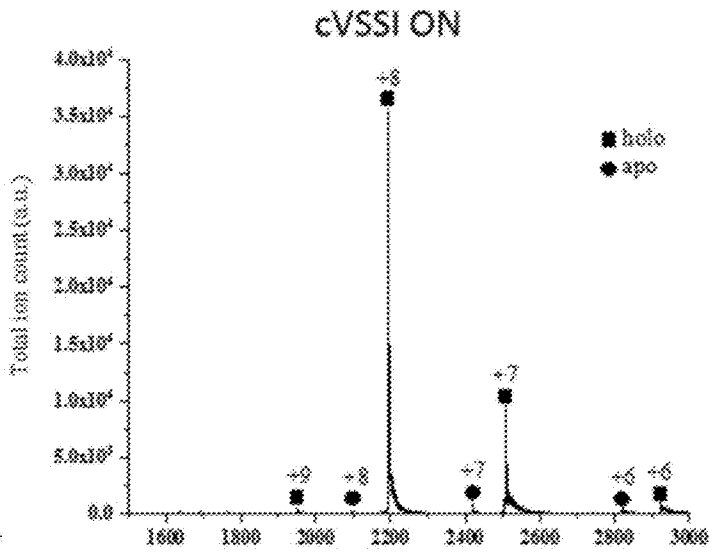
Figure 39C:
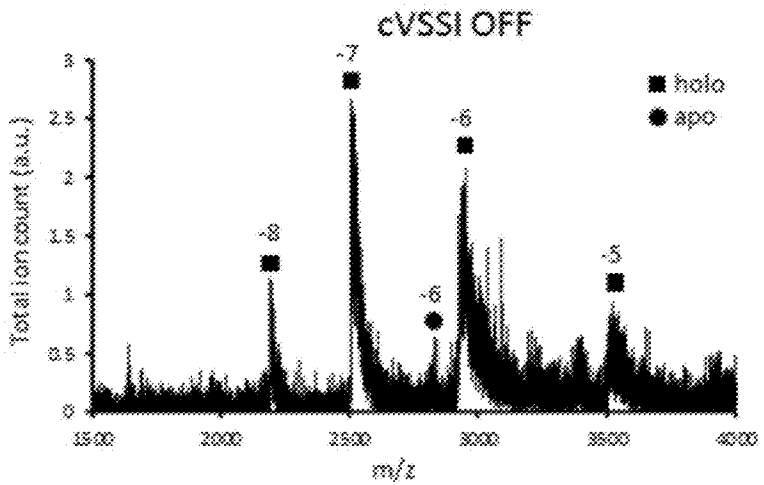
Figure 39D:
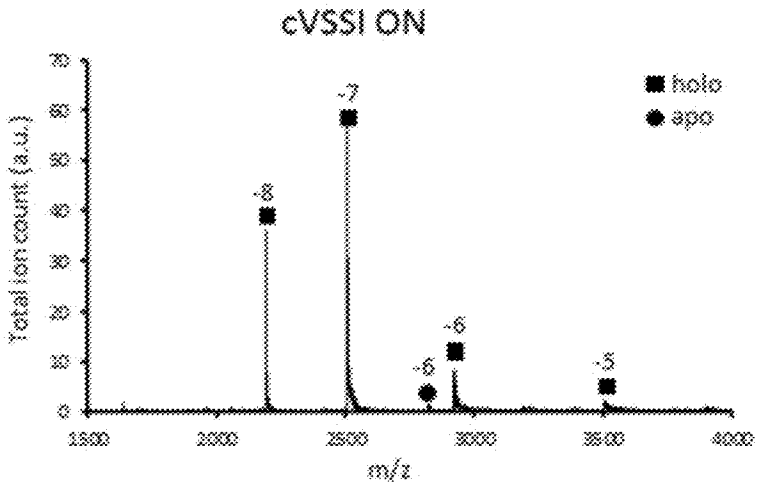
Figure 40B:
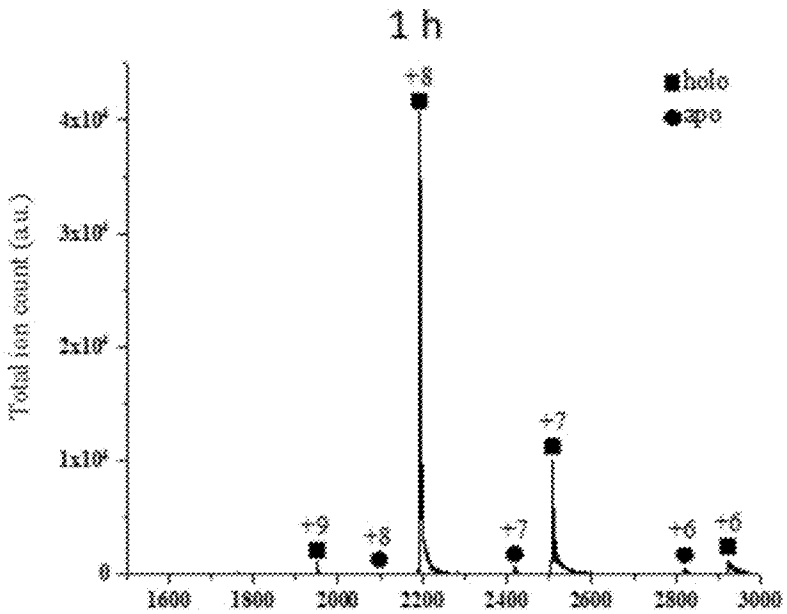
Figure 40A:
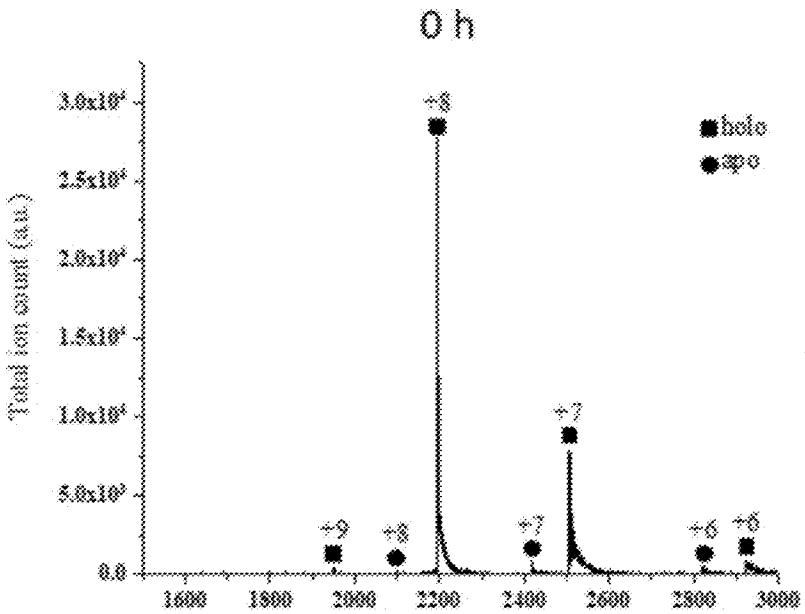

Positive and negative ion mode experiments have been conducted for a solution of the globular protein ubiquitin. Ubiquitin is a well-studied protein for native MS analysis, and the relationship between charge state distribution and solution structures has been reported before (El-Baba, T. J., et al., J. Am. Chem. Soc. 2017, 139, 6306-6309). Therefore, it is a good indicator for whether or not the cVSSI process disrupts the native structure of biomolecules. For these experiments, we also tested positive ion mode conditions in addition to those for negative ion mode analysis as most of the existing studies for ubiquitin are performed in positive ion mode. Ion production using a commercial ESI source was compared to that using a cVSSI source plus voltage. In positive ion mode, ESI produces two charge states comprised of $[M+6H]^{6+}$ (m/z 1428.58) and $[M+5H]^{5+}$ (m/z 1713.92) ions (FIG. 30A) for 10 μM ubiquitin in 100 mM $NH_4AC$ solution. Here the +5 charge state intensity is nearly half that of the base peak, +6 charge state. When the cVSSI plus voltage is used (FIG. 30B), the base peak ion signal and S/N levels increased by values of ~10- and ~35-fold, respectively. The same two charge states dominate the mass spectrum. A difference is that the +5 charge state comprises a slightly lower level (~10% of the base peak) of the total ion population. The notable similarity in the two mass spectra shown in FIG. 6 is that the charge state distribution is "pinched off" at the +6 charge state. Previous experiments have shown that, for native MS, such a phenomenon is indicative of the preservation of solution structure into the gas phase (Wyttenbach, T. and Bowers, M. T. J. Phys. Chem. B 2011, 115, 12266-12275). Notably, a direct comparison to ESI with the same pulled-tip capillary (10 μm) also shows ~5-fold improvement for the usage of cVSSI plus voltage, as demonstrated in FIGS. 38A and 38B. The observation of similar charge state production also holds in the comparison conducted for negative ion mode analysis of ubiquitin as shown in FIGS. 30C and 30D. Here a notable difference is that the "pinch off" occurs at an even lower charge state (−5) for both the ESI and cVSSI plus voltage experiments. Consistent with the DNA analysis described above, for negative ion mode experiments of ubiquitin, ion signal level and S/N enhancements are also dramatic (~60- and ~15-fold, respectively). Here we note that further evidence for the preservation of the solution structure is provided in FIG. 39A-D, where the preservation of holo-myoglobin is observed with the usage of cVSSI in both negative ion mode and positive ion mode. In addition, we also tested long-term operation of cVSSI and its impact on protein structures using myoglobin in 100 mM $NH_4OAc$. Results show that with cVSSI on, the spray was continuous and stable for 1 h with a flow rate of 1 μL/min. Comparing the mass spectrum at 0 and 1 h shows no difference in the ratio between the holo and the apo (barely present) forms of myoglobin (FIGS. 40A and 40B).

Figure 31A:
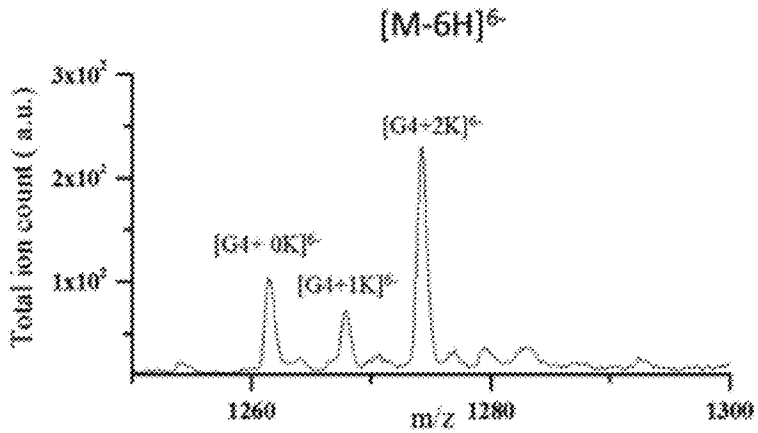
Figure 31B:
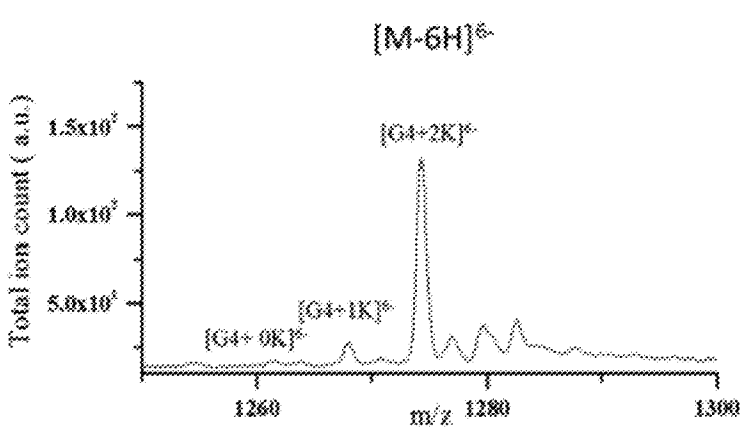
FIG. 31B show data obtained for the $[M-6H]^{6-}$ charge state in 500 μM KCl solution.
Figure 31C:
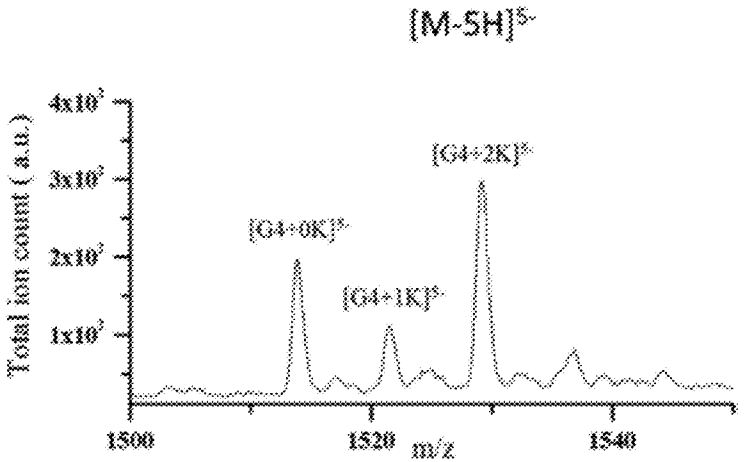
FIG. 31C show data obtained for the $[M-5H]^{5-}$ charge state in 100 μM KCl solution.
Figure 31D:
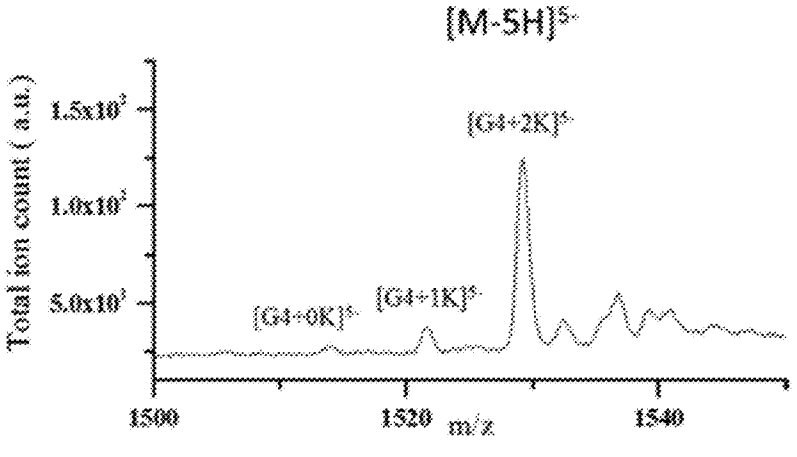
Figure 32A:
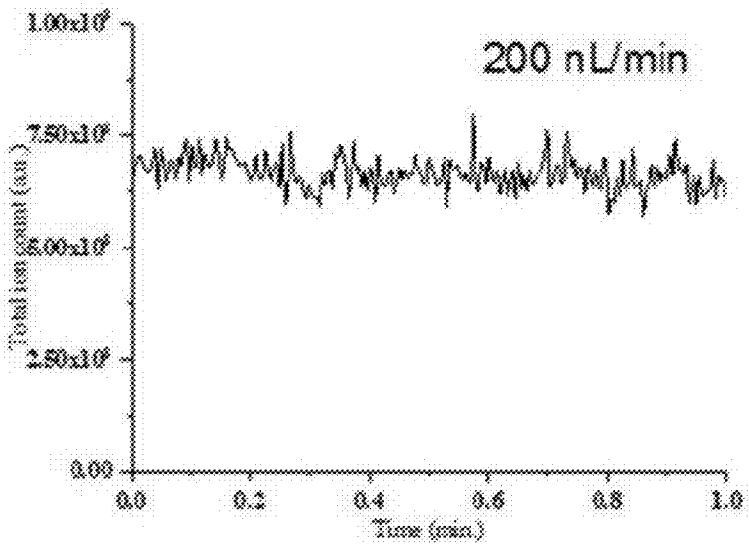
FIGS. 32A-32F show representative total ion count data obtained by a disclosed cVSSI method and voltage under different flow rates. 10 μM chondroitin disaccharide with 0.1% acetic acid in H2O was sprayed with cVSSI under a voltage of −1.3 kV.
Figure 32B:
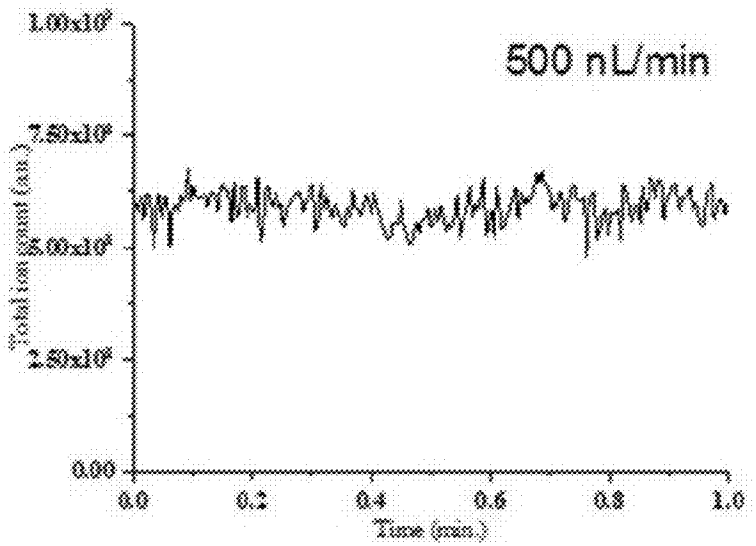
Figure 32C:
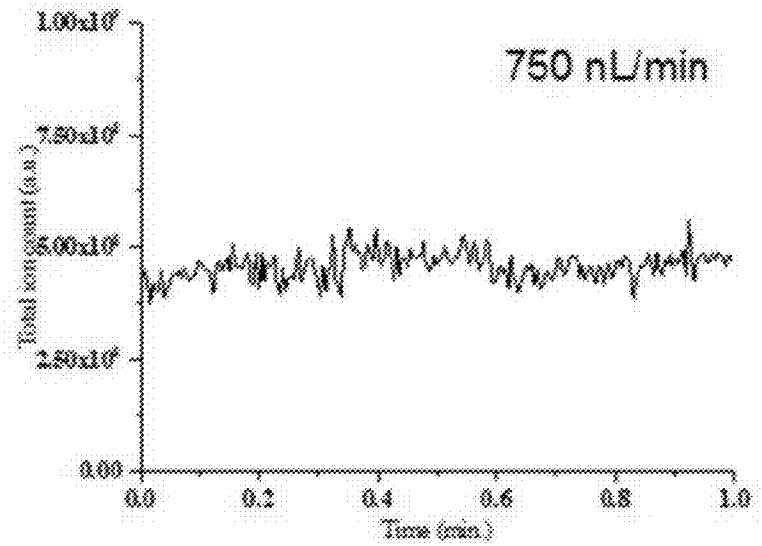
Figure 32D:
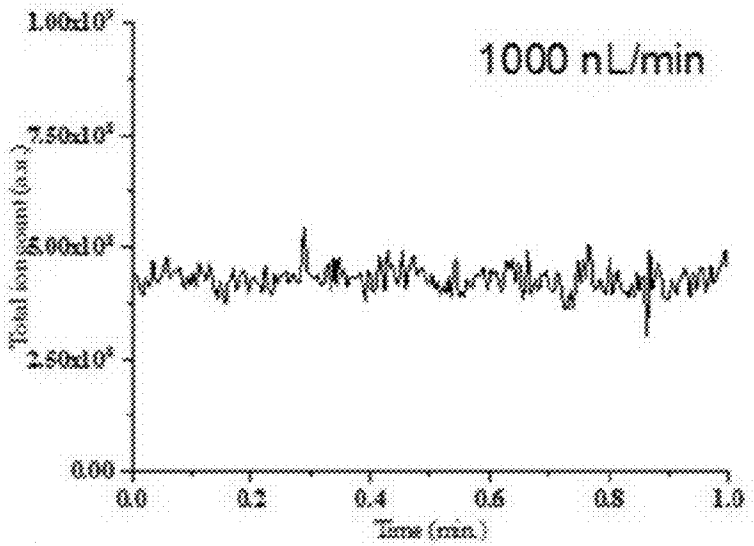
Figure 32F:
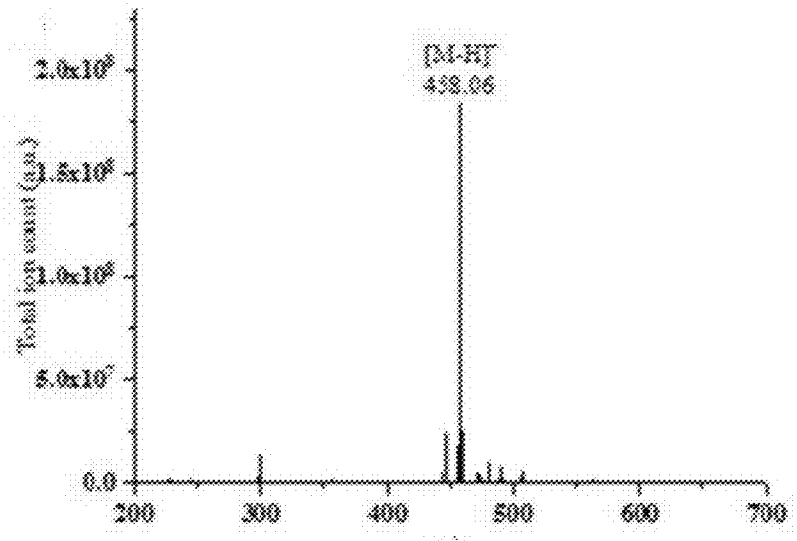
Figure 32E:
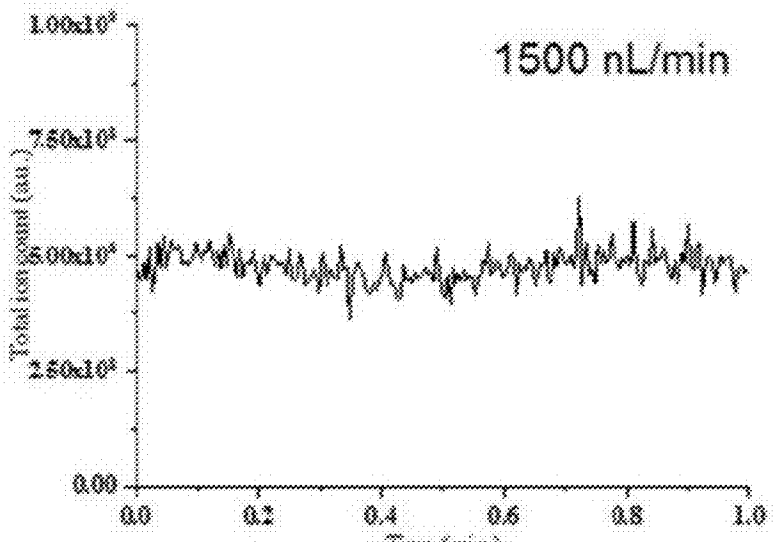

Nucleic acids are another important class of biomolecules that can assume 3D structures in solution. While nucleic acids can be studied in both positive and negative ion mode, studies suggest that ions produced in negative ion mode better reflect their solution structure (Rosu, F., et al., Int. J. Mass Spectrom. 2006, 253, 156-171). Therefore, native DNA/RNA mass spectrometry experiments are usually performed in negative ion mode. Some biomolecular structures require solutions of significant ionic strength in order to form. An example is the G-quadruplex DNA, which can form in solutions containing potassium due to charge-dipole stabilization of the G-quartets. To demonstrate that the new VSSI source can preserve the G-quadruplex structure similar to ESI (Marchand, A. and Gabelica, V. J. Am. Soc. Mass Spectrom. 2014, 25, 1146-1154), experiments were conducted with the human telomeric G-quadruplex DNA (TTGGGTTAGGGTTAGGGTTAGGGA) sequence (G4). As above, experiments were conducted using the cVSSI plus voltage device. Samples containing two different concentrations (100 and 500 μM) of KCl were examined by MS. FIGS. 31A-31D show expanded regions of the MS spectra highlighting the −6 and −5 charge states of the DNA ions. For discussion purposes, oligonucleotide peaks are described (and labeled in FIGS. 31A-31D) as the form [G4+nK]m where n and m correspond to the number of associated $K^+$ ions and net charge, respectively. For solutions containing 100 μM KCl, for the $[M-6H]^{6-}$ ions (FIG. 31A), data set features corresponding to $[G4+0K]^{6-}$, $[G4+1K]^{6-}$, and $[G4+2K]^{6-}$ appeared at m/z ~1261.50, 1268.00, and 1274.25, respectively. Similarly, for $[M-5H]^{5-}$ ions (FIG. 31C), $[G4+0K]^{5}$, $[G4+1K]^{5-}$, and $[G4+2K]^{5-}$ peaks were observed at m/z ~1514.00, 1521.67, and 1529.25, respectively. Notably, the relative intensity levels of the respective ions produced by the new VSSI ion source are very similar to those produced by ESI experiments previously (Marchand, A. and Gabelica, V. J. Am. Soc. Mass Spectrom. 2014, 25, 1146-1154). Additionally, when the KCl concentration is increased to 500 μM, the dominant species observed for both charge states are the $[G4+2K]^{m-}$ ions (FIGS. 31B and 31D). This is also consistent with the prior ESI experiments.[62] This limiting effect is consistent with the G4- quadruplex structure containing 3 G-quartets stabilized by 2 $K^+$ ions. Taken together, this data suggests that the new ionization source employing cVSSI plus voltage can preserve the G-quadruplex structure to a similar degree as ESI. Notably, the present system achieved similar results to the previous study (Marchand, A. and Gabelica, V. J. Am. Soc. Mass Spectrom. 2014, 25, 1146-1154) with 3-6-fold lower flow rates, which can be a much desired characteristic for studying biomolecules.

Further Discusssion. Combining the disclosed cVSSI processes with a voltage can effectively suppress the discharge in conventional ESI experiments, thereby improving the signal quality significantly. Overall, the disclosed cVSSI processes are easy and cost-effective to implement with a wide range of working flow rates. When coupled to a pulled-tip capillary, it can handle flow rates of 0.2-1 μL/min for small volume samples. The disclosed cVSSI processes can also work with normal capillaries (ID approximately 100 μm) to accommodate high flow rates. All the components of the cVSSI system can be purchased directly with a cost of less than $10 per device.

The present example has emphasized negative ion mode analyses is because such studies are significantly hindered in native MS, as evidenced by the fact that, for the most part, they require auxiliary methods/techniques to obtain useful analyses. Additionally, the signal enhancement provided by cVSSI is significantly greater for negative ion mode studies. That said, FIGS. 30A-30D and 38A-38B suggest that significant signal enhancements can also be made available to native MS using positive ion mode.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

SEQUENCE LISTING

```
<160> NUMBER OF SEQ ID NOS: 73

<210> SEQ ID NO 1
<211> LENGTH: 4
<212> TYPE: PRT
<213> ORGANISM: Equus caballus

<400> SEQUENCE: 1

His Gly Leu Phe
```

1

<210> SEQ ID NO 2
<211> LENGTH: 4
<212> TYPE: PRT
<213> ORGANISM: Equus caballus

<400> SEQUENCE: 2

Ile Ala Tyr Leu
1

<210> SEQ ID NO 3
<211> LENGTH: 5
<212> TYPE: PRT
<213> ORGANISM: Equus caballus

<400> SEQUENCE: 3

Lys Glu Glu Thr Leu
1 5

<210> SEQ ID NO 4
<211> LENGTH: 6
<212> TYPE: PRT
<213> ORGANISM: Equus caballus

<400> SEQUENCE: 4

Lys Lys Ala Thr Asn Glu
1 5

<210> SEQ ID NO 5
<211> LENGTH: 6
<212> TYPE: PRT
<213> ORGANISM: Equus caballus

<400> SEQUENCE: 5

Lys Gly Lys Lys Ile Phe
1 5

<210> SEQ ID NO 6
<211> LENGTH: 7
<212> TYPE: PRT
<213> ORGANISM: Equus caballus

<400> SEQUENCE: 6

Leu Lys Lys Ala Thr Asn Glu
1 5

<210> SEQ ID NO 7
<211> LENGTH: 8
<212> TYPE: PRT
<213> ORGANISM: Equus caballus

<400> SEQUENCE: 7

Tyr Leu Lys Lys Ala Thr Asn Glu
1 5

<210> SEQ ID NO 8
<211> LENGTH: 10
<212> TYPE: PRT
<213> ORGANISM: Equus caballus

<400> SEQUENCE: 8

Gly Arg Lys Thr Gly Gln Ala Pro Gly Phe
1 5 10

<210> SEQ ID NO 9
<211> LENGTH: 11
<212> TYPE: PRT
<213> ORGANISM: Equus caballus

<400> SEQUENCE: 9

Lys Gly Gly Lys His Lys Thr Gly Pro Asn Leu
1 5 10

<210> SEQ ID NO 10
<211> LENGTH: 9
<212> TYPE: PRT
<213> ORGANISM: Equus caballus

<400> SEQUENCE: 10

Lys Glu Glu Thr Leu Met Glu Tyr Leu
1 5

<210> SEQ ID NO 11
<211> LENGTH: 10
<212> TYPE: PRT
<213> ORGANISM: Equus caballus

<400> SEQUENCE: 11

Ala Gly Ile Lys Lys Lys Thr Glu Arg Glu
1 5 10

<210> SEQ ID NO 12
<211> LENGTH: 11
<212> TYPE: PRT
<213> ORGANISM: Equus caballus

<400> SEQUENCE: 12

Gly Ile Lys Lys Lys Thr Glu Arg Glu Asp Leu
1 5 10

<210> SEQ ID NO 13
<211> LENGTH: 12
<212> TYPE: PRT
<213> ORGANISM: Equus caballus

<400> SEQUENCE: 13

Ala Gly Ile Lys Lys Lys Thr Glu Arg Glu Asp Leu
1 5 10

<210> SEQ ID NO 14
<211> LENGTH: 14
<212> TYPE: PRT
<213> ORGANISM: Equus caballus

<400> SEQUENCE: 14

Lys Gly Gly Lys His Lys Thr Gly Pro Asn Leu His Gly Leu
1 5 10

<210> SEQ ID NO 15
<211> LENGTH: 14
<212> TYPE: PRT
<213> ORGANISM: Equus caballus

<400> SEQUENCE: 15

His Gly Leu Phe Gly Arg Lys Thr Gly Gln Ala Pro Gly Phe
1 5 10

<210> SEQ ID NO 16

<211> LENGTH: 13
<212> TYPE: PRT
<213> ORGANISM: Equus caballus

<400> SEQUENCE: 16

Gly Ile Lys Lys Lys Thr Glu Arg Glu Asp Leu Ile Ala
1 5 10

<210> SEQ ID NO 17
<211> LENGTH: 13
<212> TYPE: PRT
<213> ORGANISM: Equus caballus

<400> SEQUENCE: 17

Thr Tyr Thr Asp Ala Asn Lys Asn Lys Gly Ile Thr Trp
1 5 10

<210> SEQ ID NO 18
<211> LENGTH: 15
<212> TYPE: PRT
<213> ORGANISM: Equus caballus

<400> SEQUENCE: 18

Lys Gly Gly Lys His Lys Thr Gly Pro Asn Leu His Gly Leu Phe
1 5 10 15

<210> SEQ ID NO 19
<211> LENGTH: 14
<212> TYPE: PRT
<213> ORGANISM: Equus caballus

<400> SEQUENCE: 19

Glu Asn Pro Lys Lys Tyr Ile Pro Gly Thr Lys Met Ile Phe
1 5 10

<210> SEQ ID NO 20
<211> LENGTH: 15
<212> TYPE: PRT
<213> ORGANISM: Equus caballus

<400> SEQUENCE: 20

Thr Tyr Thr Asp Ala Asn Lys Asn Lys Gly Ile Thr Trp Lys Glu
1 5 10 15

<210> SEQ ID NO 21
<211> LENGTH: 15
<212> TYPE: PRT
<213> ORGANISM: Equus caballus

<400> SEQUENCE: 21

Leu Glu Asn Pro Lys Lys Tyr Ile Pro Gly Thr Lys Met Ile Phe
1 5 10 15

<210> SEQ ID NO 22
<211> LENGTH: 16
<212> TYPE: PRT
<213> ORGANISM: Equus caballus

<400> SEQUENCE: 22

Thr Tyr Thr Asp Ala Asn Lys Asn Lys Gly Ile Thr Trp Lys Glu Glu
1 5 10 15

<210> SEQ ID NO 23
<211> LENGTH: 5
<212> TYPE: PRT

<213> ORGANISM: Equus caballus

<400> SEQUENCE: 23

Lys Glu Glu Thr Leu
1 5

<210> SEQ ID NO 24
<211> LENGTH: 7
<212> TYPE: PRT
<213> ORGANISM: Equus caballus

<400> SEQUENCE: 24

Leu Lys Lys Ala Thr Asn Glu
1 5

<210> SEQ ID NO 25
<211> LENGTH: 8
<212> TYPE: PRT
<213> ORGANISM: Equus caballus

<400> SEQUENCE: 25

Tyr Leu Lys Lys Ala Thr Asn Glu
1 5

<210> SEQ ID NO 26
<211> LENGTH: 10
<212> TYPE: PRT
<213> ORGANISM: Equus caballus

<400> SEQUENCE: 26

Gly Arg Lys Thr Gly Gln Ala Pro Gly Phe
1 5 10

<210> SEQ ID NO 27
<211> LENGTH: 11
<212> TYPE: PRT
<213> ORGANISM: Equus caballus

<400> SEQUENCE: 27

Lys Gly Gly Lys His Lys Thr Gly Pro Asn Leu
1 5 10

<210> SEQ ID NO 28
<211> LENGTH: 10
<212> TYPE: PRT
<213> ORGANISM: Equus caballus

<400> SEQUENCE: 28

Ala Gly Ile Lys Lys Lys Thr Glu Arg Glu
1 5 10

<210> SEQ ID NO 29
<211> LENGTH: 12
<212> TYPE: PRT
<213> ORGANISM: Equus caballus

<400> SEQUENCE: 29

Ala Gly Ile Lys Lys Lys Thr Glu Arg Glu Asp Leu
1 5 10

<210> SEQ ID NO 30
<211> LENGTH: 14
<212> TYPE: PRT
<213> ORGANISM: Equus caballus

<400> SEQUENCE: 30

Lys Gly Gly Lys His Lys Thr Gly Pro Asn Leu His Gly Leu
1 5 10

<210> SEQ ID NO 31
<211> LENGTH: 14
<212> TYPE: PRT
<213> ORGANISM: Equus caballus

<400> SEQUENCE: 31

His Gly Leu Phe Gly Arg Lys Thr Gly Gln Ala Pro Gly Phe
1 5 10

<210> SEQ ID NO 32
<211> LENGTH: 13
<212> TYPE: PRT
<213> ORGANISM: Equus caballus

<400> SEQUENCE: 32

Gly Ile Lys Lys Lys Thr Glu Arg Glu Asp Leu Ile Ala
1 5 10

<210> SEQ ID NO 33
<211> LENGTH: 13
<212> TYPE: PRT
<213> ORGANISM: Equus caballus

<400> SEQUENCE: 33

Thr Tyr Thr Asp Ala Asn Lys Asn Lys Gly Ile Thr Trp
1 5 10

<210> SEQ ID NO 34
<211> LENGTH: 13
<212> TYPE: PRT
<213> ORGANISM: Equus caballus

<400> SEQUENCE: 34

Asn Lys Asn Lys Gly Ile Thr Trp Lys Glu Glu Thr Leu
1 5 10

<210> SEQ ID NO 35
<211> LENGTH: 15
<212> TYPE: PRT
<213> ORGANISM: Equus caballus

<400> SEQUENCE: 35

Lys Gly Gly Lys His Lys Thr Gly Pro Asn Leu His Gly Leu Phe
1 5 10 15

<210> SEQ ID NO 36
<211> LENGTH: 14
<212> TYPE: PRT
<213> ORGANISM: Equus caballus

<400> SEQUENCE: 36

Glu Asn Pro Lys Lys Tyr Ile Pro Gly Thr Lys Met Ile Phe
1 5 10

<210> SEQ ID NO 37
<211> LENGTH: 15
<212> TYPE: PRT
<213> ORGANISM: Equus caballus

<400> SEQUENCE: 37

Leu Glu Asn Pro Lys Lys Tyr Ile Pro Gly Thr Lys Met Ile Phe
1 5 10 15

<210> SEQ ID NO 38
<211> LENGTH: 16
<212> TYPE: PRT
<213> ORGANISM: Equus caballus

<400> SEQUENCE: 38

Thr Tyr Thr Asp Ala Asn Lys Asn Lys Gly Ile Thr Trp Lys Glu Glu
1 5 10 15

<210> SEQ ID NO 39
<211> LENGTH: 18
<212> TYPE: PRT
<213> ORGANISM: Equus caballus

<400> SEQUENCE: 39

Thr Tyr Thr Asp Ala Asn Lys Asn Lys Gly Ile Thr Trp Lys Glu Glu
1 5 10 15

Thr Leu

<210> SEQ ID NO 40
<211> LENGTH: 6
<212> TYPE: PRT
<213> ORGANISM: Equus caballus

<400> SEQUENCE: 40

Lys Gly Lys Lys Ile Phe
1 5

<210> SEQ ID NO 41
<211> LENGTH: 7
<212> TYPE: PRT
<213> ORGANISM: Equus caballus

<400> SEQUENCE: 41

Leu Lys Lys Ala Thr Asn Glu
1 5

<210> SEQ ID NO 42
<211> LENGTH: 8
<212> TYPE: PRT
<213> ORGANISM: Equus caballus

<400> SEQUENCE: 42

Tyr Leu Lys Lys Ala Thr Asn Glu
1 5

<210> SEQ ID NO 43
<211> LENGTH: 10
<212> TYPE: PRT
<213> ORGANISM: Equus caballus

<400> SEQUENCE: 43

Gly Arg Lys Thr Gly Gln Ala Pro Gly Phe
1 5 10

<210> SEQ ID NO 44
<211> LENGTH: 10
<212> TYPE: PRT
<213> ORGANISM: Equus caballus

<400> SEQUENCE: 44

Gly Asp Val Glu Lys Gly Lys Lys Ile Phe
1 5 10

<210> SEQ ID NO 45
<211> LENGTH: 11
<212> TYPE: PRT
<213> ORGANISM: Equus caballus

<400> SEQUENCE: 45

Lys Gly Gly Lys His Lys Thr Gly Pro Asn Leu
1 5 10

<210> SEQ ID NO 46
<211> LENGTH: 10
<212> TYPE: PRT
<213> ORGANISM: Equus caballus

<400> SEQUENCE: 46

Ala Gly Ile Lys Lys Lys Thr Glu Arg Glu
1 5 10

<210> SEQ ID NO 47
<211> LENGTH: 11
<212> TYPE: PRT
<213> ORGANISM: Equus caballus

<400> SEQUENCE: 47

Gly Ile Lys Lys Lys Thr Glu Arg Glu Asp Leu
1 5 10

<210> SEQ ID NO 48
<211> LENGTH: 12
<212> TYPE: PRT
<213> ORGANISM: Equus caballus

<400> SEQUENCE: 48

Ala Gly Ile Lys Lys Lys Thr Glu Arg Glu Asp Leu
1 5 10

<210> SEQ ID NO 49
<211> LENGTH: 14
<212> TYPE: PRT
<213> ORGANISM: Equus caballus

<400> SEQUENCE: 49

Lys Gly Gly Lys His Lys Thr Gly Pro Asn Leu His Gly Leu
1 5 10

<210> SEQ ID NO 50
<211> LENGTH: 14
<212> TYPE: PRT
<213> ORGANISM: Equus caballus

<400> SEQUENCE: 50

His Gly Leu Phe Gly Arg Lys Thr Gly Gln Ala Pro Gly Phe
1 5 10

<210> SEQ ID NO 51
<211> LENGTH: 13
<212> TYPE: PRT
<213> ORGANISM: Equus caballus

<400> SEQUENCE: 51

Gly Ile Lys Lys Lys Thr Glu Arg Glu Asp Leu Ile Ala
1 5 10

<210> SEQ ID NO 52
<211> LENGTH: 13
<212> TYPE: PRT
<213> ORGANISM: Equus caballus

<400> SEQUENCE: 52

Thr Tyr Thr Asp Ala Asn Lys Asn Lys Gly Ile Thr Trp
1 5 10

<210> SEQ ID NO 53
<211> LENGTH: 13
<212> TYPE: PRT
<213> ORGANISM: Equus caballus

<400> SEQUENCE: 53

Asn Lys Asn Lys Gly Ile Thr Trp Lys Glu Glu Thr Leu
1 5 10

<210> SEQ ID NO 54
<211> LENGTH: 15
<212> TYPE: PRT
<213> ORGANISM: Equus caballus

<400> SEQUENCE: 54

Lys Gly Gly Lys His Lys Thr Gly Pro Asn Leu His Gly Leu Phe
1 5 10 15

<210> SEQ ID NO 55
<211> LENGTH: 14
<212> TYPE: PRT
<213> ORGANISM: Equus caballus

<400> SEQUENCE: 55

Glu Asn Pro Lys Lys Tyr Ile Pro Gly Thr Lys Met Ile Phe
1 5 10

<210> SEQ ID NO 56
<211> LENGTH: 15
<212> TYPE: PRT
<213> ORGANISM: Equus caballus

<400> SEQUENCE: 56

Thr Tyr Thr Asp Ala Asn Lys Asn Lys Gly Ile Thr Trp Lys Glu
1 5 10 15

<210> SEQ ID NO 57
<211> LENGTH: 15
<212> TYPE: PRT
<213> ORGANISM: Equus caballus

<400> SEQUENCE: 57

Leu Glu Asn Pro Lys Lys Tyr Ile Pro Gly Thr Lys Met Ile Phe
1 5 10 15

<210> SEQ ID NO 58
<211> LENGTH: 16
<212> TYPE: PRT
<213> ORGANISM: Equus caballus

<400> SEQUENCE: 58

Thr Tyr Thr Asp Ala Asn Lys Asn Lys Gly Ile Thr Trp Lys Glu Glu
1 5 10 15

<210> SEQ ID NO 59
<211> LENGTH: 18
<212> TYPE: PRT
<213> ORGANISM: Equus caballus

<400> SEQUENCE: 59

Thr Tyr Thr Asp Ala Asn Lys Asn Lys Gly Ile Thr Trp Lys Glu Glu
1 5 10 15

Thr Leu

<210> SEQ ID NO 60
<211> LENGTH: 22
<212> TYPE: PRT
<213> ORGANISM: Equus caballus

<400> SEQUENCE: 60

Val Gln Lys Cys Ala Gln Cys His Thr Val Glu Lys Gly Gly Lys His
1 5 10 15

Lys Thr Gly Pro Asn Leu
20

<210> SEQ ID NO 61
<211> LENGTH: 25
<212> TYPE: PRT
<213> ORGANISM: Equus caballus

<400> SEQUENCE: 61

Val Gln Lys Cys Ala Gln Cys His Thr Val Glu Lys Gly Gly Lys His
1 5 10 15

Lys Thr Gly Pro Asn Leu His Gly Leu
20 25

<210> SEQ ID NO 62
<211> LENGTH: 28
<212> TYPE: PRT
<213> ORGANISM: Equus caballus

<400> SEQUENCE: 62

Lys Gly Lys Lys Ile Phe Val Gln Lys Cys Ala Gln Cys His Thr Val
1 5 10 15

Glu Lys Gly Gly Lys His Lys Thr Gly Pro Asn Leu
20 25

<210> SEQ ID NO 63
<211> LENGTH: 12
<212> TYPE: PRT
<213> ORGANISM: Equus caballus

<400> SEQUENCE: 63

Ala Gly Ile Lys Lys Lys Thr Glu Arg Glu Asp Leu
1 5 10

<210> SEQ ID NO 64
<211> LENGTH: 15
<212> TYPE: PRT
<213> ORGANISM: Equus caballus

<400> SEQUENCE: 64

Lys Gly Gly Lys His Lys Thr Gly Pro Asn Leu His Gly Leu Phe
1 5 10 15

<210> SEQ ID NO 65
<211> LENGTH: 15

<212> TYPE: PRT
<213> ORGANISM: Equus caballus

<400> SEQUENCE: 65

Thr Tyr Thr Asp Ala Asn Lys Asn Lys Gly Ile Thr Trp Lys Glu
1 5 10 15

<210> SEQ ID NO 66
<211> LENGTH: 18
<212> TYPE: PRT
<213> ORGANISM: Equus caballus

<400> SEQUENCE: 66

Thr Tyr Thr Asp Ala Asn Lys Asn Lys Gly Ile Thr Trp Lys Glu Glu
1 5 10 15

Thr Leu

<210> SEQ ID NO 67
<211> LENGTH: 22
<212> TYPE: PRT
<213> ORGANISM: Equus caballus

<400> SEQUENCE: 67

Val Gln Lys Cys Ala Gln Cys His Thr Val Glu Lys Gly Gly Lys His
1 5 10 15

Lys Thr Gly Pro Asn Leu
20

<210> SEQ ID NO 68
<211> LENGTH: 25
<212> TYPE: PRT
<213> ORGANISM: Equus caballus

<400> SEQUENCE: 68

Val Gln Lys Cys Ala Gln Cys His Thr Val Glu Lys Gly Gly Lys His
1 5 10 15

Lys Thr Gly Pro Asn Leu His Gly Leu
20 25

<210> SEQ ID NO 69
<211> LENGTH: 17
<212> TYPE: PRT
<213> ORGANISM: Equus caballus

<400> SEQUENCE: 69

Lys Gly Lys Lys Ile Phe Val Gln Lys Cys Ala Gln Cys His Thr Val
1 5 10 15

Glu

<210> SEQ ID NO 70
<211> LENGTH: 28
<212> TYPE: PRT
<213> ORGANISM: Equus caballus

<400> SEQUENCE: 70

Lys Gly Lys Lys Ile Phe Val Gln Lys Cys Ala Gln Cys His Thr Val
1 5 10 15

Glu Lys Gly Gly Lys His Lys Thr Gly Pro Asn Leu
20 25

<210> SEQ ID NO 71
<211> LENGTH: 22

-continued

```
<212> TYPE: PRT
<213> ORGANISM: Equus caballus

<400> SEQUENCE: 71

Val Gln Lys Cys Ala Gln Cys His Thr Val Glu Lys Gly Gly Lys His
1               5                   10                  15

Lys Thr Gly Pro Asn Leu
            20


<210> SEQ ID NO 72
<211> LENGTH: 25
<212> TYPE: PRT
<213> ORGANISM: Equus caballus

<400> SEQUENCE: 72

Val Gln Lys Cys Ala Gln Cys His Thr Val Glu Lys Gly Gly Lys His
1               5                   10                  15

Lys Thr Gly Pro Asn Leu His Gly Leu
            20                  25


<210> SEQ ID NO 73
<211> LENGTH: 28
<212> TYPE: PRT
<213> ORGANISM: Equus caballus

<400> SEQUENCE: 73

Lys Gly Lys Lys Ile Phe Val Gln Lys Cys Ala Gln Cys His Thr Val
1               5                   10                  15

Glu Lys Gly Gly Lys His Lys Thr Gly Pro Asn Leu
            20                  25
```

What is claimed is:

1. An apparatus for ionizing a liquid sample, the apparatus comprising:

(a) a thin, rigid substrate; and (b) a vibration generator selected from a mechanical, electromechanical transducer, a piezoelectric transducer, and combinations thereof;

wherein the thin, rigid substrate comprises microchannels to direct fluid flow;

wherein the thin, rigid substrate comprises glass, quartz, silicon, hard plastic, hard epoxy resin, hard polymerized material, a ceramic material, metal, a composite material, fused silica, polyether ether ketone (PEEK), pyrolytic boron nitride (PBN), or a combination thereof; and wherein the thin, rigid substrate is chemically modified in order to increase hydrophobicity.

2. The apparatus of claim 1, wherein the thin, rigid substrate comprises glass.

3. The apparatus of claim 1, wherein the thin, rigid substrate comprises a proximal end with a flat surface and a distal end with at least one sharp edge.

4. The apparatus of claim 1, wherein the thin, rigid substrate comprises an irregular shape.

5. The apparatus of claim 4, wherein the irregular shape comprises a triangle or a capillary with a tapered tip.

6. The apparatus of claim 1, wherein the thin, rigid substrate is chemically modified with a polymethylsiloxane or other silicone-based network.

7. The apparatus of claim 1, wherein the thin, rigid substrate comprises a glass microscope slide.

8. The apparatus of claim 1, wherein the thin, rigid substrate comprises a top surface area of from about 24×50 mm to about 24×75 mm.

9. The apparatus of claim 1, wherein the thin, rigid substrate comprises a thickness of from about 0.08 mm to about 0.19 mm.

10. The apparatus of claim 1, wherein the vibration generator provides a frequency of from about 4 to about 120 kHz.

11. The apparatus of claim 1, wherein the vibration generator provides a peak-to-peak voltage (Vpp) from about 12.7 V to about 30.6 V.

12. The apparatus of claim 3, wherein the sharp edge is a corner.

13. The apparatus of claim 3, wherein the vibration generator is fixed to the proximal end of the thin, rigid substrate to form a combined body.

14. The apparatus of claim 13, wherein activation of the vibration generator causes the sharp edge of the thin, rigid substrate to vibrate.

15. The apparatus of claim 14, wherein the vibration frequency of the combined body is its resonant frequency.

16. A method for producing a spray of droplets, the method comprising (a) causing the thin, rigid substrate of the apparatus of claim 1 to vibrate, wherein the thin, rigid substrate comprises a proximal end with a flat surface and a distal end with at least one sharp edge; and wherein vibrating the thin, rigid substrate of the apparatus of claim 1 vibrates the sharp edge thereby generating a vibrating sharp edge;

(b) contacting a liquid sample with the vibrating sharp edge.

17. The method of claim 16, wherein the spray of droplets comprises an aerosol.

18. The method of claim 16, wherein the spray of droplets comprises an emulsion.

19. The method of claim 16, wherein the spray of droplets comprises droplets having an average diameter from about 1 μm to about 30 μm.

* * * * *